US011384496B2

(12) United States Patent
DeLaine, Jr.

(10) Patent No.: US 11,384,496 B2
(45) Date of Patent: Jul. 12, 2022

(54) SYSTEMS FOR FORMING FLOOD BARRIERS

(71) Applicant: Phillip M. DeLaine, Jr., Tyngsboro, MA (US)

(72) Inventor: Phillip M. DeLaine, Jr., Tyngsboro, MA (US)

( * ) Notice: Subject to any disclaimer, the term of this patent is extended or adjusted under 35 U.S.C. 154(b) by 0 days.

(21) Appl. No.: 17/191,006

(22) Filed: Mar. 3, 2021

(65) Prior Publication Data

US 2021/0254296 A1 Aug. 19, 2021

Related U.S. Application Data

(63) Continuation of application No. 16/863,154, filed on Apr. 30, 2020, now Pat. No. 10,954,640, which is a continuation of application No. 16/149,657, filed on Oct. 2, 2018, now Pat. No. 10,640,940.

(60) Provisional application No. 62/594,037, filed on Dec. 4, 2017.

(51) Int. Cl.
*E02B 3/10* (2006.01)
*B61D 1/00* (2006.01)

(52) U.S. Cl.
CPC ..... *E02B 3/106* (2013.01); *B61D 1/00* (2013.01)

(58) Field of Classification Search
CPC ... E02B 3/04; E02B 3/10; E02B 3/102; E02B 3/106; E02B 7/20
See application file for complete search history.

(56) References Cited

U.S. PATENT DOCUMENTS

| | | | | |
|---|---|---|---|---|
| 4,931,930 | A | 6/1990 | Shyu et al. | |
| 5,152,228 | A * | 10/1992 | Donkin | B60F 1/046 105/215.1 |
| 5,943,832 | A | 8/1999 | Russell | |
| 6,338,594 | B1 | 1/2002 | Adler et al. | |
| 6,832,870 | B1 * | 12/2004 | Krivoy | E01F 15/006 404/6 |
| 8,336,260 | B1 | 12/2012 | Mandall | |
| 9,562,336 | B2 | 2/2017 | Adler et al. | |
| 10,954,640 | B2 | 3/2021 | Delaine, Jr. | |

(Continued)

FOREIGN PATENT DOCUMENTS

| | | | |
|---|---|---|---|
| CH | 709 383 | A2 | 9/2015 |
| CN | 107034857 | A | 8/2017 |

(Continued)

OTHER PUBLICATIONS

Extended European Search Report received for European Patent Application Serial No. 18885366.7 dated Jul. 2, 2021, 9 pages.

(Continued)

*Primary Examiner* — Sean D Andrish
(74) *Attorney, Agent, or Firm* — FisherBroyles, LLP

(57) ABSTRACT

The disclosed water barrier systems may include a first mobile water barrier, and adjacent second mobile water barrier, and a translation mechanism for translating the first mobile water barrier and the second mobile water barrier toward each other. Lowering mechanisms may be configured to lower sidewalls of the mobile water barriers. The mobile water barriers may include sealing elements to form water seals between the adjacent mobile water barriers and between the sidewalls and a surface. Related methods of forming a water barrier assembly are also disclosed.

16 Claims, 125 Drawing Sheets

(56) References Cited

U.S. PATENT DOCUMENTS

| | | | | |
|---|---|---|---|---|
| 2002/0083651 | A1 | 4/2002 | Nomura et al. | |
| 2013/0071188 | A1* | 3/2013 | Taylor | E02B 3/106 405/114 |
| 2015/0036949 | A1 | 2/2015 | Lasagna et al. | |
| 2016/0076210 | A1 | 3/2016 | Sapi | |
| 2016/0244927 | A1 | 8/2016 | Adler | |
| 2016/0244929 | A1* | 8/2016 | Knezevich | E04H 9/145 |
| 2017/0284047 | A1 | 10/2017 | Terata et al. | |
| 2019/0169811 | A1 | 6/2019 | Delaine, Jr. | |

FOREIGN PATENT DOCUMENTS

| | | | |
|---|---|---|---|
| DE | 34 29 190 | A1 | 2/1986 |
| DE | 295 11 633 | U1 | 10/1995 |
| DE | 202 18 887 | U1 | 7/2003 |
| DE | 20 2004 007 954 | U1 | 9/2005 |
| EP | 0 356 362 | A1 | 2/1990 |
| JP | 2021-505802 | A | 2/2021 |
| WO | 2004/016860 | A1 | 2/2004 |
| WO | 2019/112897 | A1 | 6/2019 |

OTHER PUBLICATIONS

Communication Pursuant to Rules 70(2) and 70a(2) EPC received for EP Patent Application Serial No. 18885366.7 dated Jul. 20, 2021, 1 page.

Non-Final Office Action received for U.S. Appl. No. 16/863,154 dated Aug. 21, 2020, 47 pages.

Notice of Allowance received for U.S. Appl. No. 16/863,154 dated Dec. 4, 2020, 32 pages.

International Search Report and Written Opinion received for PCT Application Serial No. PCT/US18/63315 dated Feb. 15, 2019, 8 pages.

"Air Side Dump Car", URL: https://jk-co.com/air-side-dump-car/, as accessed Apr. 30, 2020, pp. 1-7.

Non-Final Office Action received for U.S. Appl. No. 16/149,657 dated Jul. 18, 2019, 24 pages.

Final Office Action received for U.S. Appl. No. 16/149,657 dated Jan. 28, 2020, 29 pages.

Notice of Allowance received for U.S. Appl. No. 16/149,657 dated Mar. 23, 2020, 19 pages.

International Preliminary Report on Patentability received for PCT Application Serial No. PCT/US2018/63315 dated Jun. 18, 2020, 7 pages.

First Examination Report received for Indian Patent Application Serial No. 202017024844 dated Nov. 22, 2021, 6 pages.

* cited by examiner

SYSTEMS FOR FORMING FLOOD BARRIERS

CROSS REFERENCE TO RELATED APPLICATION

This application is a continuation of U.S. patent application Ser. No. 16/863,154, titled "SYSTEMS FOR FORMING WATER BARRIERS," filed Apr. 30, 2020, which is a continuation of U.S. patent application Ser. No. 16/149,657, titled "SYSTEMS AND METHODS FOR FORMING WATER BARRIERS," filed Oct. 2, 2018, now U.S. Pat. No. 10,640,940, which claims the benefit of U.S. Provisional Application No. 62/594,037, filed Dec. 4, 2017, the entire disclosure of each of which is incorporated herein by this reference.

BACKGROUND

Hurricanes are the largest, most severe and destructive storm systems on earth. Hurricanes form over warm ocean water in the tropical region and are characterized by large rotating low-pressure systems that produce heavy rain and sustained wind speeds of 74 miles per hour or greater.

Other names for this weather phenomenon are "cyclones" and "typhoons". Use of the different names is based on the global location of the storms. Hurricanes occur in the Atlantic Ocean and northeastern Pacific Ocean, cyclones occur in the south Pacific or Indian Ocean, and typhoons occur in the northwestern Pacific Ocean. Regardless of the name used, these storms often cause significant loss of life and property when they hit land. To simplify our discussions, and where possible, the single term "hurricane" will be used to describe this weather phenomenon.

Throughout history, many countries located on or near the sea have been devastated by the effects of hurricanes. Hurricanes often create a phenomenon called a storm surge. A storm surge is a rise in the ocean water near the shore and is caused by the approach of the hurricane's low-pressure weather system where the associated high winds push the ocean water onto the shore. Storm surges can produce extensive flooding up to 25 miles inland and are by far the most costly and deadly characteristic of hurricanes. For example, in 2005, in the United States, Hurricane Katrina produced a storm surge of 28 feet that caused $108 billion in damages and the deaths of 1,200 people. In 2008, in the United States, Hurricane Ike produced a storm surge of 20 feet that caused $29.5 billion in damages and 82 deaths. Given this recent history and the high probability for future similar losses given the warming of the planet, several countries around the world have a vested interest in deploying a practical defense system against storm surges.

Two of the most common defenses against storm surges are "storm surge barriers" and "artificial levees."

Storm surge barriers are tall elongated walls constructed with concrete and steel. An example of this type of barrier is the Lake Borgne Surge Barrier located in New Orleans, La. The Lake Borgne Surge Barrier is permanently fixed to the ground, stands 26 feet high and extends a distance of 1.8 miles. The barrier was completed in 2013 at a cost of $1.1 billion, or $611 million a mile. At this rate, it would cost approximately $10.5 trillion to protect the 17,141 miles of the U.S. tidal coastline along the Gulf of Mexico. This price does not include the cost to protect the U.S. Atlantic coast. Though they may be effective against storm surges, the construction of these barriers to protect American shores may be cost-prohibitive.

Artificial levees, also known as dykes or dikes, are elongated constructed walls that are built by piling earth on a cleared, level, ground surface. Levees are typically wide at the base and taper to a top level where the resulting structure can stand several feet high as measured from the levee's base. In addition to storm surge protection, artificial levees are commonly used to prevent river flooding. Even though levees are used extensively throughout the world, levees often have a serious weakness. Since levees are made from piles of earth (e.g., dirt and rocks), if any portion of the levee's earthen structure becomes saturated, eroded, or is overtopped with water, such a levee will often fail or "breach." A breach represents a special hazard because the sudden release of water can quickly inundate a community, destroying property and life along the way.

Using these flood barrier technologies may present some of the following challenges, for example: (1) the construction cost per mile may be very high; (2) these structures may be permanent; (3) these structures may be aesthetically unappealing; (4) these structures often block aesthetically appealing views, such as coastlines; (5) public resistance is often high when these structures are proposed for pristine locations; (6) the maintenance cost per mile may be very high; and (7) these structures may be subject to failure over time due to exposure to water or weather.

Turning to the field of railcars, there are a number of different railcar types, including gondola railcars and flatcar railcars.

FIG. 1 shows a side view of a conventional gondola railcar 11 with railcar couplers 12 attached at each end of the gondola railcar 11. A sidewall 13 has a height H1 and extends the length L1 of the gondola railcar 11 terminating at endwalls 14. Two supporting trucks 15 are respectively disposed under the ends of the gondola railcar 11. The trucks 15 are shown positioned on a railroad track 4. The sidewalls 13 and endwalls 14 are made of generally planar sheets of thick rigid steel that is reinforced against bending by steel rib wall reinforcements 19. These components are assembled as shown and securely attached by welds, rivets, bolts and/or other attachment means.

FIG. 2 shows a side view of the gondola railcar 16 that is similar to the gondola railcar 11 shown in FIG. 1, except that the gondola railcar 16 has a sidewall 13 and endwall 14 construction that has a greater height H2 than the height H1 of the railcar 11 of FIG. 1.

FIG. 3 shows an end view of the gondola railcar 16 with a railcar coupler 12 attached at the end of the gondola railcar 16 and an endwall 14 that has a width L2 that terminates at the sidewalls 13. The bottom of the endwall 14 may be attached and secured by a weld to the top of a gondola floor 17. FIG. 3 also illustrates a gondola underframe 18 assembly and a truck 15 supporting the gondola underframe 18. The truck 15 may be positioned on a railroad track 4.

FIG. 4 shows a bottom perspective view of the gondola railcar 16. The bottom of the sidewall 13 and endwall 14 may be attached to the top of the gondola floor 17, and the gondola underframe 18 assembly may be attached to the bottom of the gondola floor 17. The trucks 15 may be attached to the bottom of the gondola underframe 18.

FIG. 5 shows a top perspective view of the gondola railcar 16. The sidewall 13 is cut away to show an interior view of the gondola railcar 16, with the gondola floor 17 located at the bottom of the sidewalls 13 and endwalls 14. The trucks 15 may support the bottom of the gondola railcar 16 and a railcar coupler 12 may be located at the end of the gondola railcar 16. Some conventional gondola railcars have at least one drainage hole 173 positioned on the gondola floor 17 to empty precipitation (e.g., water) or other fluids out of the gondola railcar 16 interior and onto the ground below. When the drainage hole(s) 173 is plugged or absent, the interior of the gondola railcar 16 above the gondola floor 17 may fill with precipitation (water) or other fluids.

FIG. 6 shows a side cut-away view of the gondola railcar 16, which shows the bottom of the endwalls 14 attached and secured by a weld to the top of the gondola floor 17 and gondola underframe 18 assembly.

FIG. 7 shows an end cut-away view of the gondola railcar 16, which shows the bottom of the sidewalls 13 attached and secured by a weld to the top of the gondola floor 17 and gondola underframe 18 assembly.

FIG. 8 shows a side view of a conventional flatcar railcar 24 with railcar couplers 20 attached at each end of the flatcar railcar 24 and a planar floor surface 22 that is attached on top of and extends the length L3 of the flatcar underframe 23. The flatcar underframe 23 and floor surface 22 may be supported by flatcar trucks 21 respectively attached to each end of the flatcar railcar 24. The flatcar trucks 21 are shown positioned on a railroad track 4.

FIG. 9 shows an end view of the flatcar railcar 24 with a railcar coupler 20 attached at the end of the flatcar railcar 24. The planar floor surface 22 extends the width L4 of the flatcar underframe 23 and is attached and secured by a weld on top of the flatcar underframe 23. A flatcar truck 21 is attached to the bottom of the flatcar underframe 23 and the flatcar truck 21 is positioned on a railroad track 4.

FIG. 10 shows a bottom perspective view of the flatcar railcar 24 with the flatcar trucks 21 attached to the bottom of the flatcar underframe 23. The railcar couplers 20 are attached at each end of the flatcar railcar 24. A hand brake mechanism 25 is attached to an end of the flatcar railcar 24.

FIG. 11 shows a top perspective view of the flatcar railcar 24 with a railcar coupler 20 attached at the end of the flatcar railcar 24 and the planar floor surface 22 attached and secured by a weld on top. The floor surface 22 extends the length and width of the flatcar underframe 23. The flatcar underframe 23 is supported by the flatcar trucks 21 attached at each end of the flatcar railcar 24.

SUMMARY

As will be described in greater detail below, the present disclosure describes methods and systems for forming a water barrier using specialized mobile water barriers.

In some embodiments, the present disclosure includes water barrier systems that may include a first mobile water barrier, a second mobile water barrier adjacent to the first mobile water barrier, and a translation mechanism for translating the first mobile water barrier and the second mobile water barrier toward each other. The first mobile water barrier may include a first sidewall, a first side sealing element positioned along an end of the first sidewall, and a first bottom sealing element positioned along a first bottom edge of the first sidewall. The first mobile water barrier may also include a first lowering mechanism for lowering the first sidewall to abut the first bottom sealing element against a surface to form a first bottom seal between the first sidewall and the surface. The second mobile water barrier may be connected to the first mobile water barrier with a coupler. The second mobile water barrier may include a second sidewall, a second side sealing element positioned along an end of the second sidewall, a second bottom sealing element positioned along a second bottom edge of the second sidewall, and a second lowering mechanism for lowering the second sidewall to abut the second sealing element against the surface to form a second bottom seal between the second sidewall and the surface. Translation of the first mobile water barrier and the second mobile water barrier toward each other may abut the first side sealing element against the second side sealing element to form an upper water seal between the first sidewall and the second sidewall.

In some examples, each of the first bottom sealing element and the second bottom sealing element may include a compressible bottom gasket extending along a length of the first sidewall and second sidewall, respectively. Each of the compressible bottom gaskets may have a generally rectangular cross-section. Each of the first sidewall and the second sidewall may also include a flange extending along at least a portion of a vertical wall of the respective compressible bottom gaskets. The compressible bottom gaskets may be sized and shaped to leave a gap between the vertical walls and an inner surface of the flange when the compressible bottom gaskets are in an initial, uncompressed state. Each of the compressible bottom gaskets may include a rubber material.

In some examples, each of the first side sealing element and the second side sealing element may include a compressible side gasket extending along at least a portion of a height of the respective first sidewall and second side wall. Each of the first lowering mechanism and the second lowering mechanism may include a hydraulic vertical position controlling cylinder for respectively lowering the first sidewall and the second sidewall. Each of the first lowering mechanism and the second lowering mechanism may include a vertical guide rail extending vertically upward from a floor of the respective first mobile water barrier and second mobile water barrier, parallel to which the first sidewall and second sidewall may move when lowered. Each of the first lowering mechanism and the second lowering mechanism may include a movable interlocking beam positioned to maintain the respective first sidewall and second sidewall in an initial, raised position prior to lowering to form the respective first bottom seal and second bottom seal. Each of the first lowering mechanism and the second lowering mechanism may include a safety block to provide a stop in the event of a failure of other components of the first lowering mechanism and the second lowering mechanism to maintain the respective first sidewall and second sidewall in a raised position, wherein the safety blocks may be rigidly attached to a respective floor of the first mobile water barrier and second mobile water barrier. The water barrier system may also include at least one electrical control system for controlling the lowering of the respective first sidewall and second sidewall. The translation mechanism may include an inner sill controlling cylinder coupled to the coupler. The inner sill controlling cylinder may be configured to longitudinally move the coupler relative to one or both of the first mobile water barrier or the second mobile water barrier to translate the first mobile water barrier and the second mobile water barrier toward each other. The system may also include at least one locating pin and at least one locating pin bushing configured to align the first side sealing element with the second side sealing element upon translation of the first mobile water barrier and the second mobile water barrier toward each other.

In some embodiment, the present disclosure may also include methods of forming a water barrier assembly. In accordance with such methods, a first mobile water barrier and an adjacent, second mobile water barrier may be moved to a location in which to form a water barrier. The first mobile water barrier may include a first sidewall, a first side sealing element, and a first bottom sealing element. The second mobile water barrier may include a second sidewall, a second side sealing element, and a second bottom sealing element. The first mobile water barrier may be translated toward the second railcar. The first side sealing element may be abutted against the second side sealing element to form a water seal between the first sidewall and the second sidewall. The first sidewall of the first mobile water barrier and the second sidewall of the second mobile water barrier may be lowered. The first bottom sealing element and the second bottom sealing element may be abutted against a surface to form a lower water seal between the first sidewall and the surface and between the second sidewall and the surface.

In some examples, the translation of the first mobile water barrier toward the second mobile water barrier may include retracting a coupling link between the first mobile water barrier and the second mobile water barrier. Lowering the first mobile water barrier and the second mobile water barrier may include hydraulically lowering the first mobile water barrier and the second mobile water barrier. Abutting the first side sealing element against the second side sealing element may include compressing at least one of the first side sealing element or the second side sealing element. The methods may also include lifting the first sidewall and the second sidewall to break the water barrier between the first sidewall and the surface and between the second sidewall and the surface and translating the first mobile water barrier away from the second mobile water barrier to break the upper water seal between the first sidewall and the second sidewall.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of example embodiments and are a part of the specification. In some cases, similar or the same reference numerals used in the various drawings may identify similar, but not necessarily identical, elements. Together with the following description, these drawings demonstrate and explain various principles of the present disclosure.

FIG. 102 shows a cross-sectional end view, taken at line 102-102 of FIG. 103, of the railcar with the primary wave deflectors deployed on both sides of the WBA, and with primary wave deflector deadbolts engaged, according to embodiments of this disclosure.

FIG. 103 shows a side view of the railcar of FIG. 102.

FIG. 104A shows a cross-sectional view of an engaged primary wave deflector deadbolt assembly and a drain and drain valve attached to the WBA floor, according to embodiments of this disclosure.

FIG. 104B shows a cross-sectional view of a disengaged primary wave deflector deadbolt assembly and a drain and drain valve attached to the WBA floor, according to embodiments of this disclosure.

FIG. 105 shows a cross-sectional end view, taken at line 105-105 of FIG. 106, of the railcar with primary wave deflectors deployed and primary wave deflector deadbolts disengaged, according to embodiments of this disclosure.

FIG. 106 shows a side view of a railcar with a secondary wave deflector deployed on top of the WBA sidewall, according to embodiments of this disclosure.

FIG. 107 shows a cross-sectional end view of the railcar with the secondary wave deflectors deployed on top of the WBA sidewalls, according to embodiments of this disclosure.

FIG. 108 shows a cross-sectional end view of the railcar of FIG. 107, but with the secondary wave deflectors in a lowered position, according to embodiments of this disclosure.

FIG. 109 shows a cross-sectional end view of a railcar with deployed arcuate-shaped secondary wave deflectors according to embodiments of this disclosure FIG. 110 shows a cross-sectional side view of a railcar, where a BTPS brace/lock deadbolt is disengaged from a WBA endwall, according to embodiments of this disclosure.

FIG. 111 shows a cross-sectional top view of the railcar, where the BTPS brace/lock deadbolt is disengaged from the WBA endwall, according to embodiments of this disclosure.

FIG. 112 shows an end view of the railcar, where the BTPS brace/lock deadbolt is disengaged from the WBA endwall, according to embodiments of this disclosure.

FIG. 113 shows a cross-sectional side view of the railcar, where the BTPS brace/lock deadbolt is engaged into the WBA endwall, according to embodiments of this disclosure.

Figure 114:
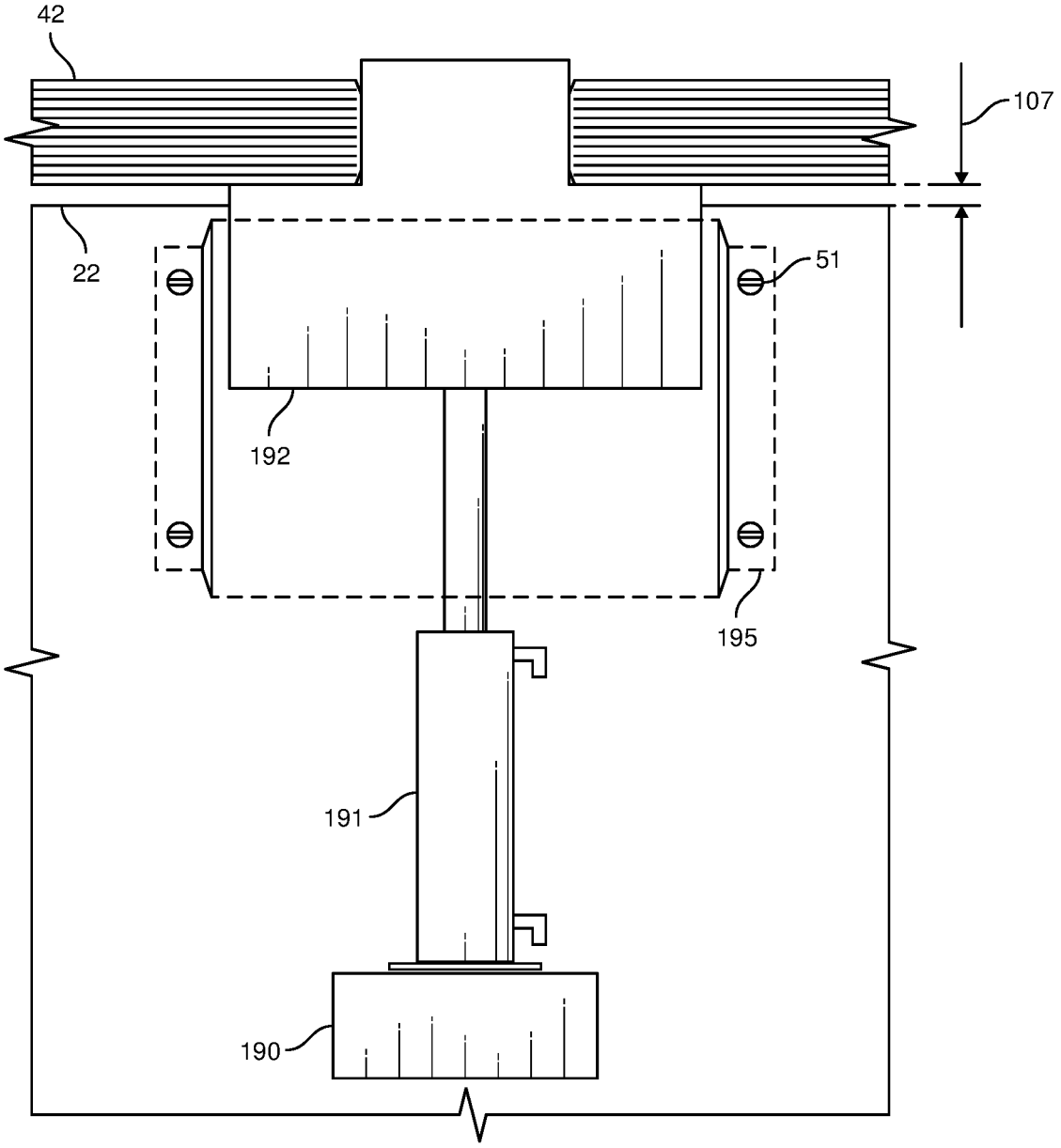

FIG. 114 shows a cross-sectional top view of the railcar, where the BTPS brace/lock deadbolt is engaged into the WBA endwall, according to embodiments of this disclosure.

Figure 115:
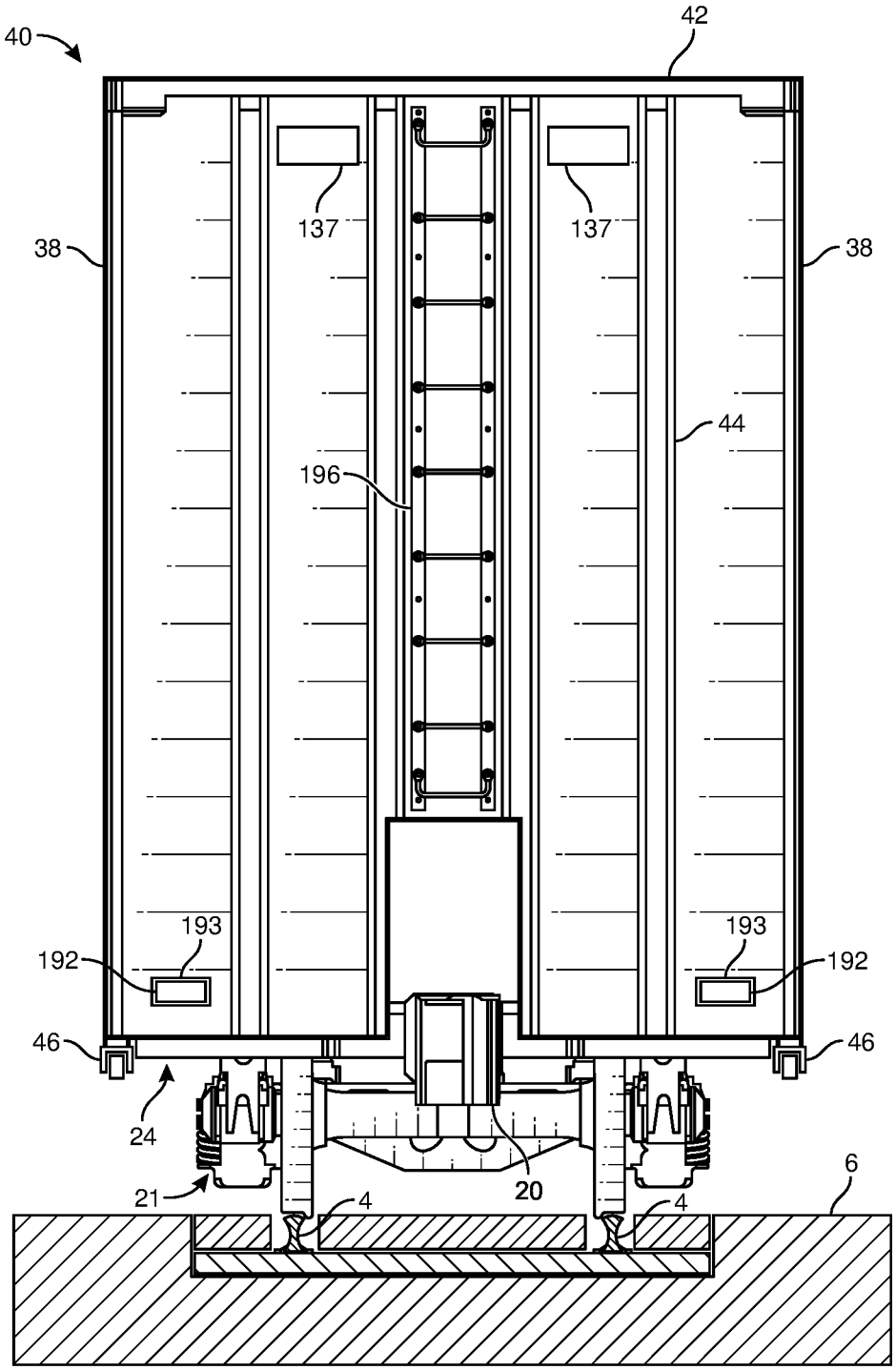

FIG. 115 shows an end view of the railcar of FIG. 114.

Figure 116:
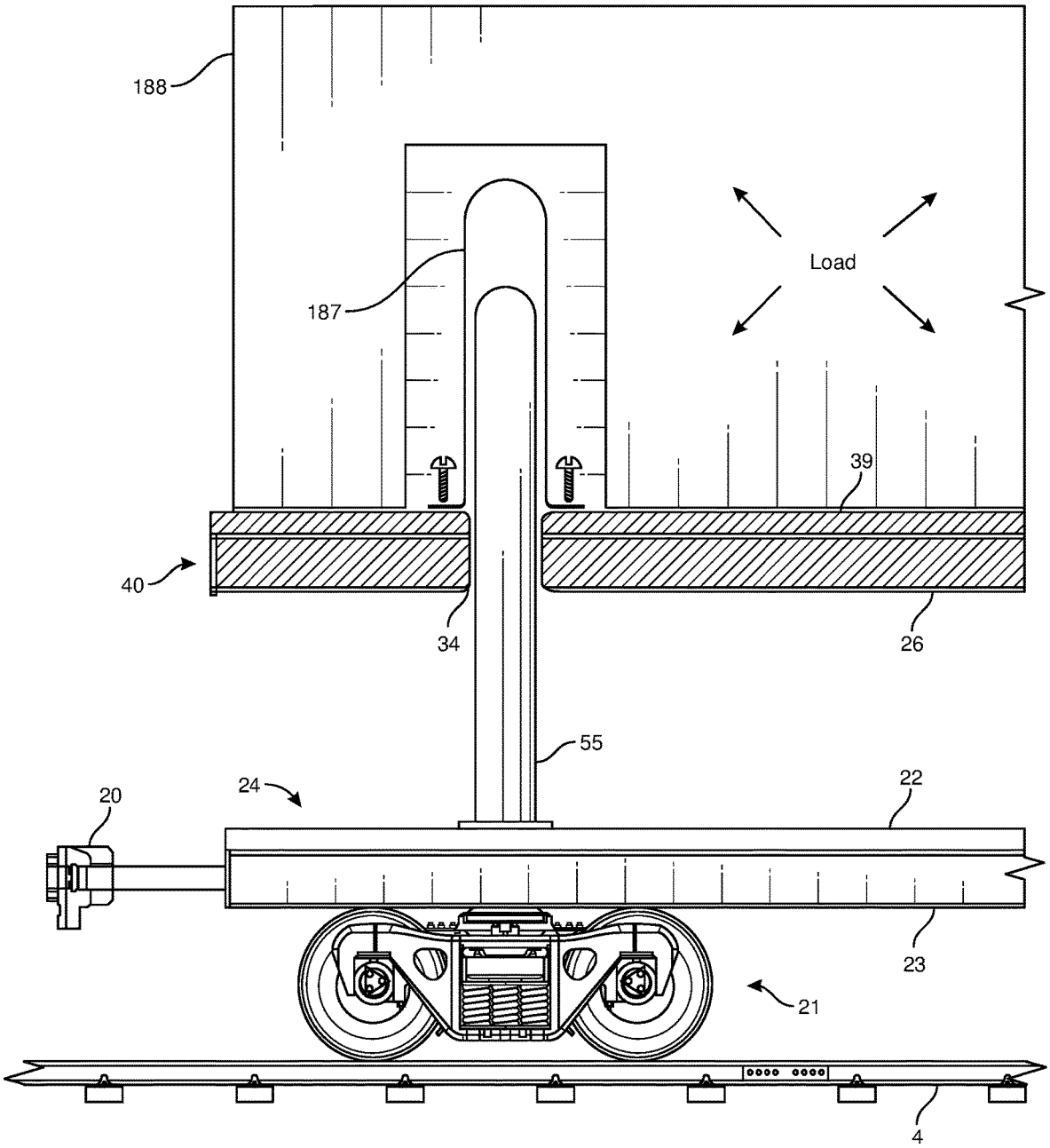

FIG. 116 shows a cross-sectional side view of a railcar with a vertical guide rail cover and load disposed on a WBA, according to embodiments of this disclosure.

Figure 117:
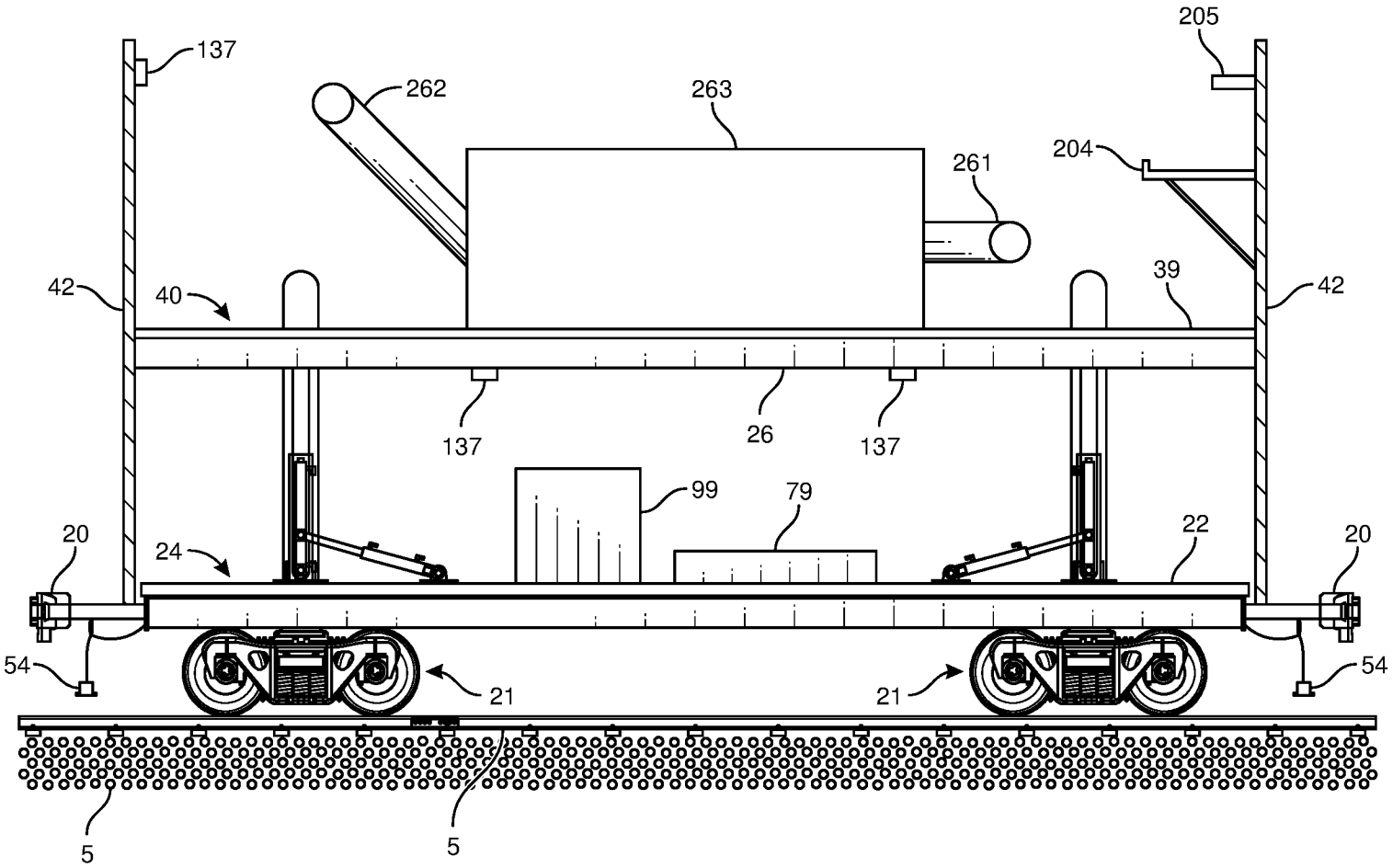

FIG. 117 shows a cross-sectional side view of a railcar with a water pump system, an operator platform, and a manual control system console positioned on a WBA, according to embodiments of this disclosure.

Figure 118:
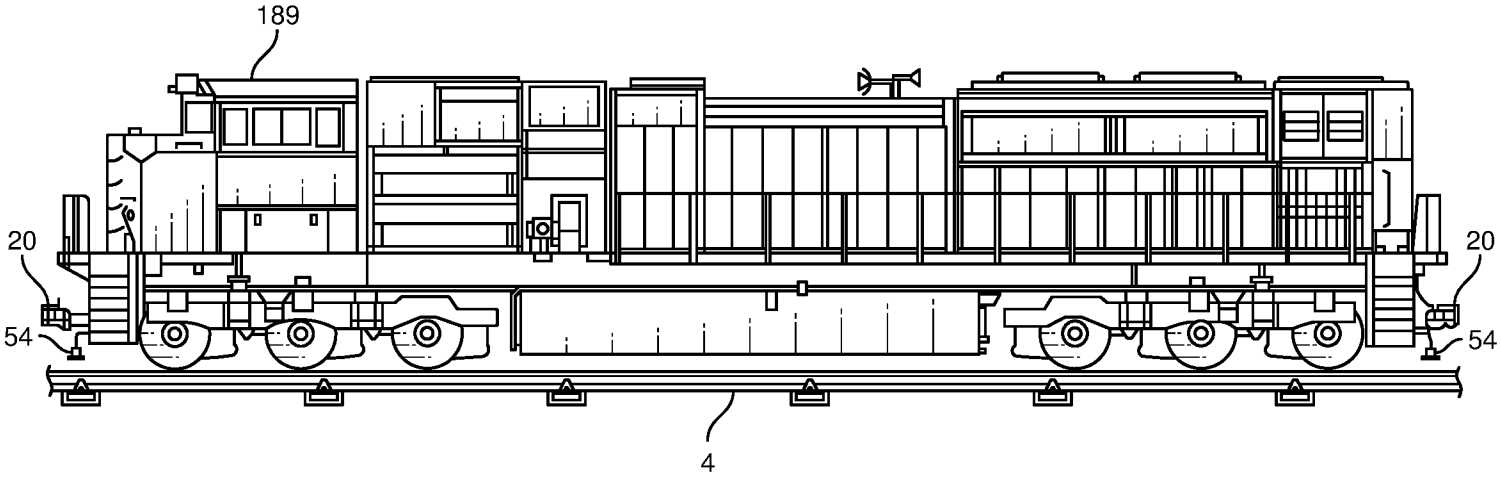

FIG. 118 shows a side view of a locomotive for moving railcars on railroad tracks, according to embodiments of this disclosure.

Figure 119:
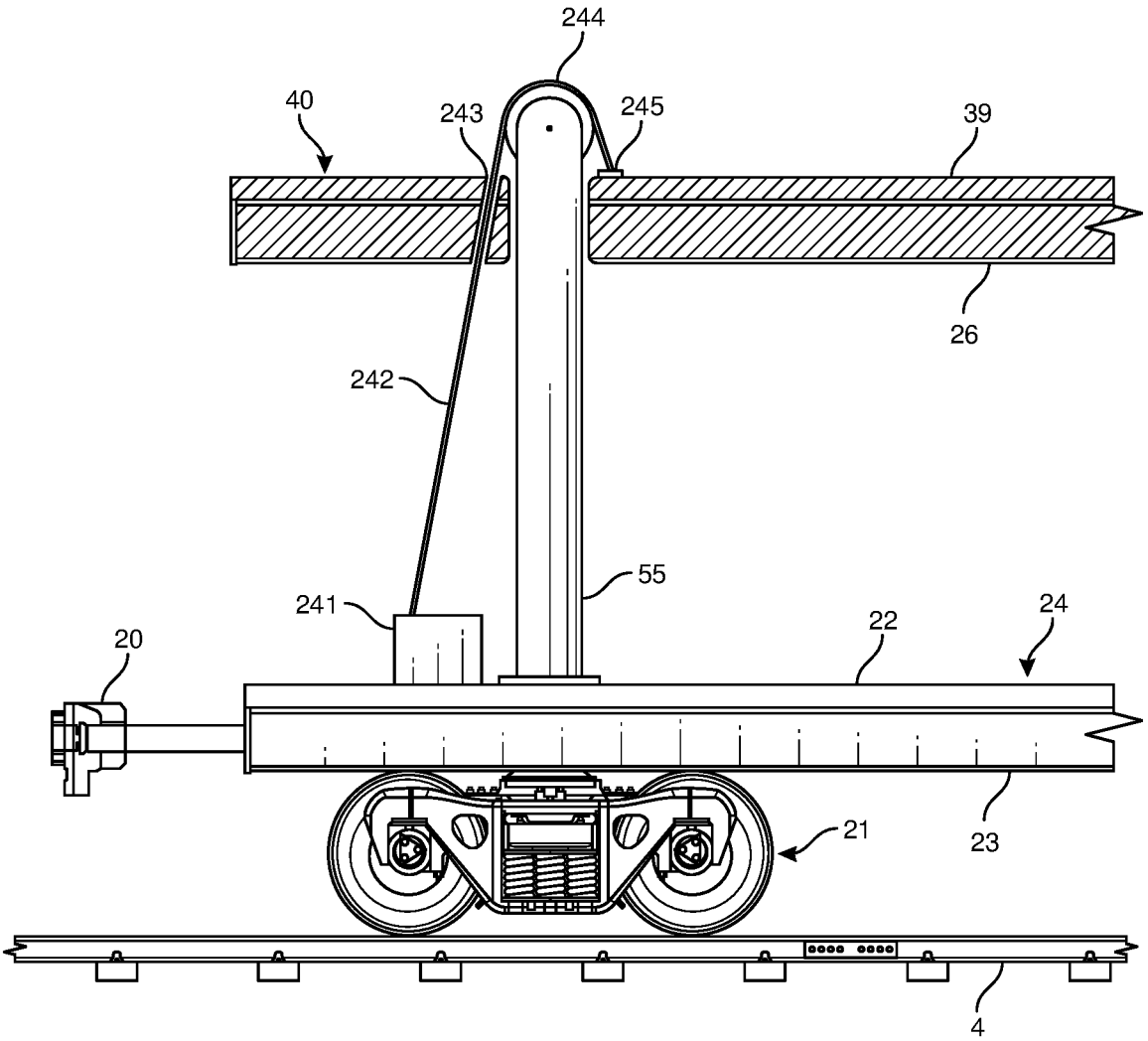

FIG. 119 shows a side view of an electric winch that may move a WBA vertically, according to additional embodiments of this disclosure.

Figures 120A, 120B, 120C:
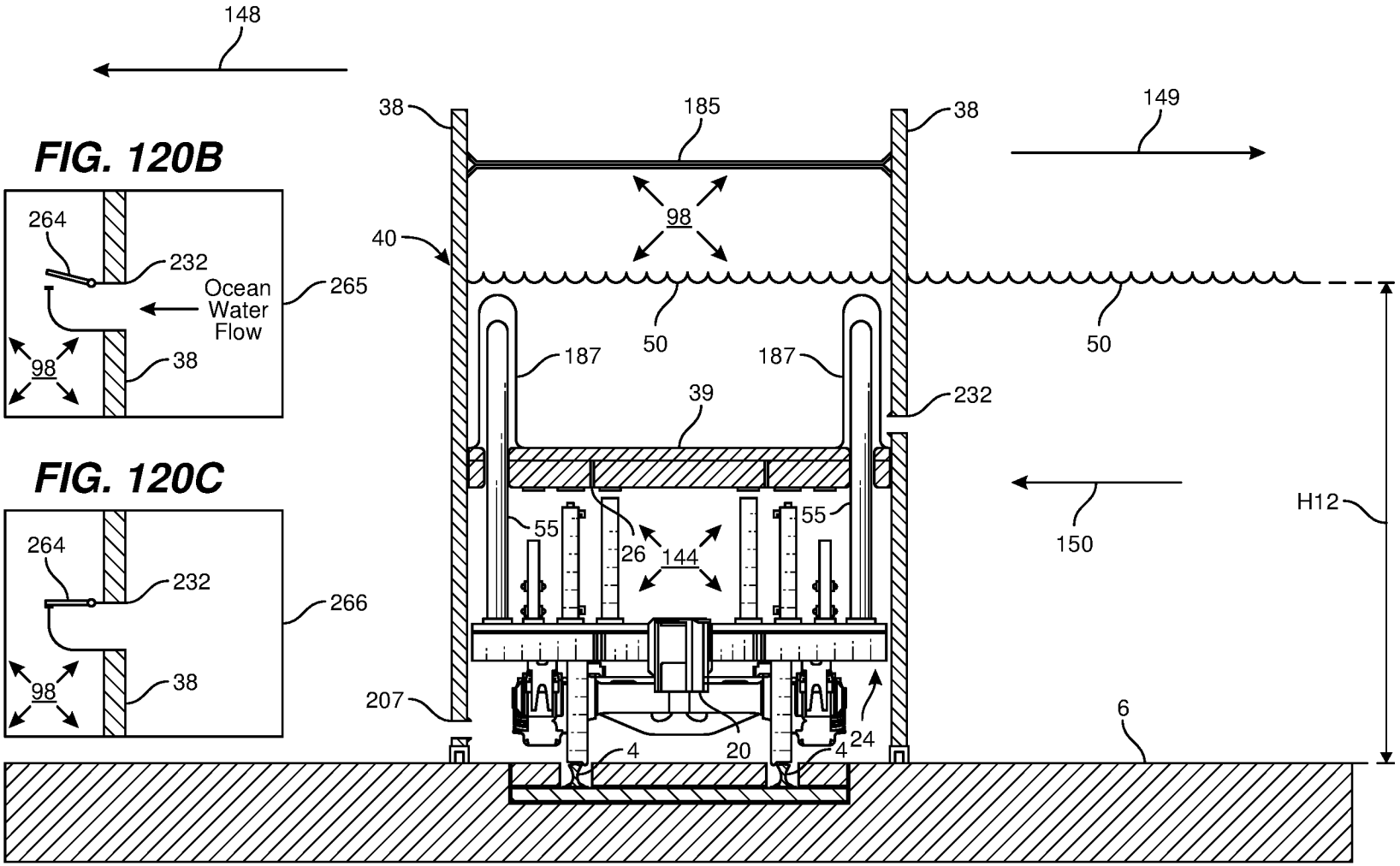

FIG. 120A shows a cross-sectional end view of the railcar with a WBA upper section enabled for flooding, according to embodiments of this disclosure. FIGS. 120B and 120C show detailed views of a portion of the railcar.

Figure 121:
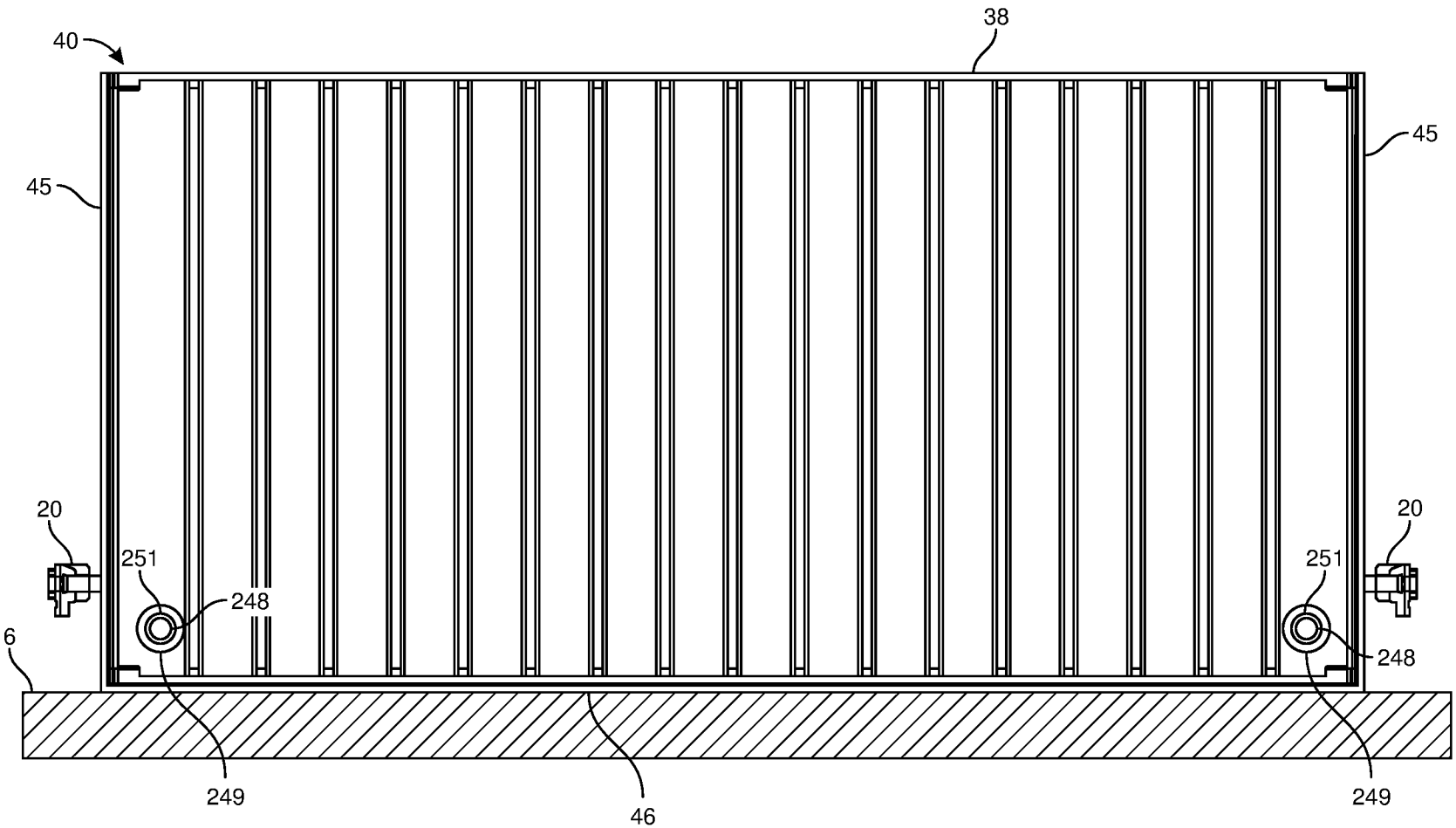

FIG. 121 shows a side view of a lower stabilizing system, according to embodiments of this disclosure.

Figure 122:
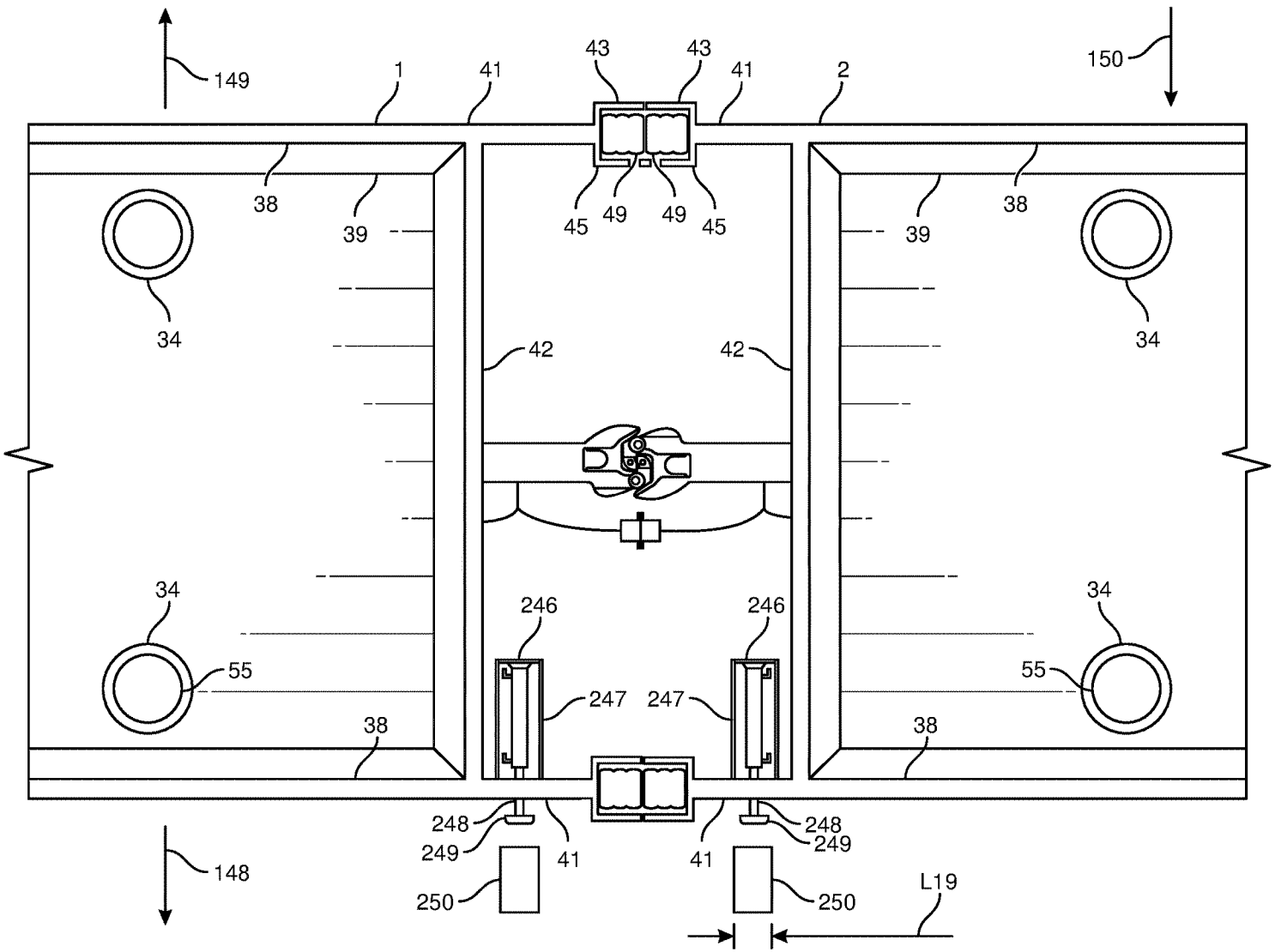

FIG. 122 shows a top view of two adjacent railcars with a lower stabilizing system in a disengaged mode, according to embodiments of this disclosure.

Figure 123:
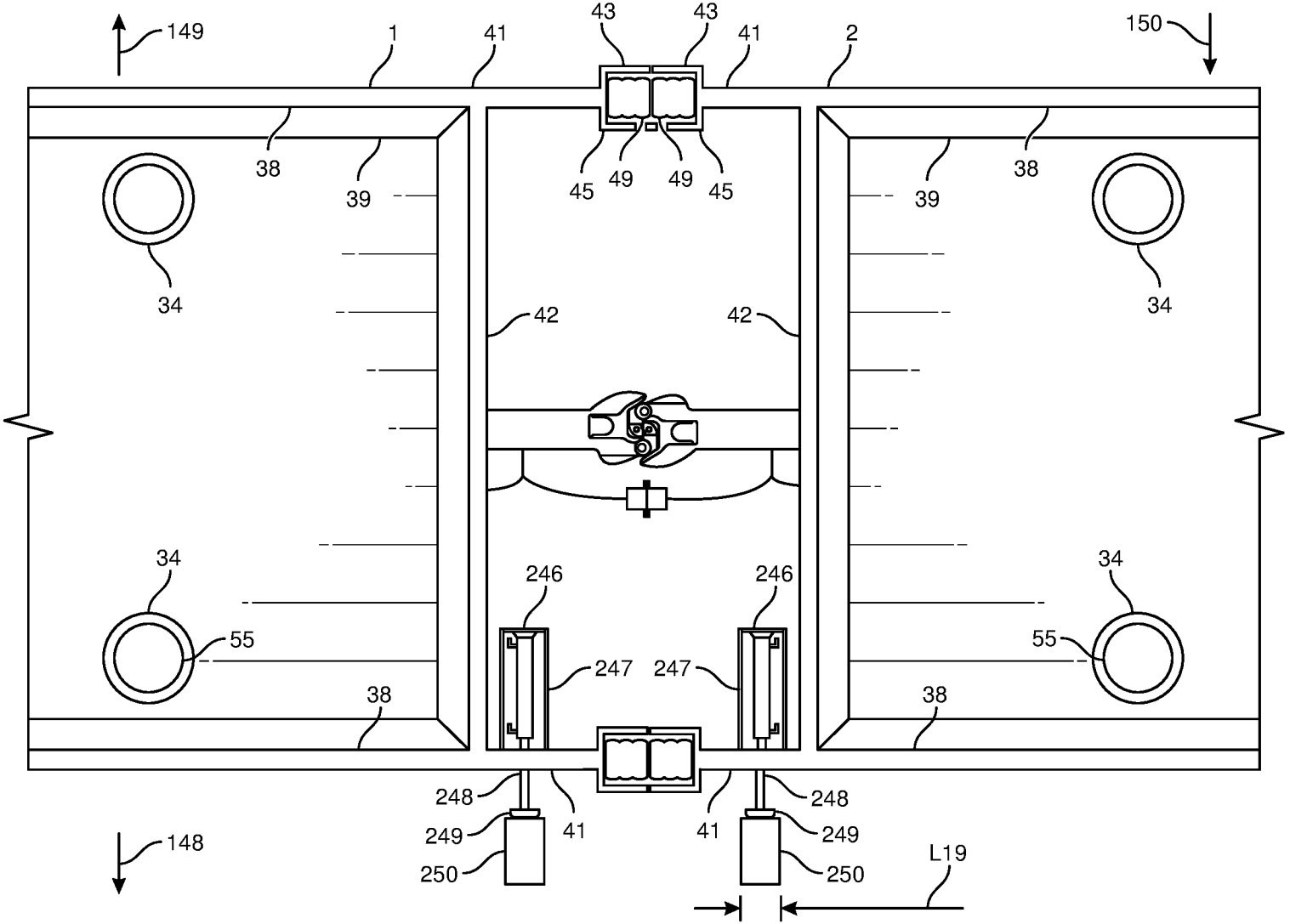

FIG. 123 shows a top view of the two adjacent railcars with the lower stabilizing system in an engaged mode, according to embodiments of this disclosure.

Figure 124A:
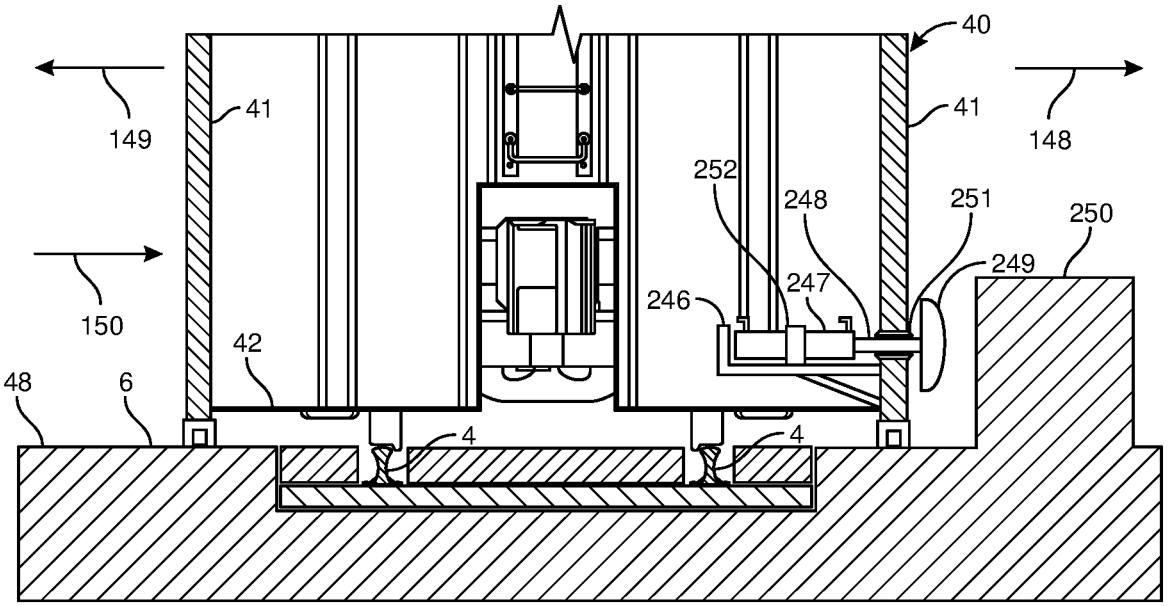

FIG. 124A shows an end view of the lower stabilizing system in the disengaged mode, according to embodiments of this disclosure.

Figure 124B:
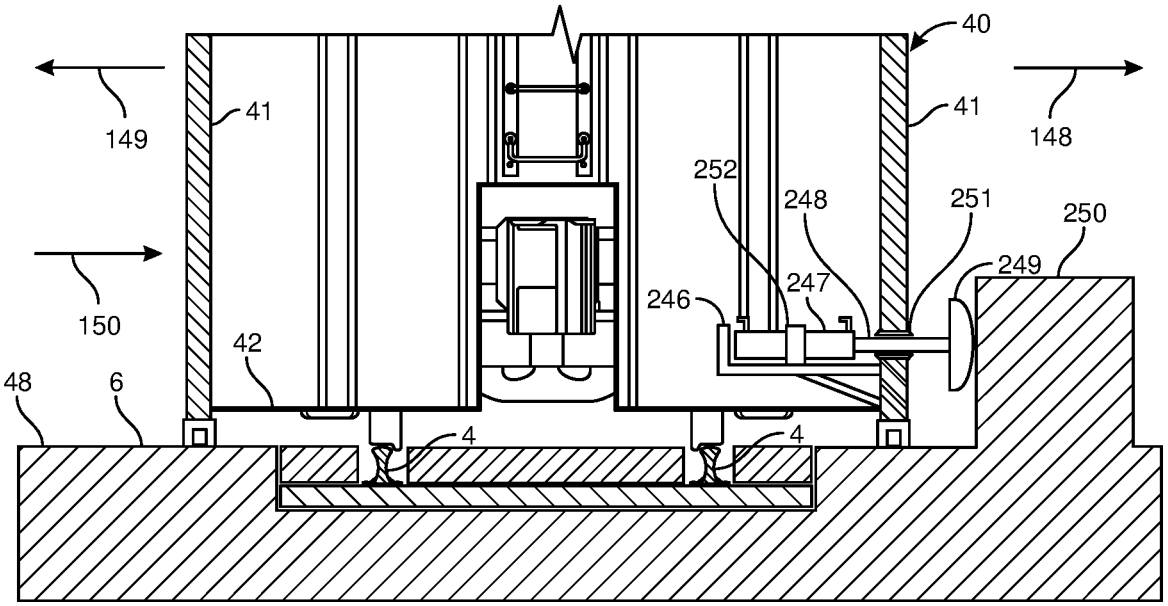

FIG. 124B shows an end view of the lower stabilizing system in the engaged mode, according to embodiments of this disclosure.

Figure 125A:
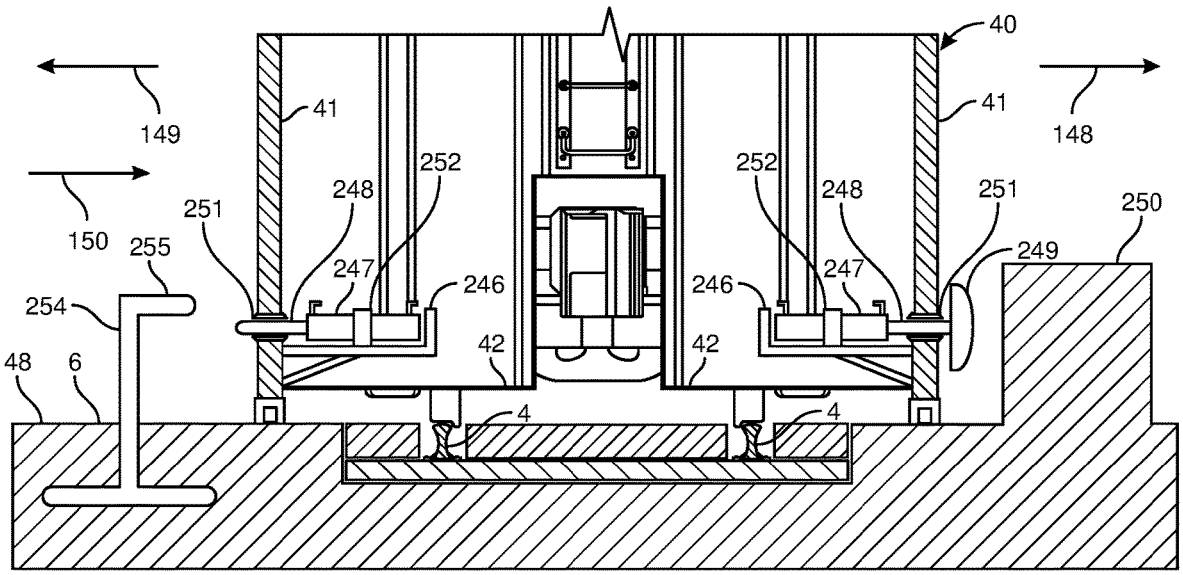

FIG. 125A shows an end view of the lower stabilizing system with an anti-tip configuration in a disengaged mode, according to embodiments of this disclosure.

Figure 125B:
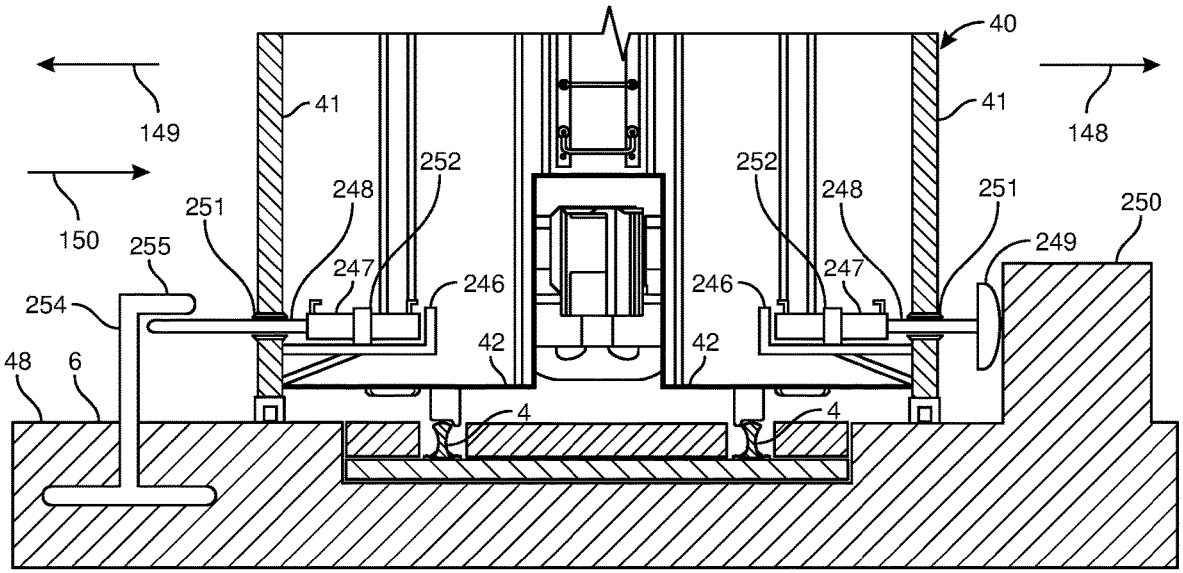

FIG. 125B shows an end view of the lower stabilizing system with the anti-tip configuration in an engaged mode, according to embodiments of this disclosure.

Throughout the drawings, identical reference characters and descriptions indicate similar, but not necessarily identical, elements. While the example embodiments described herein are susceptible to various modifications and alternative forms, specific embodiments have been shown by way of example in the drawings and will be described in detail herein. However, the example embodiments described herein are not intended to be limited to the particular forms disclosed. Rather, the present disclosure covers all modifications, equivalents, combinations, and alternatives falling within the scope of the appended claims.

DETAILED DESCRIPTION OF EXAMPLE EMBODIMENTS

The present disclosure is generally directed to a water barrier system that may be formed by specialized mobile water barriers. The mobile water barriers may include sealing elements along their sidewalls, which may be lowered and translated together to form water seals for creating a water barrier assembly. The systems and methods of the present disclosure may be used to form water (e.g., storm surge) barriers more quickly, efficiently, and cost-effectively than conventional techniques.

Figure 12:
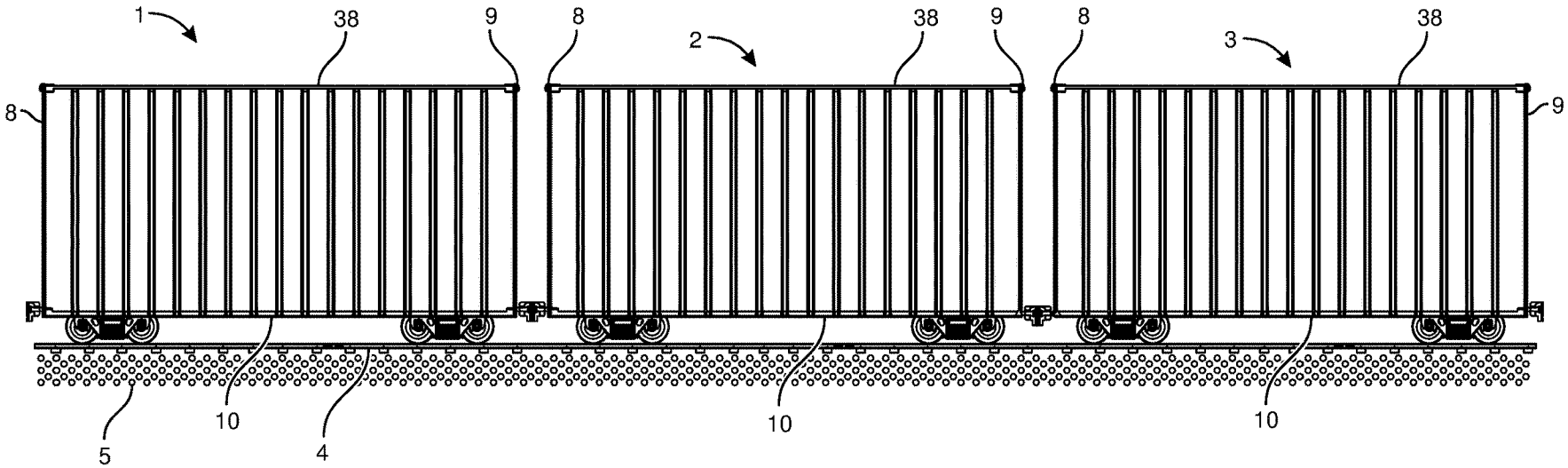
FIG. 12 shows a side view of a water barrier system in a transportation mode, according to embodiments of this disclosure.

FIG. 12 shows a side view of a water barrier system according to some embodiments of the present disclosure, including mobile water barriers in the form of railcars 1, 2, and 3 connected together and riding on a railroad track 4 that may be laid on a gravel railroad track roadbed 5. The water barrier system is shown in a transportation mode, for moving along the track 4 to a location where it is desired to form a water (e.g., storm surge) barrier.

Figure 13:
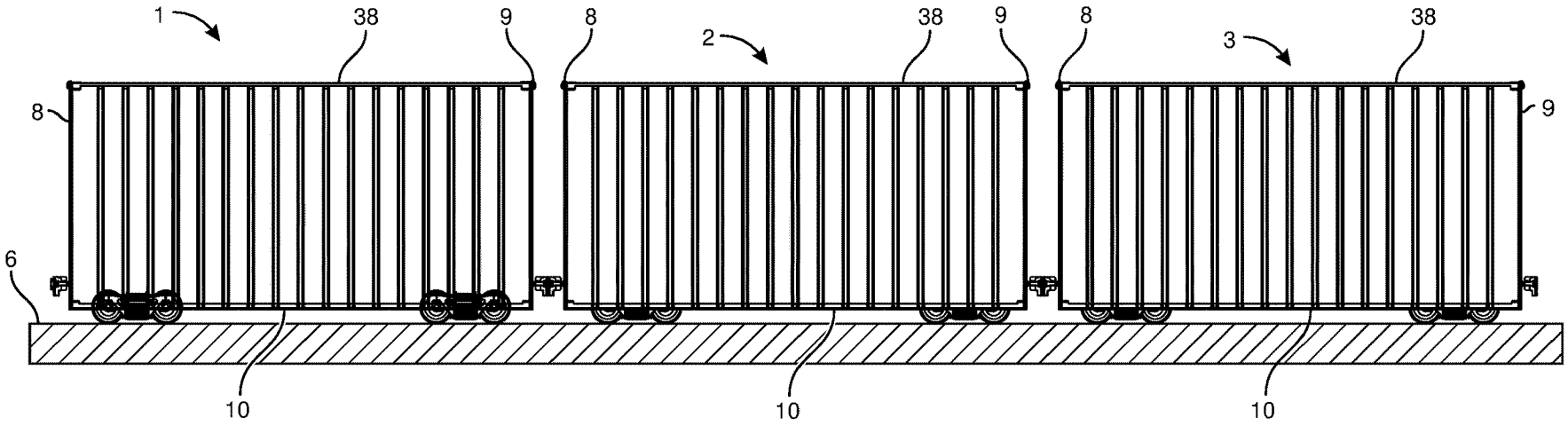
FIG. 13 shows a side view of the system of FIG. 12 in the process of its transformation into a water barrier, according to embodiments of this disclosure.

FIG. 13 shows a side view of the railcars 1, 2, and 3 at the target location, in a state in which the railcars 1, 2, and 3 are in the process of their transformation into a water barrier by lowering their sidewalls 38, including their sidewall assembly bottoms 10, toward a planar surface 6 adjacent to the track 4. Later in the transformation process, the left 8 and right 9 sides of the railcar sidewalls 38 may be drawn closer together.

Figure 14:
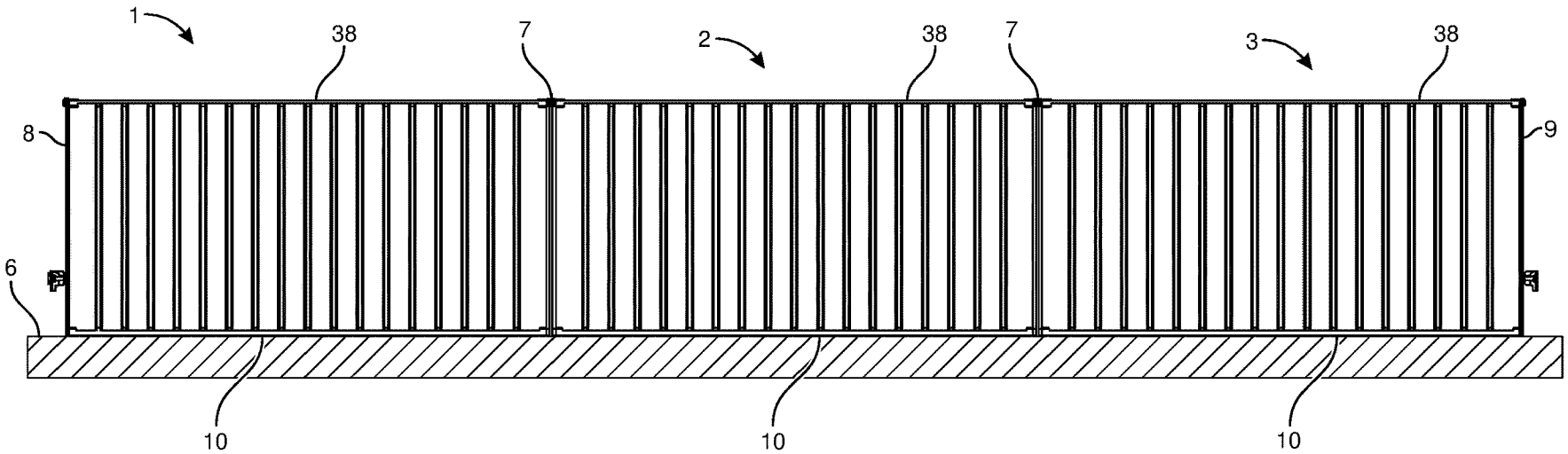
FIG. 14 shows a side view the system of FIG. 12 after completing its transformation into a water barrier, according to embodiments of this disclosure.

FIG. 14 shows a side view of the system of FIG. 12 after the completion of the process of transformation into a water barrier. The left 8 and right 9 sides of the railcar sidewalls 38 may contact each other to form a water-resistant or water-tight mechanical seal 7 between the sidewalls 38. The sidewall assembly bottoms 10 may rest on the planar surface 6 creating a water-resistant or water-tight mechanical seal between the sidewall assembly bottoms 10 and the planar surface 6. With the transformation process completed, the railcars 1, 2, and 3 have been transformed into a continuous water barrier that may be as high as their sidewalls 38 and may extend from the left side 8 of the first railcar 1 to the right side 9 of the third railcar 3. The length of the water barrier can be varied by varying the number of railcars used. The reversal of the transformation process may result in the railcars being made ready for transport to another location, such as for storage or for further deployment and reuse. Additional details regarding the system's modes of operation will be discussed later in this disclosure.

There may be two major assemblies that make up each of the railcars 1, 2, and 3, referred to herein as the Water Barrier Assembly (WBA) and the Barrier Transport and Positioning System (BTPS). The WBA may be made by modifications to conventional gondola railcar technology, while the BTPS may be made by modifications to conventional flatcar railcar technology. Construction of the WBA will be discussed first, followed by the BTPS.

The WBA uses an underframe that is similar to the underframe of a gondola railcar. The WBA underframe may support the water barrier walls (i.e., the sidewalls 38), endwalls 42, floor 39, and other components. Vertical motion of the underframe may be controlled by components positioned on the BTPS that operate on the underframe. As indicated above, the BTPS will be further discussed below. Substantial forces from waves and loads may act on the WBA underframe. Therefore, the WBA underframe may be made with components and materials (e.g., steel) that exhibit sufficient strength to withstand the expected forces and loads.

Figure 15:
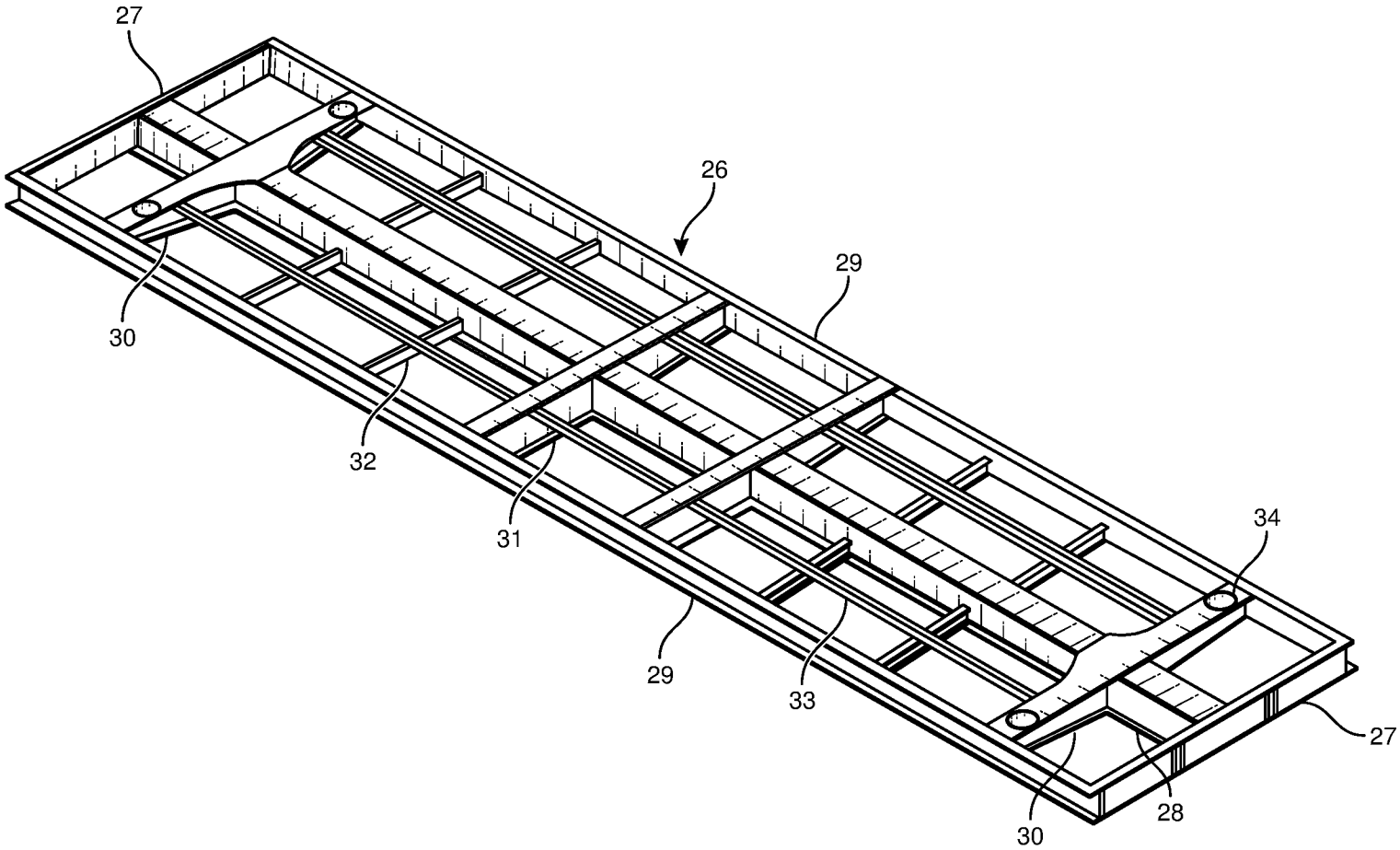
FIG. 15 shows a top perspective view of a Water Barrier Assembly (WBA) underframe, according to embodiments of this disclosure.

FIG. 15 shows a top perspective view of a WBA underframe 26 with WBA end sills 27 at both ends of the WBA underframe 26. The WBA end sills 27 may be attached at right angles to WBA side sills 29. With the WBA side sills 29 longer than the WBA end sills 27, the assembly of these sills may create a rectangular outer frame of the WBA underframe 26. A WBA center sill 28 may be centered between and parallel to the WBA side sills 29 and may terminate with connections to the WBA end sills 27. WBA body bolsters 30 may be attached to the WBA center sill 28 and WBA side sills 29 near, and may run parallel to, the WBA end sills 27. The WBA body bolsters 30 may terminate with connections to the WBA side sills 29. Additional strength may be provided by the WBA cross bearers 31 connected from WBA side sill 29 to opposing WBA side sill 29 by connecting through the WBA center sill 28 at right angles. Additional strength and support for the WBA floor (not shown in FIG. 15) may be provided by WBA floor stringers 33, which may be supported by WBA stringer supports 32. Two linear-motion bearings 34 may be positioned on, attached to, and run through each of the WBA body bolsters 30. The purpose of the linear-motion bearings 34 will be discussed in greater detail below.

The WBA components may be connected or attached together by welding or other secure means (e.g., fasteners, etc.). One of ordinary skill in the art will recognize where such use of welding or other attachment means may be appropriate.

Figure 16:
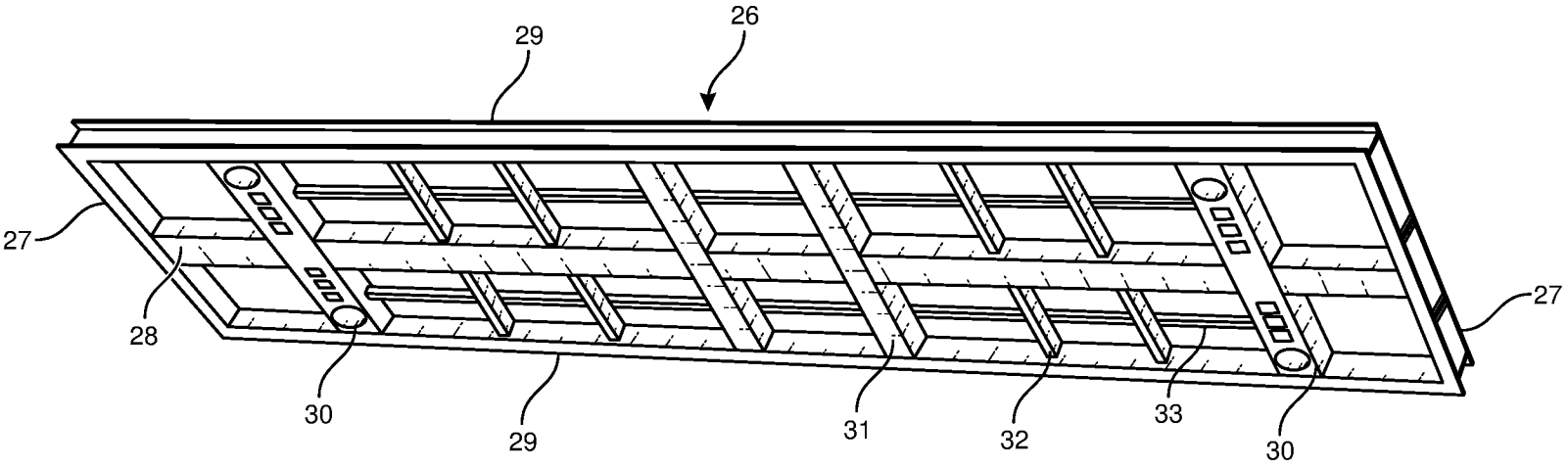
FIG. 16 shows a bottom perspective view of the WBA underframe of FIG. 15.
Figure 17:
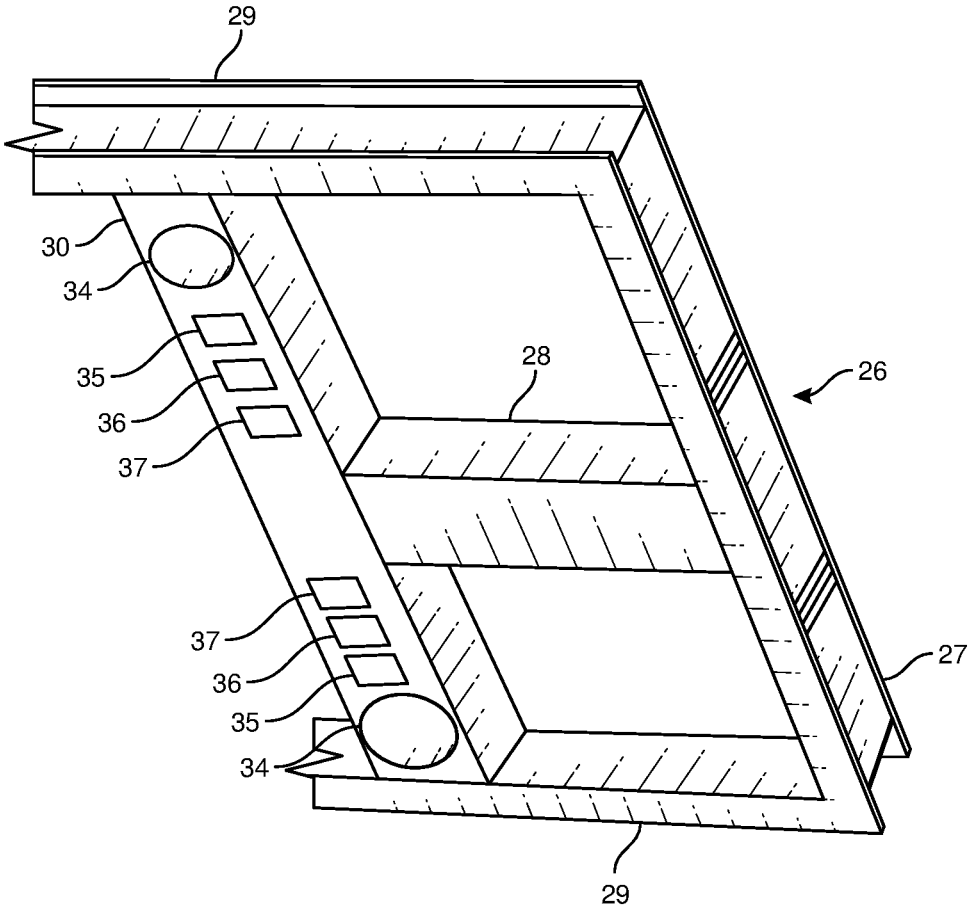
FIG. 17 shows an enlarged bottom perspective view of a WBA underframe body bolster of the WBA underframe of FIG. 15.

FIG. 16 shows a bottom perspective view of the WBA underframe 26, where significant modifications (relative to conventional flatcar railcars) to the WBA body bolsters 30 can be seen. FIG. 17 shows the WBA body bolster 30 modifications in greater detail. Strike plates 35, 36, and 37 may be welded to the bottom of the WBA body bolsters 30. In some examples, each of the strike plates 35, 36, and 37 may include a steel plate (e.g., a one-inch thick steel plate) in a planar, square configuration. The linear-motion bearings 34 may be attached to and may pass through the WBA body bolsters 30. The strike plates 35, 36, and 37 are also identified herein as the interlocking beam strike plates 35, the WBA vertical position controlling cylinder strike plates 36, and the service/safety block strike plates 37. The mechanical facilities to receive railcar couplers at the ends of the WBA center sill 28 may not be features of the WBA underframe 26.

Figure 18:
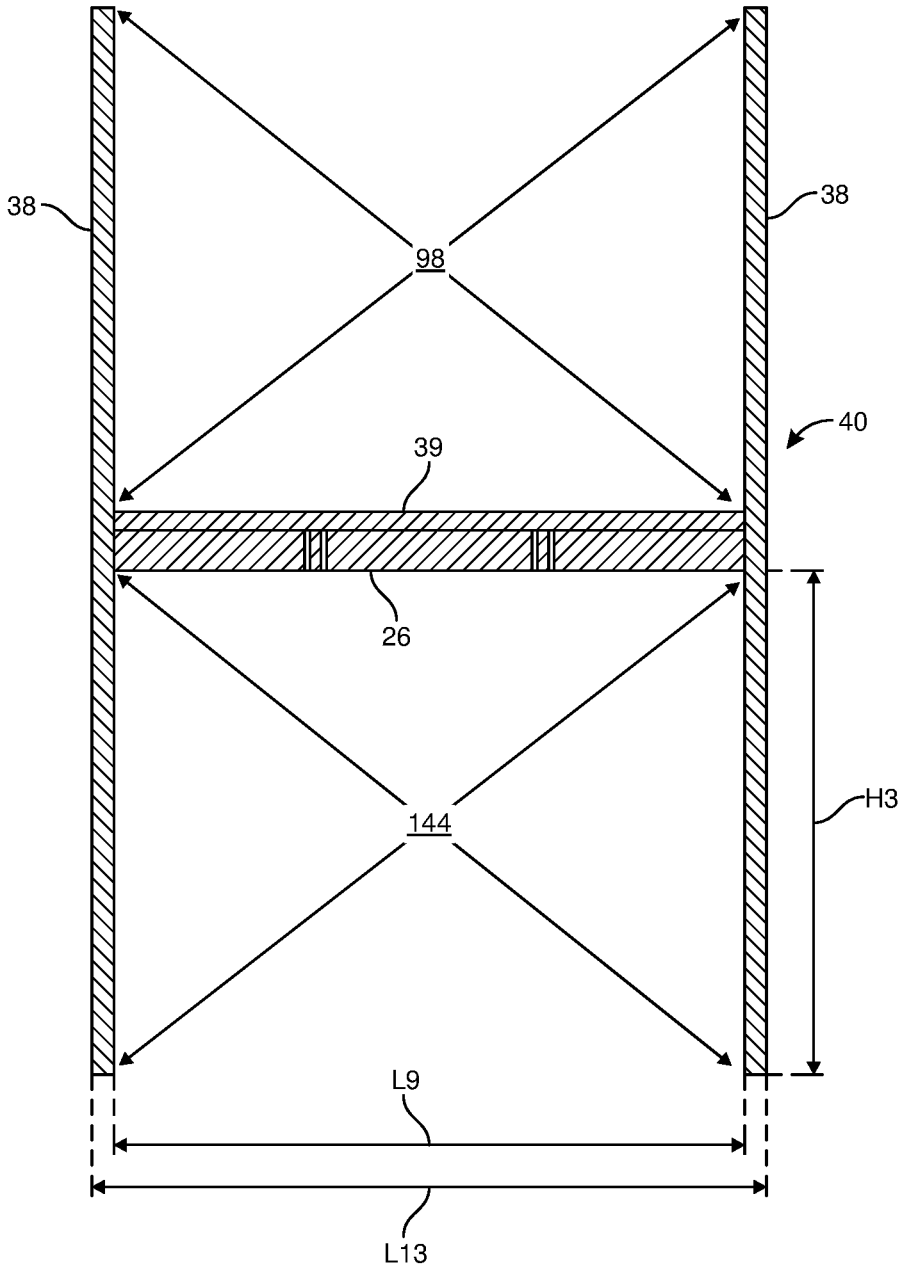
FIG. 18 shows a cross-sectional end view of a WBA according to embodiments of the present disclosure.
Figure 19:
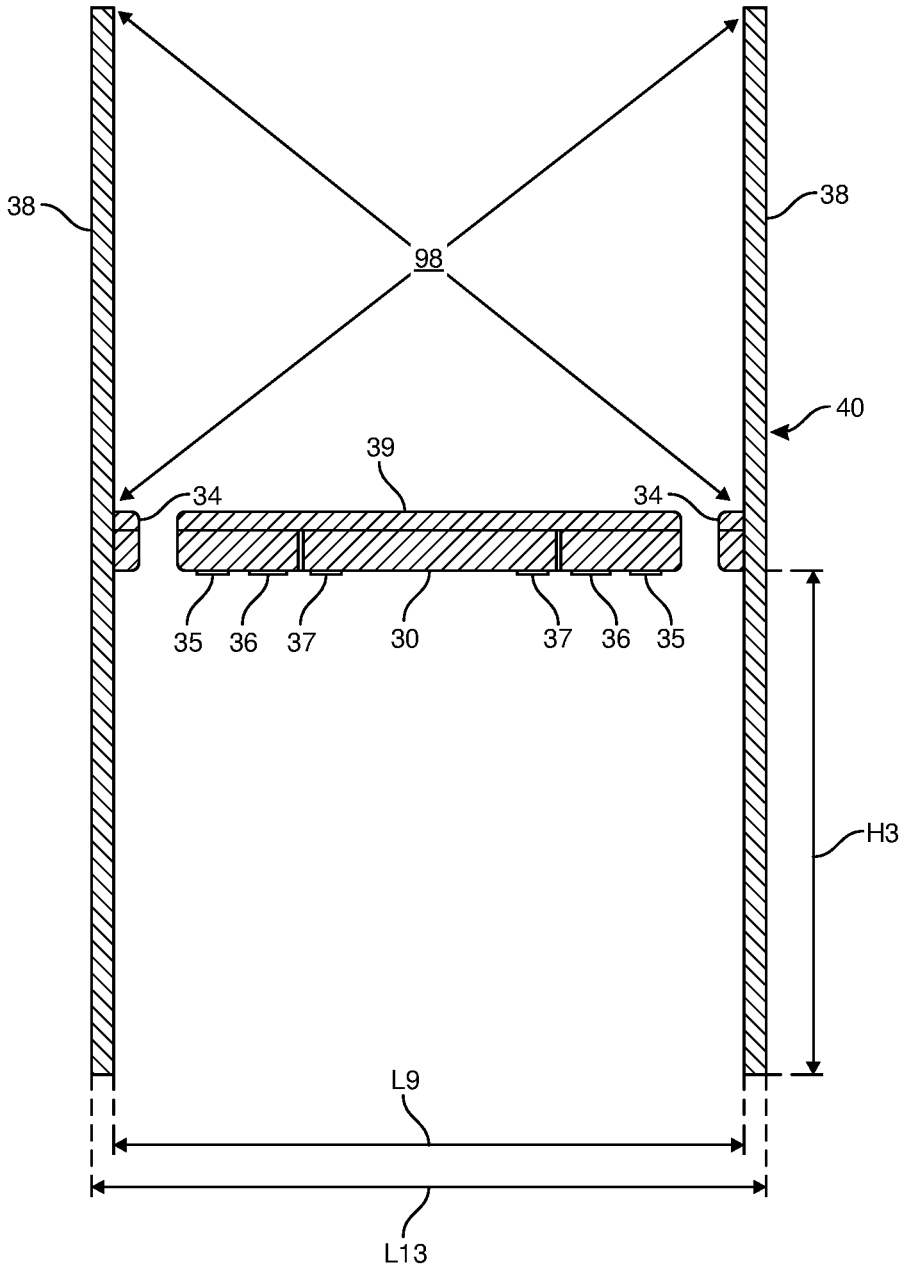
FIG. 19 shows a cross-sectional end view of the WBA of FIG. 18, taken through a WBA body bolster 30, according to embodiments of this disclosure.

The WBA underframe 26 may include two vertical sidewalls 38 attached to its side sills 29. However, unlike a conventional gondola railcar, the WBA underframe 26 may be attached to the sidewalls 38 at a higher position along the sidewalls 38. FIG. 18 shows a cross-sectional end view of the WBA 40, where the cross-section is taken near an end of the WBA underframe 26. The WBA underframe 26 side sills may be attached to interior surfaces of WBA sidewalls 38 at a height H3, as measured from the bottom of the WBA sidewalls 38. The WBA floor 39, which may be a generally planar steel plate, may be attached to the top of the WBA underframe 26. The WBA floor 39 may span the width L9 and length L10 (shown in FIG. 20) of the WBA underframe 26. The WBA floor 39 may be welded or otherwise attached to the interior surfaces of WBA sidewalls 38 and WBA endwalls 42 (shown in FIG. 21), such that the juncture is strong and waterproof to enable a volume of fluid to fill the WBA upper section 98 without conveying to a WBA lower section 144. FIG. 19 shows a cross-sectional end view of the WBA 40, where the cross-section is taken in the middle of the WBA body bolster 30 through a pair of linear-motion bearing 34. Features of the of WBA body bolster 30 include the interlocking beam strike plates 35, the WBA vertical position controlling cylinder strike plates 36, the service/safety block strike plates 37, and the linear-motion bearings 34. The linear-motion bearings 34 may pass through the WBA floor 39 as well as through the WBA body bolsters 30.

Figure 20:
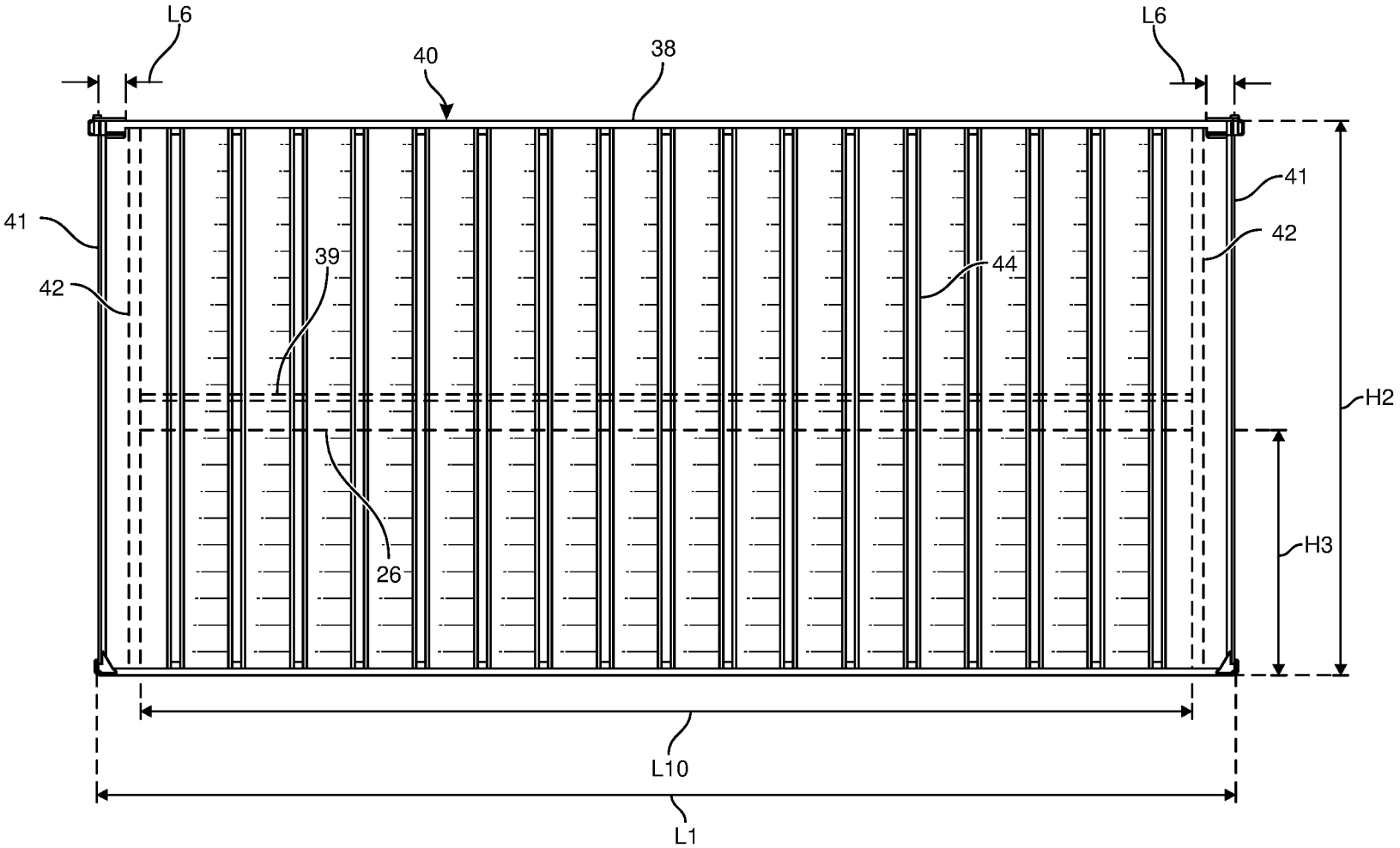
FIG. 20 shows a side view of the WBA, according to embodiments of this disclosure.

FIG. 20 shows a transparent side view of the WBA 40, with the position of the WBA underframe 26 and WBA endwalls 42 shown in dashed lines. The position and height H3 of the WBA underframe 26 can be seen behind the WBA sidewall 38. The WBA sidewall 38 extends along a length L1 and has a height H2. The WBA sidewall 38 may include vertical steel rib wall reinforcements 44. The WBA floor 39 may be attached on the top of the WBA underframe 26 and may span along the length L10 of the WBA underframe 26. The WBA underframe 26 and the WBA floor 39 may end where they both attach to the WBA endwalls 42 at both ends of the WBA 40. The WBA endwalls 42 have a height H2 (FIG. 21) and width L9 (FIG. 19) and may be attached to the WBA sidewalls 38 on both sides of the WBA 40. An end view of the WBA endwall 42 can be seen in FIG. 112 which will be discussed in greater detail below.

Figure 21:
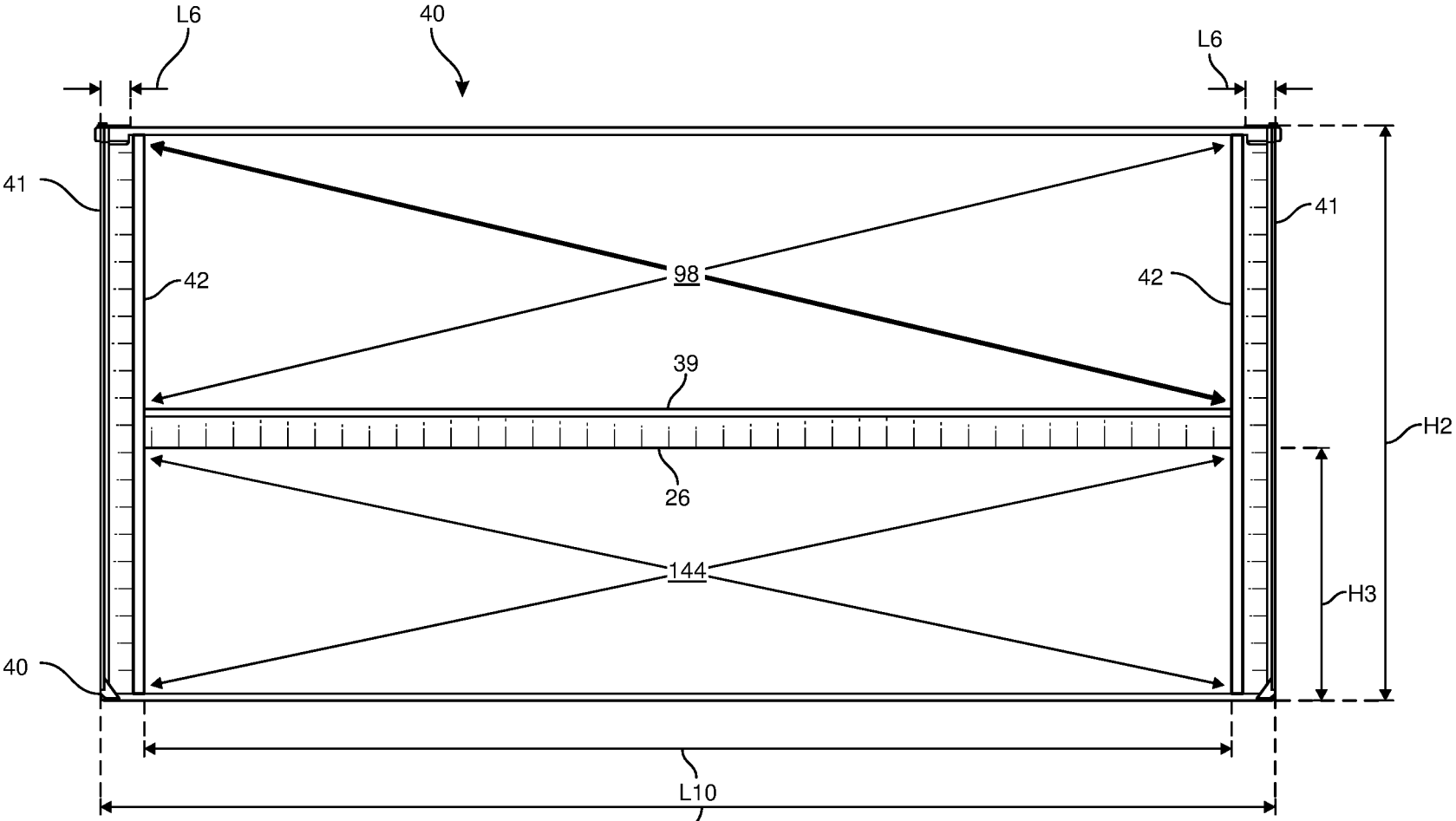
FIG. 21 shows a side view of the WBA, with the sidewall and side ribbing removed to better view internal components, according to embodiments of this disclosure.

FIG. 20 further shows the WBA sidewall extensions 41, located on both ends of the WBA 40, which may be a part of the WBA sidewall 38 and may extend outwardly a distance L6 beyond the vertical plane of the WBA endwalls 42. FIG. 21 is identical to FIG. 20, except that the steel rib wall reinforcements 44 and sidewall 38 are not shown to better view the WBA sidewall extensions 41. The WBA sidewall extensions 41 may be used to properly position components that enable the WBA 40 to form water-resistant or water-tight mechanical seals with the WBAs 40 of adjacent connected railcars. The WBA sidewall extensions 41 and water sealing components will be discussed in greater detail below.

Figure 22:
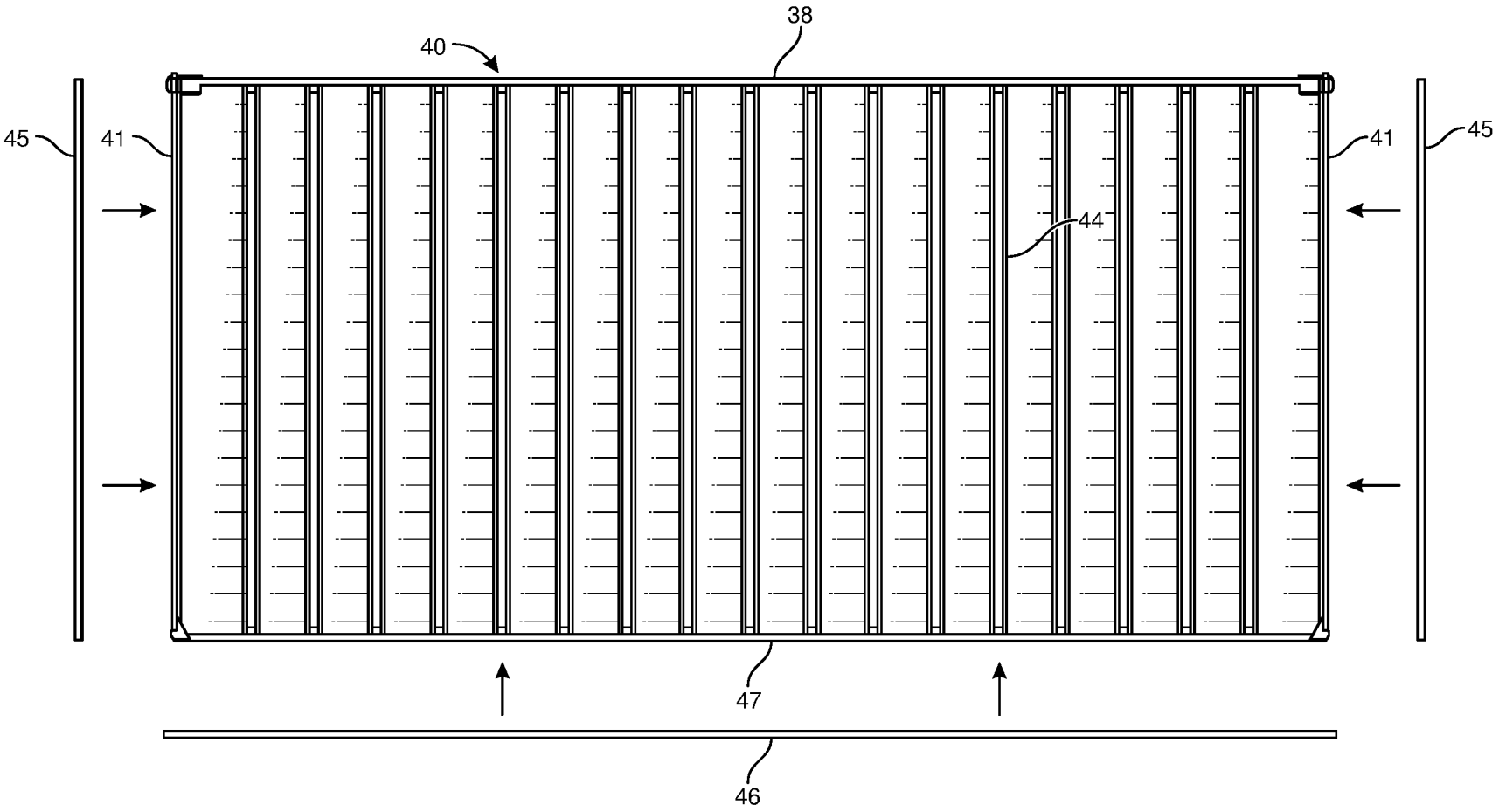
FIG. 22 shows a side view of the WBA of FIG. 18 with unattached side gasket/housing and bottom gasket assemblies, according to embodiments of this disclosure.

FIG. 22 shows a side view of the WBA 40. The WBA sidewall 38 is shown vertically oriented and may be made of sheets or plates of steel, or any other impermeable metal, welded together to form a wall that extends a length L1 and a height H2 (FIG. 21). The WBA sidewalls 38 may be used as water barriers because water cannot flow through the solid metallic wall surfaces. Therefore, the effective water barrier surface for the WBA 40 has a length L1 and a height H2. Steel rib wall reinforcements 44 may be attached to the WBA sidewall's 38 surface to add support and rigidity against forces attempting to bend or otherwise compromise the structural integrity of the WBA sidewall 38. Additional wall reinforcements including, but not limited to, base tracks, beams, braces, channel steel, cladding, metal sheets, metal plates, ribs, studs, top tracks, and wall girts may be used to strengthen the WBA sidewalls 38 to the meet the design requirements and anticipated forces on the WBA sidewalls 38.

Figure 23:
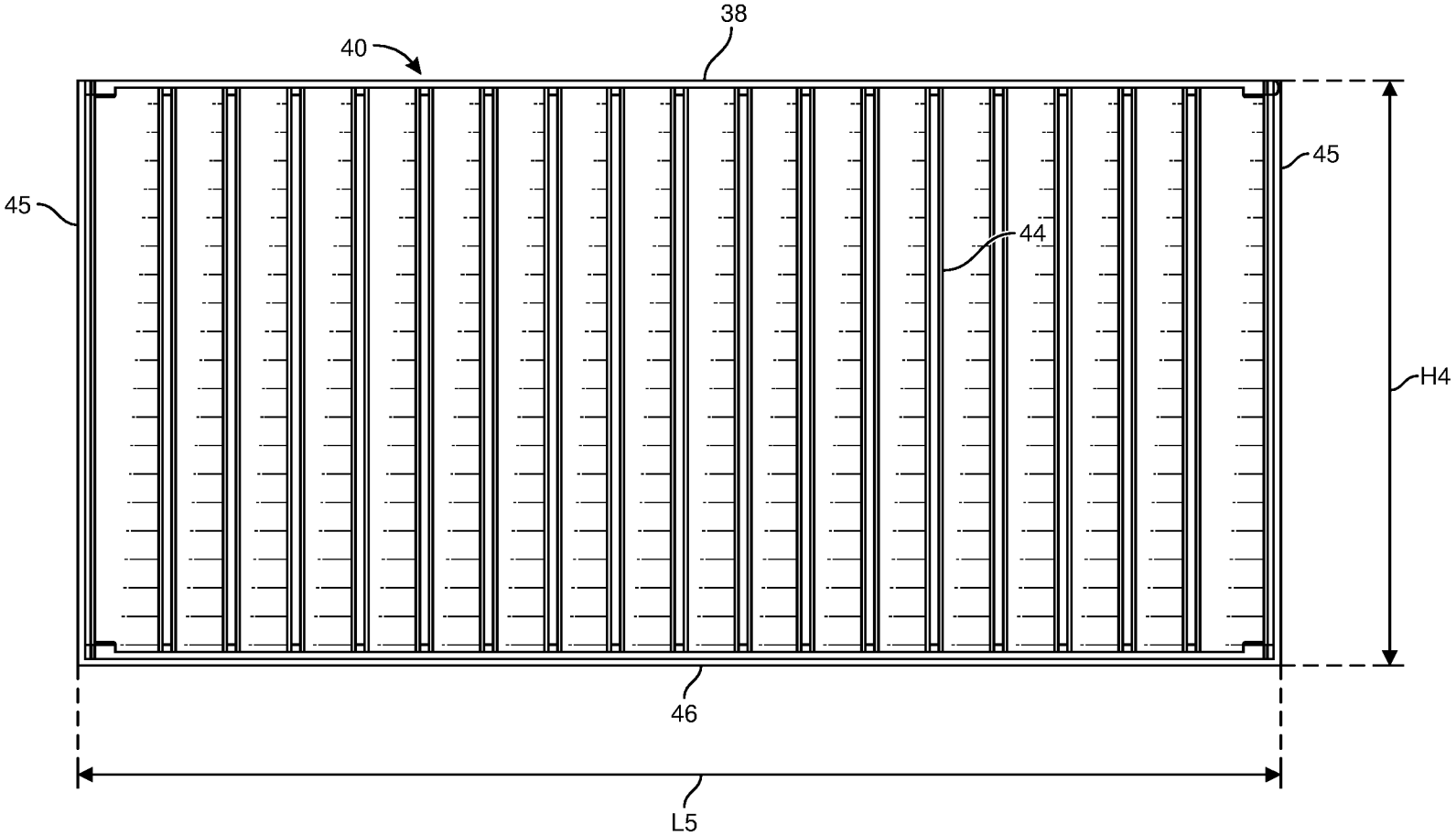
FIG. 23 shows a side view of the WBA of FIG. 18 with attached side gasket/housing assemblies, according to embodiments of this disclosure.

In order for the WBA 40 to create water-resistant or water-tight mechanical seals against the ground-level planar surface and against the WBAs 40 of adjacent connected railcars, in some embodiments the WBA may be fitted with sealing elements to form the water-resistant or water-tight mechanical seals. Example sealing elements are referred to herein as gasket/housing assemblies (GHA) 45 and 46. The GHAs 45 and 46 may be respectively attached to the sides and bottom of the WBA 40. FIG. 22 shows a side view of the WBA 40 with a horizontally oriented bottom GHA 46 removed from the sidewall bottom 47 and vertically oriented side GHAs 45 removed from the ends of the WBA sidewall extensions 41. FIG. 23 shows a side view of the WBA 40 with the GHAs 45 and 46 fully assembled and attached to the WBA sidewall bottom 47 and sidewall extensions 41. With the physical additions of the bottom GHA 46 and side GHAs 45, the effective water barrier surface for the WBA 40 may be extended to a length L5 and a height H4 (FIG. 23), which is measured from the outer contact surfaces of the gaskets.

Figure 24A:
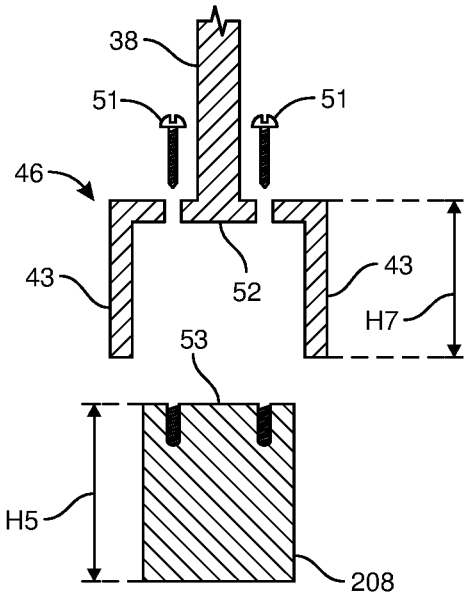
FIG. 24A shows a cross-sectional exploded view of a gasket/housing assembly, according to embodiments of this disclosure.
Figure 24B:
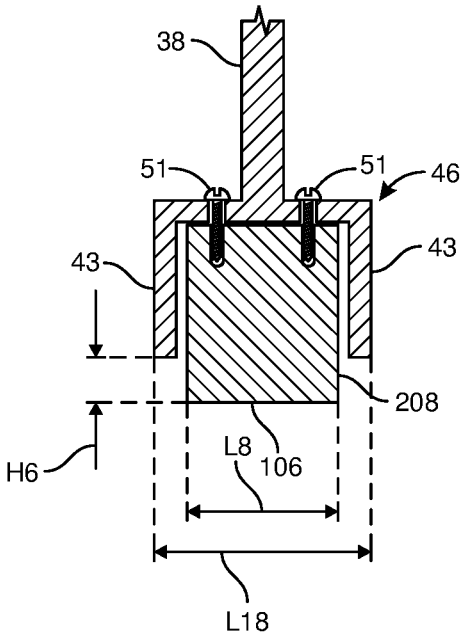
FIG. 24B shows a cross-sectional assembled view of the gasket/housing assembly of FIG. 24A.

FIG. 24A shows a cross-sectional exploded view of the bottom GHA 46, and FIG. 24B shows a cross-sectional assembled view of the bottom GHA 46. The bottom GHA 46 may include a c-section steel beam with a housing flange 43 attached to each side of a housing web 52 at right angles. The housing flanges 43 may have a width L18. Screws 51 or other fasteners may pass through the housing web 52 and into a bottom gasket 208, forcing a gasket contact surface 53 to press against the housing web 52 inner surface. Optionally, a sealant can be used between the housing web 52 and the gasket contact surface 53. An upper surface of the housing web 52 may be attached to a bottom of the WBA sidewall 38, such as by welding or other attachment means, such that the junction between the components may be water-resistant or water-tight. The bottom gasket 208 may have a height H5 that exceeds an internal flange height H7, such that, when assembled and uncompressed, the bottom gasket 208 may have an exposed height H6. The bottom gasket 208 may have a width L8 and a length that extends the length L5 (FIG. 23) of the WBA 40. The bottom gasket 208 can be made of a compressible material, such as rubber, with physical properties that are suitable to create a mechanical seal to inhibit the flow of water, or other fluid, when the bottom gasket's 208 outer contact surface 106 is forced against a generally planar surface (e.g., a surface adjacent to a railroad track).

Figure 24C:
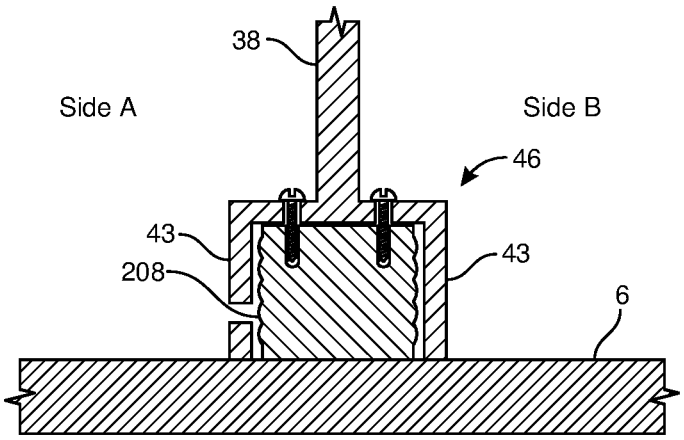
FIG. 24C shows a cross-sectional view of the gasket/housing assembly of FIGS. 24A and 24B, with the gasket/housing assembly abutting a planar surface, according to embodiments of this disclosure.

FIG. 24C shows a cross-sectional end view of the bottom GHA 46 as it is forced downward onto the planar surface 6. As shown in FIG. 24C, the housing flanges 43 may contact the planar surface 6, the gasket 208 may be compressed and the exposed height H6 (FIG. 24B) may be forced to zero. FIG. 24C shows an embodiment in which the part of the flange 43 that contacts the planar surface 6 has a planar surface. As another option, the flange 43 may include a surface with a vertical saw-tooth pattern, which can extend along its length L5. Use of such a vertical saw-tooth pattern on the contact surface of the flange 43 may increase a friction coefficient between the flange 43 and the planar surface 6 as the points of the saw-tooth pattern may penetrate the planar surface 6. A higher friction coefficient between the flange 43 and the planar surface 6 may increase a force (e.g., from water) required to move the deployed WBA 40. The bottom gasket 208 may be compressed by opposing forces from the housing web 52 and the planar surface 6 onto the gasket upper 53 and lower 106 contact surfaces, respectively. The compressive forces against the bottom gasket 208 may create a water seal (e.g., a water-resistant or water-tight mechanical seal) between the housing web 52 inner surface and the gasket upper contact surface 53 as well as between the planar surface 6 and the gasket lower contact surface 106, such that, together, water, or other fluid, may be inhibited or cannot pass from side A of the bottom gasket 208 to side B of the bottom gasket 208.

Figures 25A, 25B, 25C:
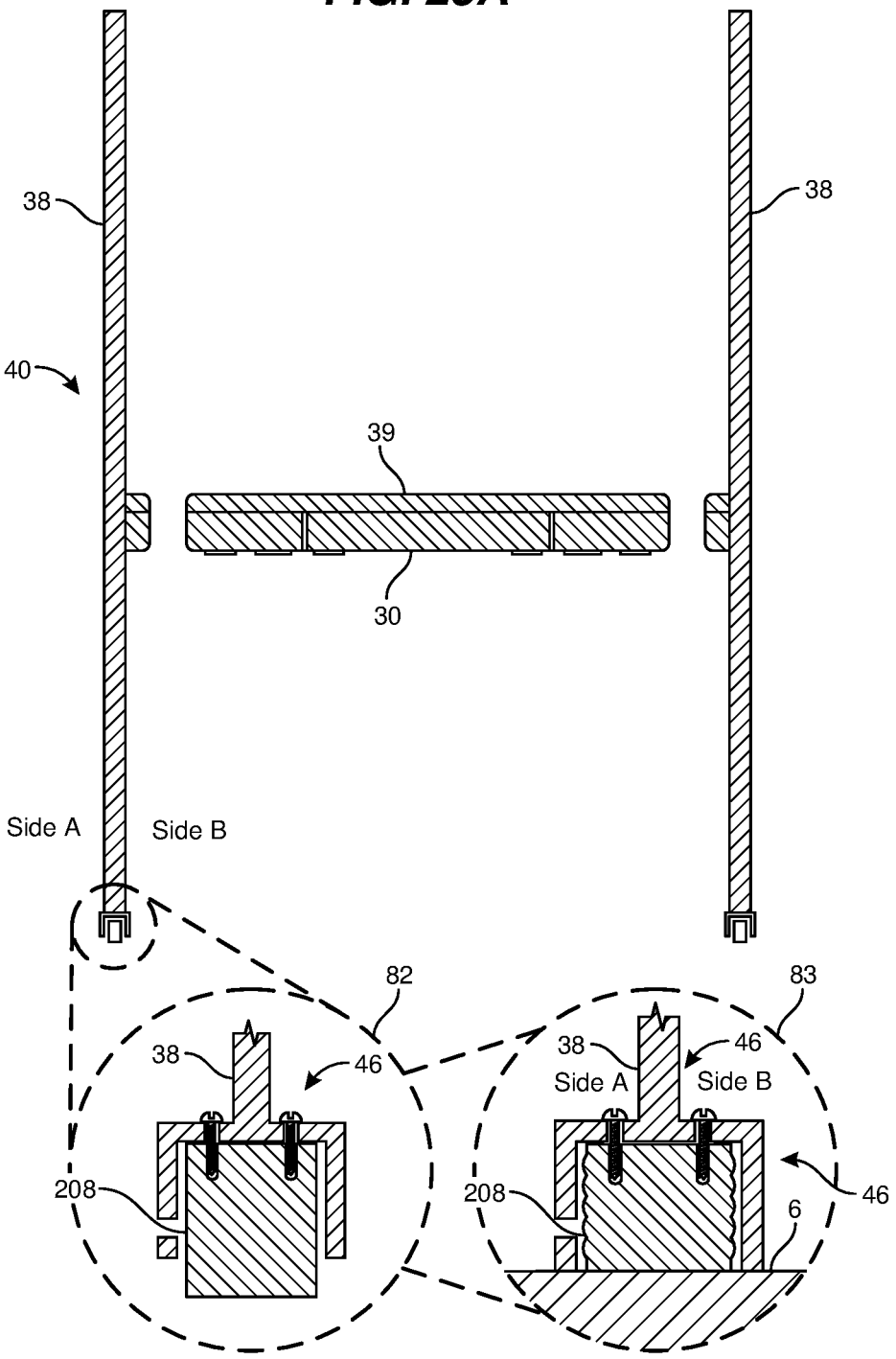
FIG. 25A shows a cross-sectional end view of the WBA with FIGS. 25B and 25C respectively showing detailed views of the gasket/housing assembly in uncompressed and compressed states, according to embodiments of this disclosure.

FIG. 25A shows a cross-sectional end view of the WBA 40 with FIG. 25B showing a detailed view 82 of the bottom GHA 46 prior to the WBA 40 landing on a ground level planar surface and where the bottom gasket 208 is uncompressed by said surface. The detailed view 83 shows the bottom GHA 46 after the WBA 40 has landed on a ground level planar surface 6, where the bottom gasket 208 is compressed by the planar surface 6, causing the gasket to form a horizontal, lower seal to inhibit or stop the flow of water from side A of the bottom gasket 208 to side B of the bottom gasket 208.

Figure 26A:
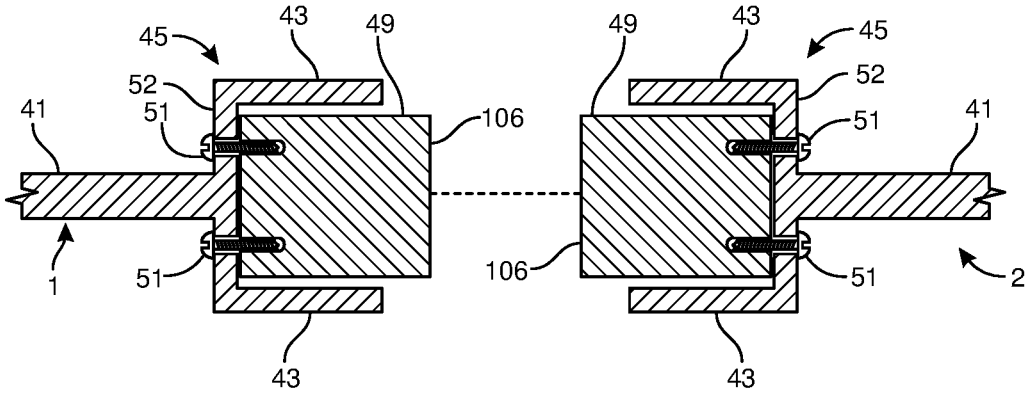
FIG. 26A shows a cross-sectional top view of two opposing side gasket/housing assemblies, according to embodiments of this disclosure.

FIG. 26A shows a cross-sectional top view of two opposing side GHAs 45 respectively of a first railcar 1 and a second, adjacent railcar 2. The side GHAs 45 may be constructed and may operate by the same principles as the bottom GHA 46 as shown in FIGS. 24A-24C, except that the side GHA 45 may attaches to the sidewall 38 with a vertical orientation and the gasket outer contact surface 106 may be designed to contact the gasket outer contact surface 106 of an adjacent connected WBA 40 from an adjacent railcar, or to contact a vertical planar surface (e.g., a wall). Given that the forces exerted on the side gasket 49 may be different than the forces exerted on the bottom gasket 208, the side gasket 49 may be made with a rubber that has different physical properties including, but not limited to; abrasion resistance, compression set, elongation, hardness, resilience, specific gravity, tear resistance, tensile modulus, and tensile strength. In additional embodiments, the side gasket 49 may be made with the same material as the bottom gasket 208. The first railcar 1 may have a side GHA 45 with a rubber side gasket 49 attached with screws 51 to the housing web 52. The housing web 52 may have housing flanges 43 connected to it at right angles. The housing web 52 may be attached to the WBA sidewall extension 41, and the side gasket 49 may have an outer contact surface 106.

Figure 26B:
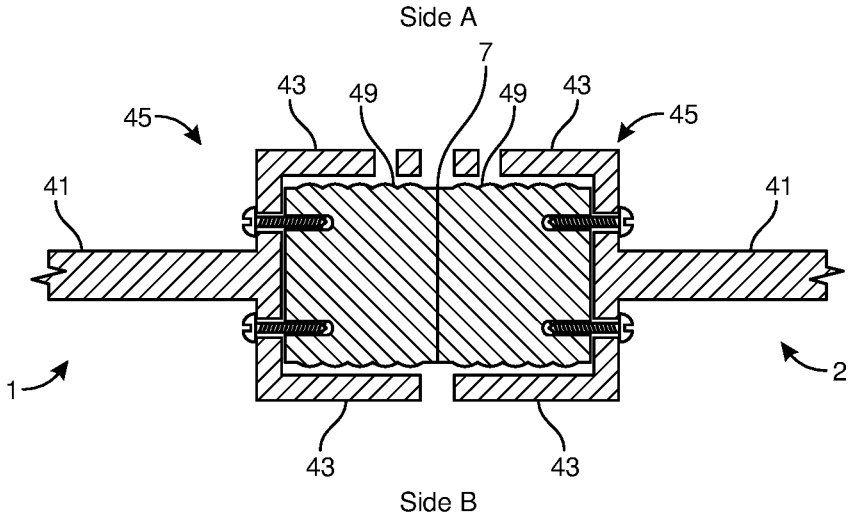
FIG. 26B shows a cross-sectional top view of the two side gasket/housing assemblies of FIG. 26A, where the two side gasket/housing assemblies are positioned such that they are in contact with each other, according to embodiments of this disclosure.

As shown in FIG. 26A, opposing the first railcar's 1 side GHA 45 is a side GHA 45 from a second, adjacent railcar 2. The side GHA 45 may have a rubber side gasket 49 attached with screws 51 (or another suitable fastener) to the housing web 52. The housing web 52 may have housing flanges 43 connected to it at right angles. The housing web 52 may be attached to the WBA sidewall extension 41. The side gasket 49 may have an outer contact surface 106. FIG. 26B shows a cross-sectional top view of the two side GHAs 45 with the opposing gasket outer contact surfaces 106 brought together and subjected to compressive forces. A water seal 7 (e.g., a water-resistant or water-tight mechanical seal) may be created between the gasket outer contact surfaces 106, such that water, or other fluid, may be inhibited or cannot pass from side A of the joined side gaskets 49 to side B of the joined side gaskets 49. The opposing housing flanges 43 may not need to contact each other before the water seal 7 is sufficiently formed. Such flange contact may, in some embodiments and for some applications, be optional. However, FIG. 122 shows an example in which housing flanges 43 may contact each other when the water seal 7 is sufficiently formed. FIG. 122 also illustrates an embodiment in which the housing flanges 43 extending from the sidewall extensions 41 of the respective railcars 1 and 2 may abut against each other when the water barrier is formed. In some examples, configuring the housing flanges 43 to abut against each other in this manner may provide additional mechanical stability to the assembly and/or may provide another seal, in addition to the seal formed between the joined side gaskets 49.

Figure 27:
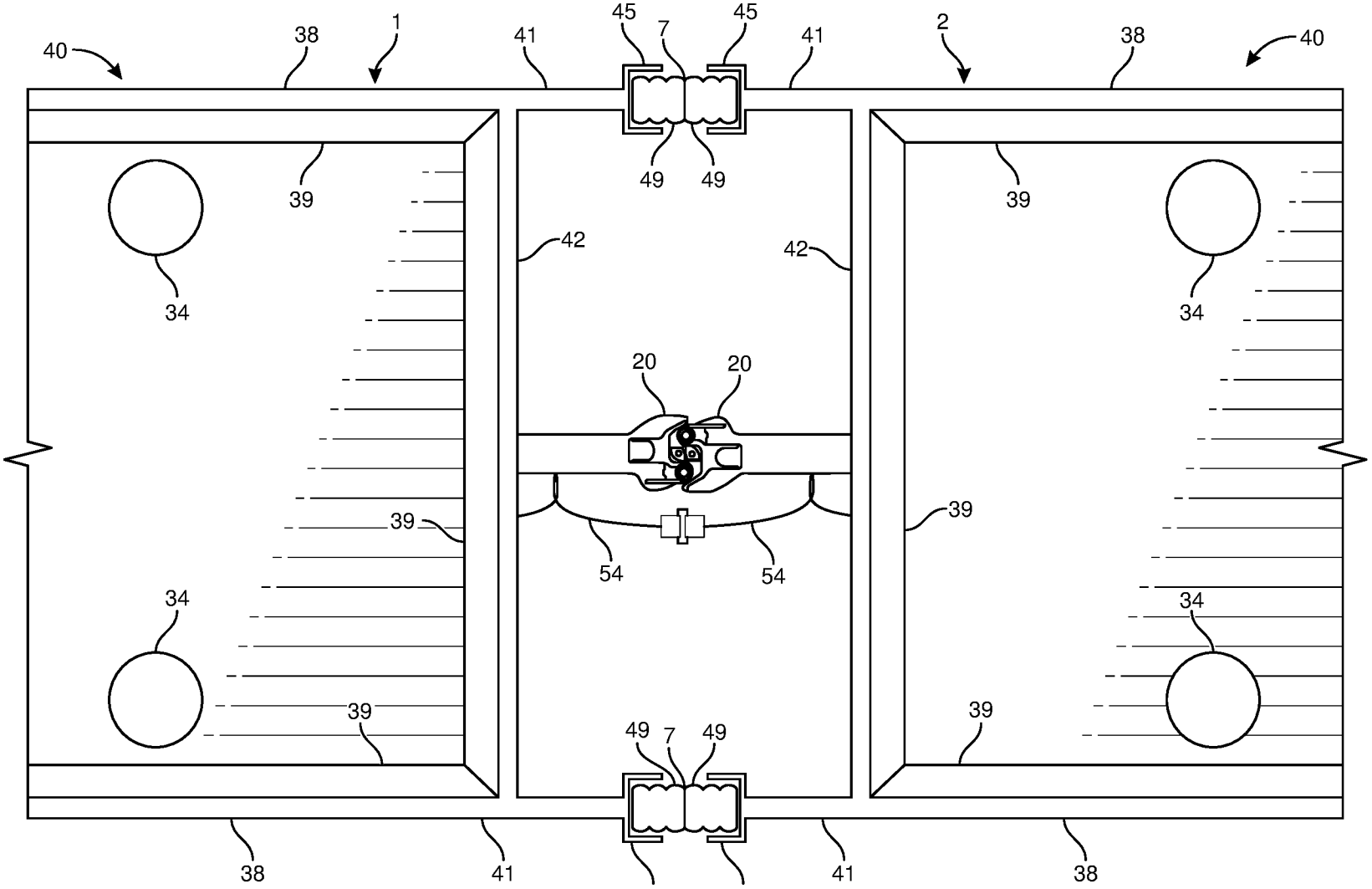
FIG. 27 shows a top view of two railcars, according to embodiments of this disclosure.

FIG. 27 shows a top view of WBAs 40 from a first railcar 1 and a second, adjacent railcar 2 that have been translated toward each other to create compressive forces on the side gaskets 49 by abutting the respective side gaskets 49 against each other. Vertical water seals 7 (e.g., water-resistant or water-tight mechanical seals) may be created between each WBA sidewall 38 of the first railcar 1 and of the second railcar 2. For purposes of illustration, railroad tracks 4 are not shown in FIG. 27.

Each of the railcars 1 and 2 may have two WBA sidewalls 38. Deployment of the water barrier system may provide two separate and distinct barriers (e.g., along the two sidewalls 38 at the top and bottom of FIG. 27) that can inhibit or stop the flow of water from one side of the railcar to the other. This dual water barrier design may improve the system's effectiveness and reliability against the passage of flood water.

Having explained example components, systems, and methods related to the WBA underframe 26, floor 39, endwalls 42, sidewalls 38, bottom GHA 46, side GHA 45, etc., the description has provided details regarding basic concepts relating to the construction and use of the WBA 40. Next, concepts relating to the Barrier Transport and Position System (BTPS), which may be used to move the WBA 40 to a desired location by rail and to deploy the WBA 40 as an effective water barrier, will be described.

Figure 11:
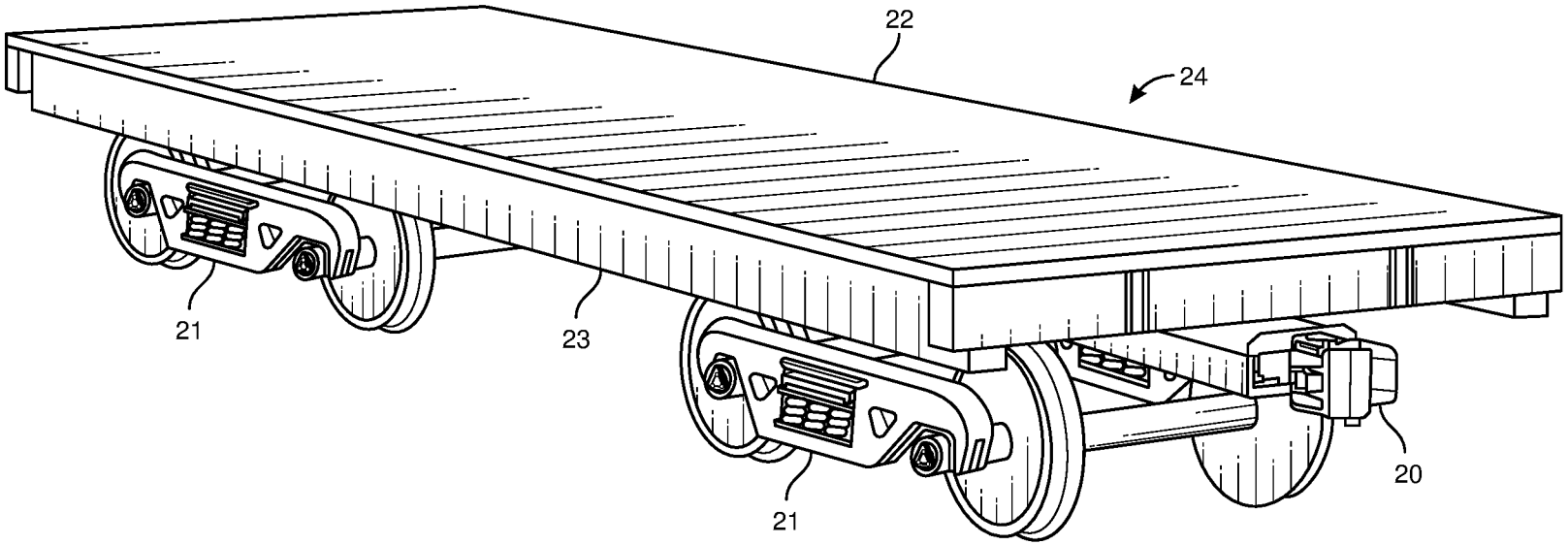
FIG. 11 (Prior Art)
FIG. 11 shows a top perspective view of the prior art flatcar railcar of FIG. 8.
Figure 28:
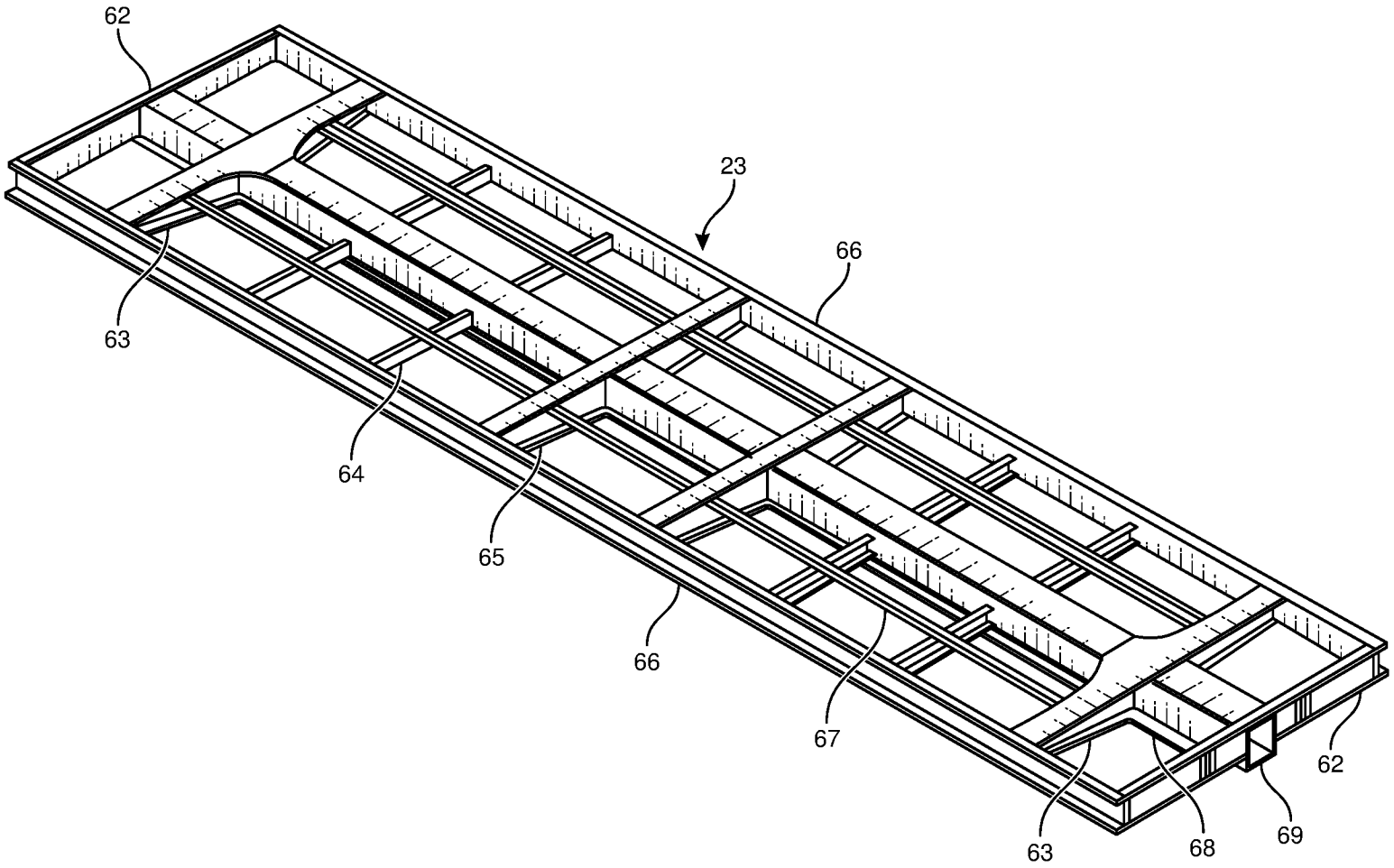
FIG. 28 shows a top perspective view of a Barrier Transport and Positioning System's (BTPS) underframe, according to embodiments of this disclosure.

FIG. 28 shows a top side view of a BTPS underframe 23 including BTPS end sills 62 at both ends of the BTPS underframe 23, which may be attached at right angles to the BTPS side sills 66. BTPS side sills 66 may be longer than the BTPS end sills 62, which may result in a rectangular outer frame of the BTPS underframe 23. The BTPS center sill 68 may be centered between and parallel to the BTPS side sills 66 and may terminate with connections to the BTPS end sills 62. BTPS body bolsters 63 may be attached at a relatively short distance from, and may run parallel to, the BTPS end sills 62 and may terminate with connections to the BTPS side sills 66. BTPS cross bearers 65 may be connected from BTPS side sill 66 to opposing BTPS side sill 66 by connecting through the BTPS center sill 68 at right angles. A BTPS floor 22 (not shown here, but may be similar to the floor 22 shown in FIG. 11) may be supported by BTPS floor stringers 67, which may be supported by stringer supports 64. The BTPS center sill 68 may extend through the BTPS end sills 62, where BTPS draft gear pockets 69 may be positioned. The BTPS draft gear pockets 69 may be sized and shaped to receive and/or support a draft gear, cushioning units, yoke, and railcar coupler assemblies.

Figure 29:
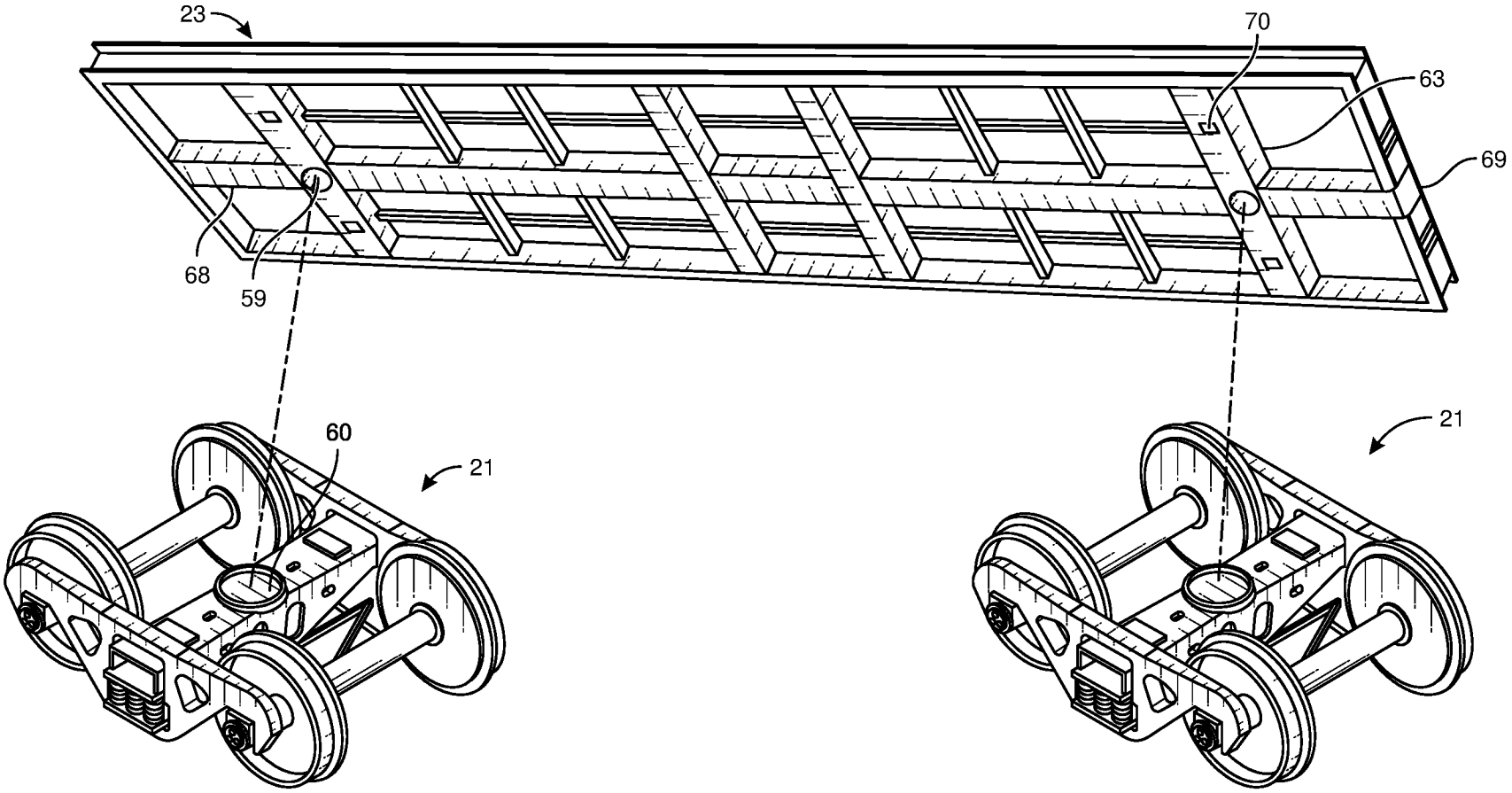
FIG. 29 shows a bottom perspective view of the BTPS underframe, according to embodiments of this disclosure.

FIG. 29 shows a bottom perspective view of the BTPS underframe 23 with the BTPS center sill 68 connected to the BTPS body bolsters 63 (e.g., at right angles). Each BTPS body bolster 63 may include a BTPS center plate 59 attached under an intersection of the BTPS body bolster 63 and the BTPS center sill 68. Two side bearings 70 may be attached to each BTPS body bolster 63, one on each side of the BTPS center plate 59. Two trucks 21 (sometimes called "bogies") may be positioned below the BTPS underframe 23 with BTPS truck bolster bowls 60. When assembled, the BTPS center plates 59 may be fitted into the respective BTPS truck bolster bowls 60 of the trucks 21.

Figure 30:
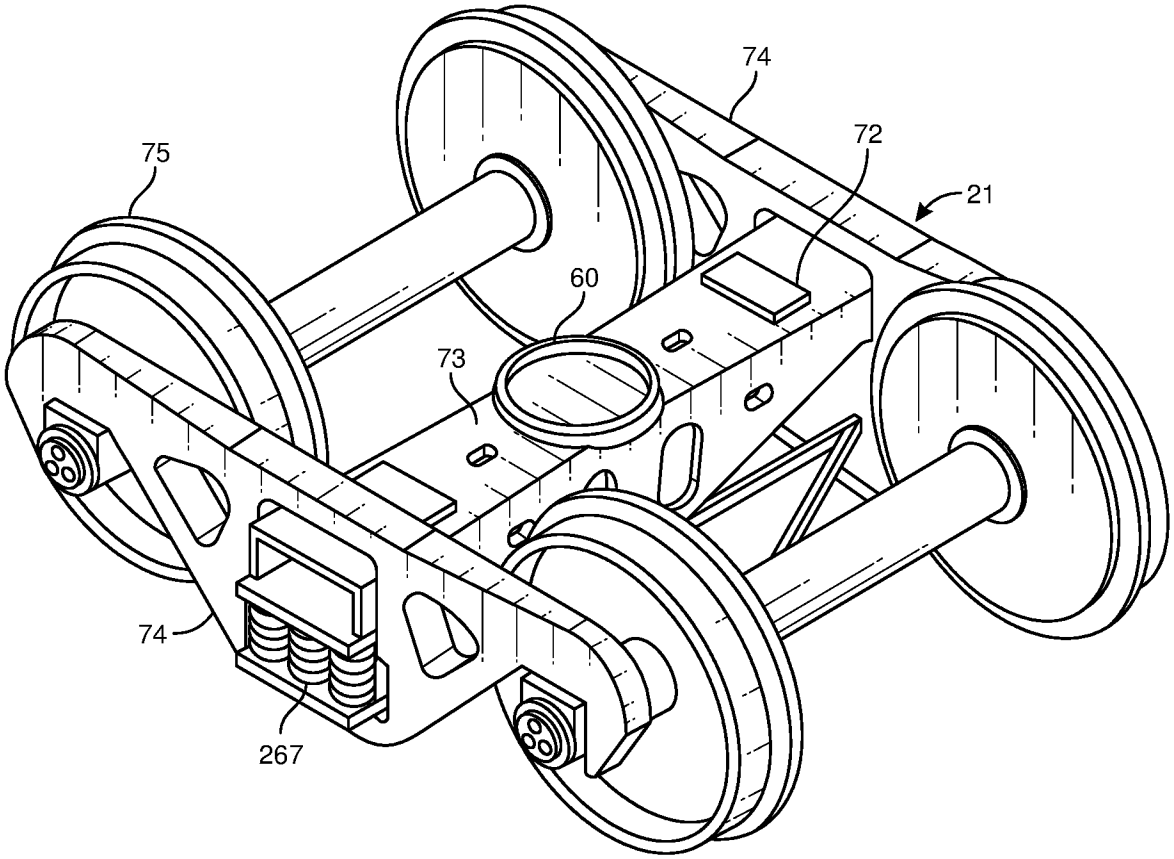
FIG. 30 shows a top perspective view of a BTPS truck, according to embodiments of this disclosure.

FIG. 30 shows a top perspective view of the BTPS truck 21 with wheels 75 attached and held in position by the truck side frame assemblies 74. The truck side frame assemblies 74 may be attached to the truck bolster 73 at right angles via a spring assembly 267. The truck side frame assemblies 74, truck bolster 73, and spring assembly 267 may be parts of a suspension system of the truck 21. When assembled, the truck bolster 73 may be fitted with two truck side bearings 72 that interact with BTPS underframe side bearings 70 to provide longitudinal roll stability to the BTPS underframe 23 when the BTPS is in motion on the railroad tracks 4 (see, e.g., FIGS. 12-14). The truck bolster 73 may be fitted with the BTPS truck bolster bowl 60 that may accept the BTPS center plate 59 (FIG. 29) when the BTPS underframe 23 is assembled onto the BTPS truck 21. When the assembled BTPS underframe 23 and BTPS trucks 21 are operated on railroad tracks, the mechanical interaction between the railroad track and trucks may provide a "gross" horizontal alignment between this and adjacent railcar assemblies. The automatic mechanical alignment of railcars into water barriers is a highly efficient aspect of this rail-based water barrier design. Methods for further improving the horizontal alignment between railcars (e.g., providing a "fine" alignment) will be discussed later in this document.

Figure 49:
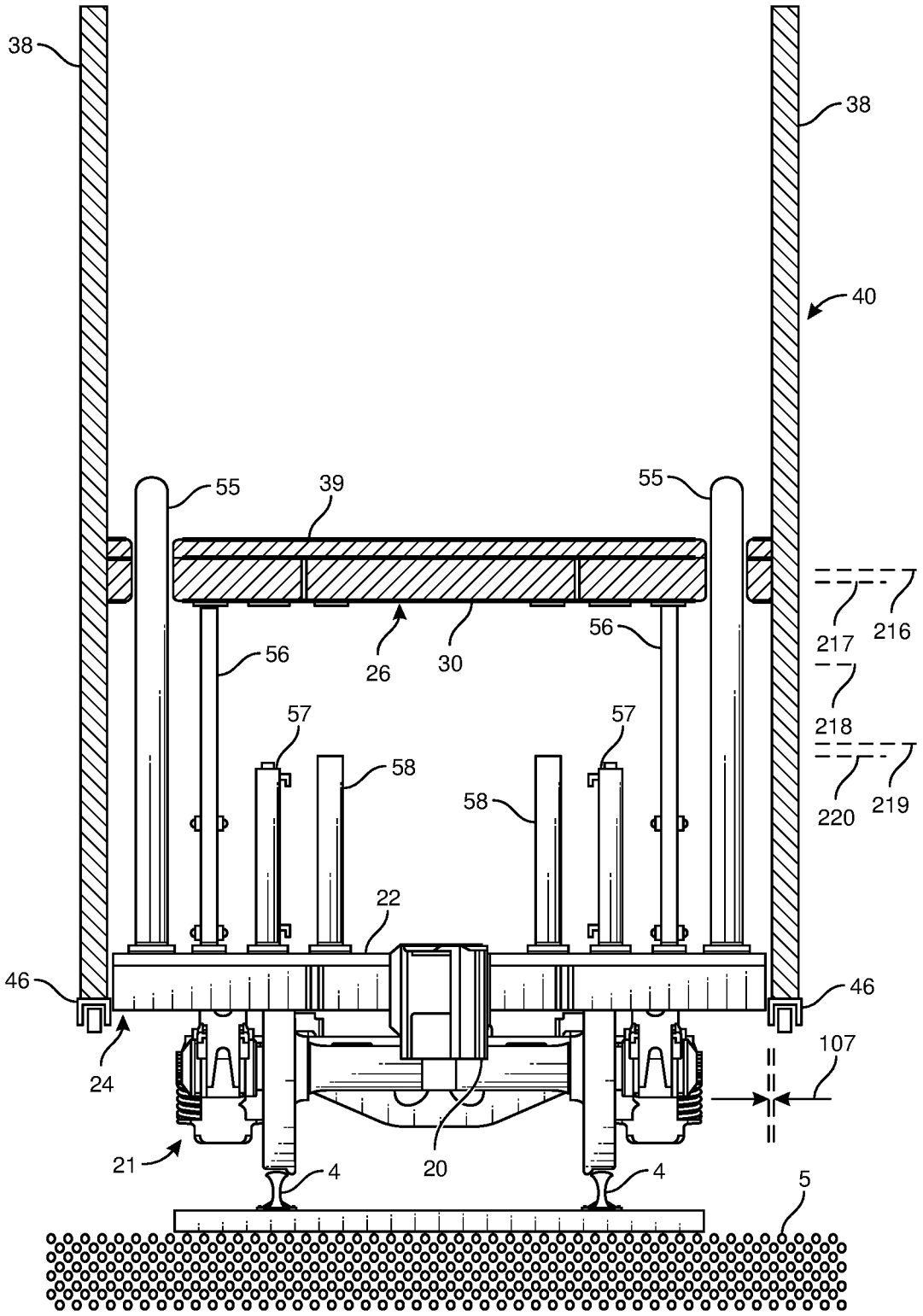
FIG. 49 shows a cross-sectional end view, taken at line 49-49 of FIG. 50, of a railcar in a transport mode, according to embodiments of this disclosure.

Starting at FIG. 49, some of the drawings will show different views of the BTPS operating on different railroad track beds. So that these drawings can be better understood, some different views and kinds of railroad beds they represent will be described with reference to FIGS. 31A-32C.

Figure 31A:
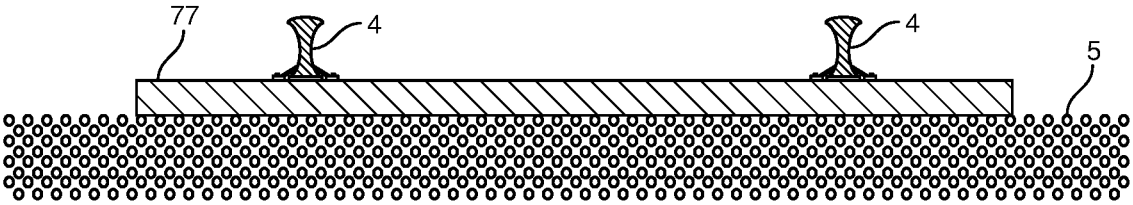
FIG. 31A shows a cross-sectional view of a railroad track on a gravel surface, according to embodiments of this disclosure.
Figure 31B:
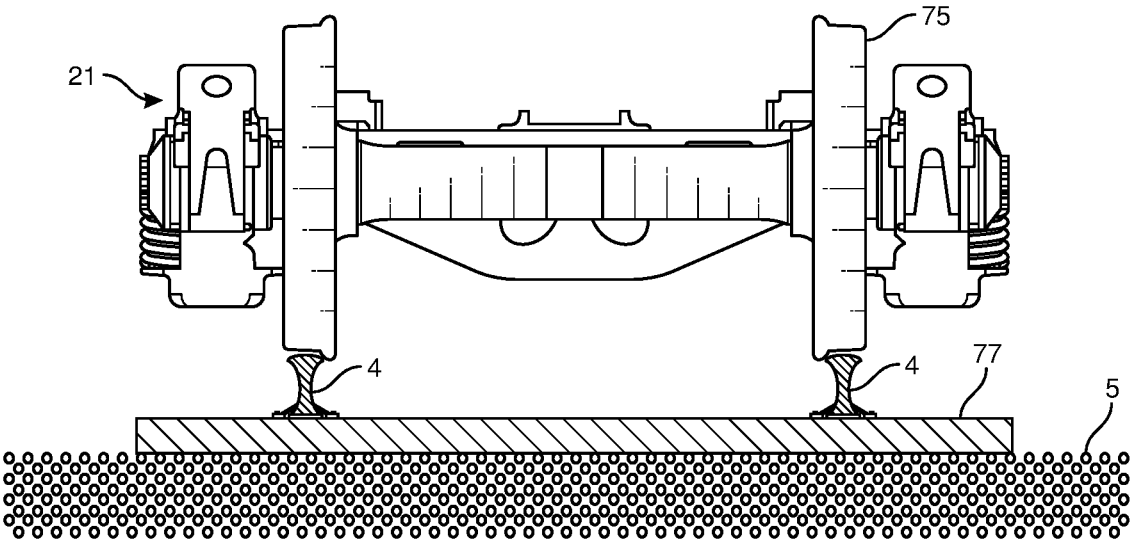
FIG. 31B shows a cross-sectional view of the railroad track of FIG. 31A with a truck positioned on the railroad track, according to embodiments of this disclosure.
Figure 31C:
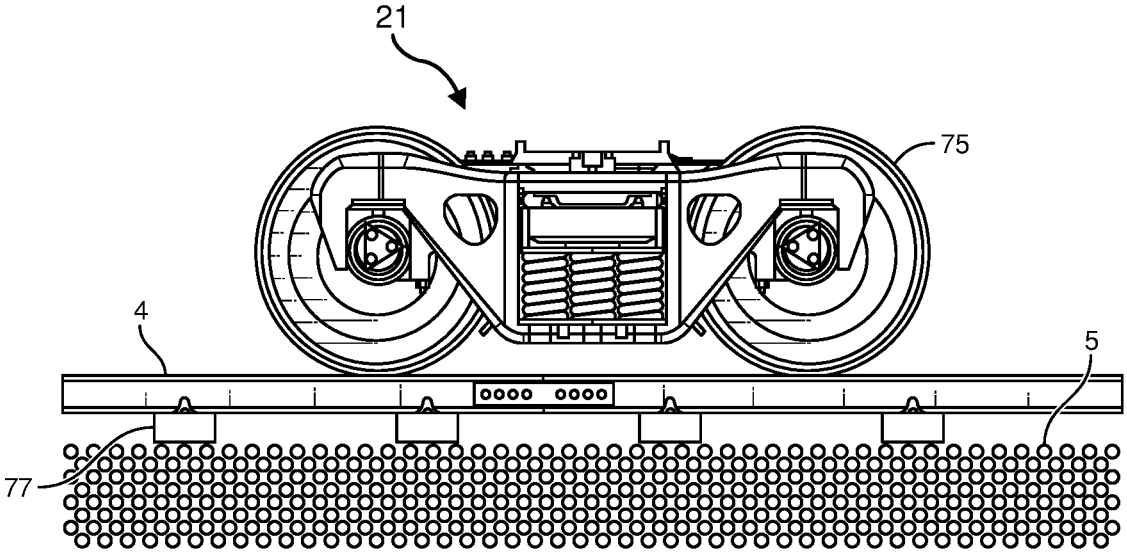
FIG. 31C shows a side view of the railroad track of FIGS. 31A and 31B on the gravel surface with the truck positioned on the railroad track, according to embodiments of this disclosure.

FIG. 31A shows a cross-sectional end view of a railroad track 4 with rails and crossties 77. The crossties 77 may connect and hold the rails into a fixed position relative to each other and to a surrounding ground. The trails 4 and crosstie 77 assembly is shown in FIGS. 31A-31C sitting on a gravel railroad track bed 5. FIG. 31B shows a cross-sectional end view of the railroad track with a BTPS truck 21 and its wheels 75 operating on top of the rails. The rails 4 and crosstie 77 assembly is shown as sitting on the gravel railroad track bed 5. FIG. 31C shows a side view of the railroad track with the BTPS truck 21 and its wheels 75 placed on top of the rails. The rails and crosstie 77 assembly is shown as sitting on the gravel railroad track bed 5. Hereafter, the rails trails and crosstie 77 assembly (or another similar assembly) may also be referred to as railroad track(s) 4.

Figure 32A:
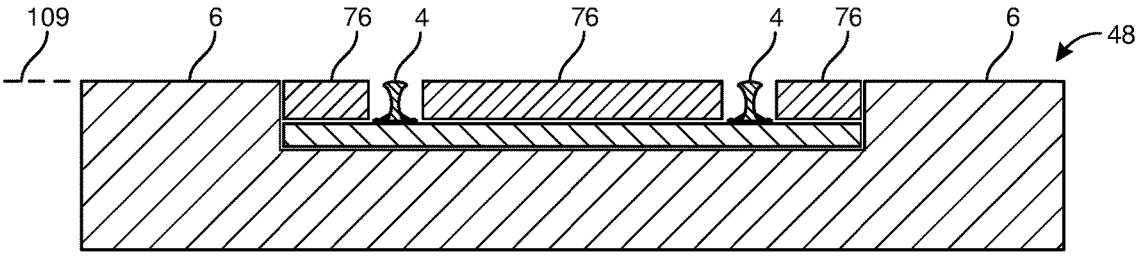
FIG. 32A shows a cross-sectional view of a railroad track embedded in a concrete structure with grade crossing panels, according to embodiments of this disclosure.
Figure 32B:
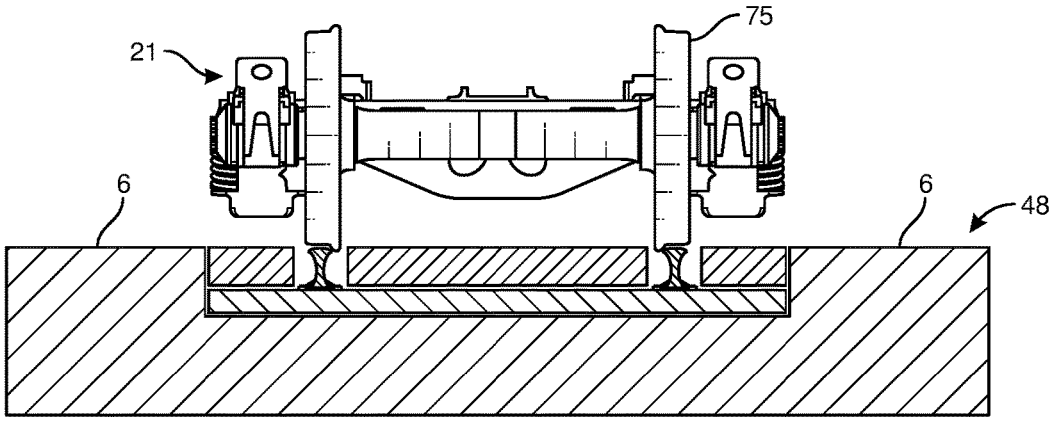
FIG. 32B shows a cross-sectional view of the railroad track of FIG. 32A embedded in a concrete structure with grade crossing panels, where a truck is positioned on the railroad track, according to embodiments of this disclosure.
Figure 32C:
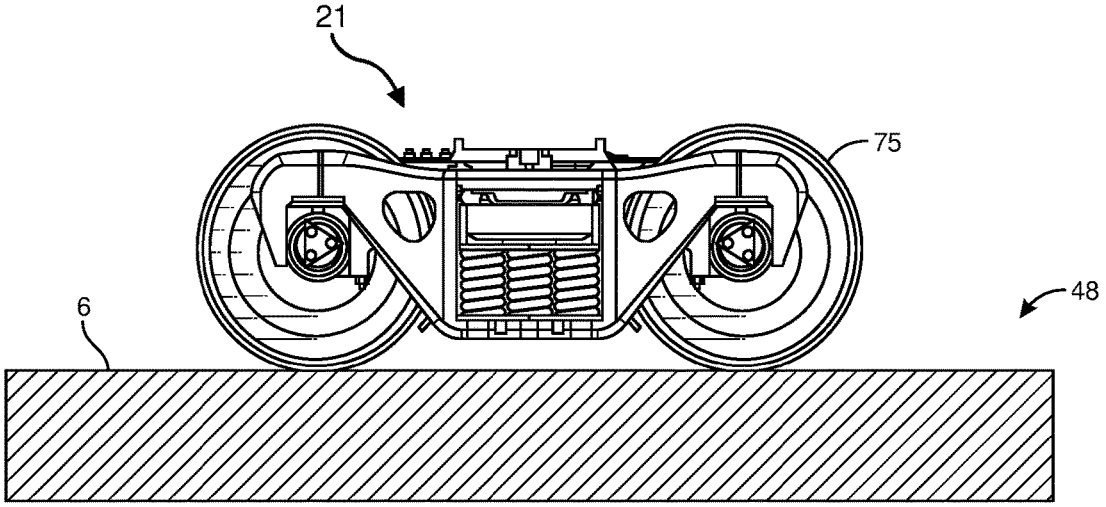
FIG. 32C shows a side view of the railroad track of FIGS. 32A and 32B embedded in a grade crossing assembly with a truck positioned on the railroad track, according to embodiments of this disclosure.

FIG. 32A shows a cross-sectional end view of a railroad track 4 with an adjacent concrete structure 48, which may partially enclose the railroad track 4. The concrete structure 48 can be a concrete casting, for example. The concrete structure 48 may provide a railroad bed underneath the railroad track 4 and substantially planar surfaces 6 located on one or both sides of the railroad track 4. In this case, the substantially planar surfaces 6 of the concrete structure 48 are illustrated at the same height, or horizontal plane 109, as a top of the railroad track 4. Because people may have access and need to walk or drive over the railroad track 4, grade crossing panels 76 (a/k/a level crossing panels) may optionally be added to improve transit across the railroad track 4. The concrete structure 48 is shown as a single unit. However, alternatively, two or more separate concrete structures with substantially planar surfaces 6 can be used and positioned along the sides of the railroad track 4, and the railroad track bed can be made separately of concrete, gravel, or some other appropriate aggregate. FIG. 32B shows a cross-sectional end view of the railroad track 4 and concrete structure 48 with a BTPS truck 21 and its wheels 75 operating on top of the railroad track 4. FIG. 32C shows a side view of the railroad track 4 and concrete structure 48 with the BTPS truck 21 and its wheels 75 operating on top of the railroad track 4. In the side view of FIG. 32C, the view of the railroad track 4 is obscured by the concrete structure 48. Therefore, in some of the following drawings having similar views, it should be understood that the BTPS truck 21 may actually be operating on railroad tracks 4 that are positioned inside or otherwise below a level of the concrete structure 48.

Figure 33:
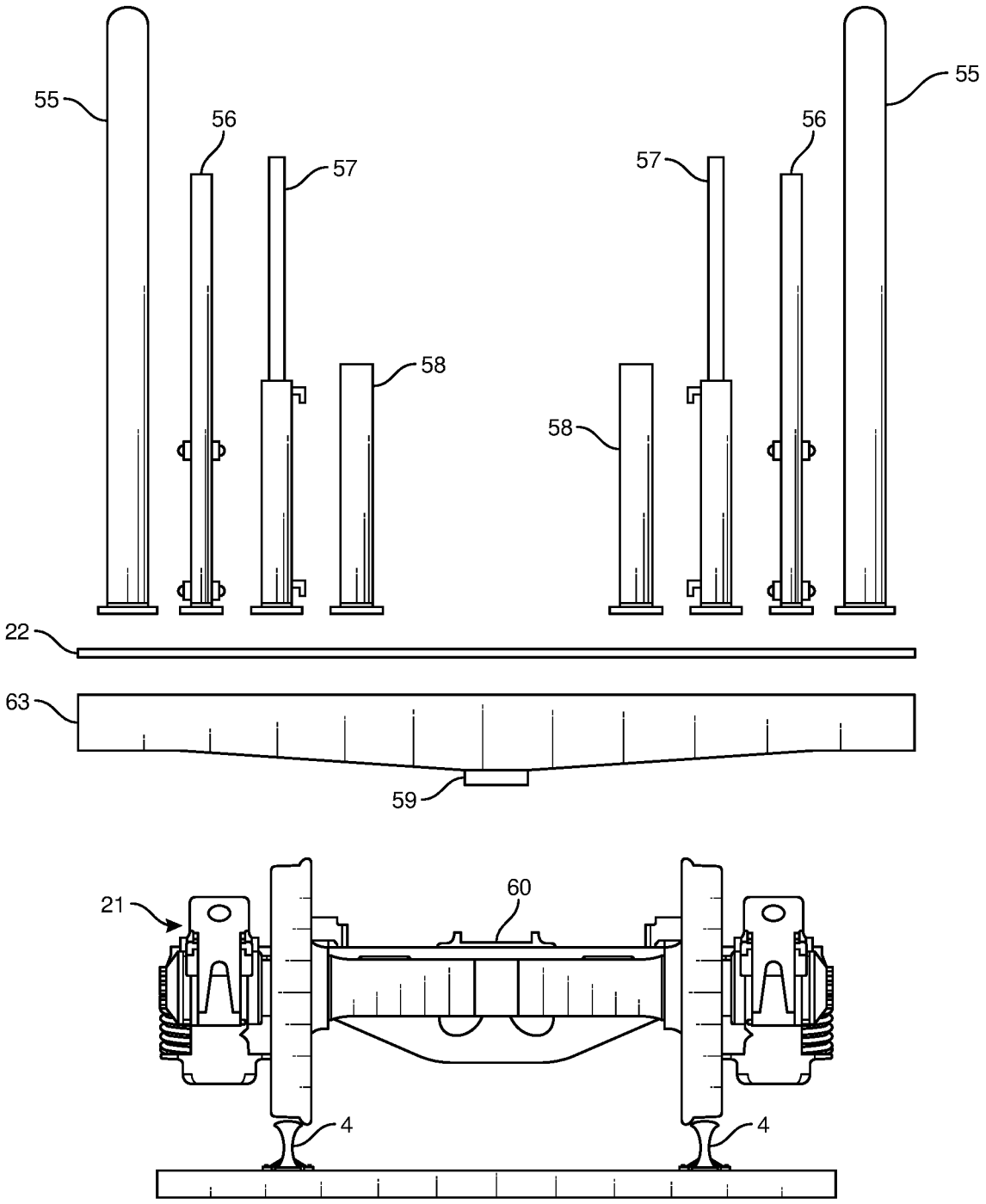
FIG. 33 shows an exploded end view of the BTPS, where the positions of vertical control systems that operate on the WBA are shown, according to embodiments of this disclosure.

FIG. 33 shows an exploded end view of a BTPS. The BTPS body bolster 63 is illustrated in a position over a BTPS truck 21. The BTPS body bolster 63 may have a BTPS center plate 59 that connects to the bolster bowl 60 of the BTPS truck 21. The BTPS truck 21 is shown in a position on the railroad track 4. The BTPS floor 22 may be positioned above the BTPS body bolster 63. Vertical control components 55, 56, 57, and 58 for securing, lowering, and/or raising the WBA 40 relative to the railroad track 4 may be positioned above the BTPS floor 22. Further descriptions relating to the vertical control components 55, 56, 57, and 58 are provided below.

Figures 34A, 34B:
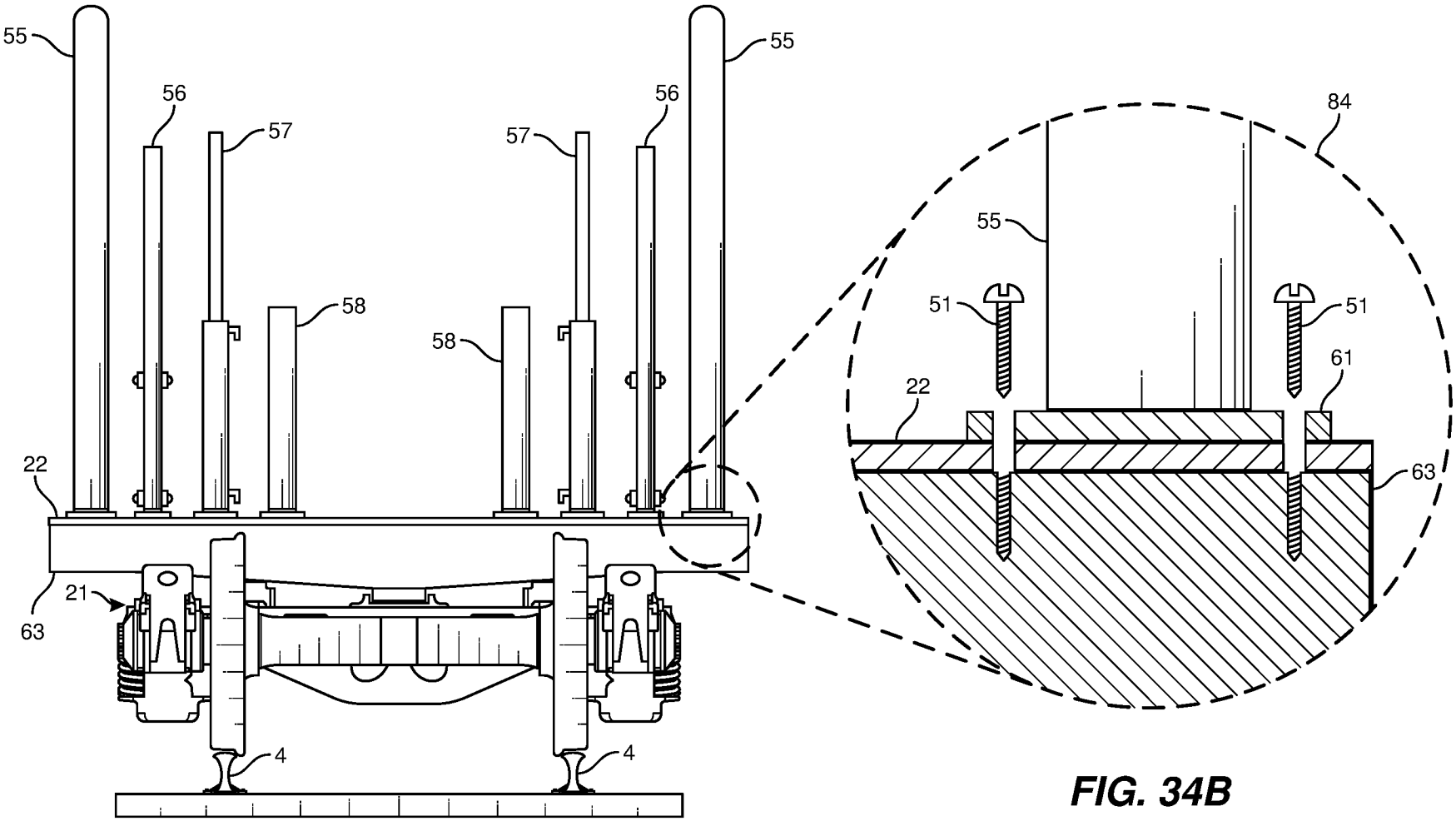
FIG. 34A shows an end view of an assembled BTPS, with FIG. 34B showing a detailed view of the attachment of certain control components, according to embodiments of this disclosure.

FIG. 34A shows an assembled BTPS, where the BTPS center plate 59 is fitted into and onto the bolster bowl 60 of the BTPS truck 21. The BTPS floor 22 may be attached to the top of the BTPS body bolster 63 and the remainder of the BTPS underframe 23. The vertical control components 55, 56, 57, and 58 may be attached to the BTPS floor 22 and/or through the BTPS floor 22 and onto the BTPS body bolster 63. The detailed view 84 of FIG. 34B shows that the attachment of the vertical control components 55, 56, 57, and 58 can be accomplished with screws 51 through the mounting flange 61. However, other methods of attachment may be used, such as welding. Alternatively, the bottoms of the vertical control components 55, 56, 57, and 58 can be made with tenons such that the vertical control components 55, 56, 57, and 58 can be fitted into mortises provided in the BTPS floor 22 and BTPS body bolster 63. The vertical control components 55, 56, 57, and 58 secured by mortise and tenon can be further secured by screws, welds, or other fasteners.

Figure 35:
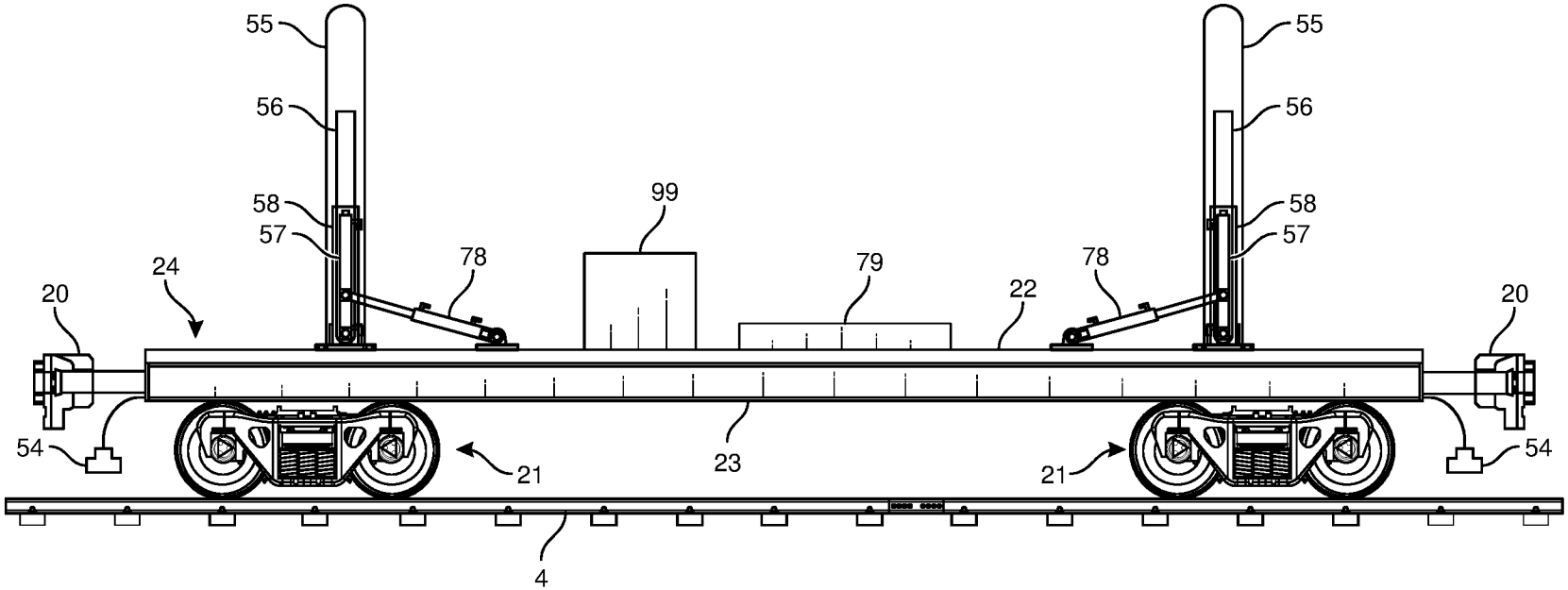
FIG. 35 shows a side view of the BTPS of FIG. 34A.

FIG. 35 shows a side view of an assembled BTPS 24. The BTPS underframe 23 may be supported by the BTPS trucks 21 that are attached near each end of the BTPS underframe 23. The BTPS trucks 21 are illustrated as positioned and operating on the railroad track 4. The BTPS floor 22 may be attached on top of the BTPS underframe 23. Railcar couplers 20 and their associated assemblies may be attached to the BTPS underframe 23 via the BTPS draft gear pockets 69 (FIG. 28) at each end of the BTPS 24. The vertical control components 55, 56, 57, and 58 may be attached on top of the BTPS floor 22, as discussed above. A control systems housing 79, which may contain a computer, electronics, a valve system, and other control components for operating the vertical control components 55, 56, 57, and 58, may be attached on top of the BTPS floor 22. A pump and power housing 99 may also be positioned on and supported by the BTPS floor 22. The pump and power housing 99 may contain a hydraulic fluid pump and an electric generator system. Alternatively, a single control systems housing 79 and its components may be configured to control the vertical control components 55, 56, 57, and 58 of multiple railcars. In such embodiments, the single control systems housing 79 may be in information communication (e.g., via a wired or wireless connection) with the contents of several pump and power housings 99 of different respective railcars. Resource couplers 54 may be attached at each end of the BTPS 24. In order to simplify the drawings, the resource couplers 54 are not shown in all of the potentially relevant drawings. However, the resource couplers 54 may be present in additional embodiments. Details regarding the function of the resource couplers will be discussed later in this disclosure.

The BTPS 24 may have four types of vertical control components 55, 56, 57, and 58, which may be referred to individually as the vertical guide rails 55, the interlocking beams 56, the WBA vertical position controlling cylinders 57 and the service/safety blocks 58. These four vertical control components 55, 56, 57, and 58 will be described individually and illustrated in FIGS. 36-47. The WBA sidewalls 38 and endwalls 42 described above are removed in FIGS. 36-47 for purposes of illustration, so that the mechanical interactions between the vertical control components 55, 56, 57, and 58 relative to the BTPS 24 and the WBA underframe 26 can more easily be seen. Since the WBA sidewalls 38 and endwalls 42 are normally firmly attached to the WBA underframe 26, any movement of the WBA underframe 26 may cause a corresponding movement of the WBA sidewalls 38 and endwalls 42.

Figure 36:
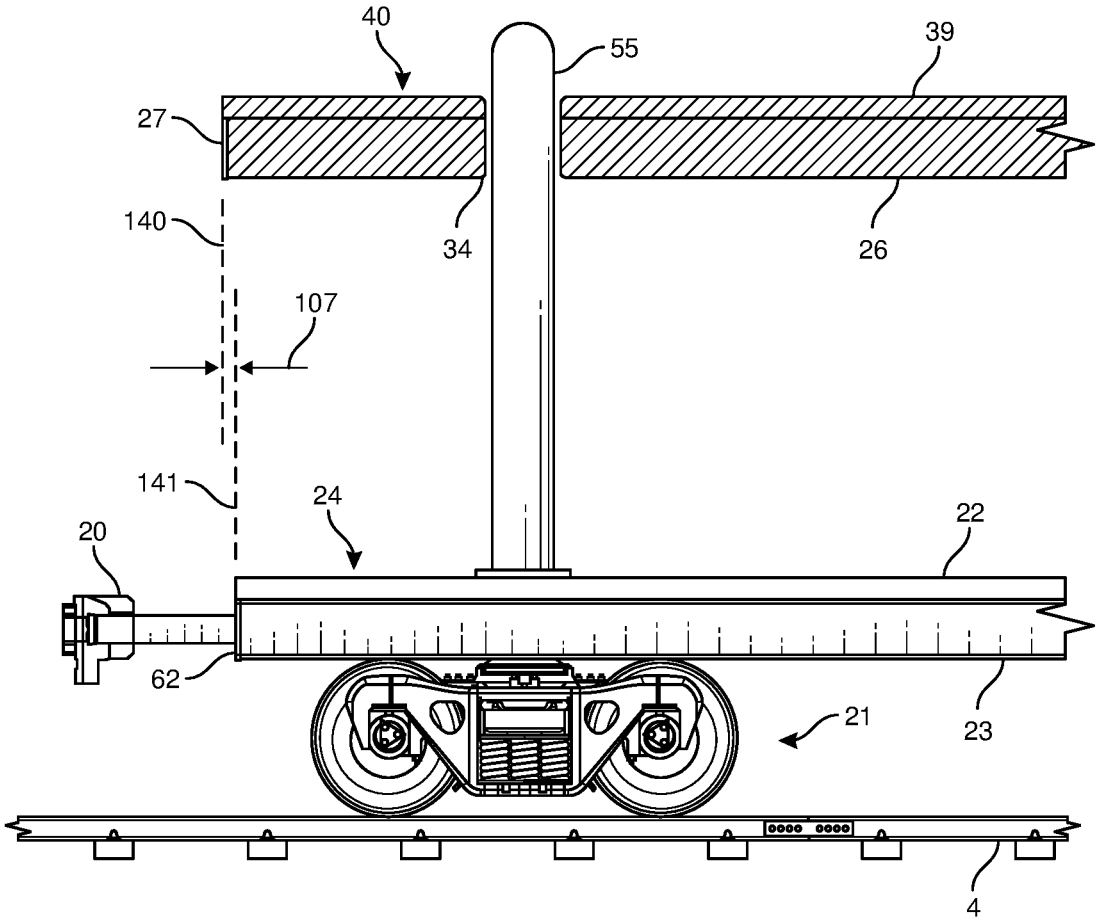
FIG. 36 shows a partial cross-sectional side view of a WBA assembled with a BTPS, with the WBA in an upper position, according to embodiments of this disclosure.

FIG. 36 shows a partial cross-sectional side view of the BTPS 24 and WBA underframe 26 when assembled together. The vertical guide rail 55 may be attached to the BTPS floor 22. The WBA underframe 26 is illustrated in FIG. 36 in an upper position above the BTPS floor 22. The vertical guide rail 55 may be a vertically oriented cylinder made of, for example, rigid, hardened steel with a size (e.g., outer radius) sufficient to present resistance to lateral movement when subjected to expected lateral forces. In order to maintain control of the position of the WBA underframe 26 at all operational heights, the length of the vertical guide rail 55 may exceed a maximum operational height of the WBA underframe 26. A smooth, rounded cap may be provided on top of the vertical guide rail 55 to aid in the proper alignment and lowering of the WBA 40 over the BTPS 24 during assembly. To assemble the WBA 40 to the BTPS 24, the vertical guide rail 55 may be passed partially through and into the WBA's linear-motion bearing 34. In embodiments that include four vertical guide rails 55 on each BTPS 24, one located near each corner of the BTPS 24, the four vertical guide rails 55 may be passed partially through and into four respective linear-motion bearings 34 on the WBA underframe 26. The linear-motion bearings 34 may be sized and shaped to allow the vertical guide rails 55 to pass or slide through them vertically with low friction and lateral motion. In some embodiments, a lubricant (e.g., grease or oil) may be introduced between the vertical guide rails 55 and the linear-motion bearings 34. The linear-motion bearings 34 can include one or more of various types of bearings including, but not limited to: ball bearings, roller bearings, or plain bearings (bushings). The vertical guide rails 55 and linear-motion bearings 34 may provide a mechanism to keep the WBA underframe 26, and therefore the entire WBA 40, horizontally aligned over the BTPS 24 as the WBA 40 is vertically lifted and/or lowered by another mechanism.

Figure 37:
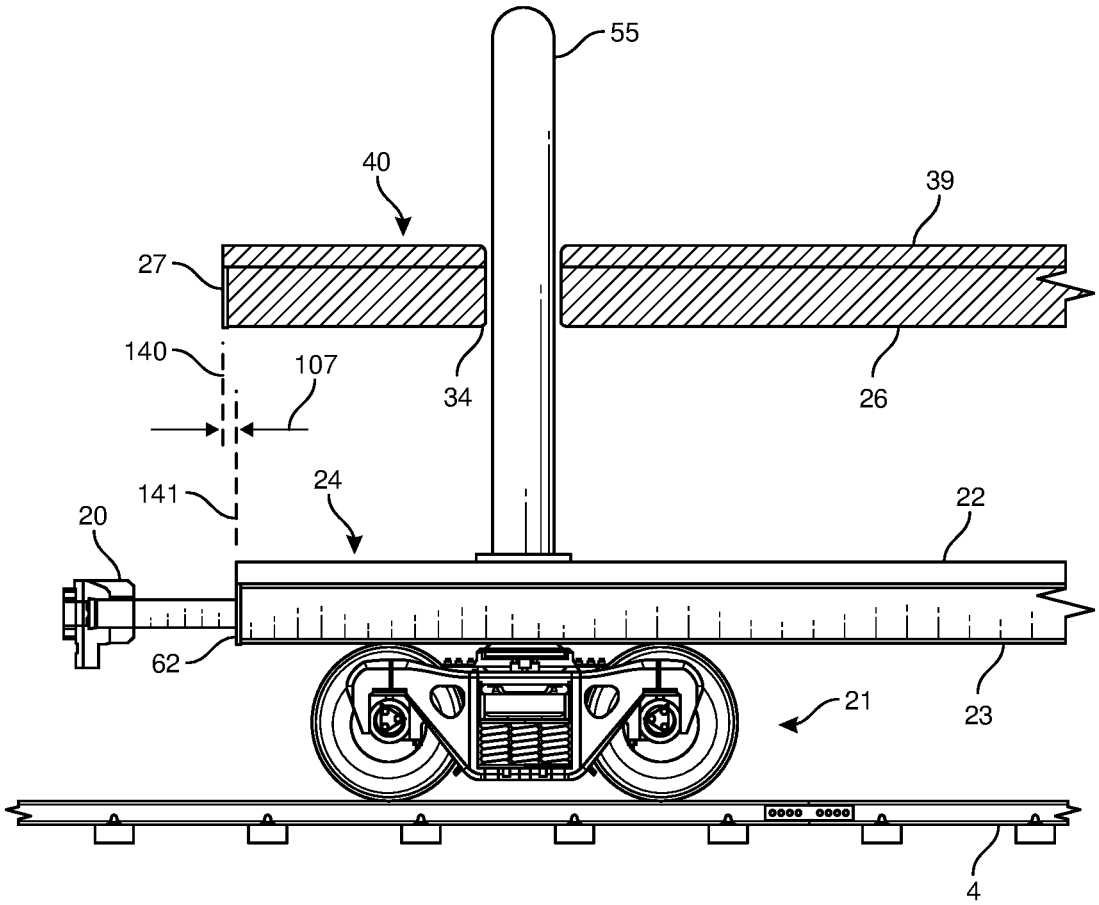
FIG. 37 shows a partial cross-sectional side view of the WBA assembled with the BTPS similar to FIG. 36, but with the WBA in a lower position, according to embodiments of this disclosure.
Figure 38:
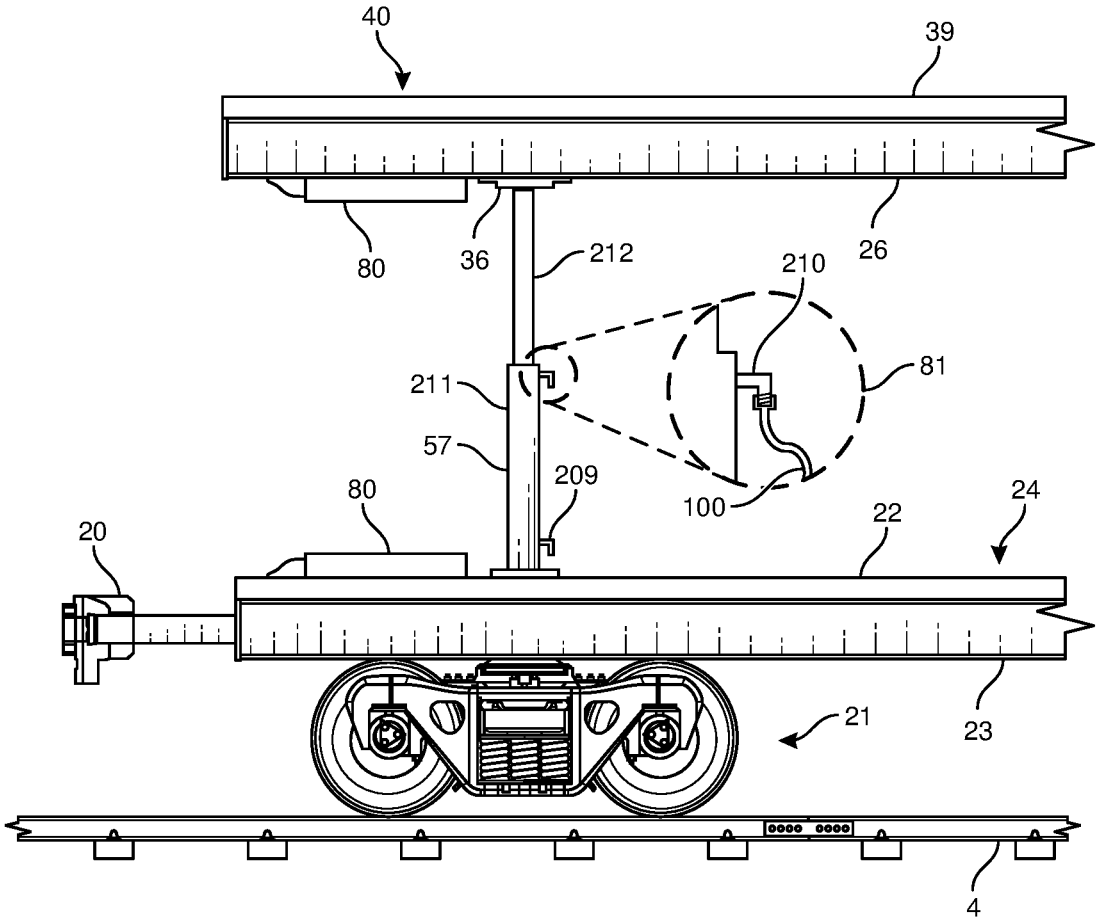
FIG. 38A shows another partial cross-sectional side view of the WBA assembled with the BTPS, with the WBA in an upper position, with FIG. 38B showing a detailed view of a connection of a port and a hose, according to embodiments of this disclosure.

FIG. 37 shows a partial cross-sectional side view of the BTPS 24 assembled with the WBA 40, with the WBA 40 located in a lower position above the BTPS floor 22. In the view of FIG. 37, the WBA underframe 26 has been vertically lowered (relative to the upper position shown in FIG. 36) and the mechanical interaction between the vertical guide rail 55 and linear-motion bearing 34 has restricted the WBA underframe 26 to a substantially vertical (e.g., substantially not horizontal) motion relative to the BTPS 24. Thus, the WBA underframe 26 may be kept in continuous substantial horizontal alignment over the BTPS 24 as the WBA underframe 26 is lowered from the upper position (FIG. 36) to the lower position (FIG. 37).

Maintaining the substantial horizontal alignment of the WBA 40 over the BTPS 24 may ensure the proper operation of the entire WBA 40 as it moves vertically over the BTPS 24. FIG. 36 and FIG. 37 show that the WBA end sill vertical plane 140 may be located outside the BTPS end sill vertical plane 141. Therefore, a gap 107 may exist between the two vertical planes 140 and 141. This gap is referred to herein as the WBA-to-BTPS gap 107. The WBA-to-BTPS gap 107 may allow inner surfaces of the WBA end walls 42 (not shown in FIGS. 36 and 37), which are attached to the WBA end sill's 27 outer surfaces, to slide past the BTPS 24 without striking and binding against the BTPS 24 as the WBA 40 is vertically lowered or lifted. The WBA-to-BTPS gap 107 is also identified in FIG. 110, which also illustrates the WBA endwall 42.

In addition, FIG. 49 shows that the WBA-to-BTPS gap 107 may exist between inner surfaces of the WBA sidewall 38 and outer surfaces of the BTPS 24, such as for the same reasons as discussed above. The vertical guide rails 55 and linear-motion bearings 34 may facilitate the maintenance of the WBA-to-BTPS gap 107 between all four WBA walls 38, 42 and the BTPS 24, which may allow the WBA 40 to move up or down without striking and/or binding against the outer surfaces of the BTPS 24. Thus, the WBA-to-BTPS gap 107 may help avoid the WBA 40 becoming stuck, immovable, and inoperable. Of course, due to mechanical constraints, the WBA sidewalls 38 or WBA endwalls 42 may occasionally bump into or strike against some part of the BTPS 24 during normal operation. However, the vertical guide rails 55 and WBA-to-BTPS gap 107 may inhibit (e.g., reduce or eliminate) binding of the WBA 40 against the BTPS 24.

FIG. 38A shows another partial cross-sectional side view of the BTPS 24 fitted with a WBA vertical position controlling cylinder 57. The term "vertical position controlling cylinder" will hereafter be referred to as "VPCC." The WBA VPCC 57 may be attached to the BTPS floor 22 and may operate on a WBA VPCC strike plate 36. The WBA VPCC 57 may be operated by pressurized hydraulic fluid (hydraulic oil). Basic hydraulic cylinder technology is well known to one of ordinary skill in the art. However, since hydraulic cylinders are employed by several embodiments of this disclosure, basic construction and operation will be discussed. The hydraulic cylinder of the WBA VPCC 57 may include a cylinder barrel 211, in which a piston may be disposed. The piston may be connected to a piston rod 212 that may move back and forth relative to the cylinder barrel 211. The cylinder barrel 211 may be welded closed on one end by a cylinder cap and flange assembly and the other end by the cylinder head through which the piston rod 212 may extend. The piston may include sliding rings and seals that prevent the hydraulic fluid from passing between the piston and cylinder barrel's 211 inner surfaces. The movement of the piston, and thus the movement of the piston rod 212 outward or inward (e.g., upward or downward), may be caused by hydraulic fluid pressure applied to either the cylinder's base port 209 or rod port 210, and/or may be caused by the release of hydraulic fluid pressure from either the cylinder's base port 209 or rod port 210. It should be noted that the larger diameter portion of the WBA VPCC 57 shown in FIG. 38A represents the cylinder barrel 211 and the smaller diameter portion represents the piston rod 212. Hydraulic fluid pressure may be produced by a hydraulic fluid pump that is connected to a series of valves to regulate the hydraulic fluid flow through connecting hoses 100 to the ports 209 and 210, as seen in the detailed view 81 in FIG. 38B.

Figure 39:
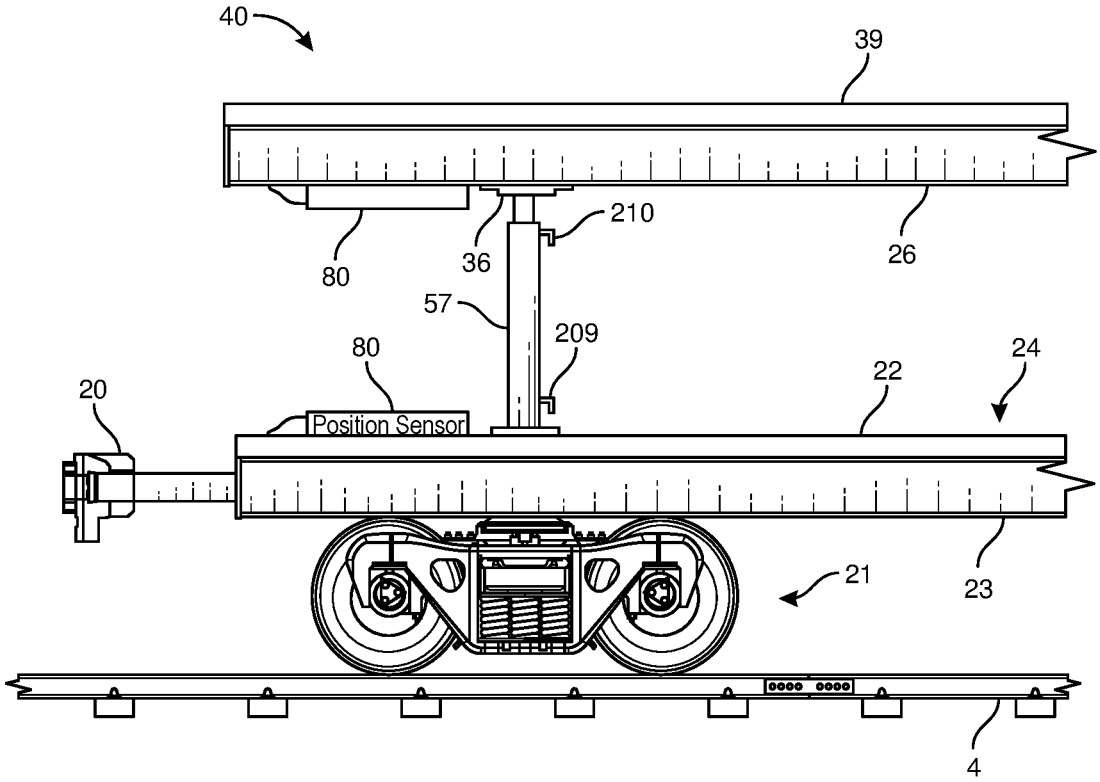
FIG. 39 shows another partial cross-sectional side view of the WBA assembled with the BTPS, with the WBA in a lower position, according to embodiments of this disclosure.

Although not shown, the cylinder ports of this disclosure may, when fully assembled, include connecting hoses 100 to their respective controlling valves. The valves can be controlled manually or by a controlling computer. In some examples, multiple railcars will be used to establish a water barrier defense. Accordingly, computer automation and computer regulation of such controlling valves may be useful to efficiently and accurately deploy the disclosed system to form a water barrier. To appropriately regulate the operation of valves, the system may use position sensing "smart cylinders" to send position data to the controlling computer. Such smart cylinders may include an attached external sensing "bar" that may use the Hall Effect (or another position-sensing mechanism) to sense the position of a permanent magnet in the piston through the walls of the cylinder barrel 211. Since the piston may be connected to the piston rod 212, the smart cylinder can provide position data for the piston rod 212 and, by mechanical connection, position data of other components connected to the piston rod 212. In this case, since the piston rod 212 is operating on the WBA VPCC strike plate 36 of the WBA 40, the WBA VPCC 57 may send vertical position data of the WBA 40 to the controlling computer through a wired or wireless connection. As shown in FIGS. 34A and 35, in some embodiments, each BTPS 24 may include four WBA VPCCs 57, with one WBA VPCC 57 located in each corner region of the BTPS 24. With vertical position data being supplied by each of the WBA VPCCs 57 and fed into a controlling computer, the controlling computer can regulate the valves of the WBA VPCCs 57 such that the WBA 40 can be vertically raised or lowered while the WBA underframe 26 remains substantially parallel to the BTPS underframe 23. FIG. 38A shows the WBA VPCC 57 in its upper, extended position. FIG. 39 shows the WBA VPCC 57 in a lower, retracted position. Substantially uniform lifting and lowering of the WBA 40 by the WBA VPCCs 57 may be performed to avoid any significant non-uniform, non-parallel, lifting or lowering of the WBA 40 that might otherwise cause the linear-motion bearings 34 to strike and bind against the vertical guide rails 55 or the WBA sidewalls 38 or WBA endwalls 42 to strike and bind against the BTPS 24.

The disclosed system can be fitted with discrete vertical distance and/or position sensors to provide data to the controlling computer that is independent of, or in place of, data provided by the smart cylinders. As shown in FIG. 38A and FIG. 39, WBA position sensors 80 may be attached to internal surfaces near each corner of the WBA 40 and BTPS 24 to provide distance data between the two platforms by a wired or wireless connection. The system can also be fitted with ultrasonic sensors, which will be discussed in greater detail below. In either case, the position data may be sent to one or both of a manual control panel or the controlling computer, where this data can be used to validate or override the data provided by the smart cylinders (if smart cylinders are employed).

Figure 40:
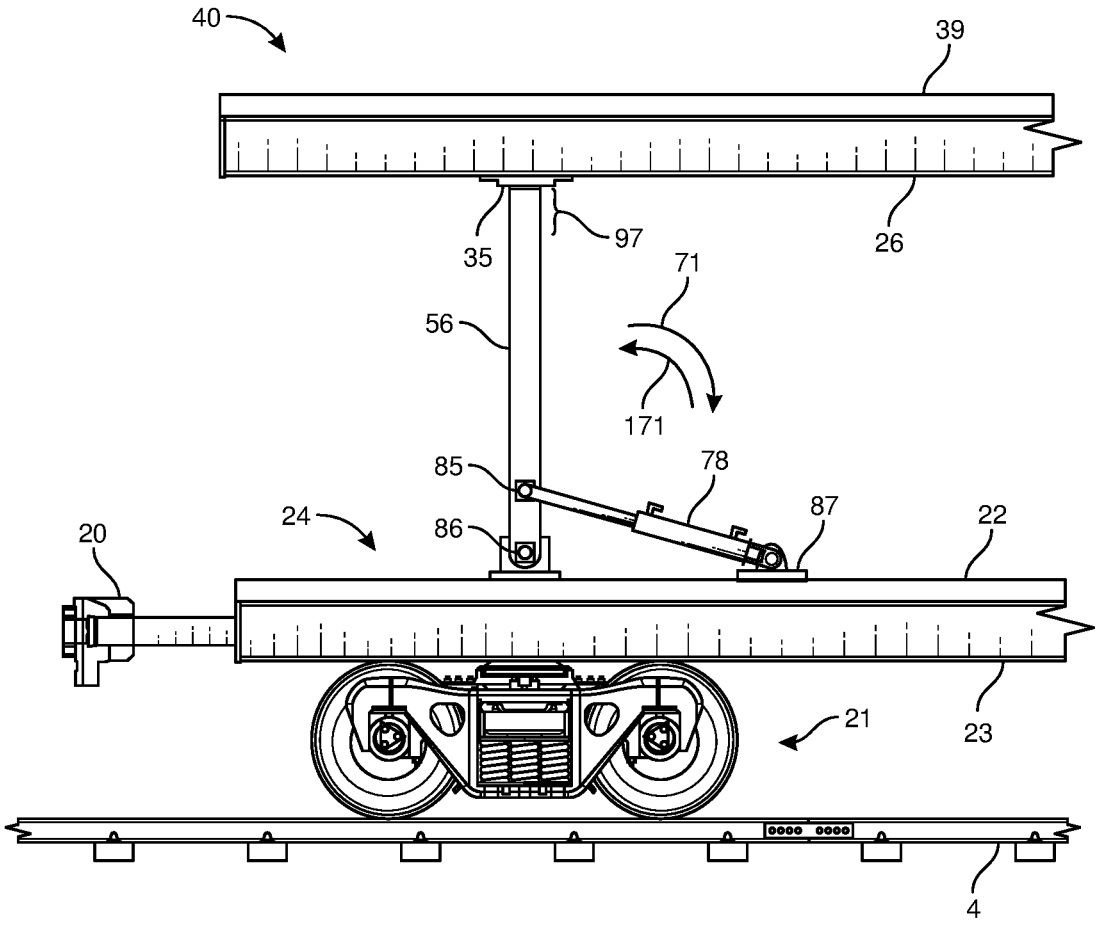
FIG. 40 shows another partial cross-sectional side view of the WBA assembled with the BTPS, with the WBA in an upper position, according to embodiments of this disclosure.

FIG. 40 shows another partial cross-sectional view of the BTPS 24 and WBA 40, taken from a view of an interlocking beam 56 interposed between the WBA 40 and BTPS 24. The bottom of the interlocking beam 56 may be attached to the BTPS 24 by a first mounting bracket and clevis hinge assembly 86, and the top of the interlocking beam 56 may be in contact with interlocking beam strike plate 35. Thus, the interlocking beam 56 may support at least a portion of the weight of a WBA 40. The interlocking beam 56 can be made of a steel I-beam or material of another configuration with sufficient strength to support the WBA 40 (together with other interlocking beams 56, as described above). In its vertical position (shown in FIG. 40), the interlocking beam 56 may mechanically block the WBA 40 from being vertically lowered toward the BTPS 24 and, therefore, may lock the WBA 40 an upper position. The interlocking beam 56 can be rotated around the clevis pin axis provided by the first mounting bracket and clevis hinge assembly 86. A clockwise (from the view of FIG. 40) rotation 71 of the interlocking beam about the clevis pin axis may result in lowering of the interlocking beam 56 from a raised position. Conversely, a counter-clockwise (from the view of FIG. 40) rotation 171 may result in the raising of the interlocking beam 56 from a lowered position to the raised position. The interlocking beam 56 may be raised or lowered by, for example, an interlocking beam controlling cylinder 78. One end of the interlocking beam controlling cylinder 78 may be attached to the BTPS floor 22 with a second mounting bracket and clevis hinge assembly 87 and the other end of the interlocking beam controlling cylinder 78 may be attached to the interlocking beam 56 with a third mounting bracket and clevis hinge assembly 85. The interlocking beam controlling cylinder 78 may be hydraulically operated by valves to supply hydraulic fluid to the cylinder's ports by connecting hoses (like the hoses 100 shown in FIG. 38B). The valves can be operated manually or by computer control. As the interlocking beam controlling cylinder 78 is operated to draw the piston rod inward toward the cylinder barrel, the mechanical connection between the interlocking beam controlling cylinder 78 and the interlocking beam 56 may force the interlocking beam 56 to rotate clockwise 71 around the first mounting bracket and clevis hinge assembly 86 to result in the lowering of the interlocking beam 56. In some embodiments, rotating of the interlocking beam 56 from the raised position to the lowered position may be facilitated by extending the WBA VPCC 57 (FIG. 38A) to relieve at least some weight on the interlocking beam 56.

Figure 41:
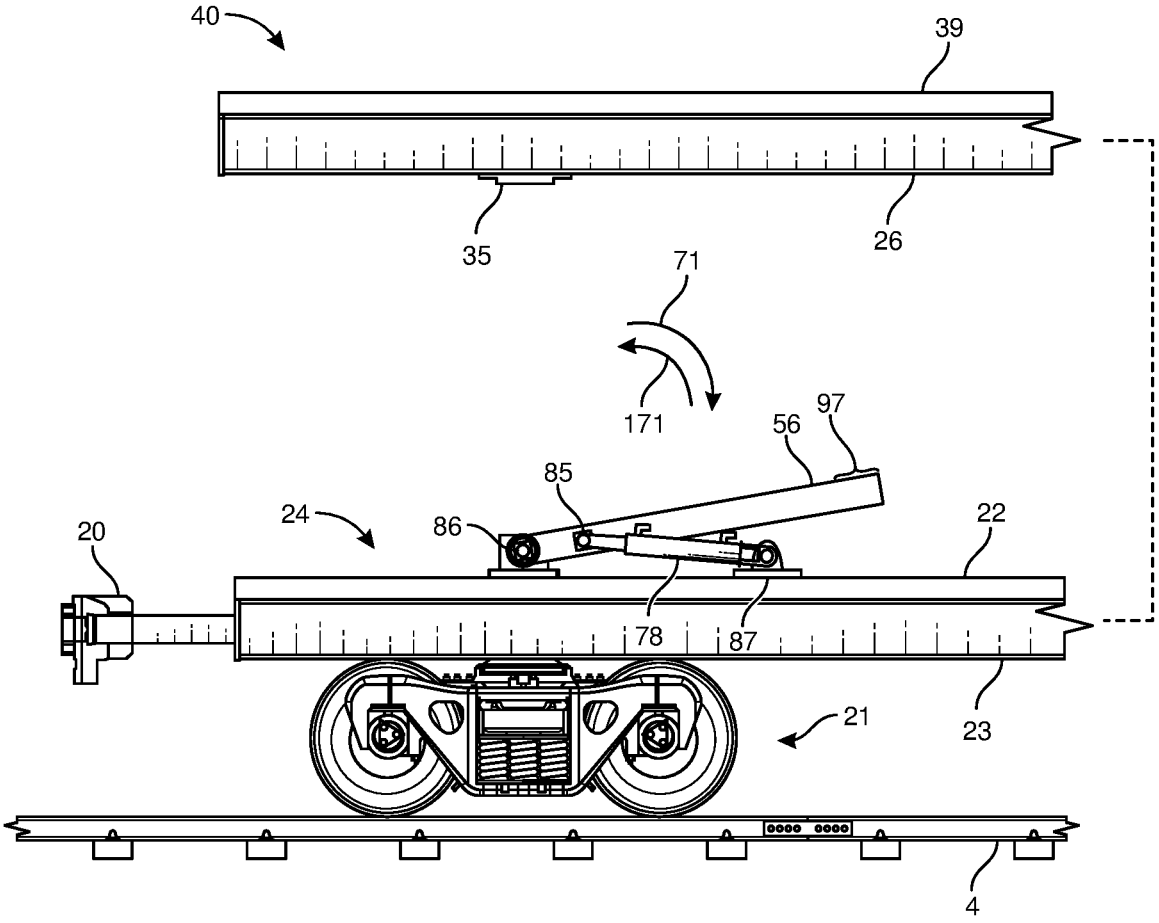
FIG. 41 shows another partial cross-sectional side view of the WBA assembled with the BTPS, with the WBA in a released position ready to be lowered, according to embodiments of this disclosure.

FIG. 41 shows the interlocking beam 56 in a lowered position. Conversely, as the interlocking beam controlling cylinder 78 is operated to extend the piston rod outward from the cylinder barrel, the mechanical connection between the interlocking beam controlling cylinder 78 and the interlocking beam 56 may force the interlocking beam 56 to rotate counter-clockwise 171 around the first mounting bracket and clevis hinge assembly 86, which may result in the raising of the interlocking beam 56 to the raised position shown in FIG. 40. To remove or restore the interlocking beam 56 from or to its fully raised, vertical position, the WBA 40 may be lifted slightly and temporarily by the WBA VPCCs 57 (FIG. 38A) such that there is an air gap between the top of the interlocking beam 56 and the interlocking beam strike plate 35 of sufficient size to allow the interlocking beam 56 to rotate without contacting the interlocking beam strike plate 35.

Figure 42:
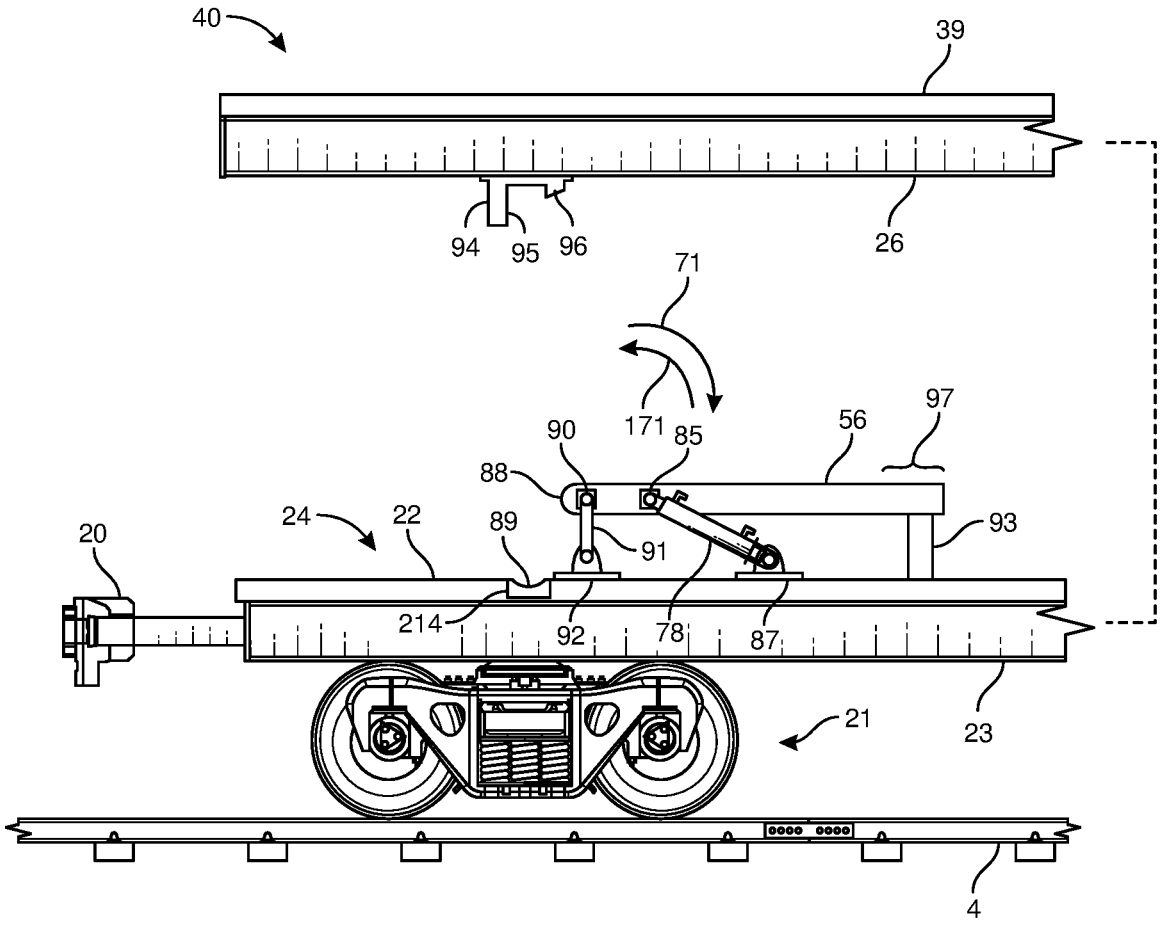
FIG. 42 shows another partial cross-sectional side view of the WBA assembled with the BTPS with an alternative interlocking beam design, with the WBA in a released position ready to be lowered, according to additional embodiments of this disclosure.
Figure 44:
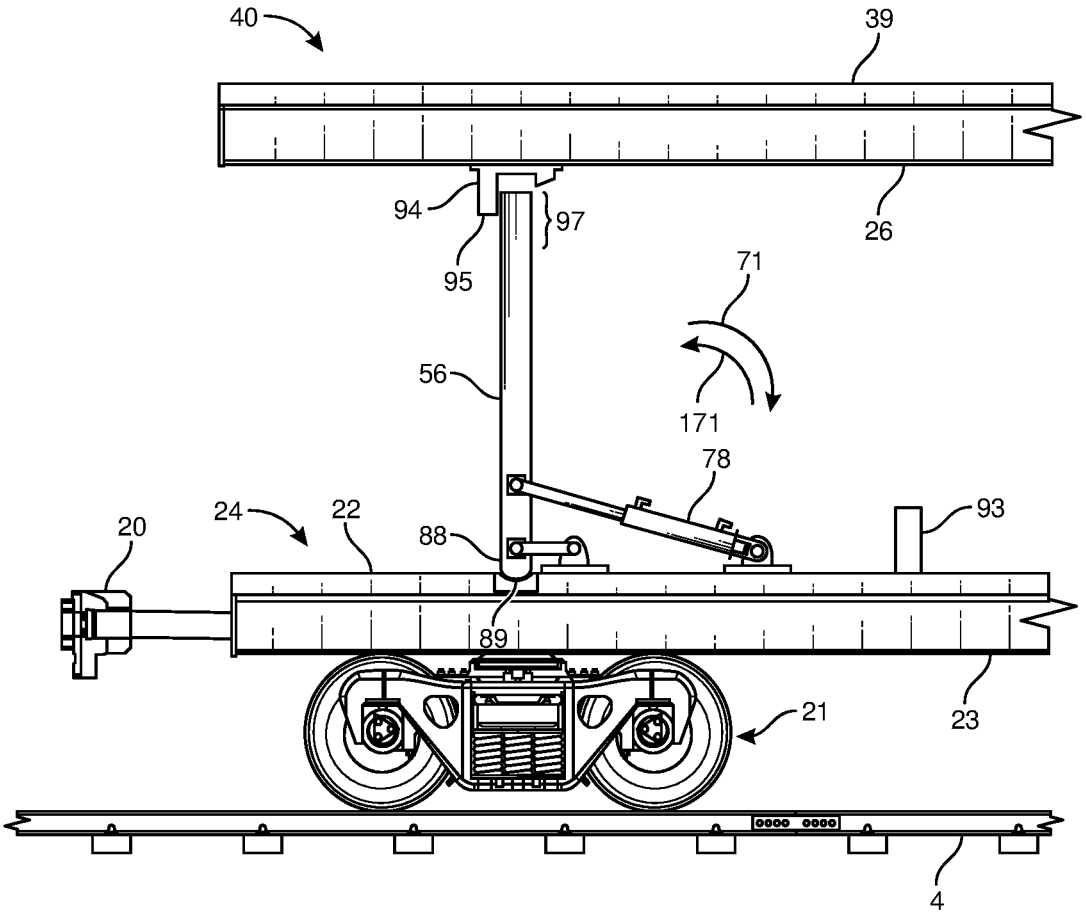
FIG. 44 shows a cross-sectional side view of an alternate interlocking beam design, where the interlocking beam in a raised vertical position prior to locking, according to embodiments of this disclosure.

FIG. 42 shows an alternative embodiment of an interlocking beam 56, in which the interlocking beam 56 may be operated by the same interlocking beam controlling cylinder 78, but the hinging mechanism at the bottom of the interlocking beam 56 is modified compared to the embodiment discussed above. Instead of using the first mounting bracket and clevis hinge assembly 86 that has a single hinge, a double hinge assembly may be used to allow the bottom of the interlocking beam 56 to come in direct contact with the BTPS floor 22 (or with a component, such as a plate, connected to the BTPS floor 22). The BTPS floor 22 may be capable of reliably sustaining greater vertical and lateral forces compared to the hinge pin of the single hinge assembly 86 discussed above. One end of the double hinge assembly may be attached to the BTPS 24 with a fourth mounting bracket and clevis hinge assembly 92, and the other end of the double hinge assembly may be attached to the interlocking beam 56 by a fifth mounting bracket and clevis hinge assembly 90. The fourth mounting bracket and clevis hinge assembly 92 and the fifth mounting bracket and clevis hinge assembly 90 may be connected by a double clevis link 91. At its first end, the double clevis link 91 may be rotationally attached to the clevis pin of the fourth mounting bracket and clevis hinge assembly 92 and, at its other end, the double clevis link 91 may be rotationally attached to the clevis pin of fifth mounting bracket and clevis hinge assembly 90. As the interlocking beam 56 is rotated counter-clockwise 171 by the interlocking beam controlling cylinder 78, the double clevis link 91 may also rotate counter-clockwise 171 until the bottom of the interlocking beam 56 lands on the BTPS floor 22. As shown in FIG. 44, after landing on the BTPS floor 22, the interlocking beam 56 may continue its counter-clockwise rotation 171 until the interlocking beam's upper portion 97 strikes the beam stop block 94. The mechanical action of the double hinge assembly may ensure that the bottom of the interlocking beam 56 lands consistently and reliably in a fixed location on the BTPS floor 22.

Referring to FIG. 42, in order to decrease the frictional forces when the interlocking beam 56 lands on the BTPS floor 22, a trunnion 88 and trunnion bearing 89 may be added to the bottom of the interlocking beam 56 and interlocking beam 56 landing spot on the BTPS floor 22, respectively.

Figure 43A:
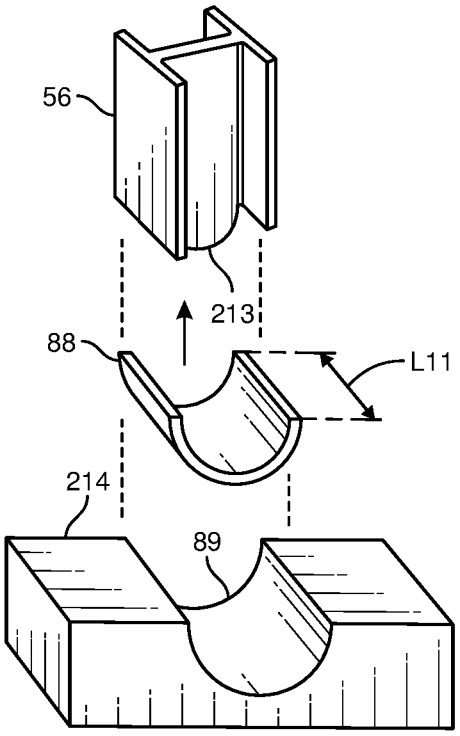
FIG. 43A shows an exploded perspective view of a portion of the interlocking beam's construction, including an interlocking beam trunnion and trunnion bearing, according to embodiments of this disclosure.

Referring to FIG. 43A, the trunnion 88 can be formed from a cylinder (e.g., a thick, hard, steel cylinder) of sufficient length L11 and radius, such that when cut in a plane across its diameter, one of the resulting semi-circle halves can cover the bottom 213 of the interlocking beam 56 and be attached to the interlocking beam 56 by a weld. The trunnion bearing 89 can be formed with a shape that is complementary to the trunnion 88. For example, a steel block 214 (e.g., a thick, hard, steel block 214) of sufficient size may be formed (e.g., molded, cut) with a semi-cylindrical groove with a length and radius slightly larger than the trunnion's 88 length and outer radius, such that the trunnion 88 can easily fit into the trunnion bearing 89. To prevent the inserted trunnion 88 from working its way out of the sides of the trunnion bearing 89, blocking plates 215 (e.g., thick steel blocking plates 215), as shown in FIG. 43B, can be attached and welded to cover both sides of the trunnion bearing 89.

Figure 43B:
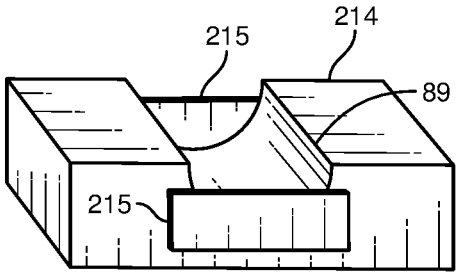
FIG. 43B shows a perspective view of a portion of a trunnion bearing according to another embodiment of this disclosure.

Referring to FIG. 43B, alternatively, the steel block 214 can be fabricated with integral steel walls blocking both sides of the trunnion bearing 89. In additional embodiments, the trunnion bearing 89 can be set in the BTPS floor 22, and portions of the BTPS floor 22 may block the trunnion 88 from moving within the trunnion bearing 89. The steel block 214, with the trunnion bearing 89, can be mounted onto the BTPS floor 22 or into the BTPS floor 22 where it can be attached to the underlying BTPS body bolster 63 by weld, bolt or other attachment means. Grease can be applied to the trunnion 88 and trunnion bearing 89 contact surfaces to reduce friction and wear between the trunnion 88 and trunnion bearing 89.

Referring to FIG. 42 and FIG. 44, as the interlocking beam controlling cylinder 78 is operated to extend the piston rod outward from the cylinder barrel, the mechanical connection between the interlocking beam controlling cylinder 78 and the interlocking beam 56 may force the interlocking beam 56 to rotate counter-clockwise 171 around the double hinge assembly. The double hinge assembly's radial action may place the interlocking beam's trunnion 88 into the trunnion bearing 89 as the interlocking beam 56 rotates to a vertical position. It should be noted that the placement of the interlocking beam's trunnion 88 into the trunnion bearing 89 may lock the bottom of the interlocking beam 56 into a fixed position such that normal lateral forces cannot move it, such as during transportation of the system along the railroad track 4 (which may subject the system to significant lateral movements, vibrations, and forces).

Figure 43C:
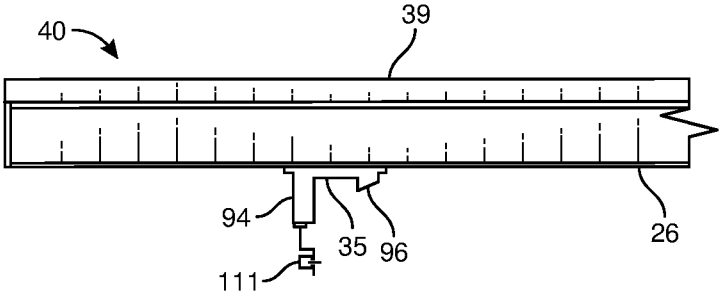
FIG. 43C shows a cross-sectional side view of the interlocking beam's locking mechanism on the WBA underframe, according to embodiments of this disclosure.

In some embodiments, the disclosed system may also include a mechanism to lock an upper portion of the interlocking beam 56 into its raised position. Referring to FIG. 42 and FIG. 43C, the interlocking beam strike plate 35 may be modified by increasing its size (relative to some other embodiments shown and described in this application) to include a beam stop block 94 and a beam locking gear 96. The following process may use these components to lock the upper portion of the interlocking beam 56 in its vertical position.

Figure 45:
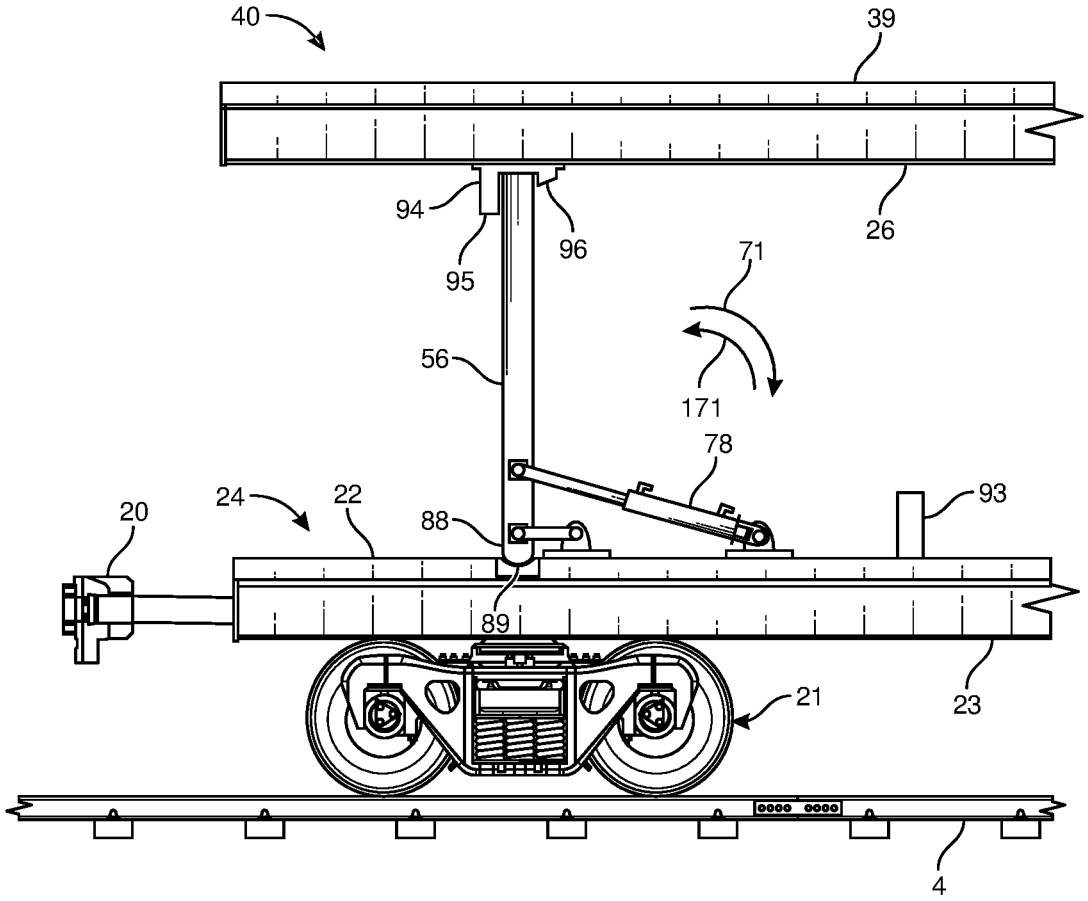
FIG. 45 shows a cross-sectional side view of the alternate interlocking beam design of FIG. 44, where the interlocking beam is in a raised vertical position and locked, according to embodiments of this disclosure.

Referring to FIG. 42 and FIG. 44: (1) The WBA 40 may be positioned at a height such that, as the interlocking beam 56 rotates counter-clockwise 171 to its vertical position, the upper portion 97 of the interlocking beam 56 may not come in contact with the beam locking gear 96, but strikes the beam stop block 94 on its inner surface 95, where the beam stop block 94 stops the counter-clockwise rotation of the interlocking beam 56. (2) After a beam position switch 111 (shown in FIG. 43C) or other position sensor verifies that the interlocking beam 56 is in its proper vertical position, the WBA VPCCs 57 may lower the WBA 40 until the interlocking beam strike plate 35 (labeled in FIG. 43C) contacts and rests on interlocking beam 56, as shown in FIG. 45. (3) With the WBA 40 resting on the interlocking beam 56, the beam stop block 94 and beam locking gear 96 may prevent the interlocking beam 56 from rotating clockwise 71 or counter-clockwise 171 and may, therefore, lock the interlocking beam 56 into its vertical position. It should be noted that steel plates, similar to the blocking plates 215 (FIG. 43B), can be attached and welded to cover both sides of the interlocking beam strike plate 35 in order to inhibit lateral motion of the interlocking beam's upper portion 97.

The following process can be used to unlock and lower the interlocking beam 56. Referring to FIGS. 44 and 45: 1) The WBA VPCCs 57 can be operated to lift the WBA 40 to a height such that the beam locking gear 96 no longer restricts the ability of the interlocking beam 56 to rotate clockwise 71. 2) The interlocking beam controlling cylinder 78 can then be operated to draw the piston rod inward toward the cylinder barrel. The mechanical connection between the interlocking beam controlling cylinder 78 and the interlocking beam 56 may force the interlocking beam 56 to rotate clockwise 71 around the double hinge assembly to result in the lowering of the interlocking beam 56 until the interlocking beam 56 strikes and rests on the resting block 93, as shown in FIG. 42. All of these processes can be controlled manually or by a controlling computer that automates the processes with software code.

Figure 46:
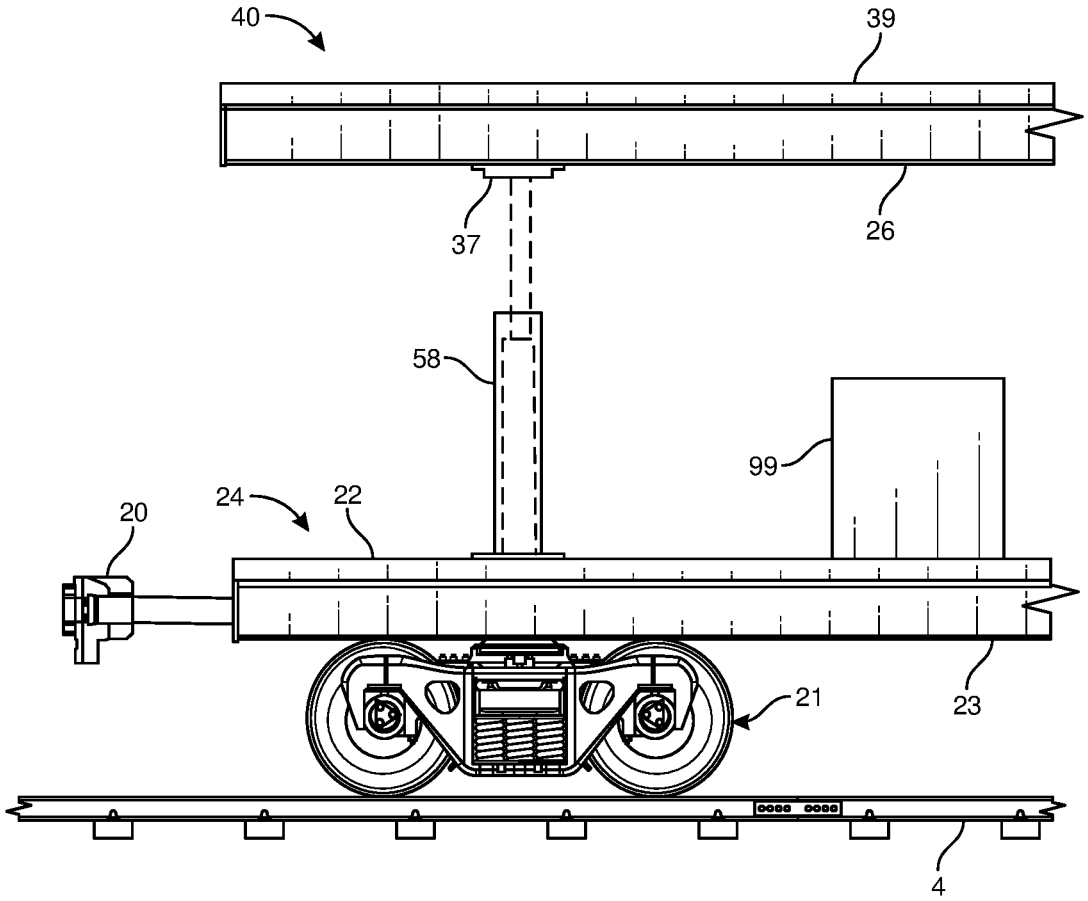
FIG. 46 shows a cross-sectional side view of a Service/Safety block, where the WBA underframe is in an upper position, according to embodiments of this disclosure.
Figure 47:
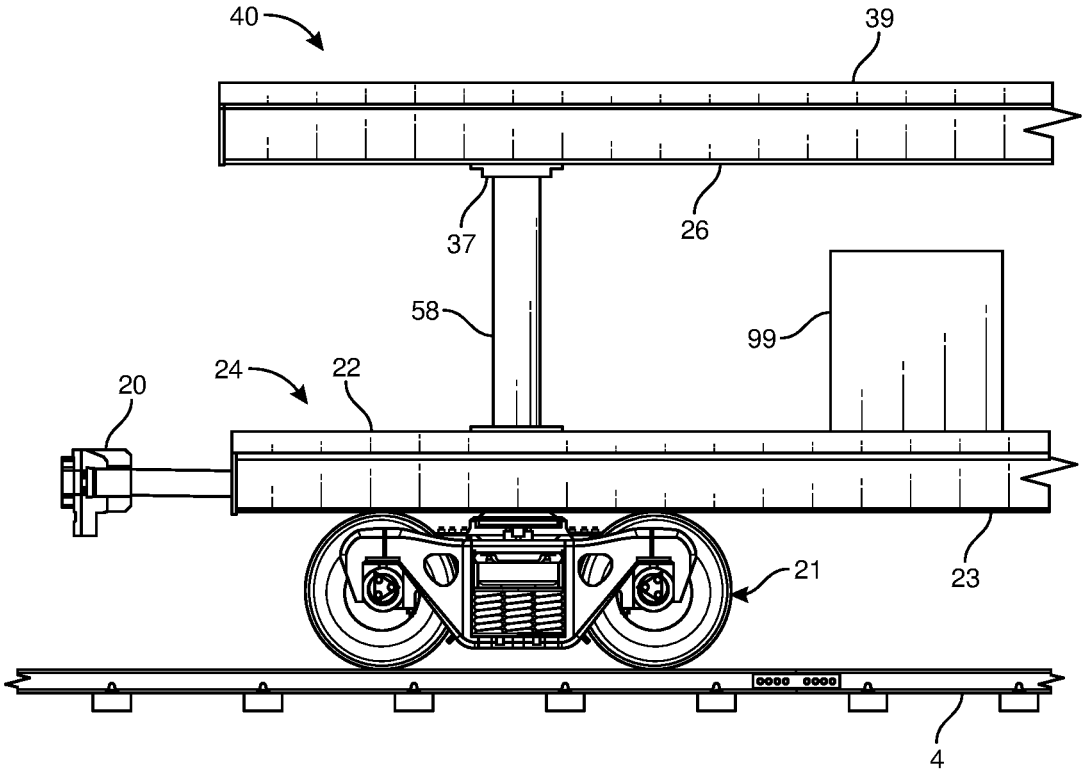
FIG. 47 shows a cross-sectional side view of the Service/Safety block, where the WBA underframe has fallen on top of the Service/Safety block, according to embodiments of this disclosure.

FIG. 46 shows another cross-sectional side view of the BTPS 24 and WBA 40. A service/safety block 58 may be rigidly attached to the BTPS floor 22. The service/safety block 58 can be made out of a steel I-beam, a solid steel block, or another suitable material and configuration. In the event that any of the components of the BTPS 24 or systems fail such that the WBA 40 falls uncontrollably, the service/safety block 58 may provide a stopping mechanism to prevent the WBA 40 from falling below a fixed height. For example, in the perspective shown in FIG. 47, the WBA 40 has fallen and landed onto the service/safety block 58. The service/safety block strike plate 37 has struck the top of the service/safety block 58 and stopped the descent of the WBA 40. For example, further descent (e.g., in the absence of the service/safety block 58) may have damaged the pump and power housing 99 and potentially other systems and components on the BTPS floor 22. The service/safety block 58 can also prevent the WBA 40 from falling and harming maintenance and service personnel working in the area.

Figure 48:
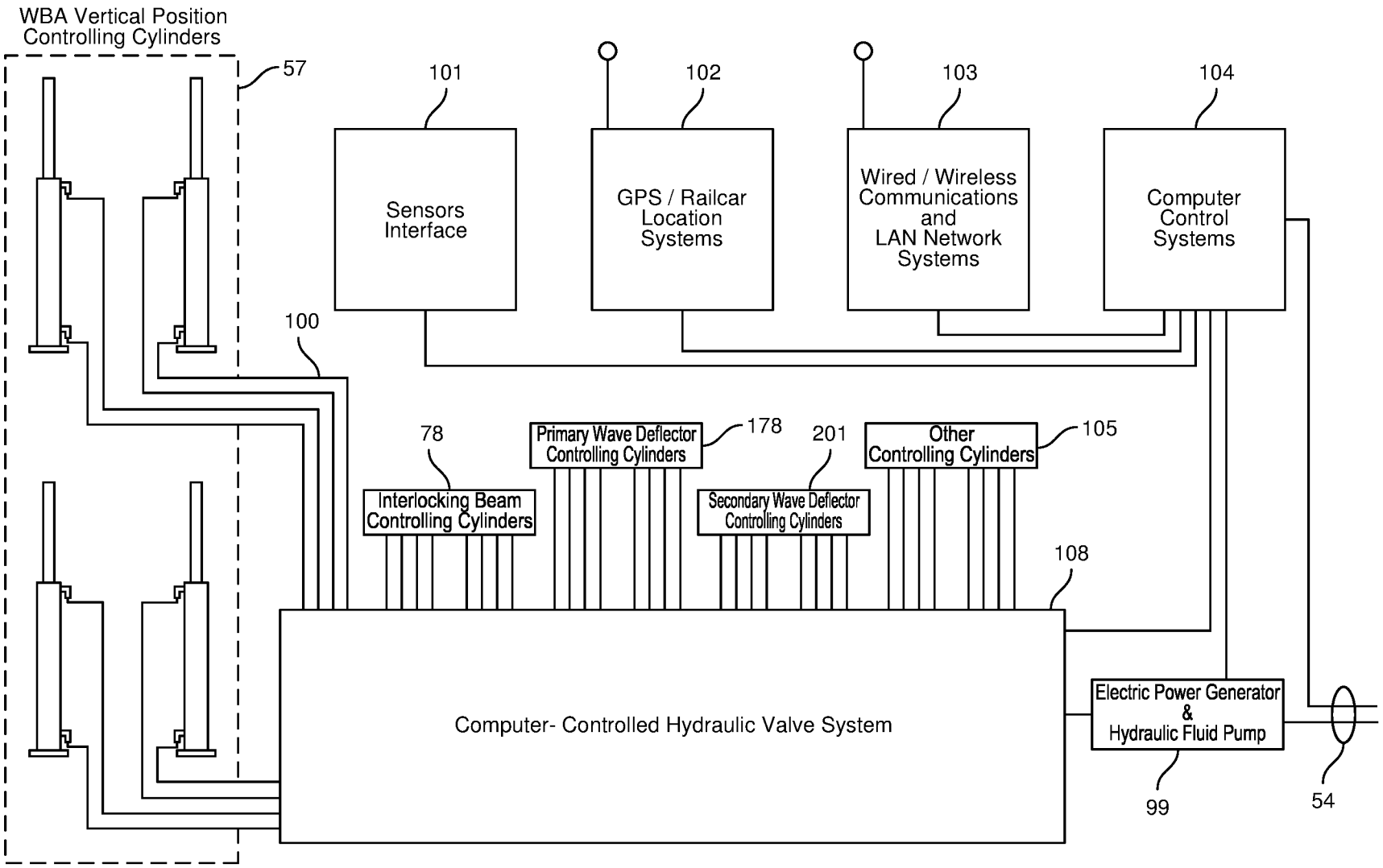
FIG. 48 shows a diagram of control systems that may operate components of the disclosed systems, according to embodiments of this disclosure.

FIG. 48 shows a diagram of control systems that may include: a sensors interface 101; a GPS railcar location system 102; a wired/wireless communications and LAN network system 103; a controlling computer system 104; a hydraulic fluid pump and electric power generation system 99; a computer-controlled hydraulic valve system 108 connected to a plurality of controlling cylinders with connecting hoses 100. These systems, as well as other systems and components, may be made to be waterproof, including the pump and power housing 99, which may automatically seal itself from the environment when the system is in a deployed mode. However, during the deployed mode, all of the system's control systems may remain electrically powered by battery systems located in the pump and power housing 99 and may remain functional and operate as follows:

The sensors interface 101 may receive data including, for example, distance, pressure, position, velocity, acceleration, video, and all other data from various sensors including switches, smart cylinders, position sensors, distance sensors, pressure sensors, ultrasonic sensors, video cameras, and other sensors. The sensors interface 101 may communicate the data to the controlling computer system 104. The data may be transmitted to a remote command and control station. The locations and identifications of all sensors, including the IDs of railcars where used, and the physical locations of the sensors on the railcars, may be transmitted along with the other data.

The GPS railcar location system 102 may receive wireless satellite location data to provide an accurate location of each railcar. The location data may be communicated to the controlling computer system 104.

The wired/wireless communications and LAN network system 103 may communicate bi-directionally with a remote command and control station. The remote command and control station may be able to send various commands to the controlling computer system 104 for the operation of the railcar. Such commands can include the activation of a sequence of several automated processes. The LAN network system 103 may provide a LAN network that may allow the controlling computer system 104 to communicate with components and systems on the railcar, as well as to communicate with adjacent connected railcars and their controlling computer systems 104 through the resource coupler 54.

The pump and power housing 99, if so equipped, may contain the hydraulic fluid pump and electric power generation system that generates hydraulic fluid pressure and electric power to operate the railcar's components and electrical systems. The controlling computer system 104 may activate, monitor, and regulate the output of the hydraulic fluid pump and electric power generation systems. Alternatively, the hydraulic fluid pressure and/or electric power can be supplied by a locomotive (e.g., the locomotive 189 shown in FIG. 118), in which case the controlling computer system 104 may still activate, monitor, and regulate fluid pressure and power that may impact the function of the railcar. As another alternative, the hydraulic fluid pressure and/or electric power can be supplied by an adjacent connected railcar, in which case the controlling computer system 104 may still activate, monitor, and regulate the fluid pressure and power impacting the function of the railcar. The pump and power housing 99 may also be the location of the railcar system's batteries, as well as back-up batteries. As an option, the system can be fitted with controlling cylinders that operate electrically, where the electrical controlling cylinders may have their own electric motors that drive hydraulic pumps to actuate the piston rods and attached components. Such electrical controlling cylinders, if present, may replace or augment the hydraulic controlling cylinders described above. The electrical cylinders would be operated by the controlling computer system 104. The electric controlling cylinders may lack the connecting hoses 100 and a computer controlled hydraulic valve system, but may use more robust wiring and electrical power generation.

As another option, instead of using electrical controlling cylinders for the WBA VPCCs 57, FIG. 119 shows the railcar with an electric winch 241 replacing the function of the WBA VPCCs 57. Such an electric winch 241 may be attached to the BTPS floor 22 and may operate on a winch cable 242 that may pass through a winch cable hole 243 in the WBA underframe 26 and WBA floor 39. The winch cable 242 may be positioned within the groove of a winch pulley 244. The winch cable 242 may loop around the winch pulley 244 and be attached to a winch cable anchor 245. The winch cable anchor 245, in turn, may be securely attached to the WBA floor 39 and WBA underframe 26 structure. The electric winch 241 may be operated by the controlling computer system 104. As the electric winch 241 is operated to draw the winch cable 242 inward toward the electric winch 241, the winch cable 242 may pass around the winch pulley 244 to lift the WBA 40 vertically. Conversely, as the electric winch 241 is operated to release the winch cable 242, the winch cable 242 may pass around the winch pulley 244 in an opposite direction to lower the WBA 40 vertically.

Referring again to FIG. 48, the computer controlled hydraulic valve system 108 may regulate hydraulic fluid from the hydraulic fluid pump to the various connected hydraulic cylinders including: the WBA VPCCs 57, the interlocking beam controlling cylinders 78, the primary wave deflector controlling cylinders 178, the secondary wave deflector controlling cylinders 201, and all other hydraulic cylinders 105. All controlling cylinders may be connected to the computer controlled hydraulic valve system 108 by connecting hoses 100, which may transport the hydraulic fluid to or from the controlling cylinders. The computer-controlled hydraulic valve system 108 may be electronically controlled by the controlling computer system 104, which may regulate the valves to operate the various controlling cylinders to perform as desired.

The controlling computer system 104 may send and receive data from the various connected systems, such as the sensors interface 101, the GPS railcar location system 102, the wired/wireless communications and LAN network system 103, the hydraulic fluid pump, the electric power generation system 99, and the computer-controlled hydraulic valve system 108. The controlling computer system 104 may also be able to transmit data to or receive data from adjacent connected railcars through the resource coupler 54, or wirelessly through the wired/wireless communications and LAN network system 103. Resource couplers 54 may be provided at each end of the railcar to provide a connection between the railcars to transmit electrical power, electronic data, hydraulic fluid, and/or pneumatic fluid (e.g., air) or other resources to the railcars as needed. The controlling computer system 104 may also be able to communicate with the locomotive 189 (shown in FIG. 118) through the resource coupler 54 or wirelessly through the wired/wireless communications and LAN network system 103, such as to activate, monitor, and/or regulate the movement of the locomotive 189 that may aid any of the processes (e.g., deployment or removable) performed by the railcars. Through a software validation process performed by controlling computer systems 104 on adjacent railcars, in the event that a controlling computer system 104 on any one railcar fails, a controlling computer system 104 on one of the adjacent railcars may take over the function(s) of the failed controlling computer system 104 and may report the failure and system override to the remote command and control station. Optionally, the command and control station operator can manually override a failed controlling computer system 104 with a fully operational controlling computer system 104 on an adjacent railcar.

The controlling computer system 104 may operate by software code that is stored on a local hard drive or other memory device (e.g., a non-transitory storage medium). The software code may contain commands to operate all systems and components, including the controlling cylinders, on the railcar. The software code may allow all of the connected railcars' controlling computer systems 104 to communicate and work co-operatively with each other to perform automated processes, such as the transformation of the connected railcars into a water barrier, or the reverse of the process, namely the transformation of the water barrier back into the railcar form that is ready for transport on railroad tracks. Each railcar may be identified electronically with its own unique identifier, and the controlling computer systems 104 may use these identifiers during communications. The remote command and control station may use these unique identifiers so that it can activate, monitor, and/or regulate, as needed, the performance of the individual railcars that form part of a dispatched train. Given that a dispatched train can contain hundreds of railcars according to the present disclosure, the controlling computer system 104 may facilitate control, automation, speed, efficiency, and effectiveness of the system's processes.

The railcar may be considered to have six basic modes of operation, all of which may be activated, monitored, and/or regulated by the controlling computer system 104. The first five modes of operation may regulate the vertical position of the WBA 40 and they may include: the "transport mode;" the "interlock transition mode;" the "WBA vertical motion enabled mode;" the "WBA deployed mode;" and the "WBA service/safety mode." All five of these modes are shown in various of the drawings FIGS. 49-66. The sixth mode is referred to herein as the "barrier assembly mode," and this mode may regulate the horizontal position of the WBA 40. The barrier assembly mode will be discussed in greater detail later in this disclosure.

FIG. 49 shows a cross-sectional end view of a railcar in the transport mode. In the transport mode, the WBA underframe 26 may be locked at a level 217 by the WBA underframe 26 resting on the interlocking beams 56, which may be positioned and locked in their vertical positions. The piston rods of the WBA VPCC 57 may be operated to their fully retracted (i.e., fully lowered) positions where they are disengaged from the WBA underframe 26. The WBA body bolster 30 may be a part or a component of the WBA underframe 26, and the level 217 may corresponds to a horizontal plane established at the bottom of the WBA underframe 26. The transport mode may be considered the mode used when the railcars are in the process of being moved by a locomotive along the railroad track 4, or when the railcars are in storage. Once the locomotive positions the railcars at their target locations for deployment, other modes of operation may be employed to transform the railcars into a water barrier.

Figure 50:
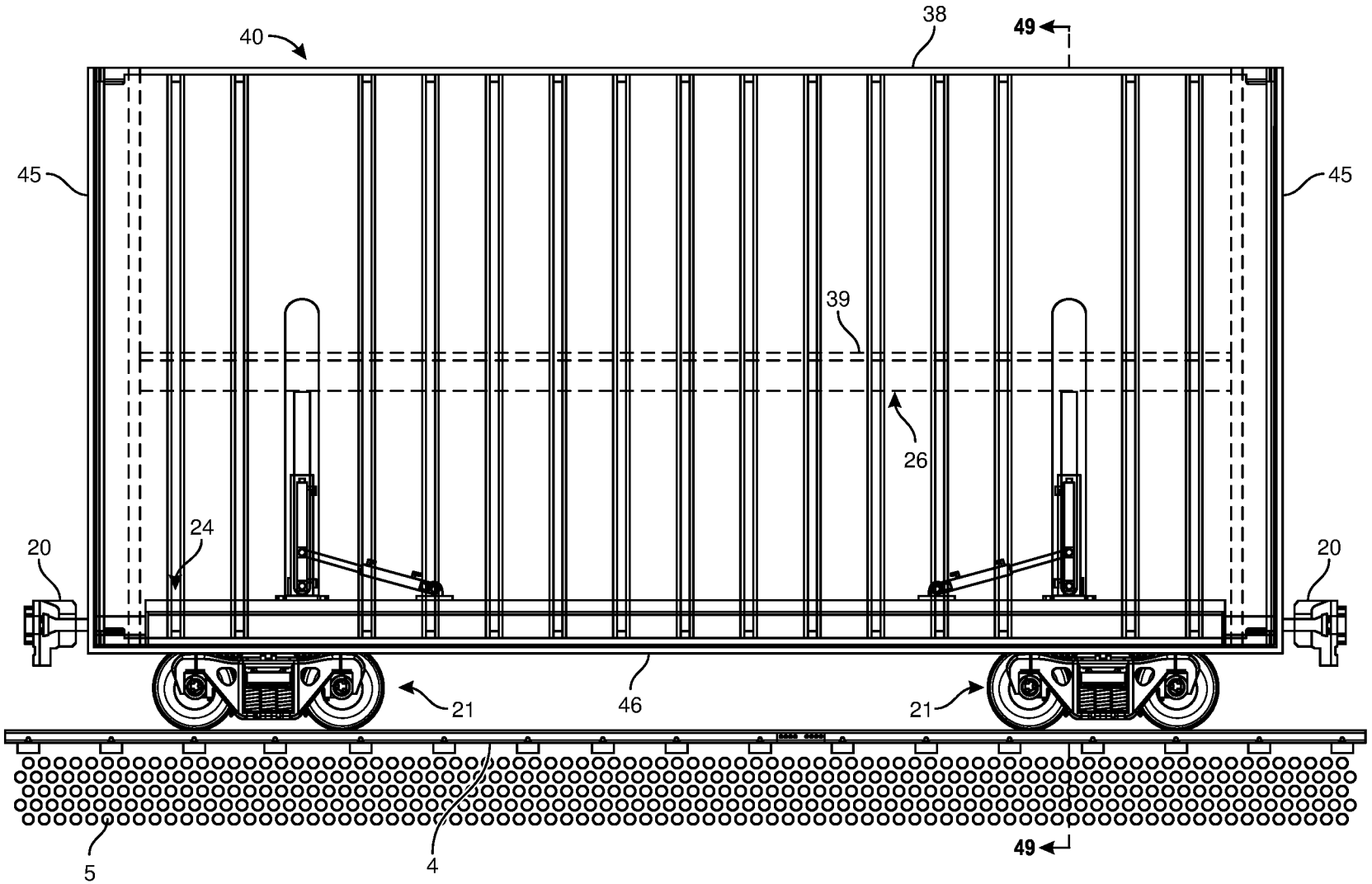
FIG. 50 shows a semi-transparent side view of the railcar in the transport mode, according to embodiments of this disclosure.
Figure 51:
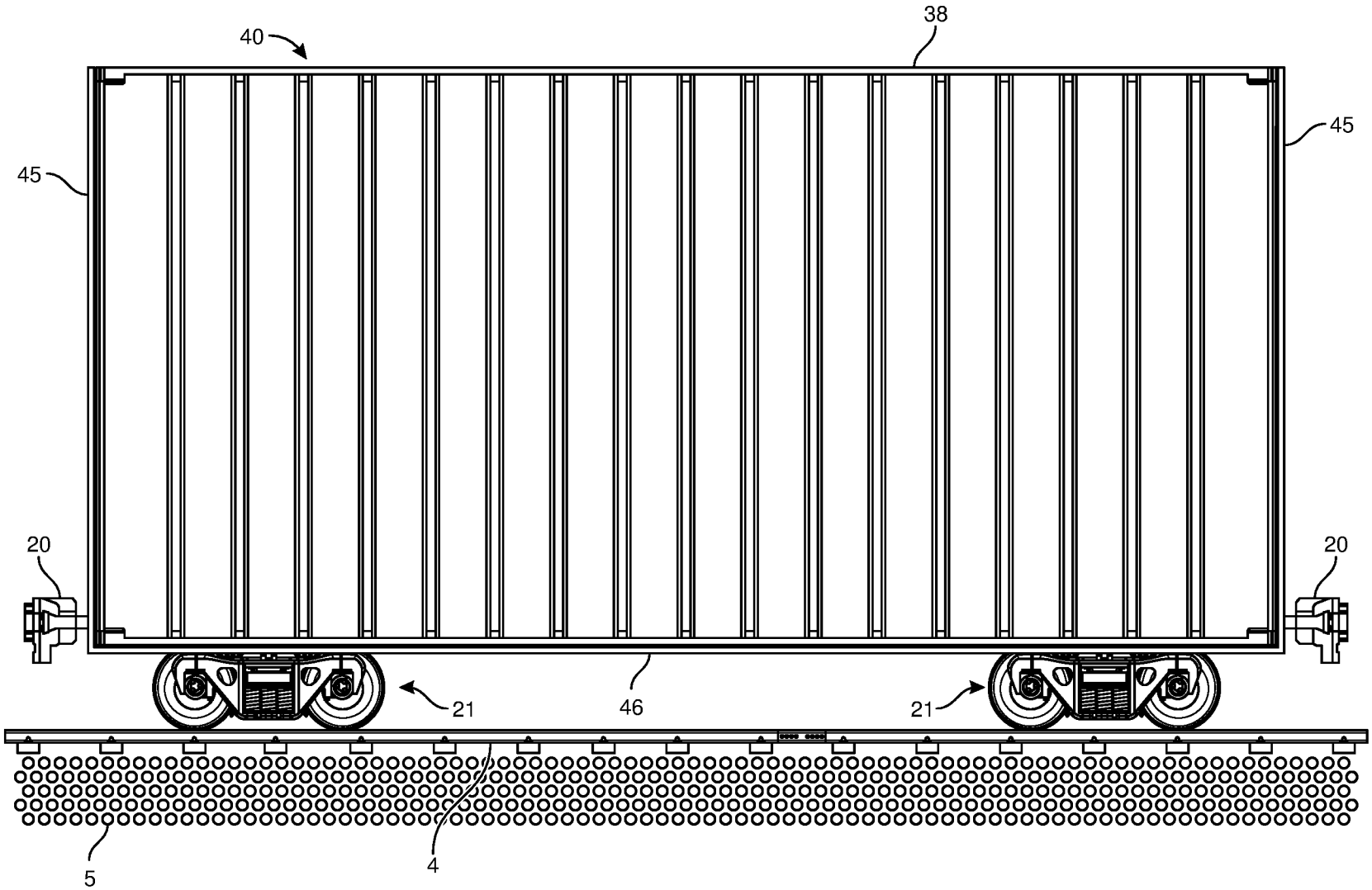
FIG. 51 shows a side view of the railcar in the transport mode, according to embodiments of this disclosure.

FIG. 50 shows a semi-transparent side view of the railcar shown in FIG. 49. The WBA underframe 26 may be resting the interlocking beams 56 that are locked in their vertical positions, and the piston rods of the WBA VPCCs 57 may be operated to their fully retracted (i.e., fully lowered) positions. FIG. 51 shows an opaque side view of the railcar shown in FIG. 50, to illustrate that the railcar may have an overall outward appearance similar to, but not necessarily identical to, a conventional gondola railcar. For example, the bottom of the WBA 40 may ride at a conventional height of a gondola railcar sidewall above the railroad track 4.

Figure 52:
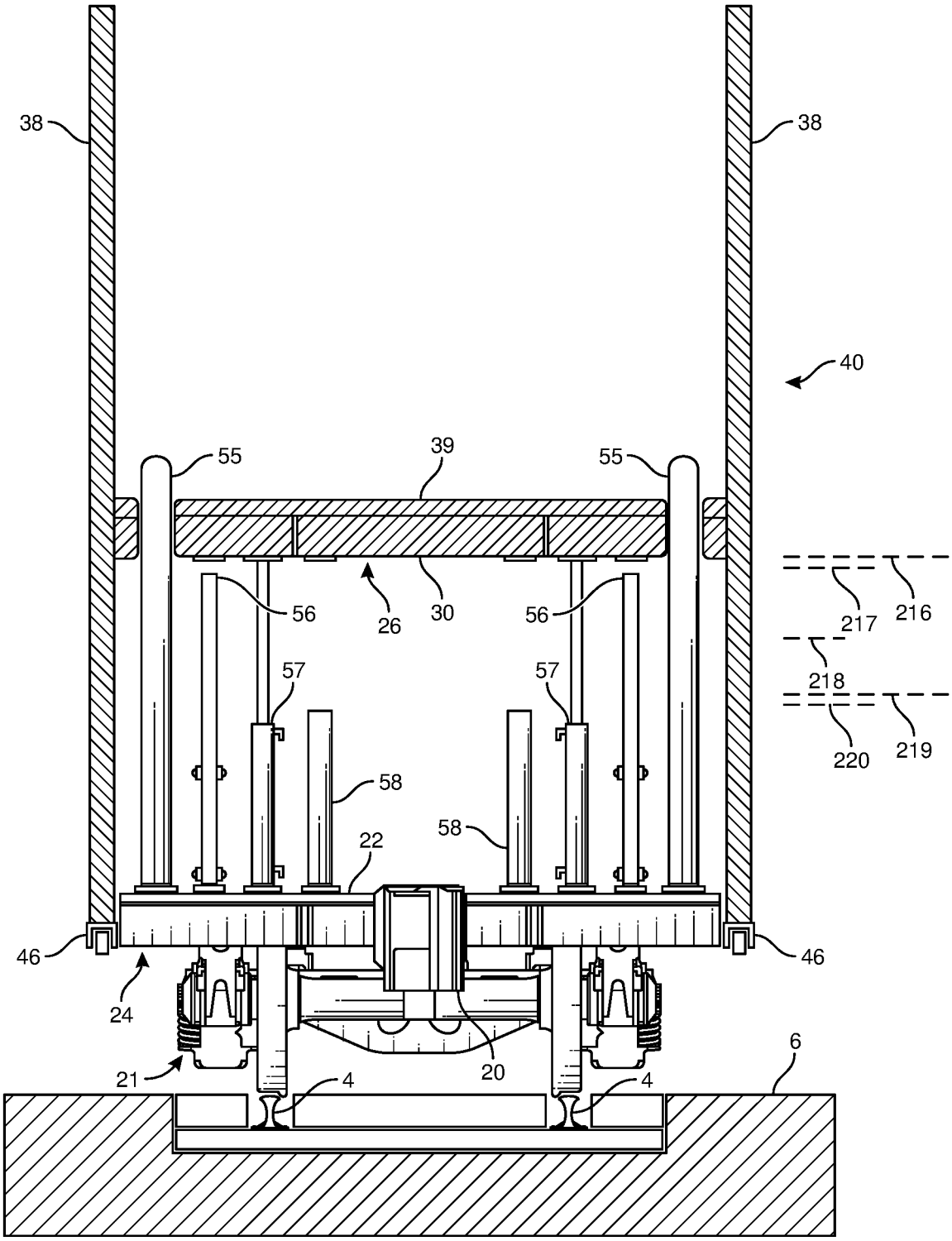
FIG. 52 shows a cross-sectional end view, taken at line 52-52 of FIG. 53, of the railcar in an interlock transition mode, according to embodiments of this disclosure.

FIG. 52 shows a cross-sectional end view of the railcar in an interlock transition mode. In the interlock transition mode, the piston rods of the WBA VPCCs 57 are operated to lift the WBA underframe 26 to an upper height, at a level 216, after which the retracting motion of the interlocking beams' upper portions 97 may not strike any part of the WBA underframe 26 and the interlocking beams 56 can be raised or lowered freely without interference.

Figure 53:
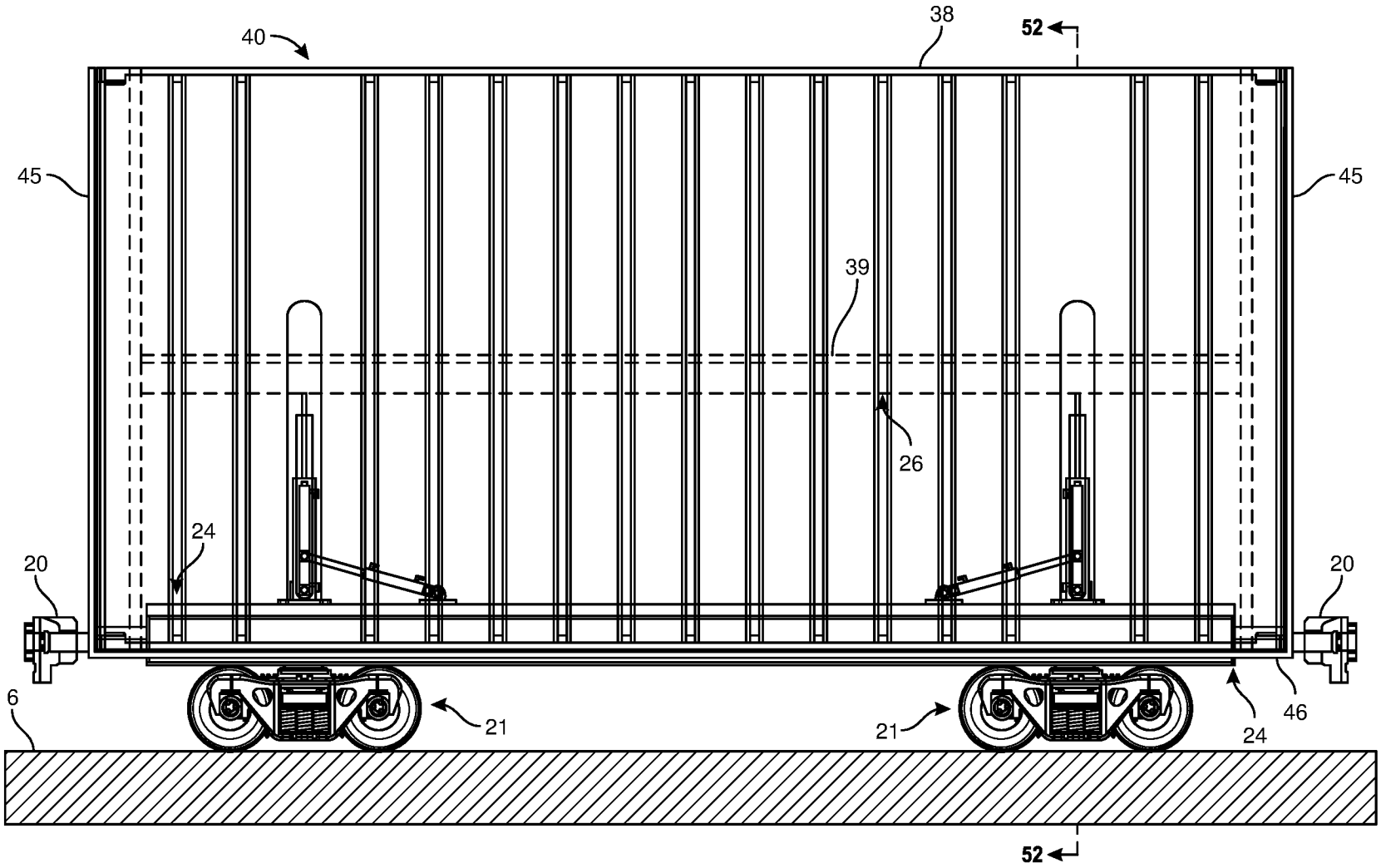
FIG. 53 shows a semi-transparent side view of the railcar in the interlock transition mode, according to embodiments of this disclosure.
Figure 54:
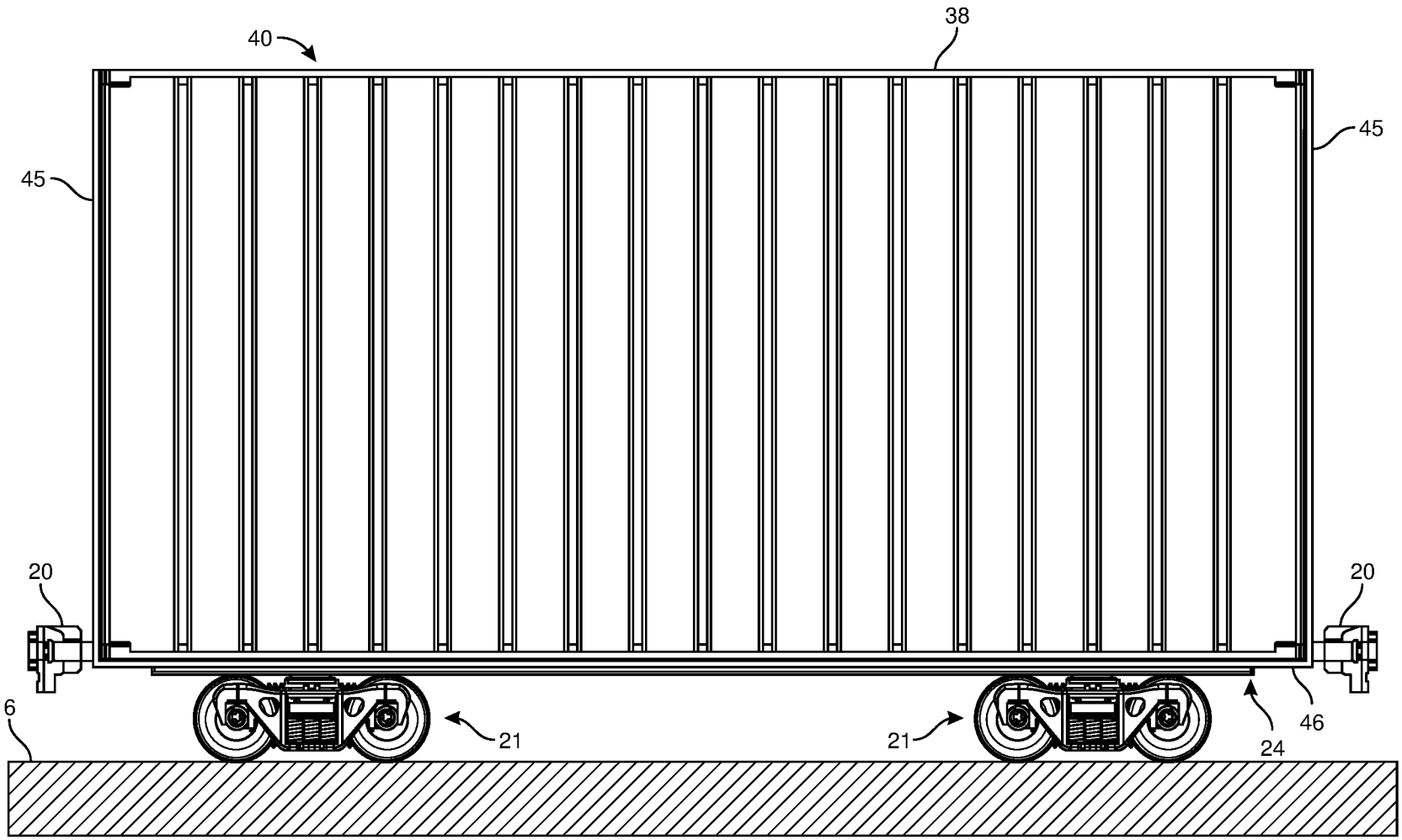
FIG. 54 shows a side view of the railcar in the interlock transition mode, according to embodiments of this disclosure.

FIG. 53 shows a semi-transparent side view of the railcar shown in FIG. 52, where the piston rods of the WBA VPCCs 57 are operated to an upper height such that the motion of the interlocking beams' upper portions 97 may be free from interference from any part of the WBA underframe 26. FIG. 54 shows an opaque side view of the railcar shown in FIG. 53, where the railcar has an outward appearance similar to, but not necessarily identical to, a conventional gondola railcar, except that the bottom of the WBA 40 may ride slightly higher than a conventional height of a gondola railcar sidewall above the railroad track 4.

Figure 55:
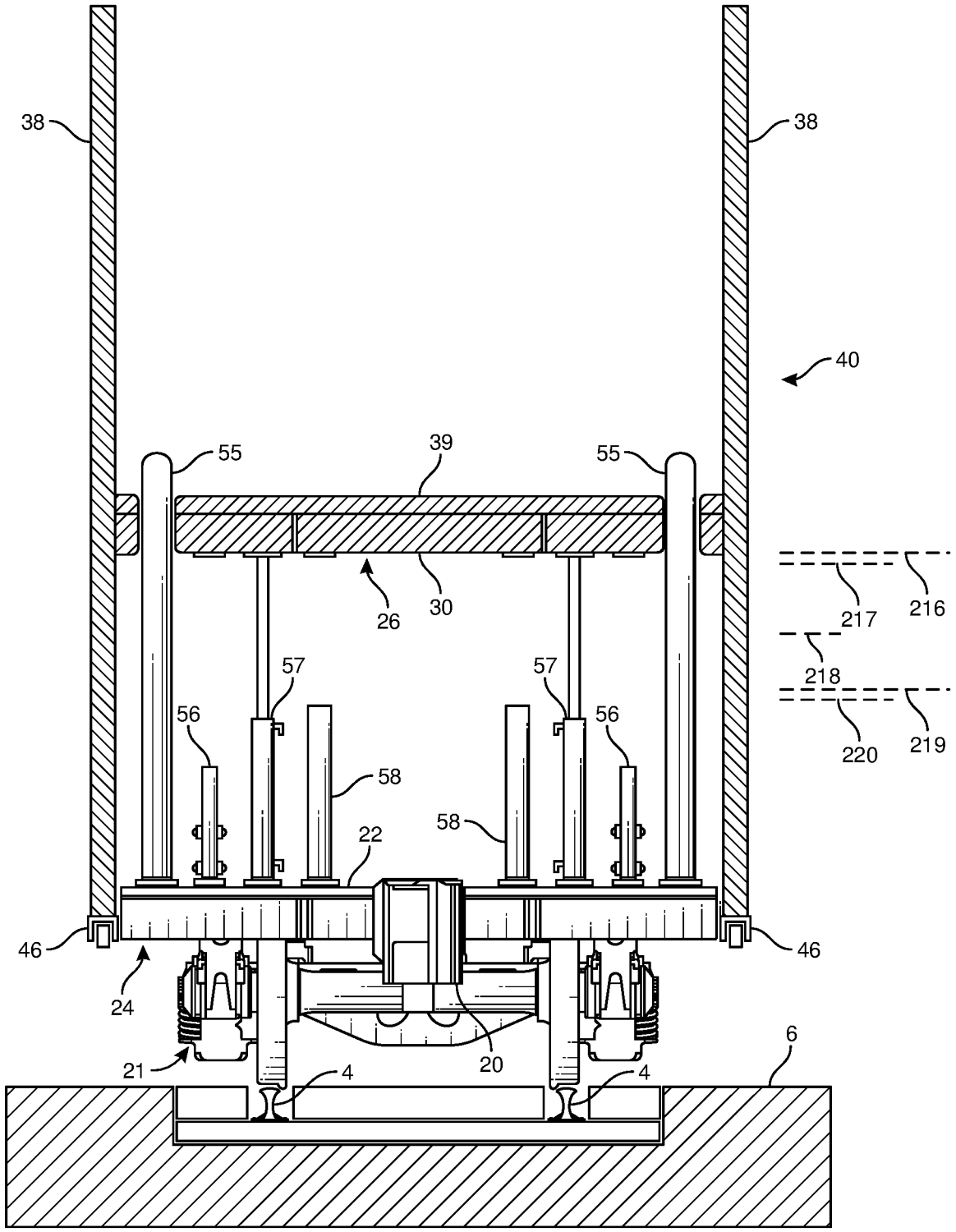
FIG. 55 shows a cross-sectional end view, taken at line 55-55 of FIG. 56, of the railcar in a WBA vertical motion enabled mode, where the WBA is in a raised position, according to embodiments of this disclosure.

FIG. 55 shows a cross-sectional end view of the railcar in the WBA vertical motion enabled mode. In the WBA vertical motion enabled mode, the interlocking beams 56 may be in their fully lowered positions, and the WBA 40 may be vertically suspended by the extended WBA VPCCs 57. With the interlocking beams 56 fully lowered, the WBA VPCCs 57 can vertically raise or lower the WBA 40 without vertical mechanical restrictions, other than the mechanical restrictions that may be imposed by the WBA 40 landing on top of a planar surface 6 or on top of the service/safety blocks 58. In this example, the WBA VPCCs 57 are illustrated to have positioned the WBA underframe 26 at its highest level 216.

Figure 56:
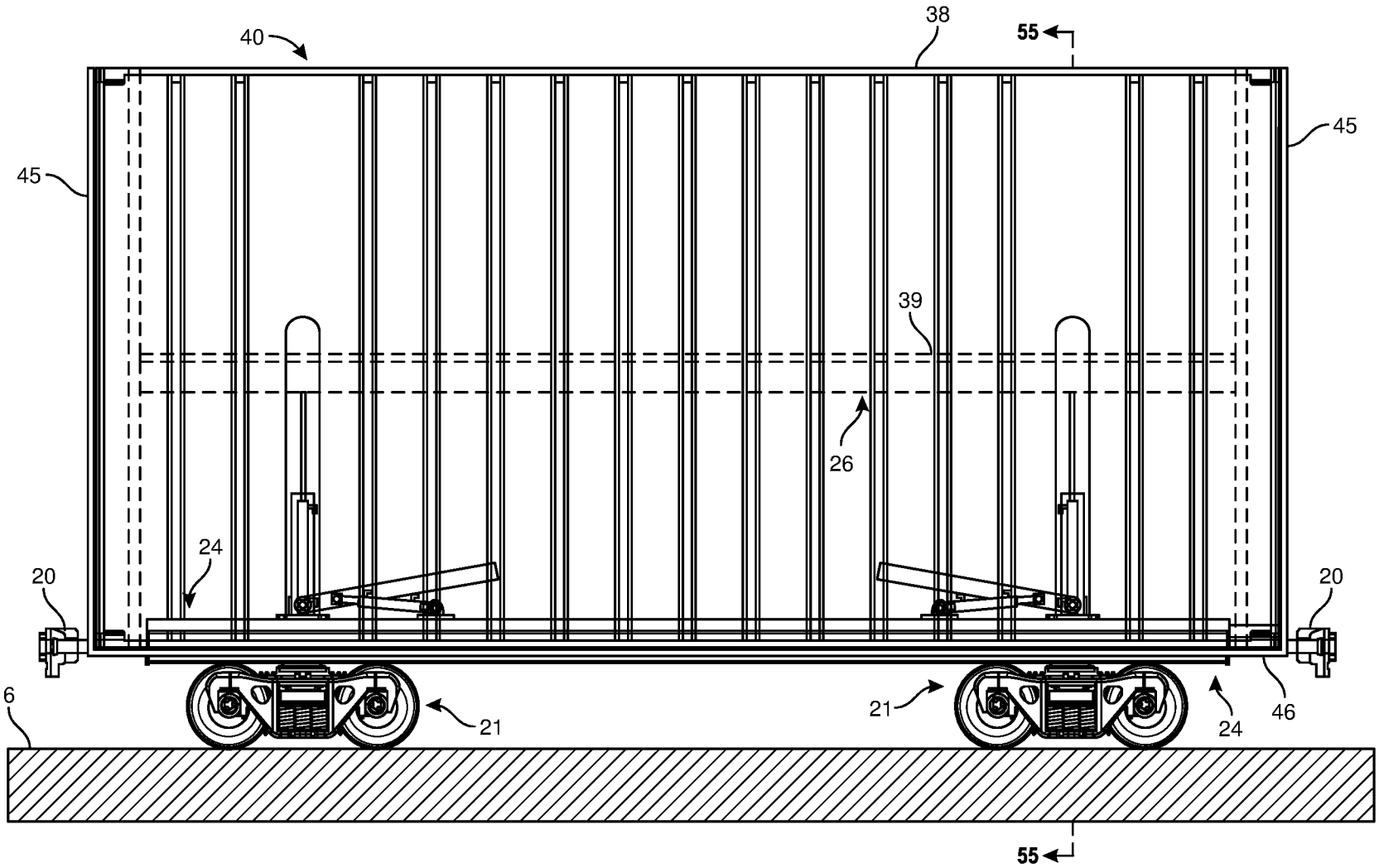
FIG. 56 shows a semi-transparent side view of the railcar in the WBA vertical motion enabled mode, where the WBA is in the raised position, according to embodiments of this disclosure.
Figure 57:
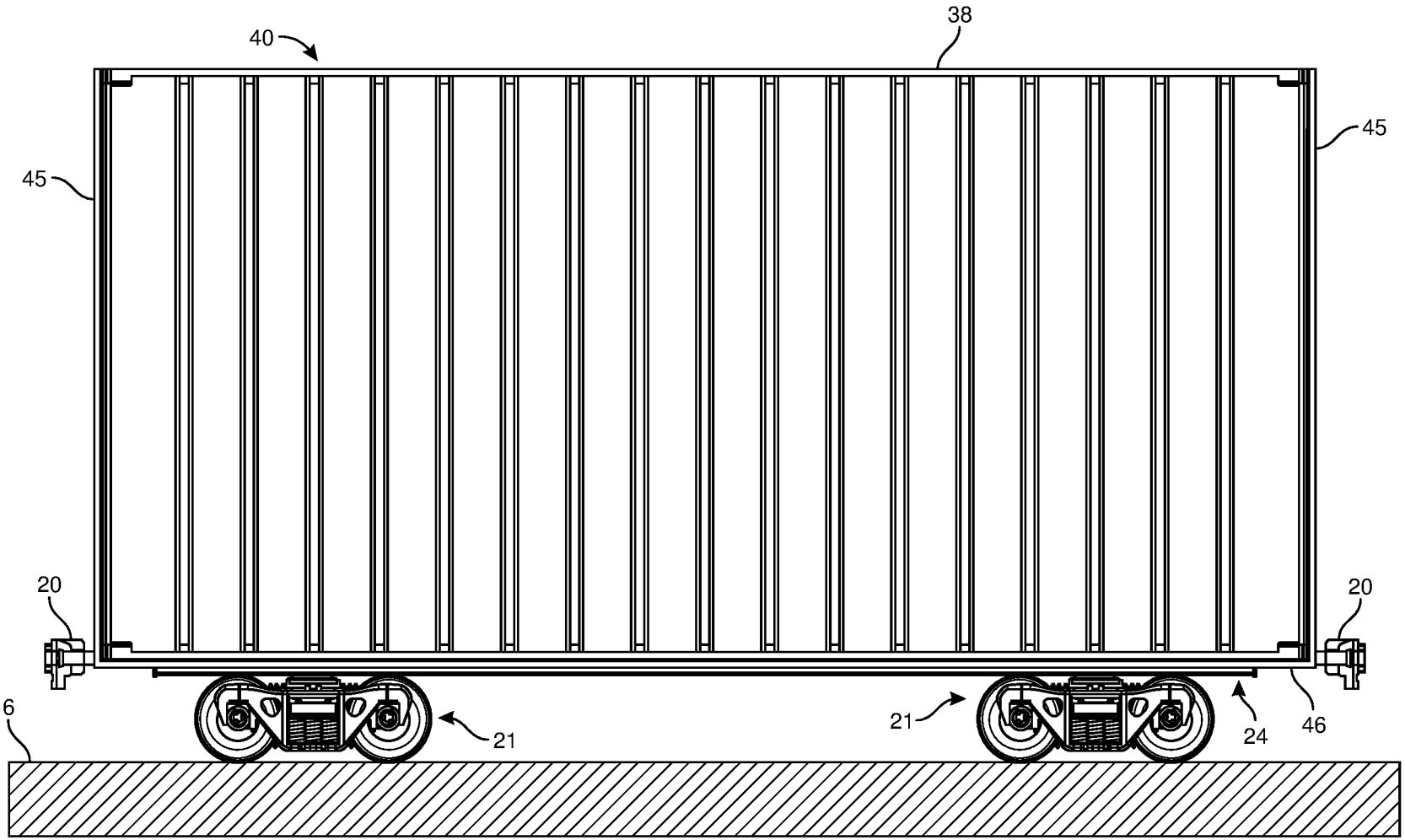
FIG. 57 shows a side view of the railcar in the WBA vertical motion enabled mode, where the WBA is in the raised position, according to embodiments of this disclosure.

FIG. 56 shows a semi-transparent side view of the railcar shown in FIG. 55, where the interlocking beams 56 are in a lowered position and the WBA 40 is vertically suspended by the WBA VPCCs 57. With the interlocking beams 56 fully lowered, the WBA VPCCs 57 can vertically raise or lower the WBA 40 without vertical mechanical restrictions, other than the mechanical restrictions that may be imposed by the WBA 40 landing on top of a planar surface 6 or on top of the service/safety blocks 58. FIG. 57 shows an opaque side view of the railcar shown in FIG. 56, where the railcar has an outward appearance similar to, but not necessarily identical to, a conventional gondola railcar, except that the bottom of the WBA 40 may ride slightly higher than a conventional height of a gondola railcar sidewall above the railroad track 4.

Figure 58:
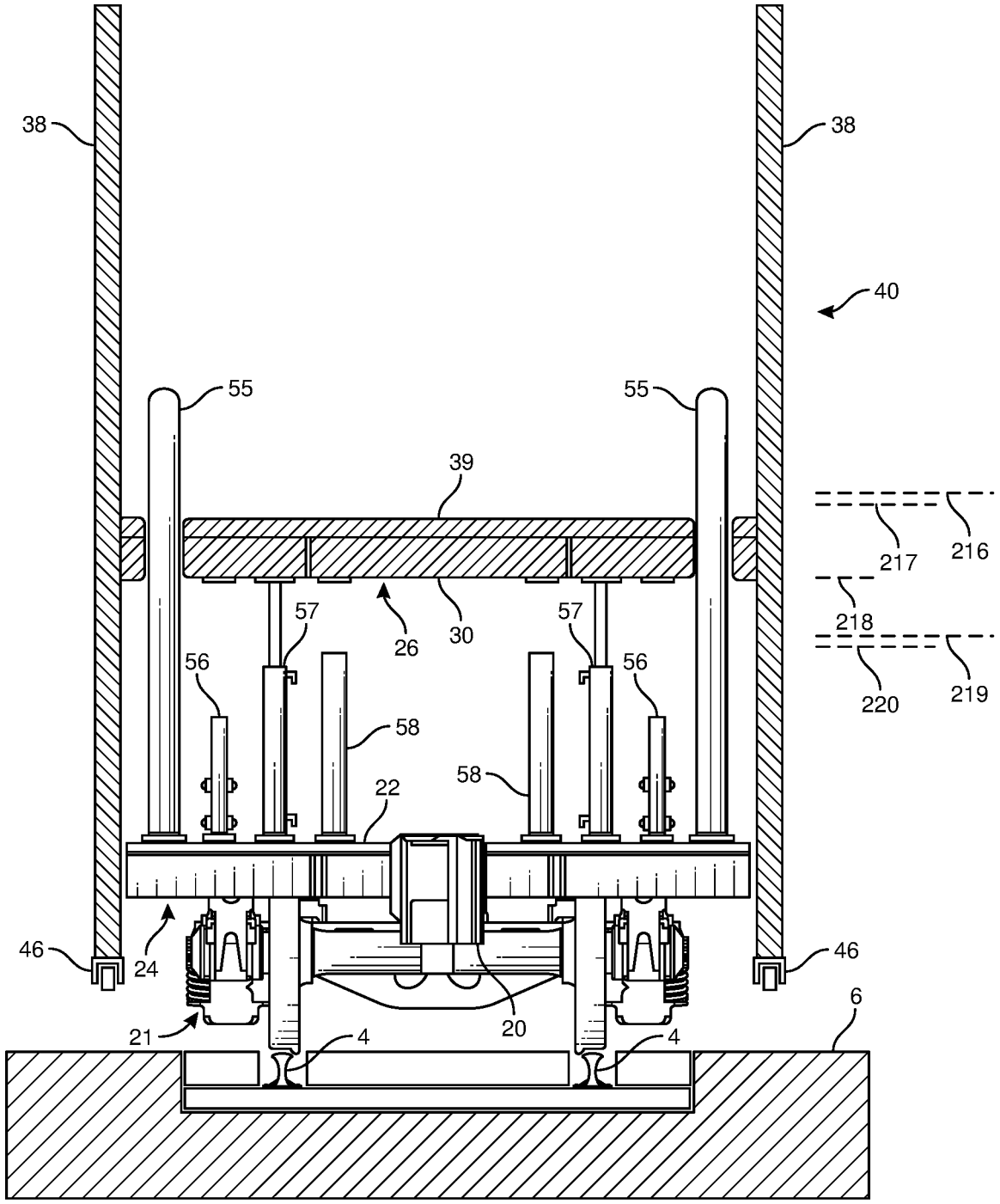
FIG. 58 shows a cross-sectional end view, taken at line 58-58 of FIG. 59, of the railcar in the WBA vertical motion enabled mode, where the WBA is lowered halfway down to ground level, according to embodiments of this disclosure.
Figure 59:
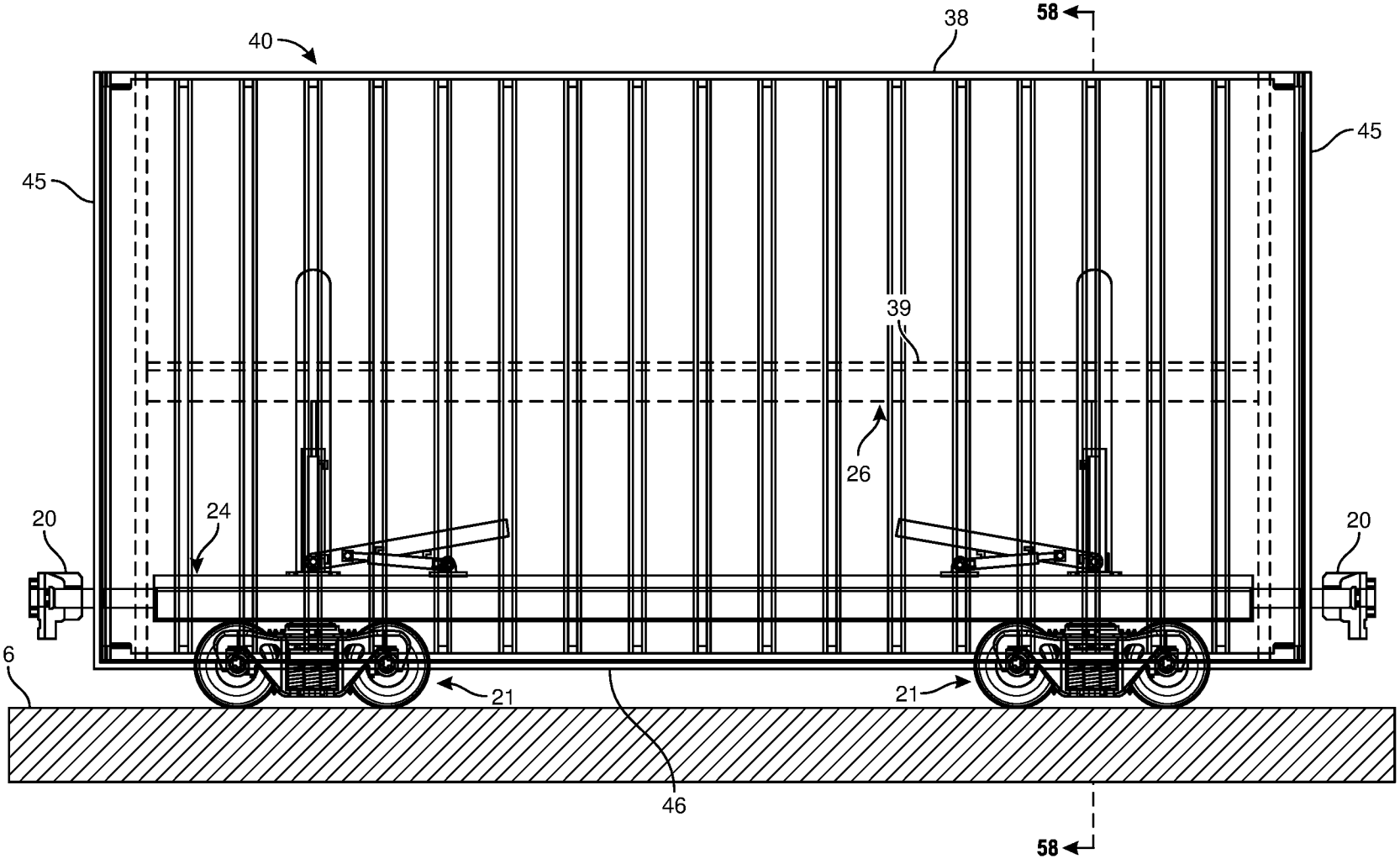
FIG. 59 shows a semi-transparent side view of the railcar in the WBA vertical motion enabled mode, where the WBA is lowered halfway down to ground level, according to embodiments of this disclosure.
Figure 60:
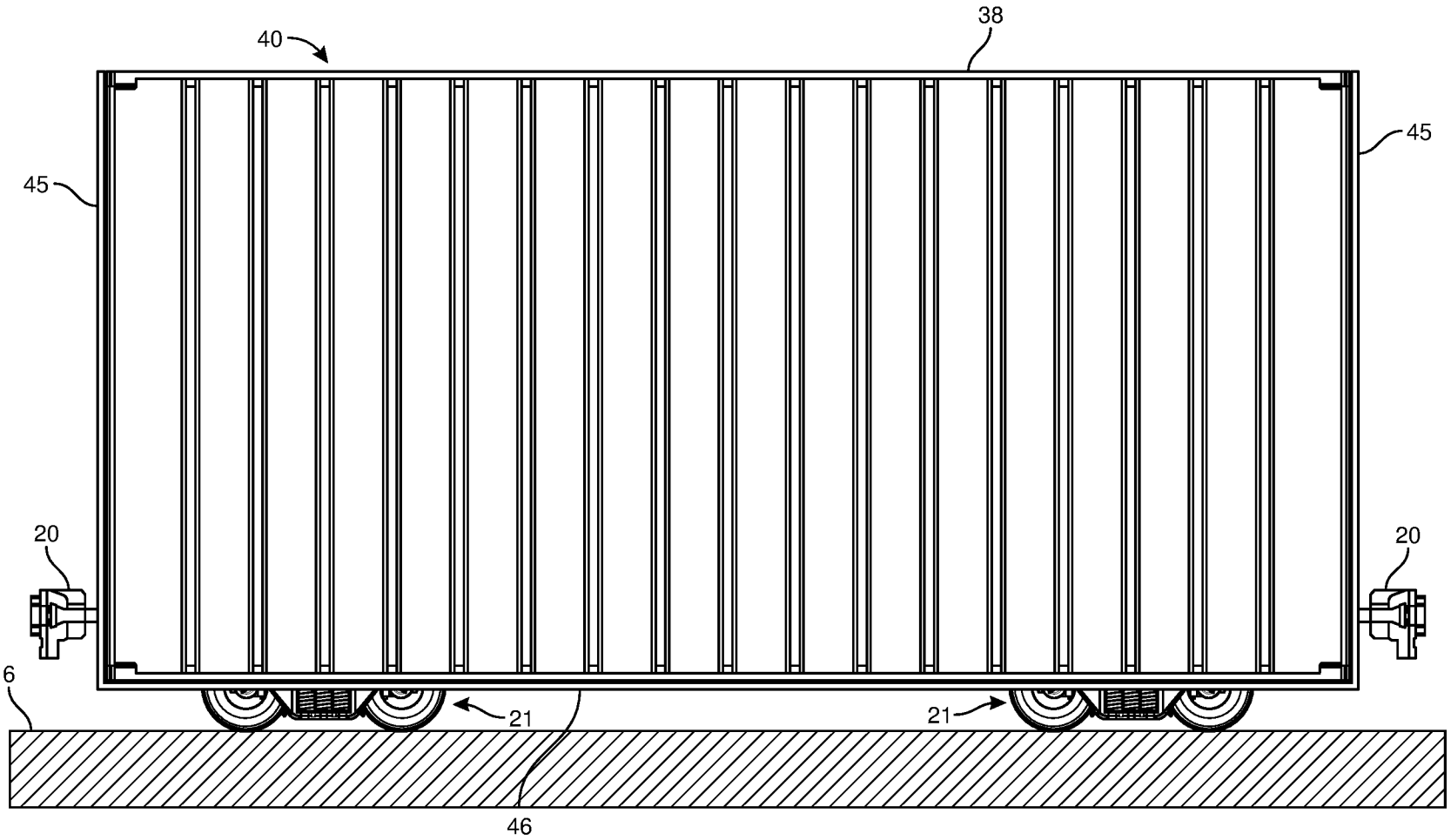
FIG. 60 shows a side view of the railcar in the WBA vertical motion enabled mode, where the WBA is lowered halfway down to ground level, according to embodiments of this disclosure.

FIG. 58 shows a cross-sectional end view of the railcar in the WBA vertical motion enabled mode, where the interlocking beams 56 are in their lowered positions and the WBA VPCCs 57 have positioned the WBA underframe 26 at a mid-level 218, approximately halfway between its highest level 216 and its lowest level 220. FIG. 59 shows a semi-transparent side view of the railcar shown in FIG. 58, where the interlocking beams 56 are in their lowered positions and the WBA VPCCs 57 have positioned the WBA underframe 26 at a mid-level 218, approximately halfway between its highest level 216 and its lowest level 220. FIG. 60 shows an opaque side view of the railcar shown in FIG. 59, where the railcar has an outward appearance similar to, but not necessarily identical to, a conventional gondola railcar, except that the bottom of the WBA 40 may be positioned substantially closer to ground level than a conventional gondola railcar sidewall, to a position where the views of the BTPS trucks 21 are partially hidden by the WBA sidewall 38.

Figure 61:
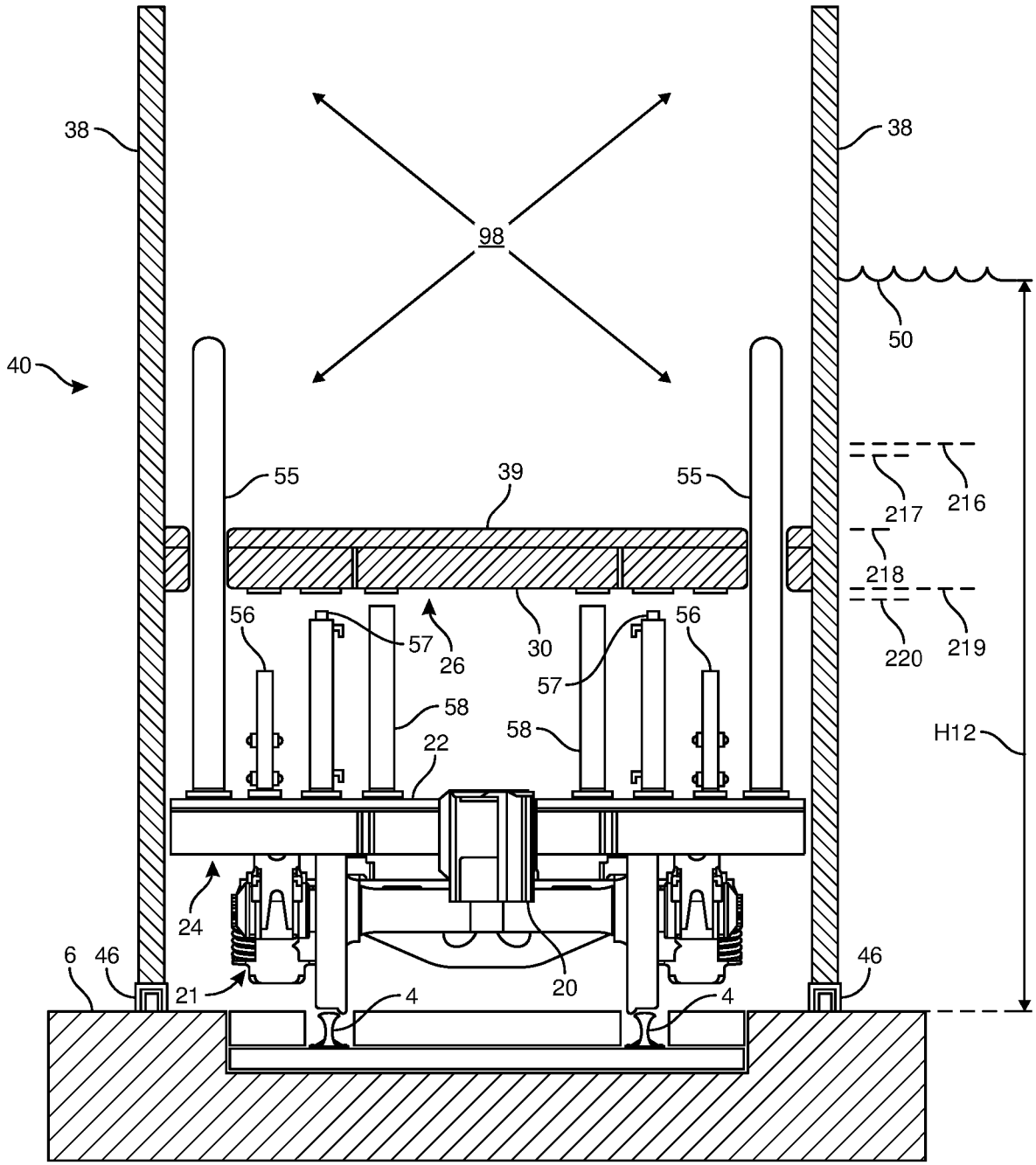
FIG. 61 shows a cross-sectional end view, taken at line 61-61 of FIG. 62, of the railcar in a WBA deployed mode, according to embodiments of this disclosure.
Figure 62:
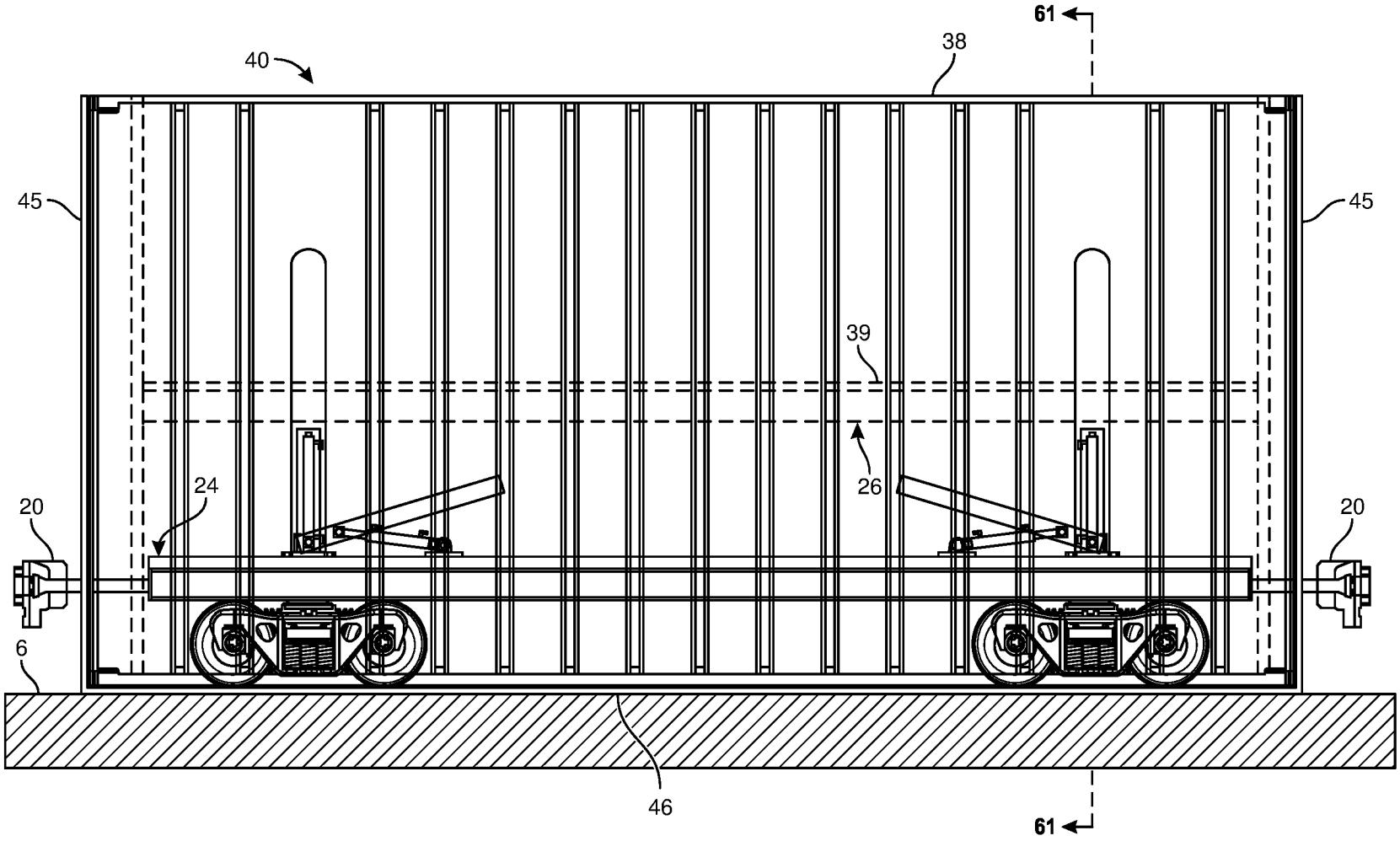
FIG. 62 shows a semi-transparent side view of the railcar in the WBA deployed mode, according to embodiments of this disclosure.
Figure 63:
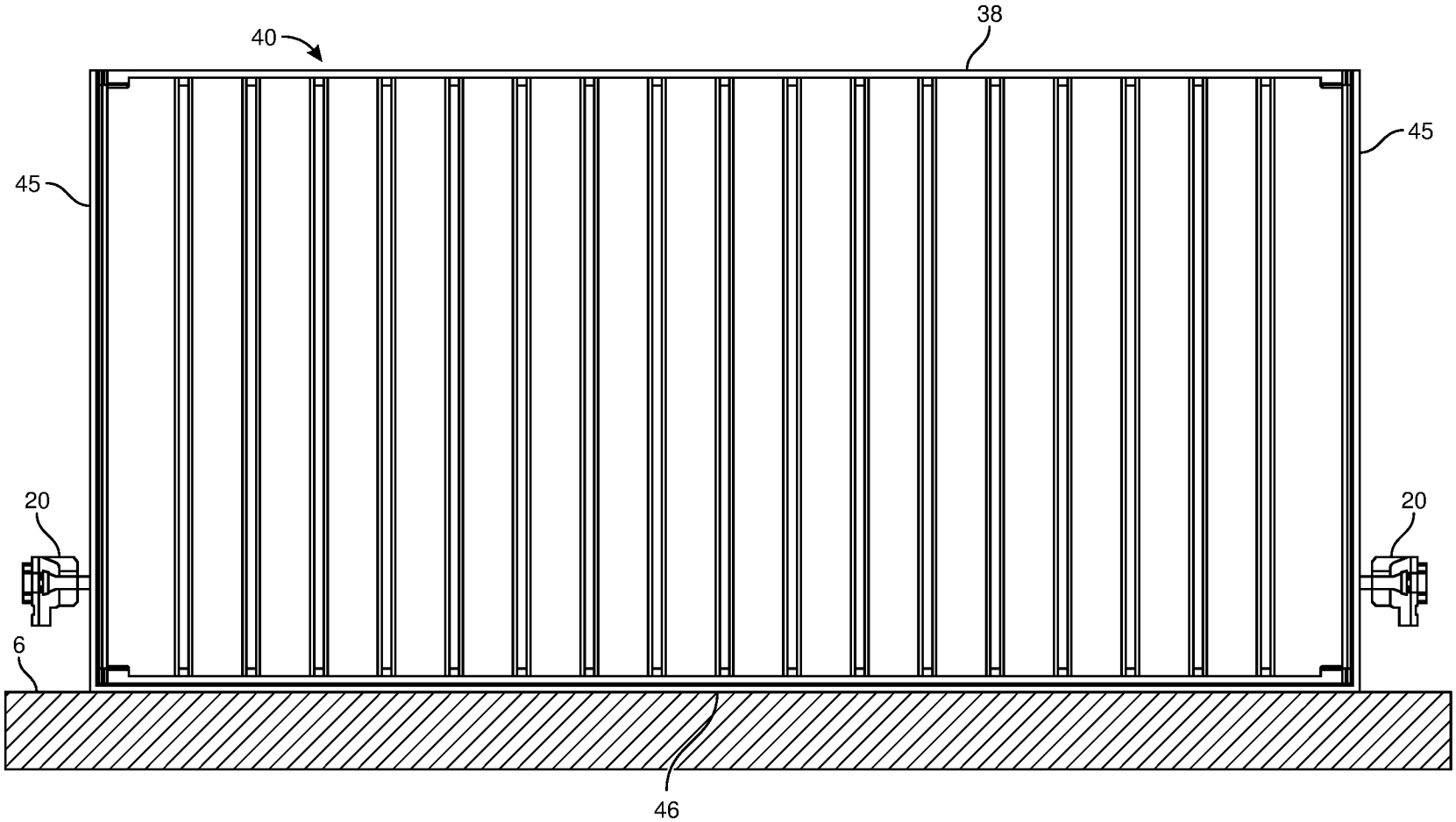
FIG. 63 shows a side view of the railcar in the WBA deployed mode, according to embodiments of this disclosure.

FIG. 61 shows a cross-sectional end view of the railcar positioned at its target location where the railcar is in a WBA deployed mode. In the WBA deployed mode, the interlocking beams 56 and WBA VPCCs 57 may be in their fully lowered positions, and the WBA 40 may be positioned on top of the planar surface 6 to create a water-resistant or water-tight seal between the bottom gasket 208 and the planar surface 6. The WBA underframe 26 may be positioned at a level 219, which may result in air gaps between the top of the piston rods of the WBA VPCCs 57 and the WBA VPCC strike plates 36, as well as air gaps between the top of the service/safety blocks 58 and the service/safety block strike plates 37. FIG. 62 shows a semi-transparent side view of the railcar shown in FIG. 61, where the interlocking beams 56 and WBA VPCCs 57 may be in their fully lowered positions, and where the WBA 40 has landed on top of the planar surface 6 to create a water-resistant or water-tight seal between the bottom gasket 208 and the planar surface 6. FIG. 63 shows an opaque side view of the railcar shown in FIG. 62, where the railcar may have an outward appearance of a water barrier on top of a solid (e.g., concrete) structure.

Figure 64:
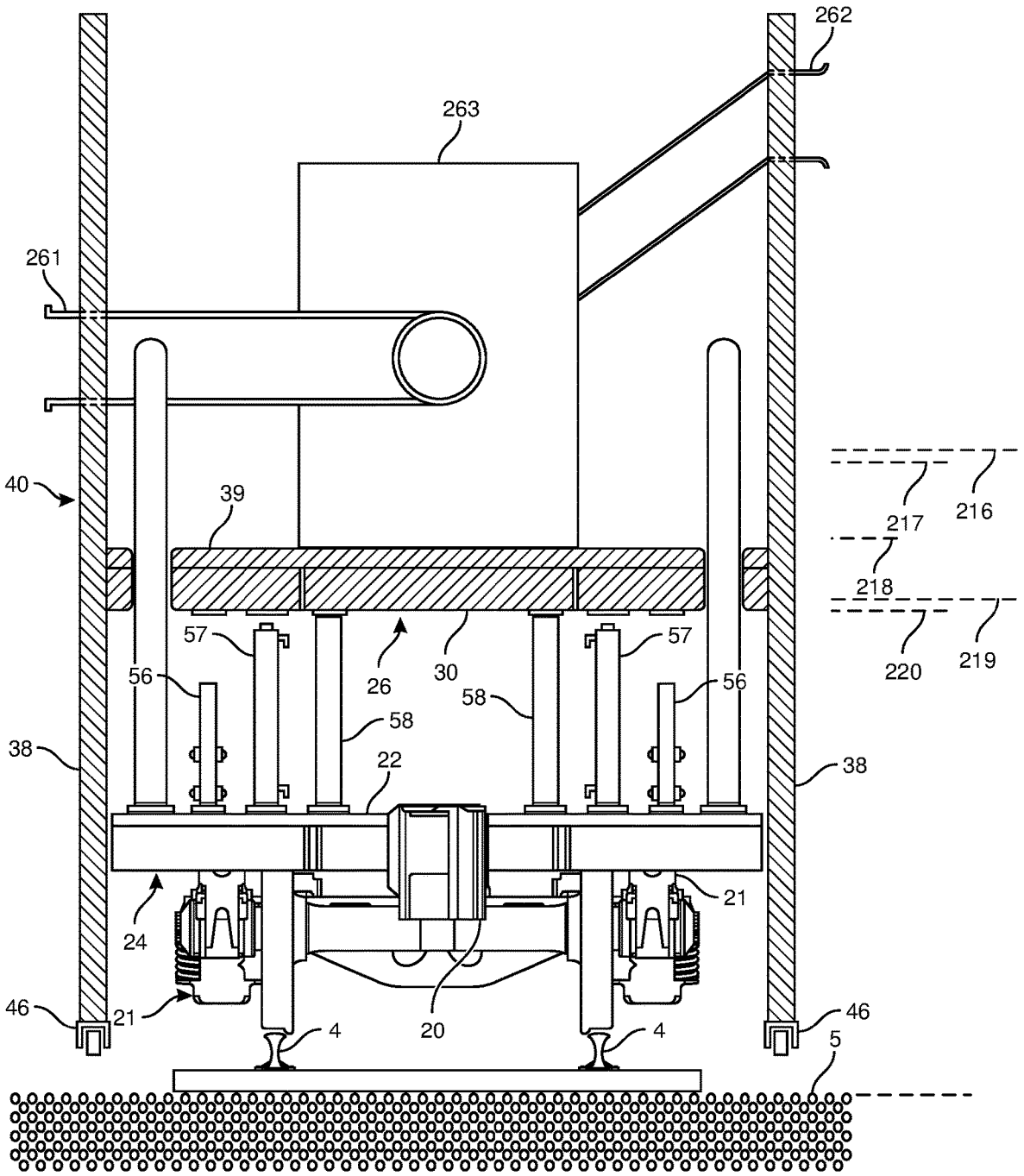
FIG. 64 shows a cross-sectional end view, taken at line 64-64 of FIG. 65, of the railcar with a water pump system and the railcar in a WBA service/safety mode, according to embodiments of this disclosure.
Figure 65:
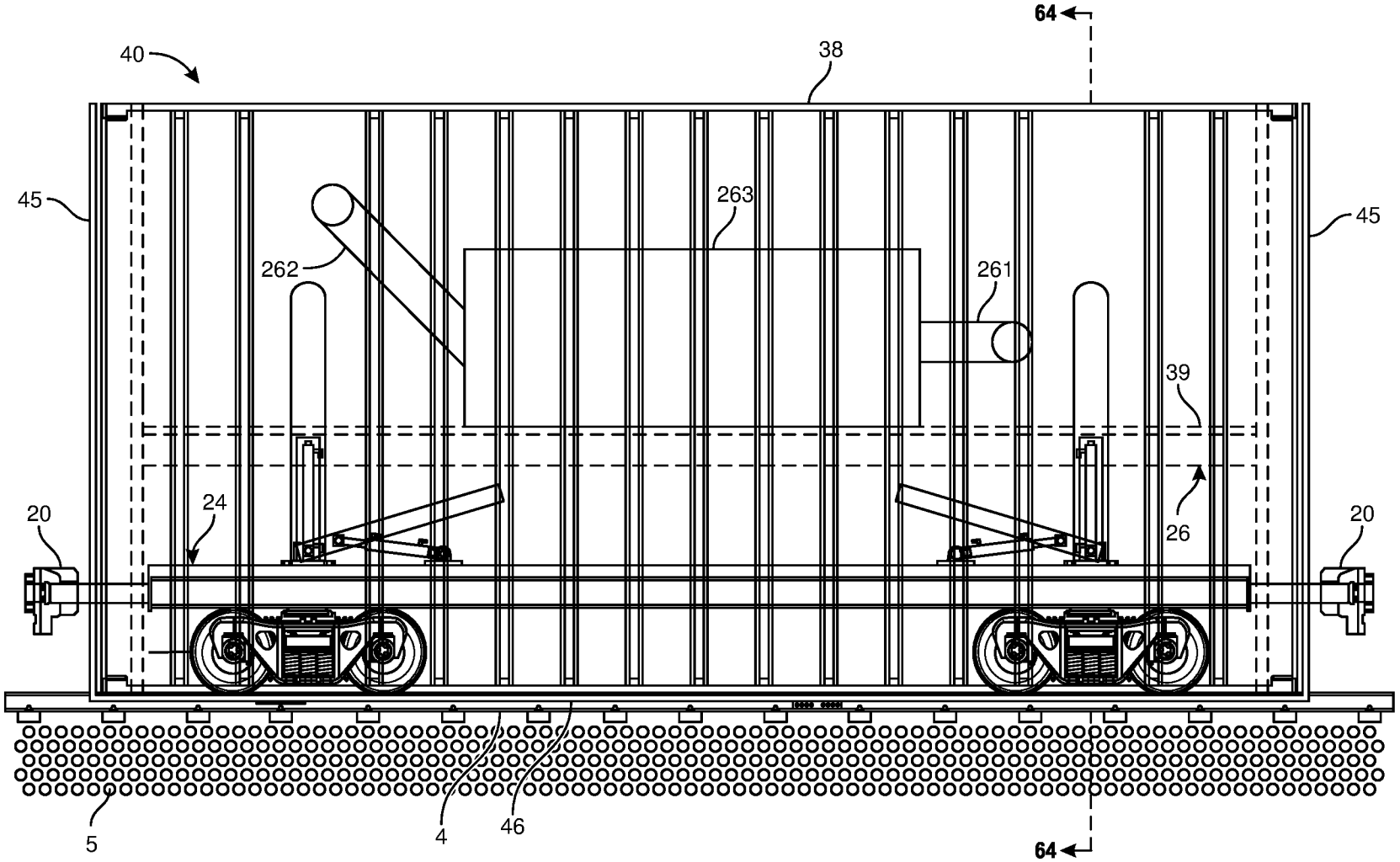
FIG. 65 shows a semi-transparent side view of the railcar with a water pump system and the railcar in the WBA service/safety mode, according to embodiments of this disclosure.
Figure 66:
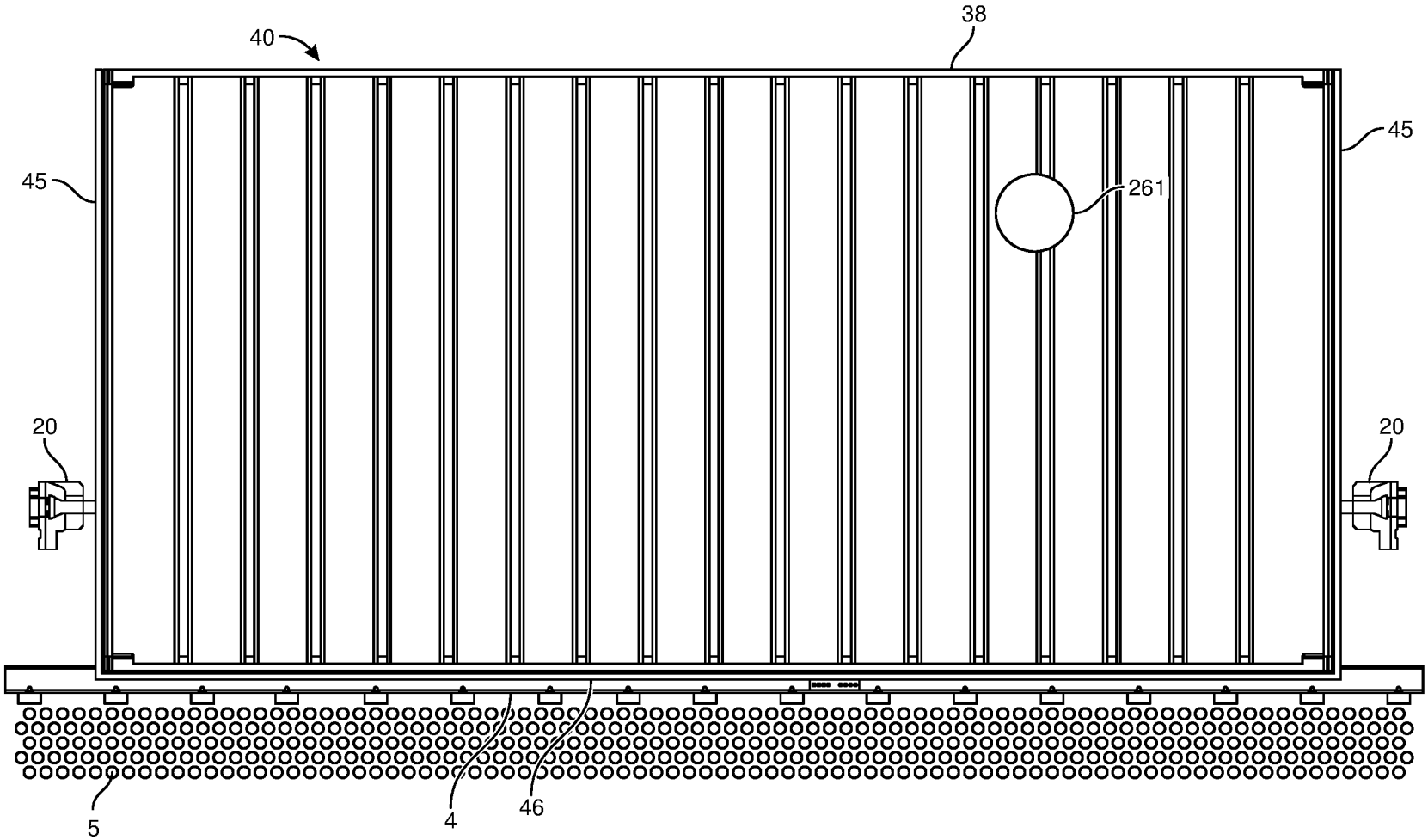
FIG. 66 shows a side view of the railcar in the WBA service/safety mode with the water pump system's intake pipe positioned on the sidewall, according to embodiments of this disclosure.

FIG. 64 shows a cross-sectional end view of the railcar in the WBA service/safety mode. In the WBA service/safety mode, the interlocking beams 56 and WBA VPCCs 57 may be in their fully lowered position and the WBA underframe 26 may be positioned on top of the service/safety blocks 58. The WBA service/safety mode can occur intentionally, such as when an emergency field service is required on the railcar, or unintentionally, such as when there has been a failure of both the interlocking beams 56 and the WBA VPCCs 57, and/or systems that control them. FIG. 65 shows a semi-transparent side view of the railcar shown in FIG. 64, where the interlocking beams 56 and WBA VPCCs 57 may be in their fully lowered position and the WBA underframe 26 may be positioned on top of the service/safety blocks 58. FIG. 66 shows an opaque side view of the railcar shown in FIG. 65, where the railcar may have an outward appearance similar to, but not necessarily identical to, a conventional gondola railcar, except that the bottom of the WBA 40 may be close to the railroad bed 5.

During a hurricane, torrential rains can overwhelm municipal storm drain systems, causing flooding and substantial land inundation. To reduce or eliminate problems caused by such flooding, a water pump system 263 (components of which are shown in FIGS. 64-66, 79, 80 and 117) may optionally be added to the disclosed systems to draw excess water from storm drains. FIG. 64 illustrates an end view of the water pump system 263 positioned on the WBA floor 39. The pump's intake pipe 261 and discharge pipe 262 pass through opposing sidewalls 38 of the WBA 40. FIG. 65 shows a side view of the water pump system 263. The pump intake pipe 261 and pump discharge pipe 262 are connected to the water pump system 263. FIG. 66 shows a side view of the sidewall 38, with the pump intake pipe 261 emerging through the sidewall 38. The pump discharge pipe 262 emerges through the sidewall 38 on the opposite side of the WBA 40 in a similar manner.

Figure 79:
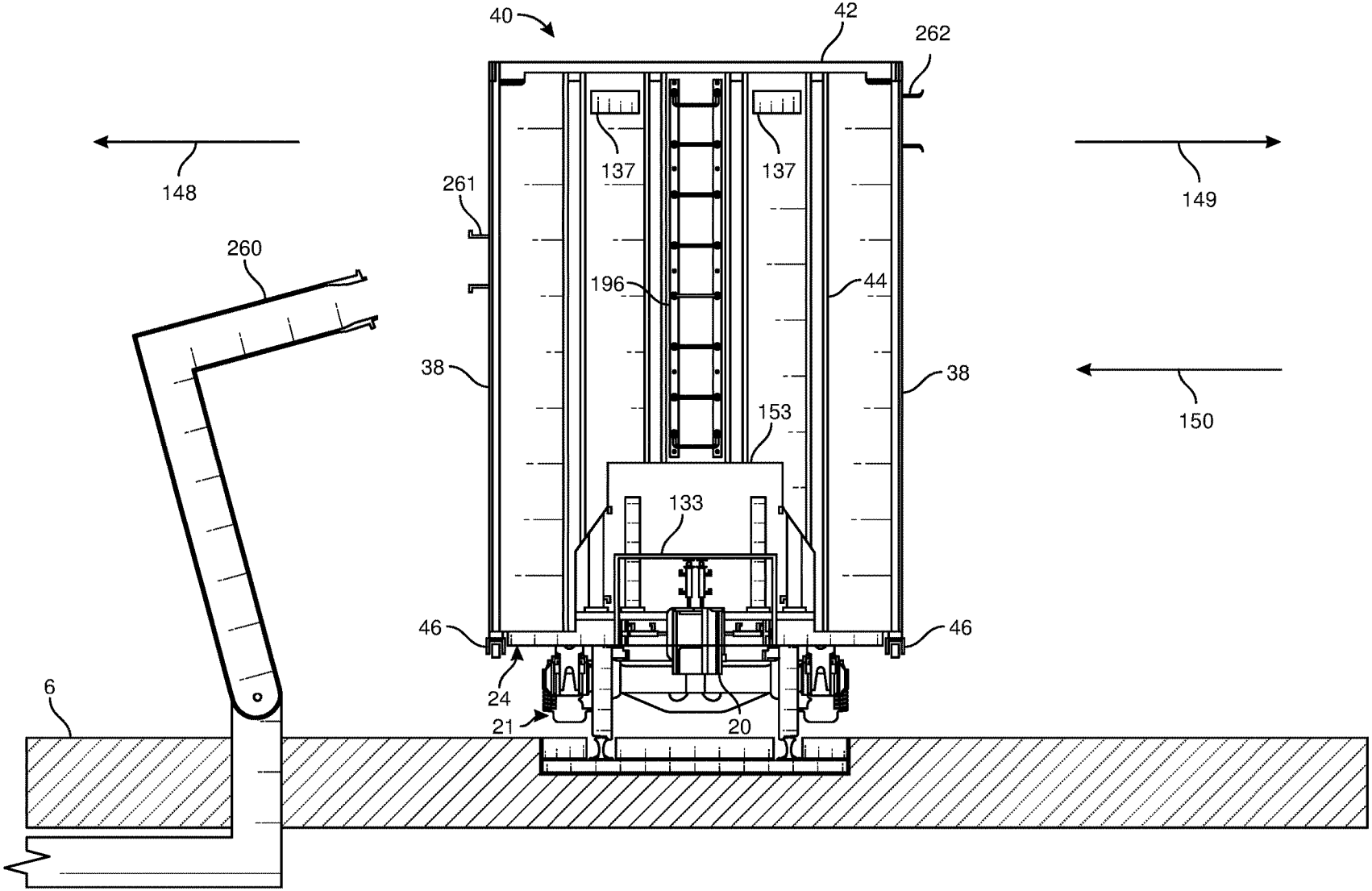
FIG. 79 shows an end view of the railcar with a raised WBA and having sidewalls through which pump piping emerges, wherein the end wall is constructed to accommodate the physical structure of the cylinder mounting frame that may be attached to the BTPS, according to embodiments of this disclosure.
Figure 80:
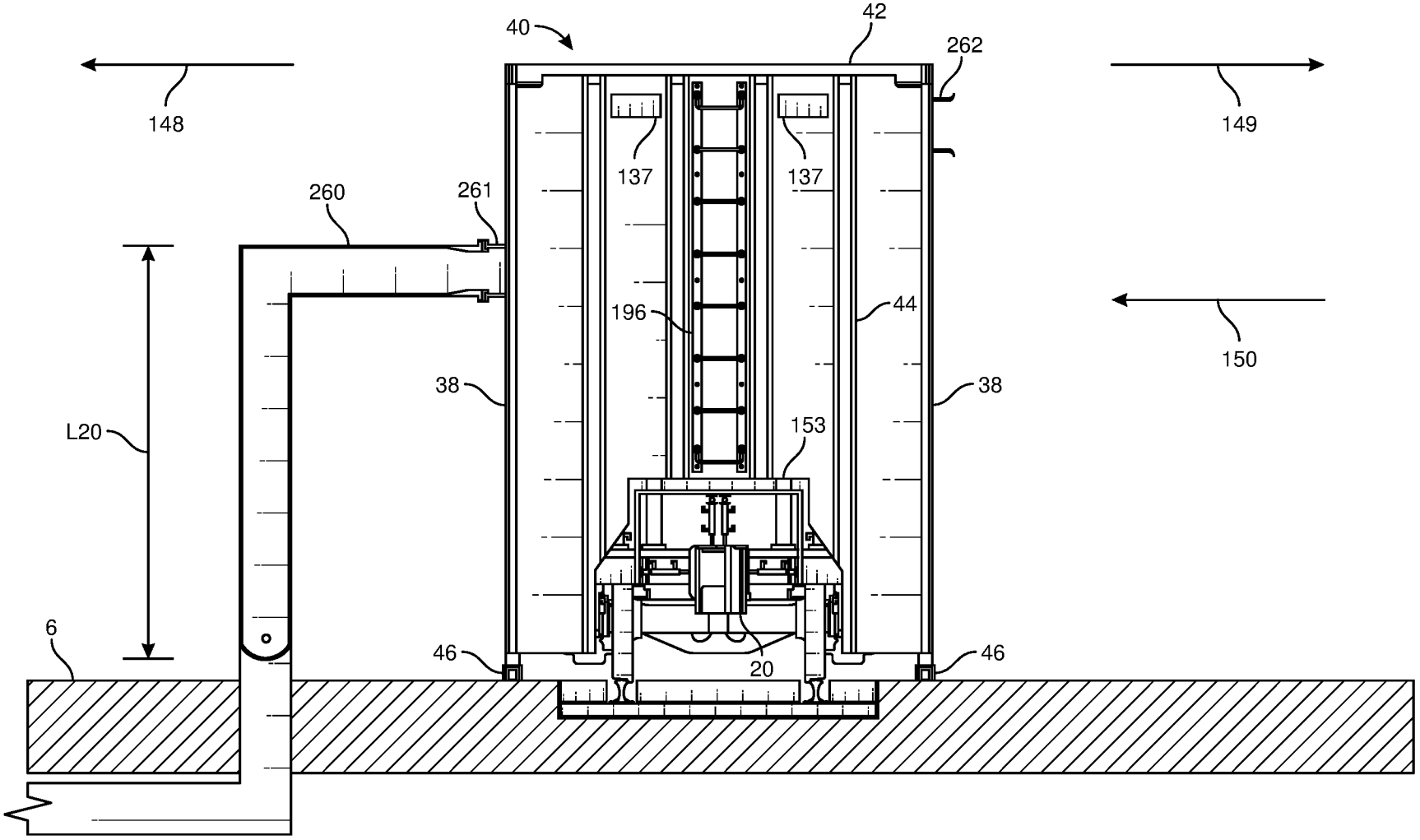
FIG. 80 shows an end view of the railcar with a lowered WBA having sidewalls with pump piping emerging through them and showing a cylinder mounting frame fitting within the endwall's physical structure, according to embodiments of this disclosure.

FIG. 79 shows the WBA 40 at its target destination in the transportation mode. A storm drain draw pipe 260 is illustrated in a disengaged position. FIG. 80 shows the WBA 40 in the WBA deployed mode, with the storm drain draw pipe 260 in an engaged position, connected to the pump intake pipe 261. An opposite end of the storm drain draw pipe 260 is connected to a municipal storm drain system such that the pipe can draw water from the storm drain system. When the water pump system 263 is activated, the water pump system 263 may pull storm drain water through the storm drain draw pipe 260 and the pump intake pipe 261 and into the water pump system 263. The water pump system 263 may then discharge the storm drain water through the pump discharge pipe 262, such as to deposit the storm drain water on the ocean side 149 of the WBA 40. As an option, the pump discharge pipe 262 may include a connector to attach a longer discharge pipe or hose as needed. As an option, water next to the WBA 40 and above ground level can be drawn into the pump by providing a shorter storm drain draw pipe 260, such as to a length L20 (FIG. 80) above the ground level. Optionally, a water channel provided by such a shorter storm drain draw pipe 260 of length L20 may be made as an integral part of, or connected to, the sidewall 38.

The water pump system 263 can also be used to flood or purge water from the WBA upper section 98. To flood the WBA upper section 98, the pump intake pipe 261 and storm drain draw pipe 260 (e.g., of length L20) may be positioned on either WBA sidewall 38 next to a water source. The pump discharge pipe 262 may be mechanically reconfigured to discharge water into the WBA upper section 98. Vertical guide rail covers 187, shown in FIG. 120, may be installed and the WBA upper section 98 sidewall 38 and floor 39 construction may be configured to be water proof, to the extent necessary to hold water in the WBA upper section 98 as desired. To purge water from the WBA upper section 98, the pump intake pipe 261 may be mechanically configured to draw water from the WBA upper section 98 and the pump discharge pipe 262 may be mechanically configured to discharge the water outside either sidewall 38, as represented in FIG. 80.

The water pump system 263 may be manually operated or operated by computer control. For example, a series of manually operated or computer-controlled valves may be provided to select a water source to the water pump system 263 and a destination for water flow from the water pump system 263 to perform the flooding or purging functions as described above. The water pump system 263 may be driven by an engine or electric motor, either of which may be waterproofed to the extent necessary for reliable operation. If driven by an electric motor, the electrical power may be provided by internal or external sources. Potential example internal electrical power sources include an onboard electric power generator, a battery, or a locomotive connected through the resource coupler 54. Example external electrical power sources include a municipal power supply, an external electric power generator, or a locomotive 189 positioned near the water pump system 263.

Having discussed the five modes relating to the regulation of the vertical position of the WBA 40, we will now discuss the mode relating to regulating the horizontal position of the WBA 40, referred to as the "barrier assembly mode."

Figure 67:
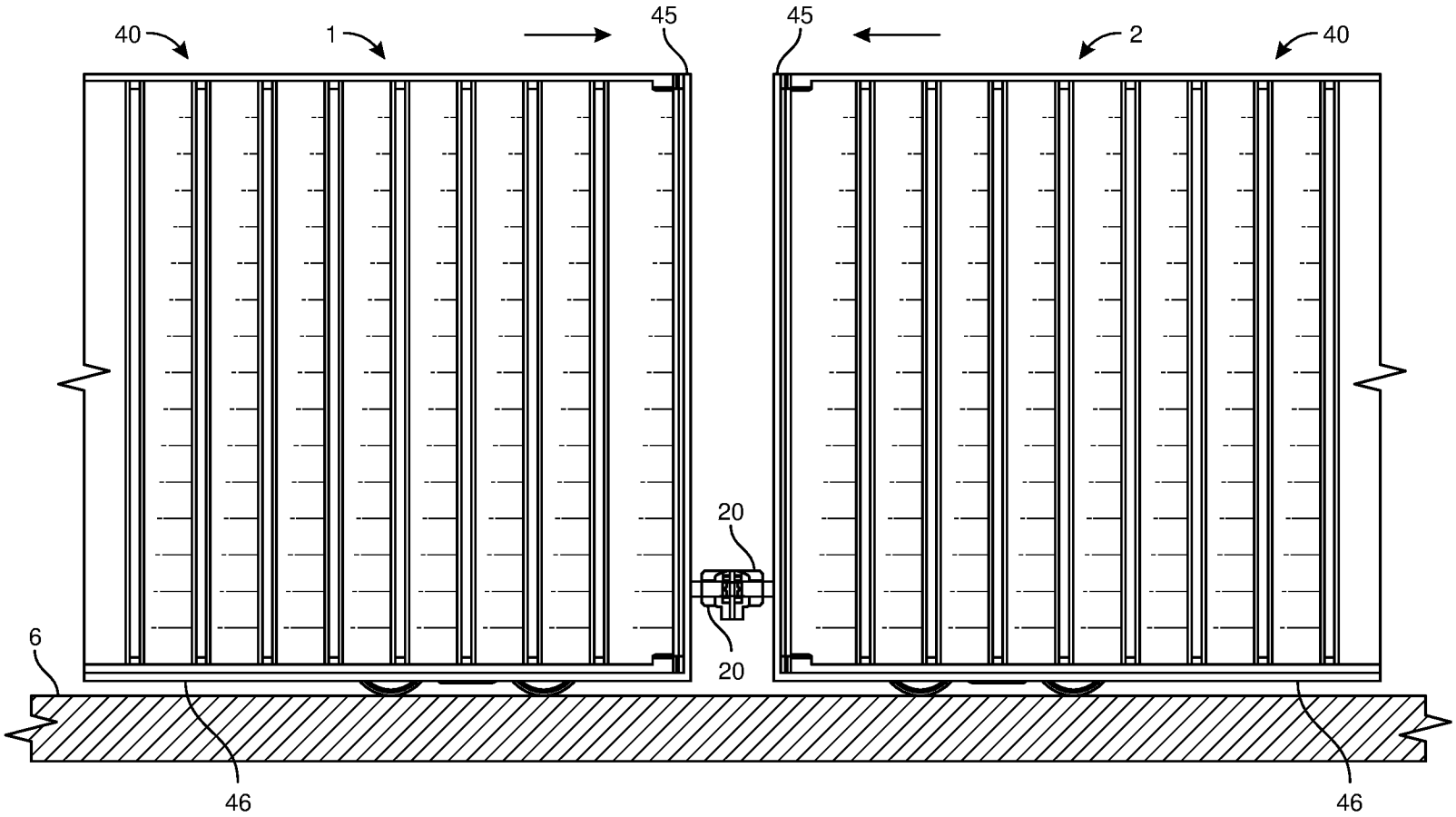
FIG. 67 shows a side view of two railcars that are at least partially lowered prior to being drawn together, according to embodiments of this disclosure.

In the barrier assembly mode, the controlling computer system 104 may operate controlling cylinders to draw adjacent connected railcars together, such as until the side gaskets 49 contact each other and create a water-resistant or water-tight seal between them. FIG. 67 shows a side view of two railcars 1 and 2 prior to the mutual contact of the side gaskets 49 that are part of the WBA side GHAs 45, as discussed above. While the WBA 40 is shown as partially lowered, the operation of translating the railcars 1 and/or 2 toward each other may occur while the WBA is in an upper position, in a lower position, in an intermediate position, or during a transition between the upper position and the lower position.

Figure 68:
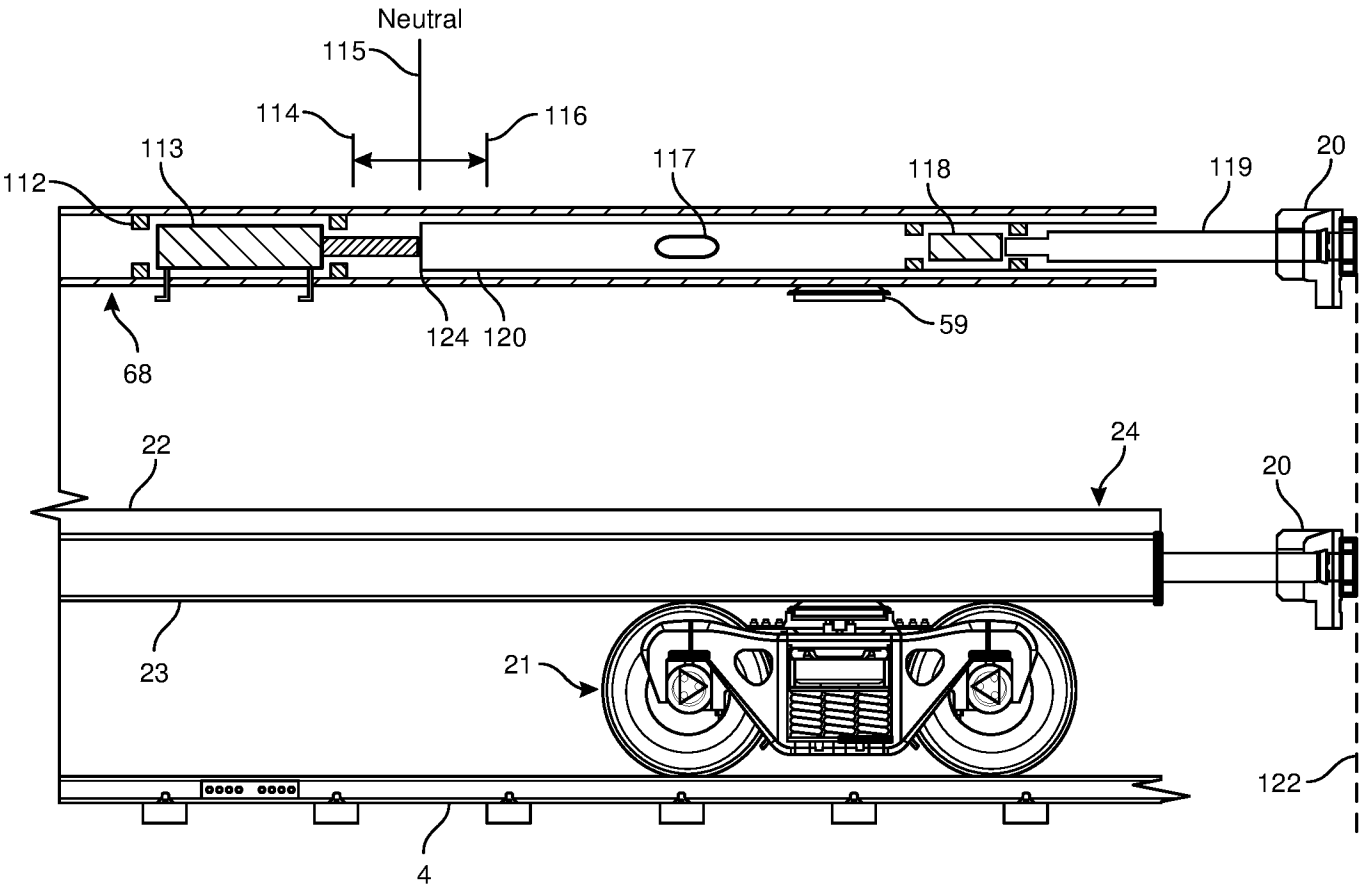
FIG. 68 shows a cross-sectional and side view of an inner sill controlling cylinder operating within a center sill assembly, where the inner sill controlling cylinder and connected railcar coupler is in a neutral position, according to embodiments of this disclosure.

FIG. 68 shows a cross-sectional and side view of a portion of the BTPS 24. The BTPS floor 22 may be attached to the top of the BTPS underframe 23. The BTPS underframe 23 may be connected to the top of the BTPS truck 21. The BTPS truck 21 may be positioned on top of the railroad track 4. The components positioned on top of the BTPS floor 22 are not shown in FIG. 68 for clarity. The BTPS 24 may include a railcar coupler 20 connected to the center sill, which cannot be seen in the side view of the BTPS 24, however, illustrated above the BTPS 24 is a cross-sectional view of the BTPS center sill 68 assembly to view internal components of the BTPS 24 below. An inner sill controlling cylinder 113 may be positioned within the BTPS center sill 68 assembly. The inner sill controlling cylinder 113 may be operated by the controlling computer system 104 described above. The inner sill controlling cylinder 113 may be attached to the inner sill 120 at the rod/sill connection point 124. The inner sill 120 may also contain a draft dear/yoke assembly 118 that may be connected to the coupler shank 119. The coupler shank 119 may exit the BTPS draft gear pocket 69 (shown and labeled in FIG. 28) and may end at the railcar coupler 20.

The inner sill 120 may slide within the BTPS center sill 68 along the longitudinal axis of the BTPS center sill 68. Inner sill controlling cylinder 113 may be locked into position by cylinder movement stop blocks 112. The inner sill controlling cylinder 113 may control the longitudinal position of the inner sill 120 relative to the BTPS center sill 68 and, by mechanical connection, the longitudinal position of the railcar coupler 20 relative to the BTPS center sill 68. In a first configuration scenario, the controlling computer system 104 has operated the inner sill controlling cylinder 113 such that the rod/sill connection point 124 is positioned at a neutral position 115, and, by mechanical connection, the railcar coupler 20 is also positioned at its neutral position 122.

Figure 69:
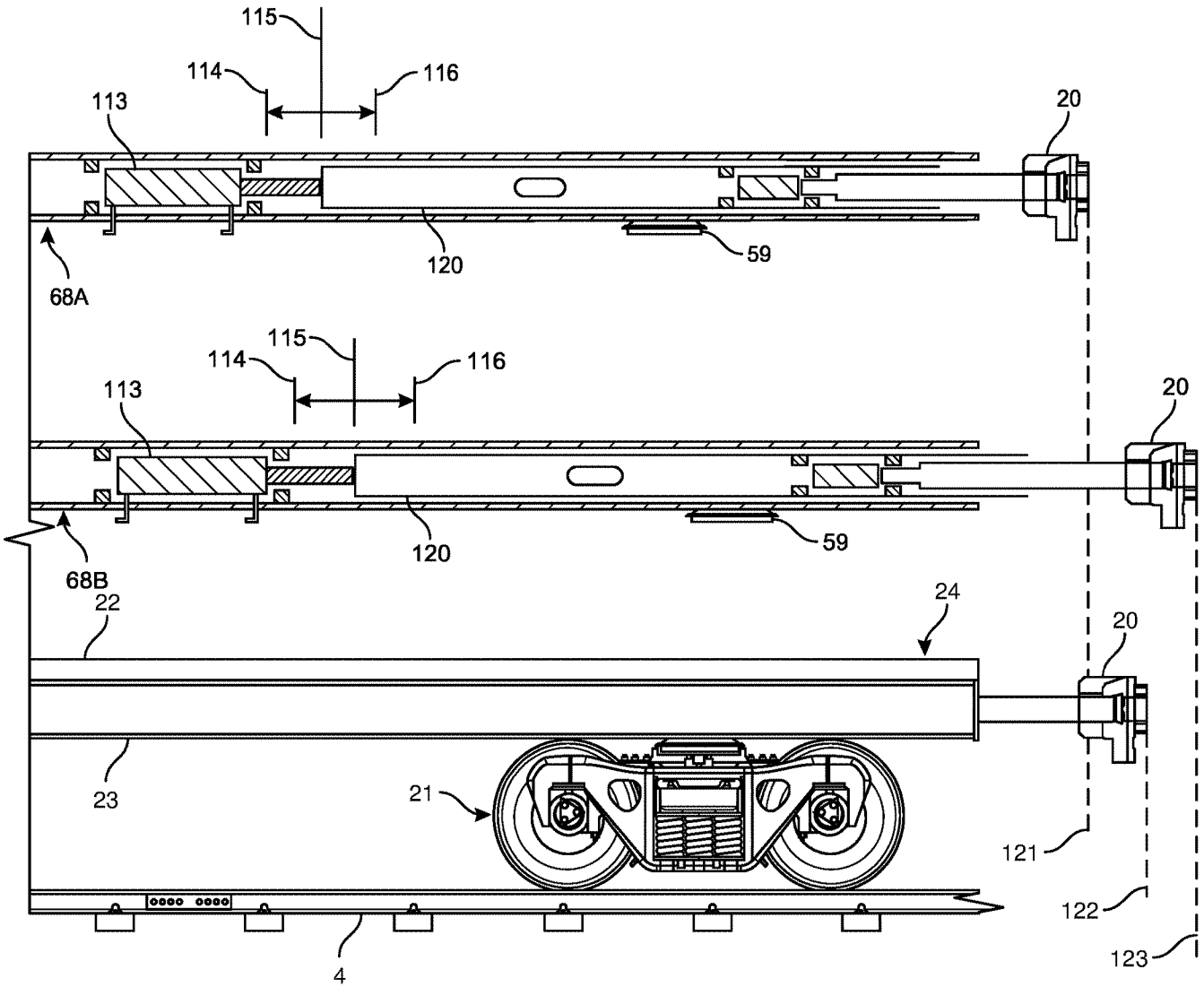
FIG. 69 shows cross-sectional views and a side view of the inner sill controlling cylinder operating within a center sill assembly in different positions, according to embodiments of this disclosure.

FIG. 69 shows, in a top portion of the drawing, a second configuration scenario, where the controlling computer system 104 has operated the inner sill controlling cylinder 113 within the center sill 68A such that the rod/sill connection point 124 is positioned at its maximum retracted position 114, and, by mechanical connection, the railcar coupler 20 is also positioned at its maximum retracted position 121. In a third configuration scenario, shown in a middle portion of FIG. 69, the controlling computer system 104 has operated the inner sill controlling cylinder 113 within the center sill 68B such that the rod/sill connection point 124 is positioned at its maximum extended position 116, and, by mechanical connection, the railcar coupler 20 is also positioned at its maximum extended position 123. The BTPS 24 at the bottom of FIG. 69, is identical to the BTPS 24 at the bottom of FIG. 68 and is provided in FIG. 69 as a visual reference for the railcar coupler 20 in its neutral position 122.

Three configuration scenarios have been explained, but it should be understood that the controlling computer system 104 may have the ability to operate the inner sill controlling cylinder 113, the rod/sill connection point 124, and the railcar coupler 20 to any desired position between its maximum retracted 114 and maximum extended 116 positions.

Referring again to FIG. 67, the controlling computer system's 104 ability to operate the inner sill controlling cylinder 113 to retract the railcar coupler 20 may horizontally draw the first railcar 1 and the second railcar 2 toward each other, until such a point that their respective side gaskets 49 contact and seal against each other. One or both of the railcars 1 and 2 may retract their respective railcar couplers 20 to draw the two railcars toward each other until they join. The inner sill controlling cylinders 113 may be sized such that the maximum retracted length from the neutral position, for any one inner sill controlling cylinder 113, may exceed a length necessary to draw the adjacent connected railcar together to make the necessary side gasket 49 contact and seal.

The modified BTPS center sill 68 assembly has been described in the context of being applied to one end of the BTPS 24. This modification (with the addition of the inner sill controlling cylinder) may also be provided on an opposite end of the BTPS 24. Therefore, each BTPS 24 may include two inner sill controlling cylinders 113 operated by the controlling computer system 104. Finally, the barrier assembly mode can also be used to separate railcars that may be joined at their side gaskets 49. For example, the controlling computer system 104 may be able to operate the inner sill controlling cylinders 113 to extend the positions of the railcar couplers 20 to their neutral positions 115, which may re-establish a distance between the WBAs 40 sufficient for operation in the transport mode.

As a locomotive moves a plurality of railcars on the railroad track 4, forces on the railcar couplers 20 may become high. Such forces may be caused by the physical actions of the connected railcars during starting, stopping, coupling, acceleration, and deceleration, which can result in high pushing and pulling forces (also referred to as "buffing and drafting") on the railcar couplers 20. Since the railcar couplers 20 may be mechanically connected to the inner sill controlling cylinders 113, any forces applied to the railcar couplers 20 may also be immediately applied to the inner sill controlling cylinders 113. To protect the inner sill controlling cylinders 113 from wear and potentially damaging forces, the BTPS 24 may be provided with inner sill locking mechanisms. When engaged, the inner sill locking mechanisms may mechanically lock the inner sills 120 to the outer BTPS center sill 68 and, as a result, may redirect forces on the railcar coupler 20 to the BTPS center sill 68 and away from the inner sill controlling cylinders 113.

Figure 70A:
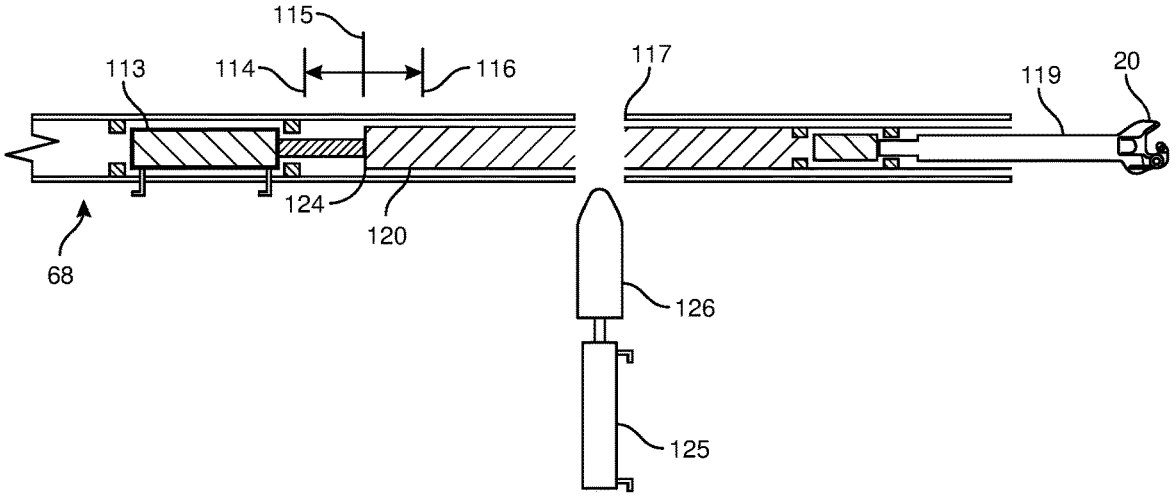
FIG. 70A shows a cross-sectional top view of an inner sill assembly, including a lock deadbolt controlling cylinder for locking and unlocking an inner sill from an outer sill, with the inner sill lock deadbolt in an unlocked position, according to embodiments of this disclosure.
Figure 70B:
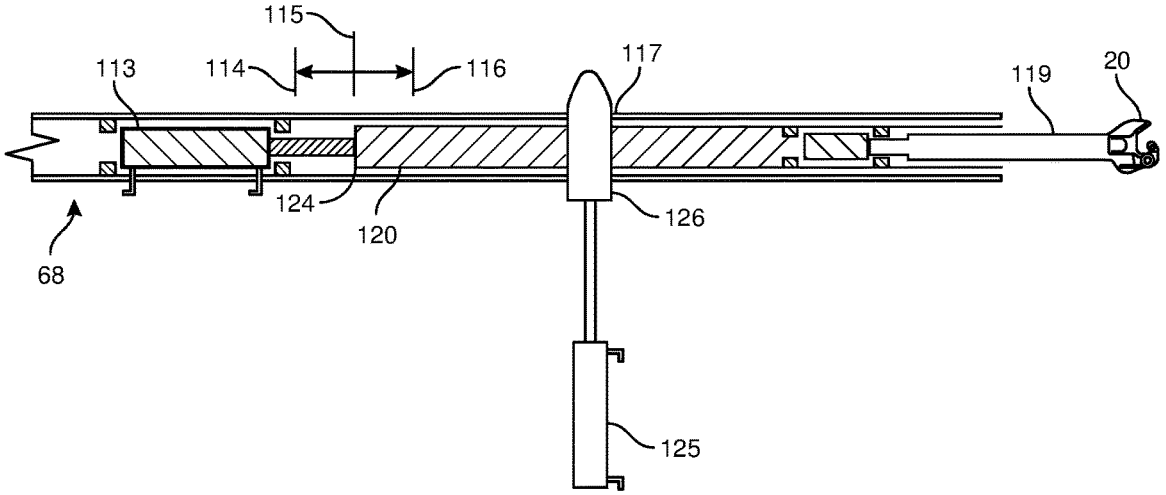
FIG. 70B shows a cross-sectional top view of the inner sill assembly of FIG. 70A, with the inner sill lock deadbolt in a locked position, according to embodiments of this disclosure.

FIG. 70A shows a cross-sectional top view of a BTPS center sill 68 assembly. The inner sill locking system may include an inner sill lock deadbolt controlling cylinder 125, an inner sill lock deadbolt 126, and sill deadbolt hole 117. The inner sill lock deadbolt controlling cylinder 125 may be connected to and may control the position of the inner sill lock deadbolt 126. The inner sill lock deadbolt controlling cylinder 125 may be operated by the controlling computer system 104. In the state shown in FIG. 70A, the inner sill lock deadbolt controlling cylinder 125 and inner sill lock deadbolt 126 have been operated to their fully retracted position. In this position, the inner sill lock deadbolt 126 may be disengaged from the sill deadbolt hole 117. With the inner sill lock deadbolt 126 out of the sill deadbolt hole 117, the inner sill 120 is free to slide within the BTPS center sill 68, as controlled by the inner sill controlling cylinder 113. The sill deadbolt hole 117 may be aligned and ready for insertion of the inner sill lock deadbolt 126 and locking when the rod/sill connection point 124 is positioned at its neutral position 115. The state shown in FIG. 70B illustrates the inner sill lock deadbolt controlling cylinder 125 and the inner sill lock deadbolt 126 having been operated to their fully extended position, where the inner sill lock deadbolt 126 is inserted into the sill deadbolt hole 117. With the inner sill lock deadbolt 126 inserted into the sill deadbolt hole 117, the inner sill lock deadbolt 126 may mechanically lock the inner sill 120 to the (outer) BTPS center sill 68 to transfer forces on the railcar coupler 20 to the BTPS center sill 68, instead of to the inner sill controlling cylinders 113.

Figure 71A:
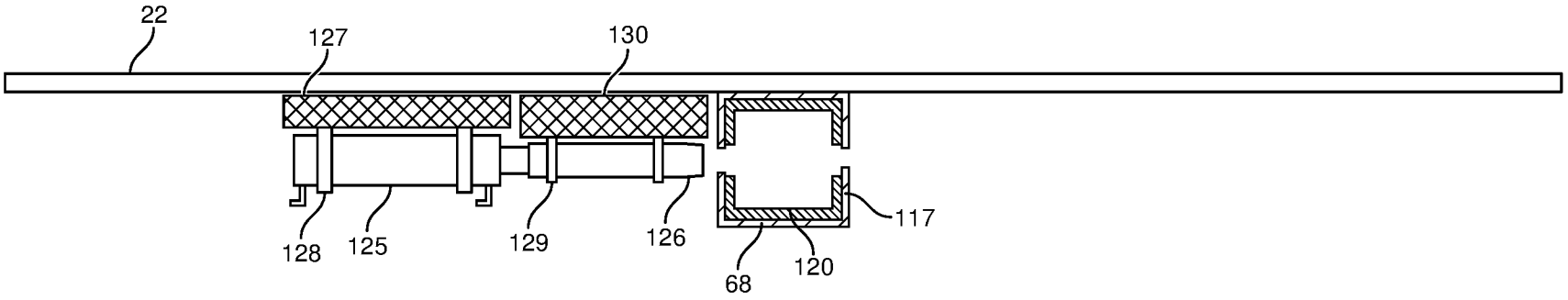
FIG. 71A shows a cross-sectional end view of an inner sill lock deadbolt controlling cylinder that may lock and unlock the inner sill from the outer sill, with the inner sill lock deadbolt in the unlocked position, according to embodiments of this disclosure.
Figure 71B:
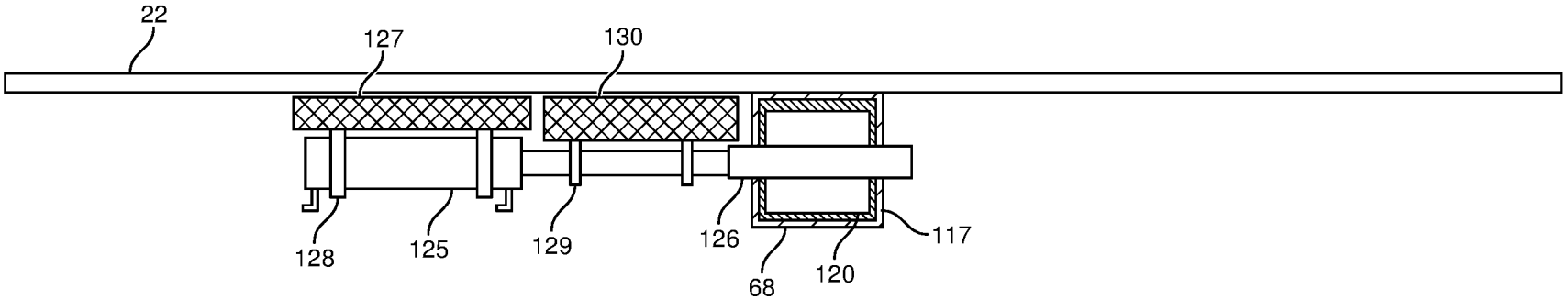
FIG. 71B shows a cross-sectional end view of the inner sill lock deadbolt controlling cylinder, with the inner sill lock deadbolt in the locked position, according to embodiments of this disclosure.

FIG. 71A shows a cross-sectional end view of the inner sill locking mechanism. Cylinder holding straps 128 may hold the inner sill lock deadbolt controlling cylinder 125 onto a cylinder platform 127 that may be attached to the BTPS floor 22. Deadbolt guiding brackets 129 may loosely hold the inner sill lock deadbolt 126 onto a deadbolt platform 130 that may also be attached to the BTPS floor 22. The inner sill lock deadbolt controlling cylinder 125 and the inner sill lock deadbolt 126 are shown in FIG. 71A in their fully retracted position where the inner sill lock deadbolt 126 is disengaged from the sill deadbolt hole 117. FIG. 71B shows the inner sill lock deadbolt controlling cylinder 125 and the inner sill lock deadbolt 126 in their fully extended position where the inner sill lock deadbolt 126 is inserted and engaged into the sill deadbolt hole 117. In the state shown in FIG. 71B, the inner sill lock deadbolt 126 may mechanically lock the inner sill's 120 movement relative to the BTPS center sill 68 and may inhibit the railcar coupler 20 from transferring forces to the inner sill controlling cylinder 113.

The controlling computer system 104 may operate the inner sill lock deadbolt controlling cylinders 125 to engage the inner sill lock deadbolts 126 into the sill deadbolt holes 117 during the transportation mode and, if the inner sill 120 is in the neutral position, during the WBA service/safety mode. In other modes and configurations, the controlling computer system 104 may operate the inner sill lock deadbolt controlling cylinders 125 to disengage the inner sill lock deadbolts 126 from the sill deadbolt holes 117, such as during barrier assembly, WBA vertical motion enabled mode and WBA deployed modes, and, optionally, during the interlock transition mode.

There may be two landing methods that may be used to transform railcars from a railcar form into a water barrier form, namely the simultaneous WBA landing method and the sequential WBA landing method. Both of these landing methods will be described below, both of which start with the railcars arriving at the target location for deployment in the transportation mode.

Figure 72A:
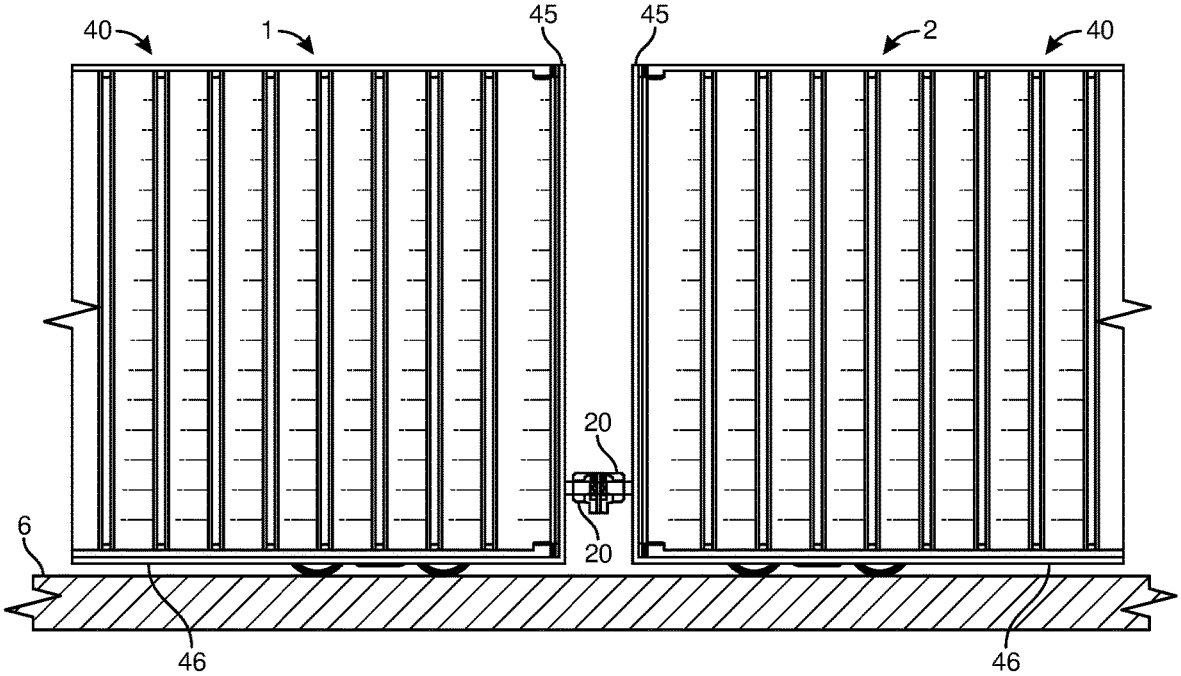
FIG. 72A shows a side view of two adjacent railcars that are lowered, according to embodiments of this disclosure.
Figure 72B:
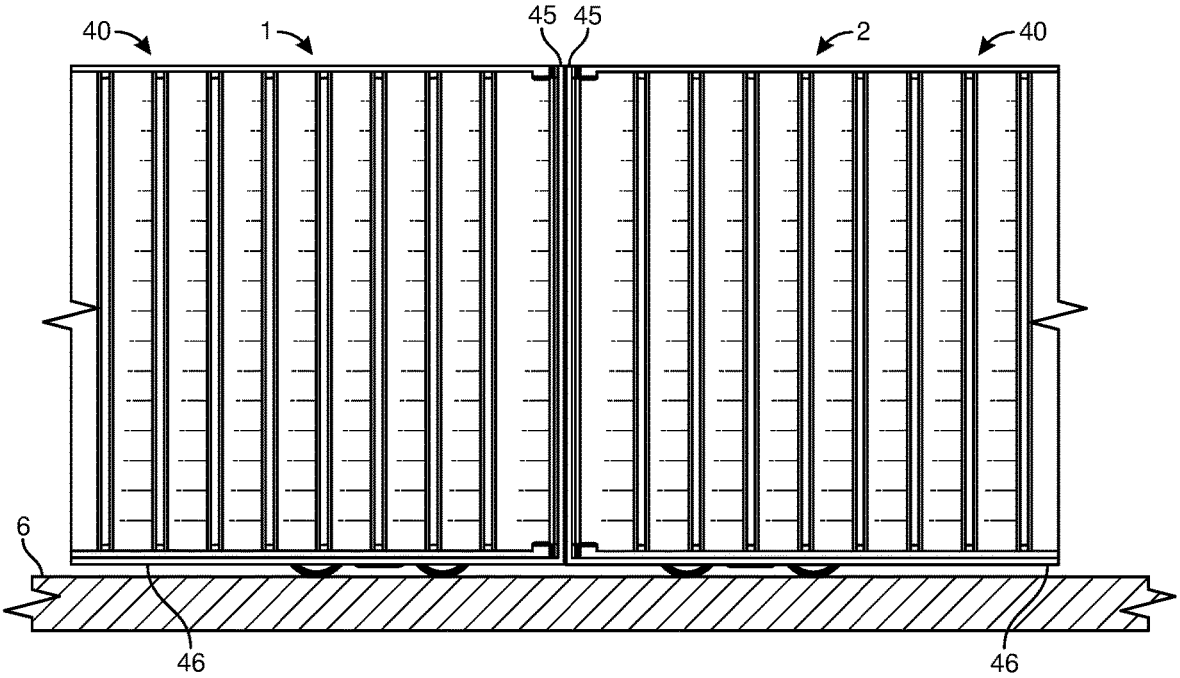
FIG. 72B shows a side view of the two adjacent railcars that are drawn together, according to embodiments of this disclosure.
Figure 74:
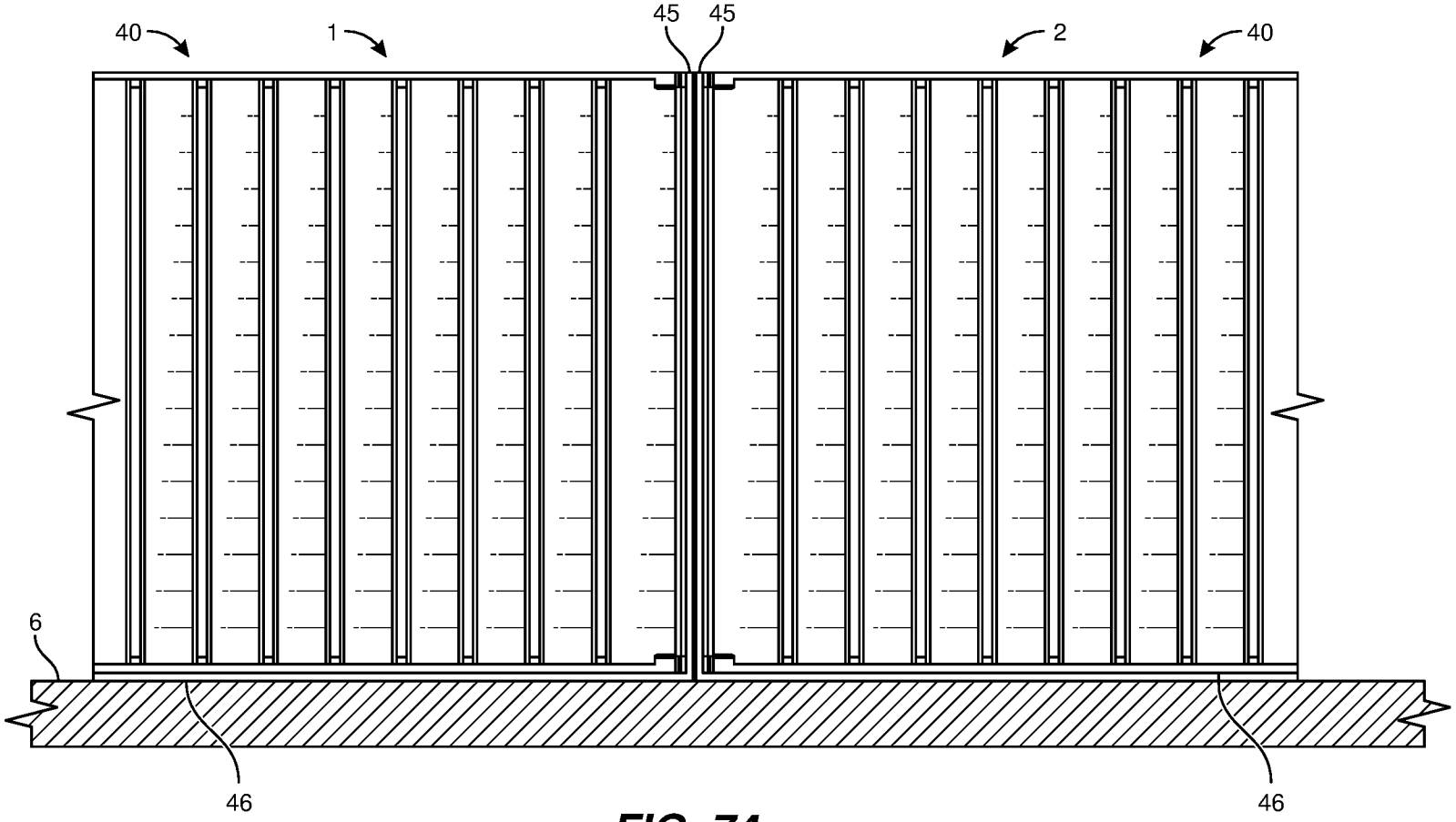
FIG. 74 shows a side view of two railcars that are landed onto a planar surface, according to embodiments of this disclosure.

For the simultaneous WBA landing method, the controlling computer systems 104 on a plurality of railcars of this disclosure may operate together to perform the following processes: (1) initiate the interlock transition mode and lowers the interlocking beams 56; (2) initiate the WBA vertical motion enabled mode and vertically lower all of the WBAs 40 to a uniform height slightly above the planar surface 6, as shown in FIG. 72A; (3) initiate the barrier assembly mode and draw the railcars together until their side gaskets 49 contact and seal against each other, as shown in FIG. 72B; (4) initiate the WBA vertical motion enabled mode and vertically lower all of the WBAs 40 substantially simultaneously until they contact the planar surface 6, which has an appearance similar to FIG. 74; and (5) initiate the WBA deployed mode and fully retract the WBA VPCCs' 57 piston rods such that the full weight of the WBAs 40 on the bottom gaskets 208 create seals against the planar surface 6 and, as a result, establishes a fully functional, continuous water barrier, as shown in FIGS. 74 and 14.

Figure 73A:
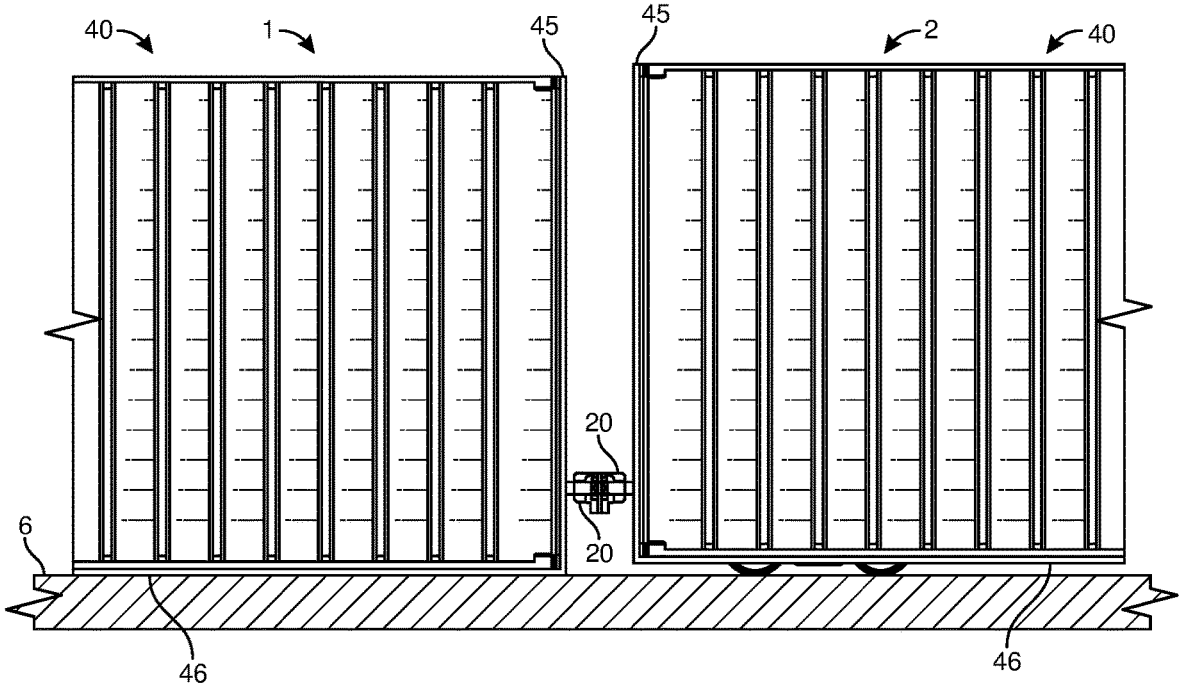
FIG. 73A shows a side view of two adjacent railcars, with the first railcar landed, according to additional embodiments of this disclosure.
Figure 73B:
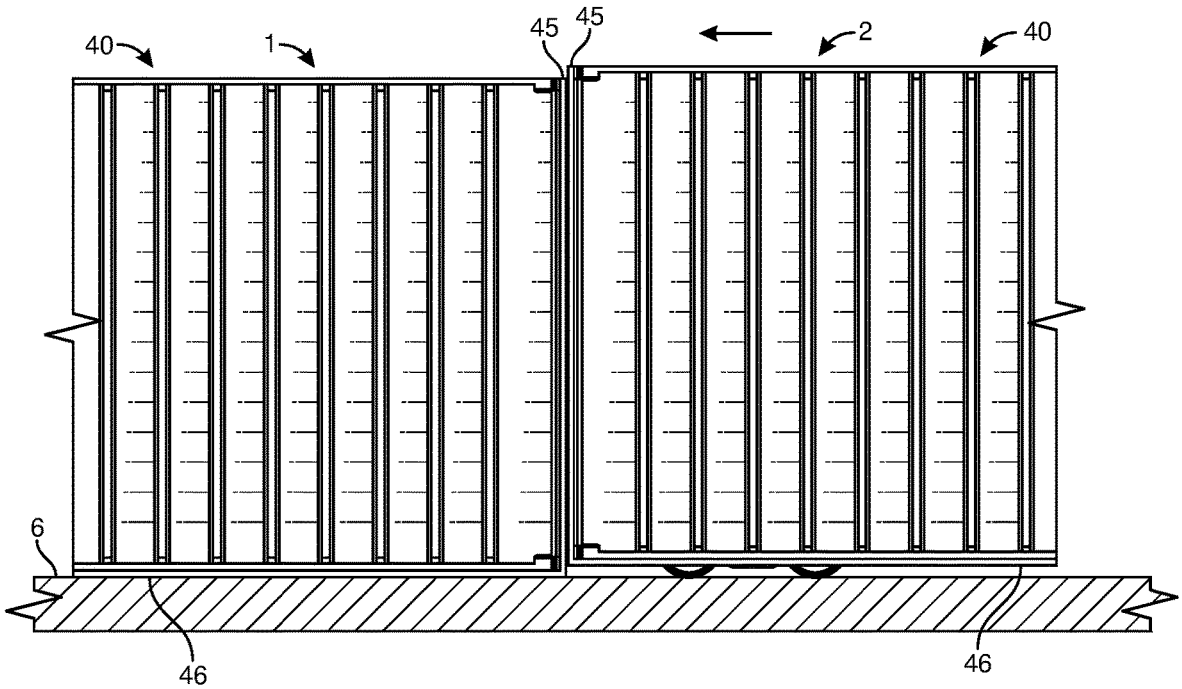
FIG. 73B shows a side view of the two adjacent railcars that are drawn together, according to additional embodiments of this disclosure.

For the sequential WBA landing method, the controlling computer systems 104 on the plurality of railcars may operate together to perform the following processes: (1) initiate the interlock transition mode and lowers the interlocking beams 56; (2) initiate the WBA vertical motion enabled mode and vertically lowers all of the WBAs 40 to a uniform height slightly above the planar surface 6, as shown in FIG. 72A; (3) initiate the WBA vertical motion enabled mode for the first railcar 1 and vertically lower its WBA 40 until it contacts the planar surface 6, which has an appearance similar to FIG. 73A; (4) initiate the WBA deployed mode for the first railcar 1 and fully retract the WBA VPCCs' 57 piston rods such that the full weight of the WBA 40 on the bottom gasket 208 creates a seal against the planar surface 6, as shown in FIG. 73A; (5) initiate the barrier assembly mode for the first and second railcars 1 and 2, where the first railcar 1 and the second railcar 2 are drawn together such that the respective side gaskets 49 contact and seal against each other, as shown in FIG. 73B; (6) initiate the WBA vertical motion enabled mode for the second railcar 2 and vertically lower its WBA 40 until it contacts the planar surface 6, which has an appearance similar to FIG. 74; (7) initiates the WBA deployed mode for the second railcar 2 and fully retract the WBA VPCCs' 57 piston rods such that the full weight of the WBA 40 on the bottom gasket 208 creates a seal against the planar surface 6, as shown in FIG. 74; and (8) steps 5 through 7 may be logically repeated for each additional railcar that may be part of the train until the completion of the last railcar which, as a result, may establish a fully functional, continuous water barrier, as shown in FIGS. 74 and 14.

Regardless of which method was used to land and deploy the plurality of WBAs 40, the following process can be used to transform the water barrier back to the transportation mode: (1) initiate the WBA vertical motion enabled mode and vertically raise all of the WBAs 40 to a uniform height slightly above the planar surface 6, as shown in FIG. 72B; (2) initiate the barrier assembly mode and extend the positions of the railcar couplers 20 to their neutral positions 115, which may re-establish a transport mode-compatible distance between the WBAs 40, as shown in FIG. 72A; (3) initiate the interlock transition mode and raise the WBAs 40 and the interlocking beams 56; and (4) initiate the transportation mode and fully retract the piston rods of the WBA VPCCs 57 and engage the inner sill lock deadbolts 126. Upon completion of this process, the plurality of railcars may be ready for transport by rail, as shown in FIG. 12.

Computer automation of the transformation processes, although not necessary in all embodiments of this disclosure, may facilitate barrier assembly and disassembly. For example, computer automation may improve a speed and efficiency of assembly or disassembly, especially in case a dispatched train has a large number (e.g., dozens or hundreds) of railcars to operate. Manual operation of these processes is possible, however manual operation may be best used during a failure of the computer automation system on a railcar or in cases where a smaller number of railcars are to be deployed or withdrawn.

Referring to FIG. 72A, as two railcars are drawn together during the barrier assembly mode, horizontal alignment of the side gaskets 49 may be controlled to ensure contact between the outer contact surfaces 106 of the side gaskets 49 and the effectiveness of the water seal 7 after the gaskets 49 have joined, as shown in FIG. 27. If the side gaskets 49 and bottom gaskets 208 are made with sufficient widths L8 (shown in FIG. 24B), then guidance provided by the railroad tracks 4 may produce sufficient gross railcar and side gasket 49 horizontal alignment such that the desired water sealing effect can be achieved after the side gaskets 49 are joined. Otherwise, a side gasket horizontal alignment system may be used to produce a fine horizontal alignment of the side gaskets. Two example gasket alignment systems are described below.

Figure 75:
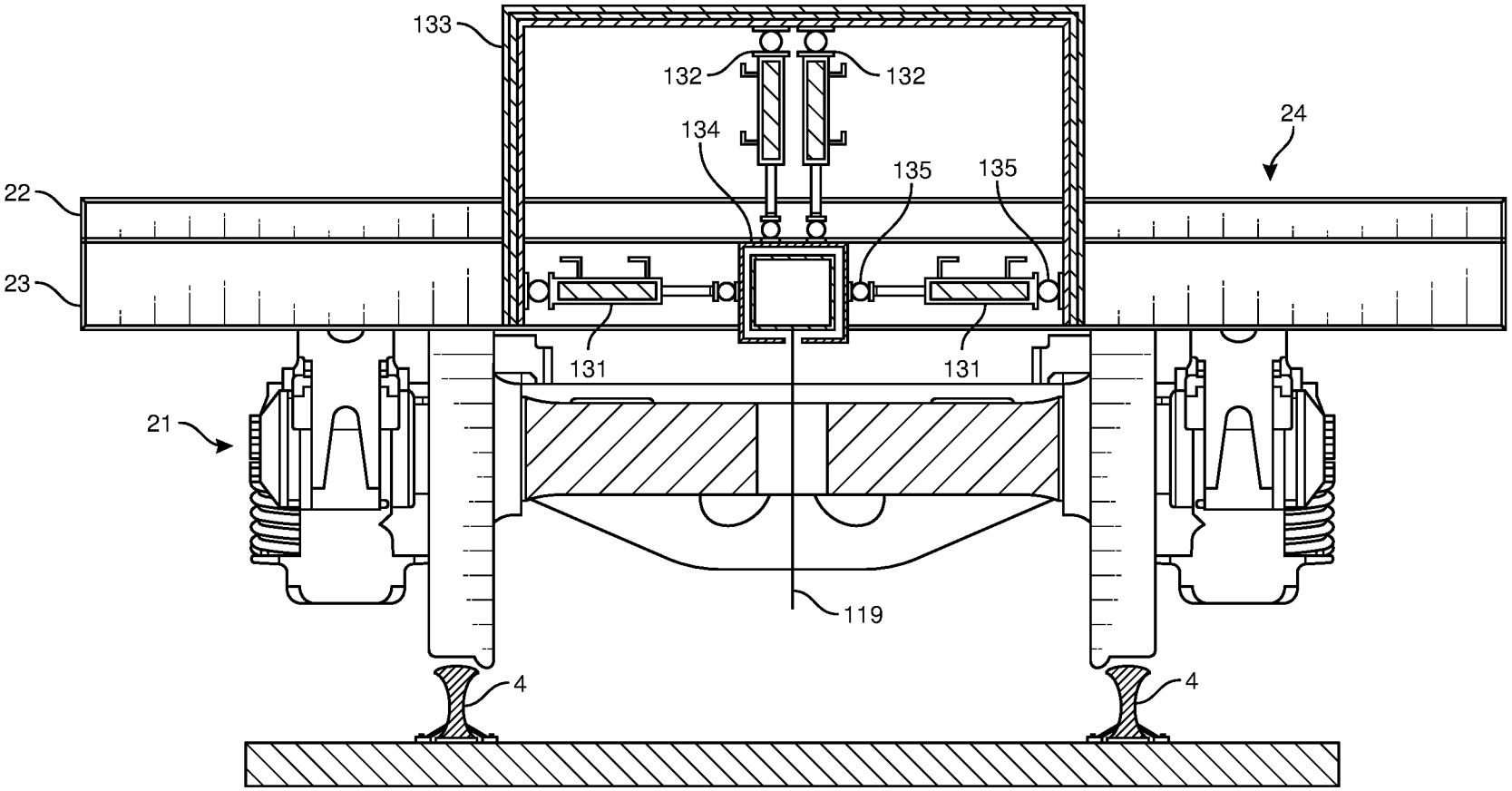
FIG. 75 shows an end view of coupler movement controlling cylinders, according to embodiments of this disclosure.

The first gasket alignment system is shown in FIG. 75, which shows a cylinder mounting frame 133 that may be attached to the BTPS 24 underframe 23. The cylinder mounting frame 133 may operate in a position around the coupler shank 119. The coupler shank 119 may have a movable shank collar 134 disposed around it and may be positioned in the same vertical plane as the cylinder mounting frame 133. Two coupler horizontal movement controlling cylinders 131 may be attached to the shank collar 134 through ball joints 135 at one end and to the cylinder mounting frame 133 through ball joints 135 at an opposite end. Two coupler vertical movement controlling cylinders 132 may be attached to the shank collar 134 through ball joints 135 at one end and to the cylinder mounting frame 133 through ball joints 135 at an opposite end. The controlling cylinders 131 and 132 may be operated by the controlling computer system 104 described above.

Figure 76:
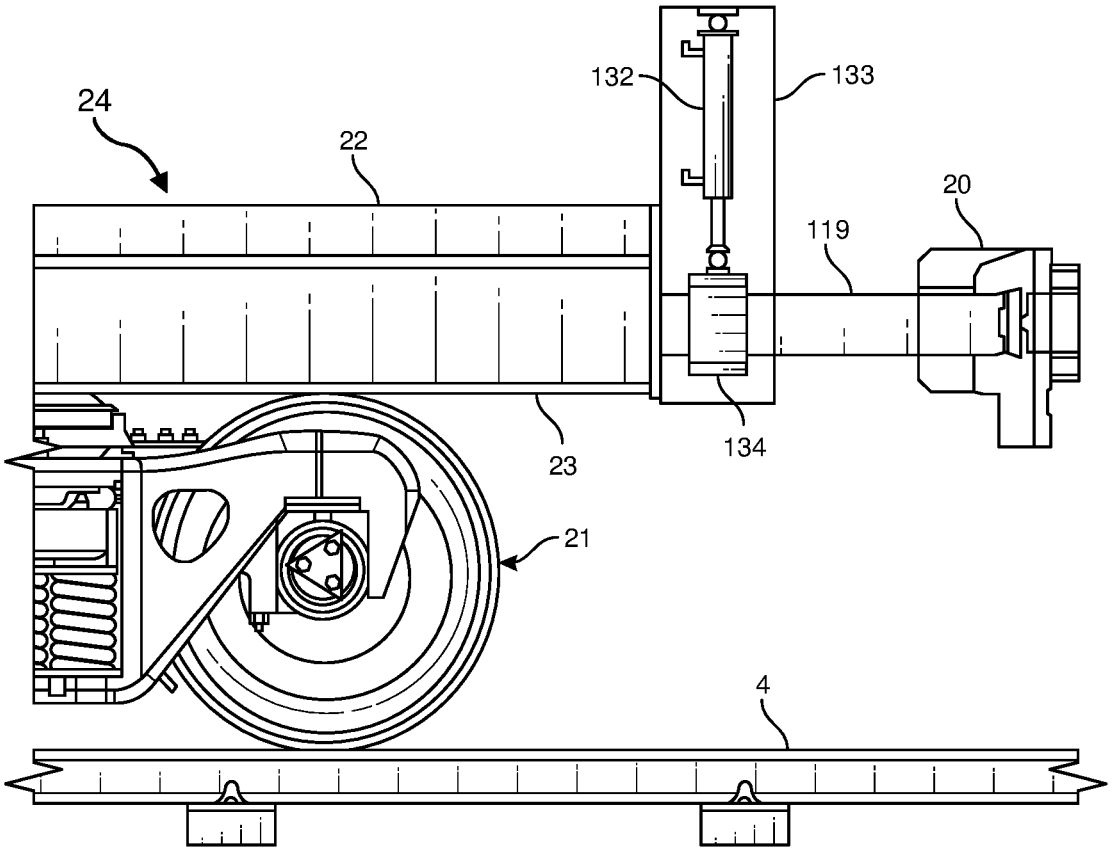
FIG. 76 shows a side view of the coupler vertical movement controlling cylinders, according to embodiments of this disclosure.

Referring to FIGS. 75 and 76, with their connection to the cylinder mounting frame 133, the coupler horizontal movement controlling cylinders 131 may be able to induce left or right movements to the shank collar 134, which, by mechanical connection, may induce a corresponding movement in the coupler shank 119 and the railcar coupler 20. An induced left or right (referring to the perspective of FIG. 75) movement at the railcar coupler 20 may cause a connected railcar to deflect its horizontal position to the left or right (referring to the perspective of FIG. 75), respectively, as a joining railcar is in motion. For ease of illustration, the coupler horizontal movement controlling cylinders 131 are not shown in FIG. 76.

Figure 77:
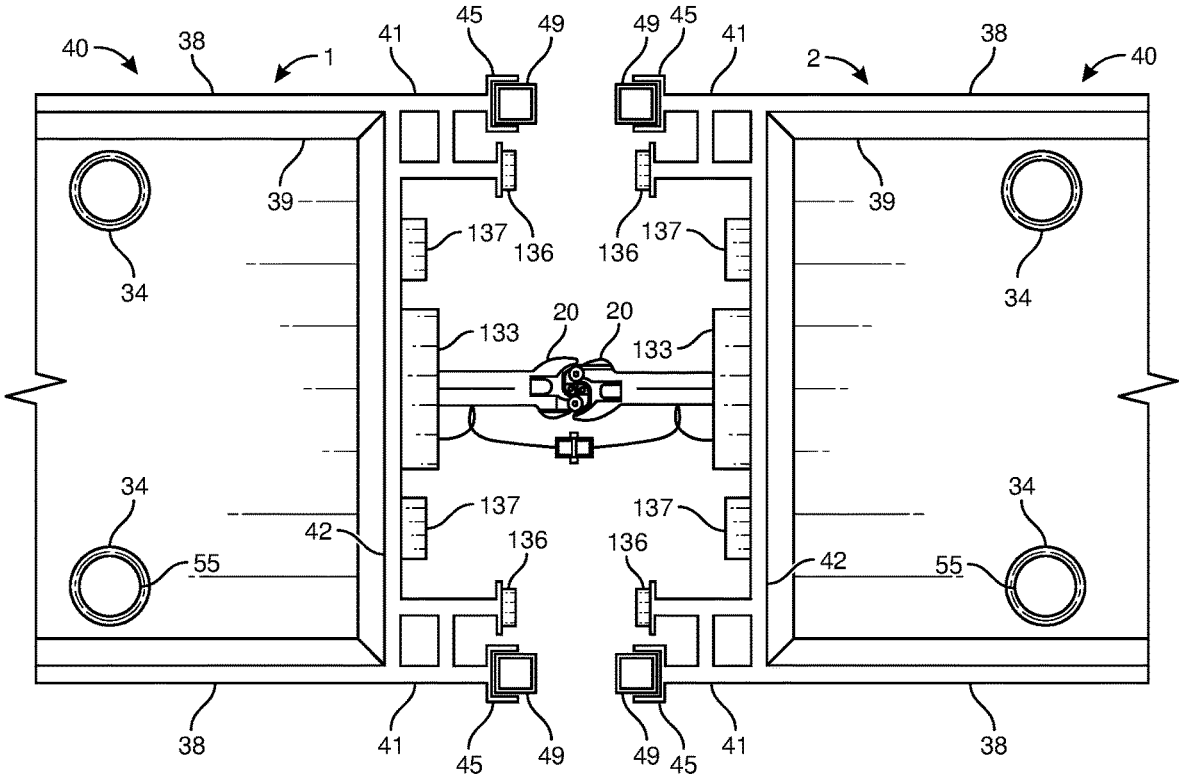
FIG. 77 shows a top view of two adjacent railcars, with horizontal alignment and distance sensors attached to both railcars and the railcars are not drawn together, according to embodiments of this disclosure.
Figure 78:
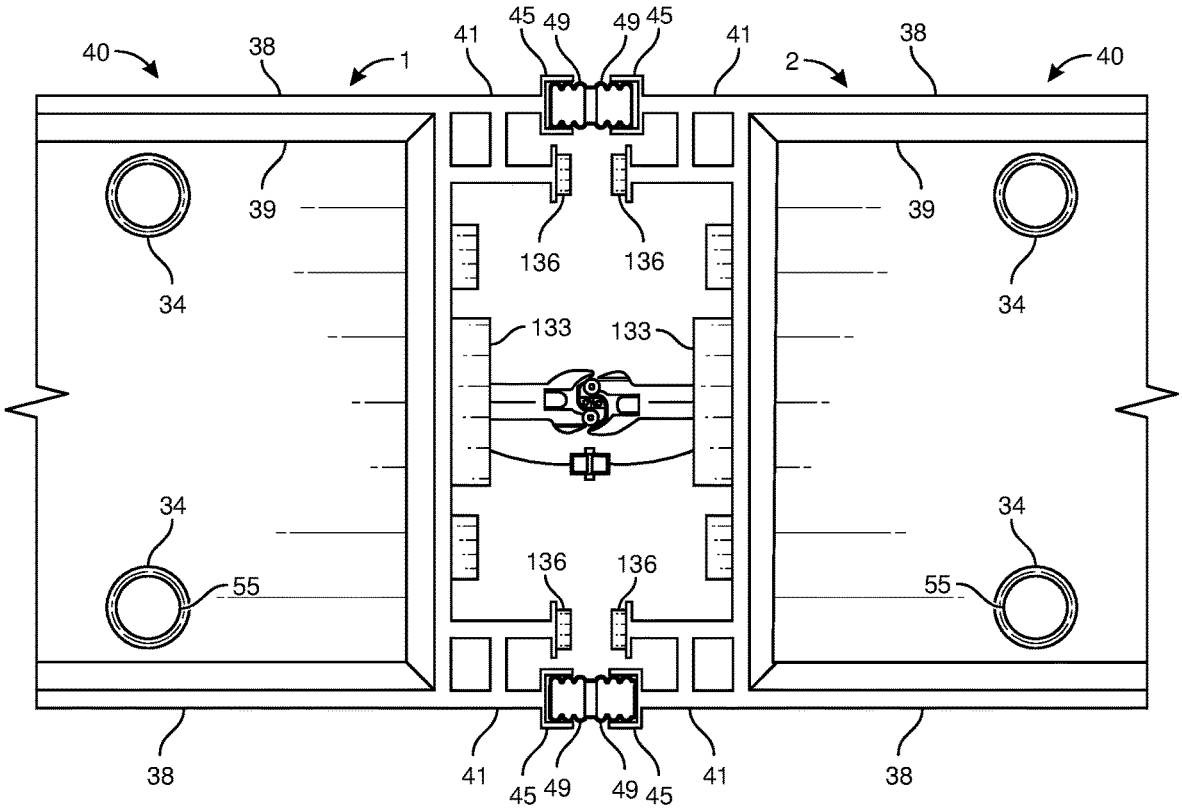
FIG. 78 shows a top view of the two adjacent railcars that are drawn together, according to embodiments of this disclosure.

Referring to FIG. 77, as the first railcar 1 and the second railcar 2 are drawn together, the controlling computer systems 104 on both railcars, which may be in communication with each other, may receive horizontal alignment data from horizontal alignment and distance sensors 136. The controlling computer systems 104 may control the left and right movements of their respective collars as needed, which may apply lateral forces to one or both of the railcars 1 and 2 to cause the lateral deflection and proper horizontal alignment and connection between the side gaskets 49, as shown in FIG. 78. The controlling computer systems 104 may operate the two coupler vertical movement controlling cylinders 132 in order to maintain the proper vertical level of the shank collar 134 on the coupler shank 119 as the two coupler horizontal movement controlling cylinders 131 apply forces on the shank collar 134 horizontally. The horizontal alignment and distance sensors 136 may be mounted on a platform that is adjacent to the side GHAs 45, where their sensors can operate by a laser, optic, acoustic, magnetic, radar, or other sensing means.

In some examples, WBA end wall 42 may include a cut-out to accommodate the physical presence of the cylinder mounting frame 133. This cut-out may reduce the possibility of physical collision with cylinder mounting frame 133 during vertical movement of the WBA 40. FIG. 79 shows an end view of the railcar in which the WBA 40 is raised in the transport mode and the shape of a WBA end wall cut-out 153 has a contour that is similar to the cylinder mounting frame 133. The contour may be sized and shaped such that the cylinder mounting frame 133 can fit within the contour.

FIG. 80 shows an end view of the railcar in which the WBA 40 is lowered in the deployed mode and the cylinder mounting frame 133 fits within the contours of the WBA end wall cut-out 153 such that the cut-out 153 and the cylinder mounting frame 133 do not contact each other or interfere with each other's operation. FIGS. 79 and 80 also show a manual control access ladder 196 that may provide a user or operator with a means to climb the WBA 40 in order to access a manual control panel that may be positioned within an upper interior of the WBA 40. The manual controls will be discussed in greater detail below.

Figure 81:
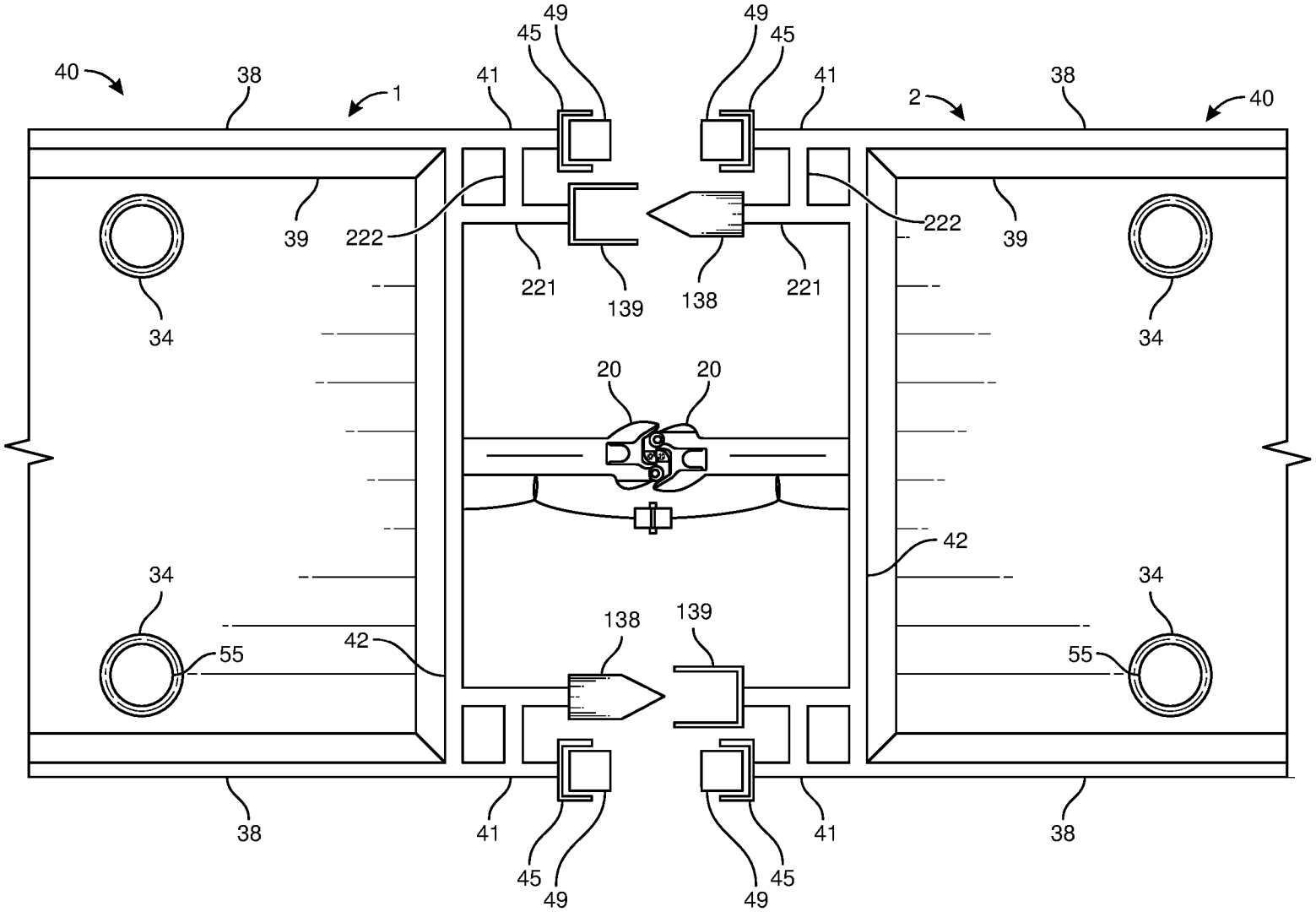
FIG. 81 shows a top view of two railcars including mechanical horizontal alignment components, where the railcars are not drawn together, according to additional embodiments of this disclosure.
Figure 82:
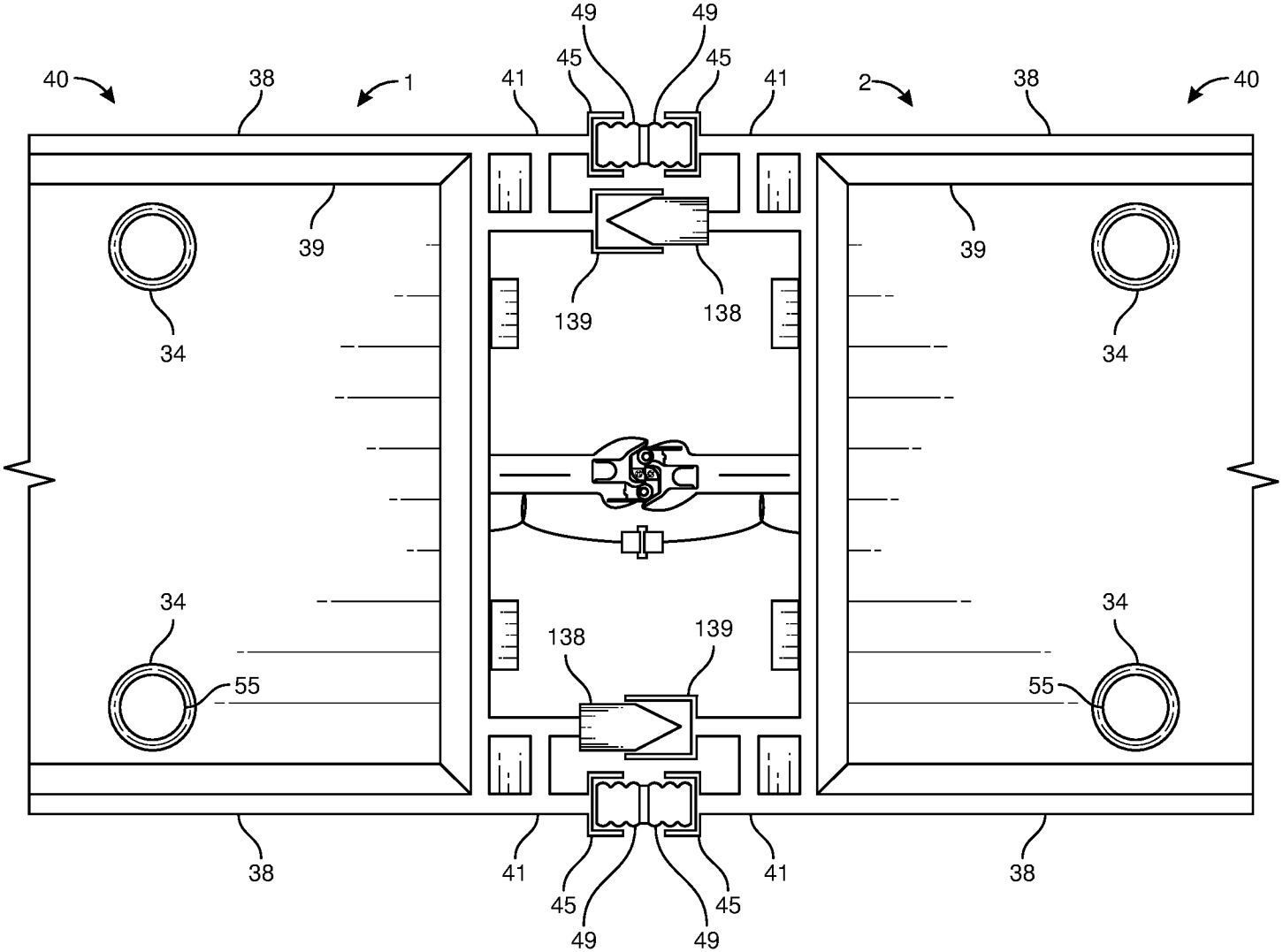
FIG. 82 shows a top view of two railcars that are drawn together, according to additional embodiments of this disclosure.

The second gasket alignment system can be seen in FIG. 81, where a top view of two railcars 1 and 2 shows locating pins 138 and locating pin bushings 139 attached firmly to primary steel members 221. Each primary steel member 221 may be part of, for example, a strong, rigid, steel box frame that may be defined by the following members: a secondary steel member 222 attached to the primary steel member 221 at a right angle, another end of the secondary steel member 222 attached to the WBA sidewall extension 41 at a right angle; the WBA sidewall extension 41 attached to the WBA end wall 42 at a right angle; and the WBA end wall 42 attached to the primary steel member 221 a right angle. The primary steel members 221 and secondary steel members 222 may vertically extend some portion of the sidewall and endwall height H4. The strength of the primary steel members 221 and the rigid steel box frames may be such that when sufficient lateral forces are applied to the primary steel members 221, the acted upon end of the WBA 40 may shift laterally commensurate with the inducing forces. The locating pins 138 and locating pin bushings 139 may be vertically elongated and made of substantially strong and thick steel and may extend vertically to the same height, or a portion of the height, of the primary steel members 221 to which they are attached. As the first railcar 1 and the second railcar 2 are drawn together, the locating pins 138 and locating pin bushings 139 on both railcars may interact and apply lateral forces to the primary steel members 221 such that both railcars may shift laterally and may finally resolve with a horizontal alignment of the WBAs 40 and side gaskets 49 such that the side gaskets' outer contact surfaces 106 have maximum contact with each other, as shown in FIG. 82.

Referring again to FIGS. 77, 79, and 80, camera/sensor housings 137 may be provided at one or several locations on the railcar. Each camera/sensor housing 137 may contain a video camera and/or an ultrasonic sensor. The video camera may provide a video monitoring capability to enable a user/operator to remotely view an image, as well as to change the viewing angle and/or zoom of the camera. Each video camera may be equipped with a high-quality audio microphone so that the remote user/operator can hear sounds that may be useful. Alternatively, such a microphone can be attached directly to the camera/sensor housing 137. The ultrasonic sensors may be pointed downward to provide data on a distance to a closest surface below, where the closest surface below can be a ground surface, planar surface 6, water surface, a railcar component surface, or another surface. The video camera and ultrasonic sensor may be connected with, and communicate their data to, the sensors interface 101 described above. If water is detected during a storm event, the controlling computer system 104 can convert the distance-to-the-water-surface data into water height data where further action can take place automatically or by user/operator intervention. In some embodiments, each location of the camera/sensor housings 137 may provide different information and data, as described below.

As first shown in FIG. 77 and FIG. 79, the video camera may allow the user/operator to remotely monitor the performance of the gasket alignment systems as well as other components between the railcars. The ultrasonic sensors may provide data on the height of any water that may be present or trapped between the railcars deployed at a target location. During a storm event, these ultrasonic sensors may confirm the performance and integrity of a created water barrier when no water is detected and/or may provide data that there is a leak in the barrier when the ultrasonic sensors detect a rising water level. Software may be able to quickly identify the leak location, such as based on data from the array of ultrasonic sensors that span a length of the water barrier.

As shown in FIG. 117, the video camera 137 may allow the user/operator to remotely monitor the performance of components or systems located in an interior of the WBA 40 above the WBA floor 39. The ultrasonic sensors may provide data on the height of any water that may be present in the interior of the WBA 40 above the WBA floor 39.

As shown in FIG. 117, additional video cameras 137 may allow the user/operator to remotely monitor the performance of components or systems located between the BTPS floor 22 and the bottom of the WBA underframe 26. The ultrasonic sensors may provide data on the height of any water above the BTPS floor 22 or the distance between the BTPS floor 22 and the bottom of the WBA underframe 26. By way of example, such distance data can be used by the controlling computer system 104 to regulate the vertical movement of the WBA 40.

Figure 106:
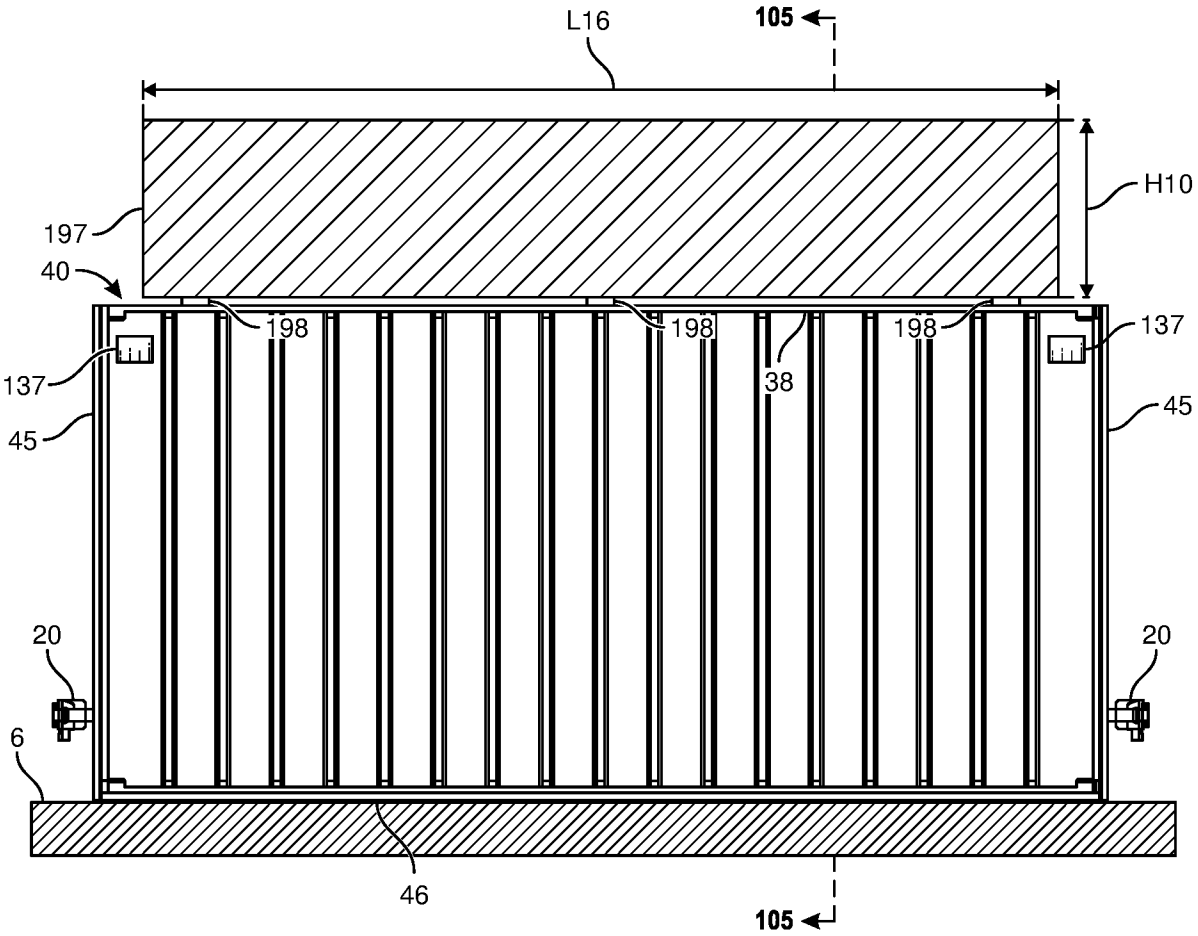

As shown in FIG. 106, video cameras 137 may be positioned to allow the user/operator to remotely monitor the exterior of the WBA sidewalls 38 as well as the storm and wave conditions. In addition, the video cameras 137 can provide security monitoring for the railcars as well as provide assistance during logistics and service operations on the railcars. Optionally, audio amplifier and loudspeaker systems may be fitted to the camera/sensor housings 137 so that a remote user/operator can issue verbal instructions or commands to authorized and/or unauthorized personnel at or near specific railcars. Optionally, such audio amplifier and loudspeaker systems may be waterproof. The ultrasonic sensors may provide data on the height of water immediately outside the WBA sidewalls 38, or, if no water is detected, the distance to ground level or the planar surface 6. The data representing distance to the planar surface 6 can be used by the controlling computer system 104 during the simultaneous WBA landing, sequential WBA landing, and/or railcar form restoration methods of operation. To enhance the scientific study of hurricanes as they approach the coast, weather equipment including, but not limited to: anemometers, thermometers, barometers, hygrometers, wind vanes, rain gauges, and/or hail pads, can be made part of or contained within the camera/sensor housing 137. All data collected by the weather equipment can be communicated real-time through the sensor interface 101 and wire, or wirelessly through the wired/wireless communications and LAN network system 103 to the command and control station. The data received by the command and control station can then be forwarded to various federal, state, and local agencies and/or other parties for further analysis.

Figure 83A:
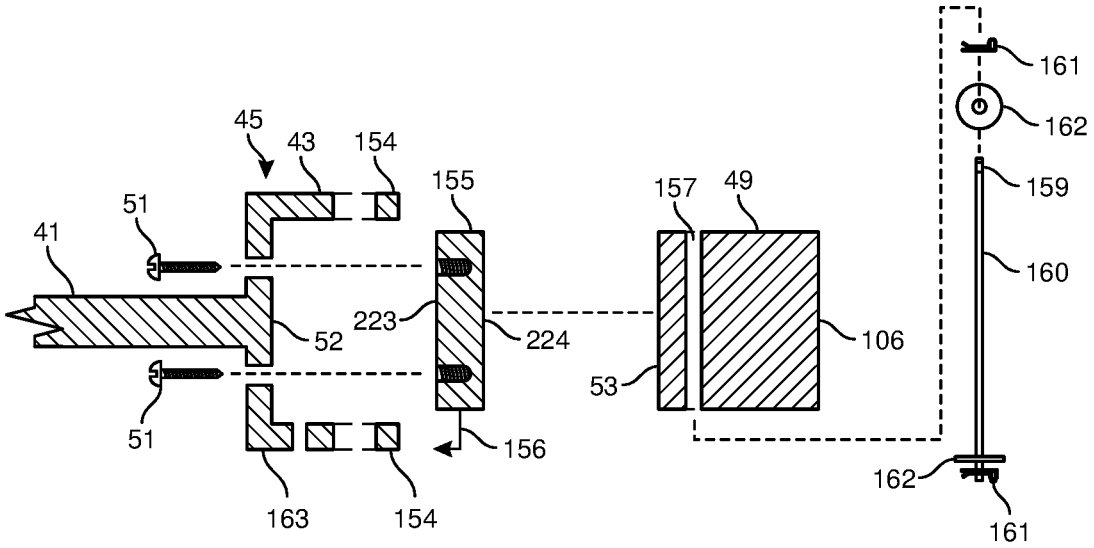
FIG. 83A shows a cross-sectional exploded top view of a side gasket/housing assembly equipped with a pressure sensor, according to embodiments of this disclosure.

Railcars of the present disclosure can be provided with a gasket pressure sensing system to measure and monitor contact forces between the side gaskets 49 of two joined railcars. FIG. 83A shows a cross-sectional exploded top view of a modified side GHA 45 that includes a pressure sensor 155 as part of the side GHA 45. The basic construction and assembly of side GHAs 45 without such a pressure sensor 155 were shown in FIG. 24A and FIG. 26A. In addition to the side GHA pressure sensor 155, FIG. 83A shows the WBA sidewall extension 41, the screws 51, the housing flange 43, the housing web 52, a wire harness flange hole 163, the elongated retaining rod flange hole 154, a pressure sensor inner contact surface 223, a pressure sensor outer contact surface 224, a pressure sensor wire harness 156, the side gasket 49, the gasket inner contact surface 53, the gasket outer contact surface 106, a retaining rod gasket hole 157, a retaining rod 160, a retaining rod cotter pin hole 159, a washer 162, and a cotter pin 161.

Figure 83B:
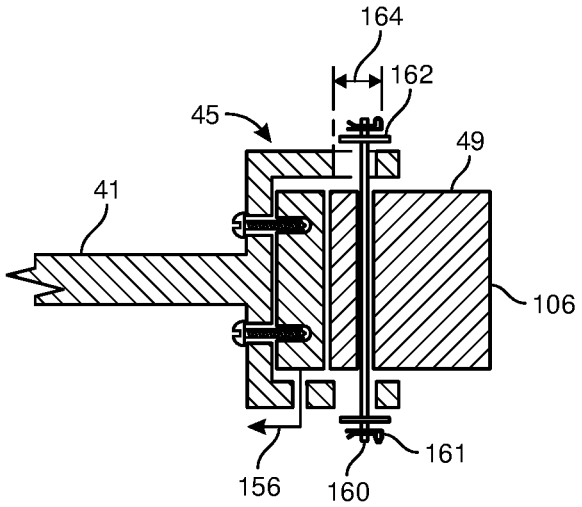
FIG. 83B shows a cross-sectional top view of the side gasket/housing assembly of FIG. 83A in an assembled configuration.

Referring to FIG. 83B, to assemble the modified side GHA 45, the side GHA pressure sensor 155 may be fit between the housing flanges 43 and onto the housing web 52. The side GHA pressure sensor 155 may be secured by screws 51 and the pressure sensor wire harness 156 may be fed through the wire harness flange hole 163 and connected to the sensor interface 101. The side gasket 49 may be fit between the housing flanges 43 and onto the side GHA pressure sensor 155. A retaining rod 160 may be fitted with a washer 162 and a cotter pin 161 through the retaining rod cotter pin hole 159 on the first end of the retaining rod 160 (as shown in FIG. 83A). An opposite end of the retaining rod 160 may be inserted first through the elongated retaining rod flange hole 154, then the retaining rod gasket hole 157, and finally the elongated retaining rod flange hole 154 on the other side of the assembly. The retaining rod 160 may be secured with a washer 162 and a cotter pin 161 through the retaining rod cotter pin hole 159. After assembly, the retaining rod 160 and, by connection, the side gasket 49 may have a horizontal range of motion 164. The range of motion may be limited by the elongated retaining rod flange hole 154 in one direction and the side GHA pressure sensor 155 in the other direction (i.e., the compressive force direction).

Figures 84A, 84B:
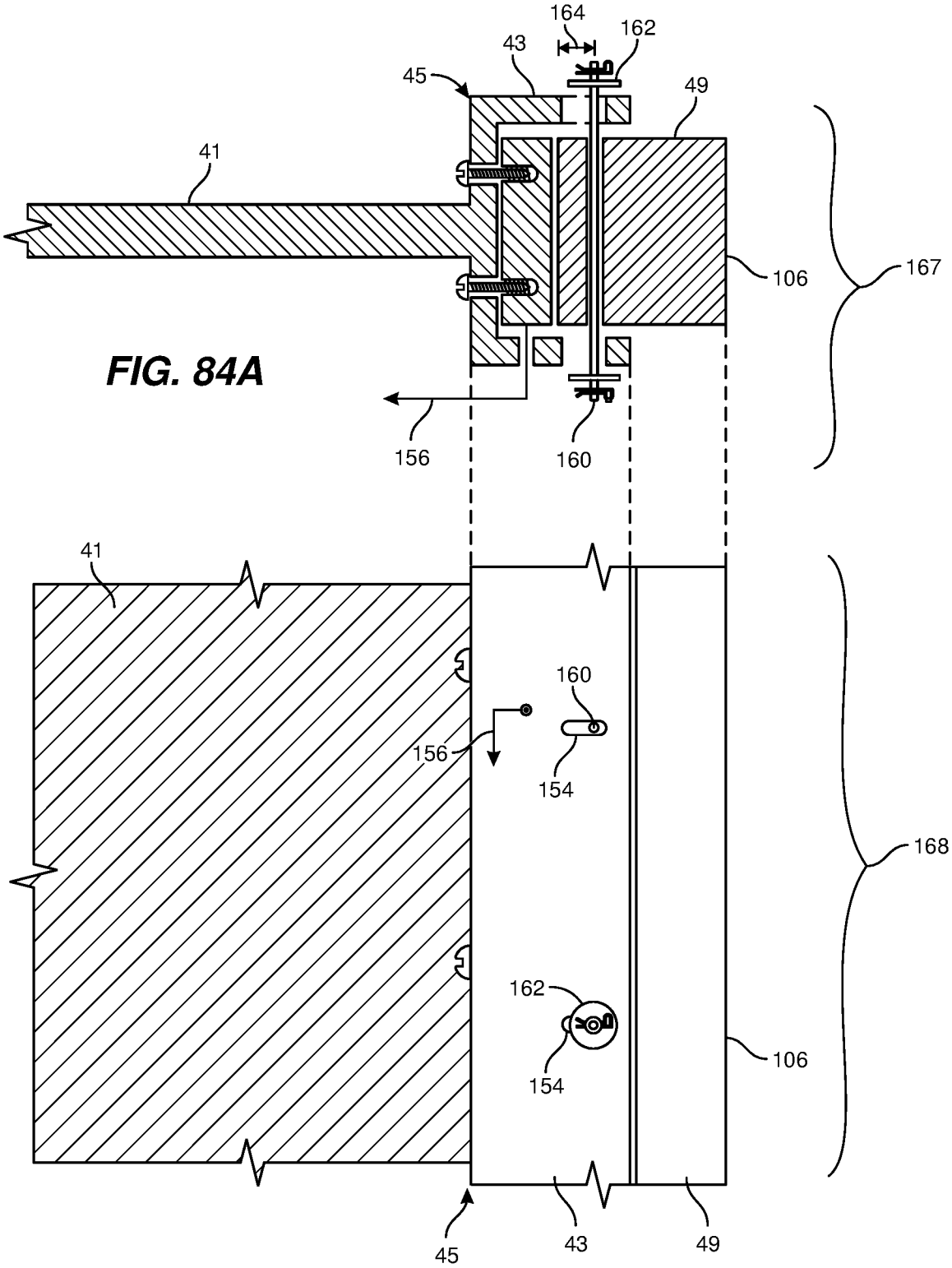
FIG. 84A shows a cross-sectional top view of the side gasket/housing assembly equipped with a pressure sensor and FIG. 84B shows a side view of the same, according to embodiments of this disclosure.

FIG. 84A shows a cross-sectional top view 167 of the side GHA 45 and FIG. 84B shows a partial side view 168 of the side GHA 45. The side view 168 illustrates a portion of the length H4 (FIG. 23) of the sidewall extension 41. The side view 168 shows that the retaining rod flange holes 154 may be horizontally elongated to allow the retaining rods 160 and side gasket 49 to move horizontally within the housing assembly.

Figure 85A:
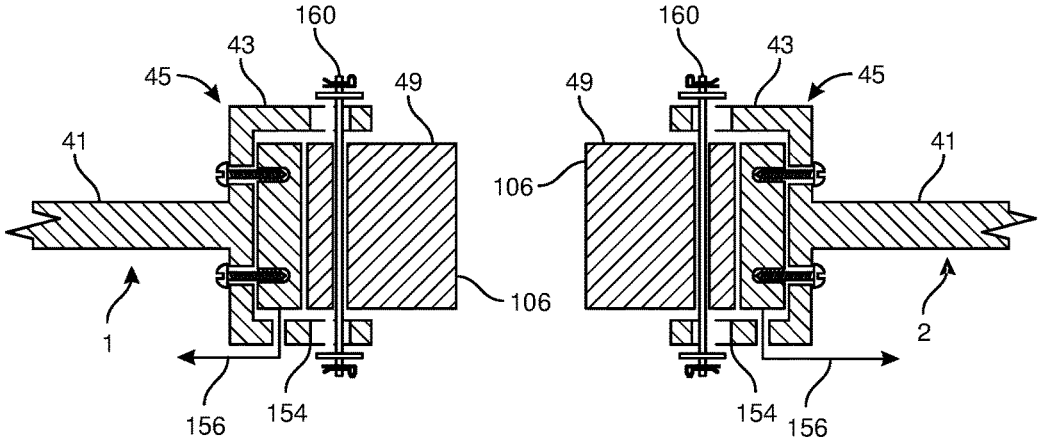
FIG. 85A shows a cross-sectional top view of separated side gasket/housing assemblies of two adjacent railcars, according to embodiments of this disclosure.

FIG. 85A shows the pressure sensing side GHAs 45 of two adjacent railcars 1 and 2 prior to the two railcars 1 and 2 being drawn together and making contact at the side gaskets 49. In this scenario, the outer contact surfaces 106 of the side gaskets 49 may not be in contact with each other, and no external forces are being applied to the side GHA pressure sensors 155 from the side gasket 49. With reference to both FIGS. 83A and 85B, after the two railcars 1 and 2 are drawn together and make side gasket 49 contact, compressive forces applied to the gasket outer contact surfaces 106 may be transferred to the gasket inner contact surface 53, where the gasket inner contact surfaces 53 may convey the forces onto the outer contact surfaces 224 of the side GHA pressure sensors 155 that may be secured to the housing webs 52.

Figure 85B:
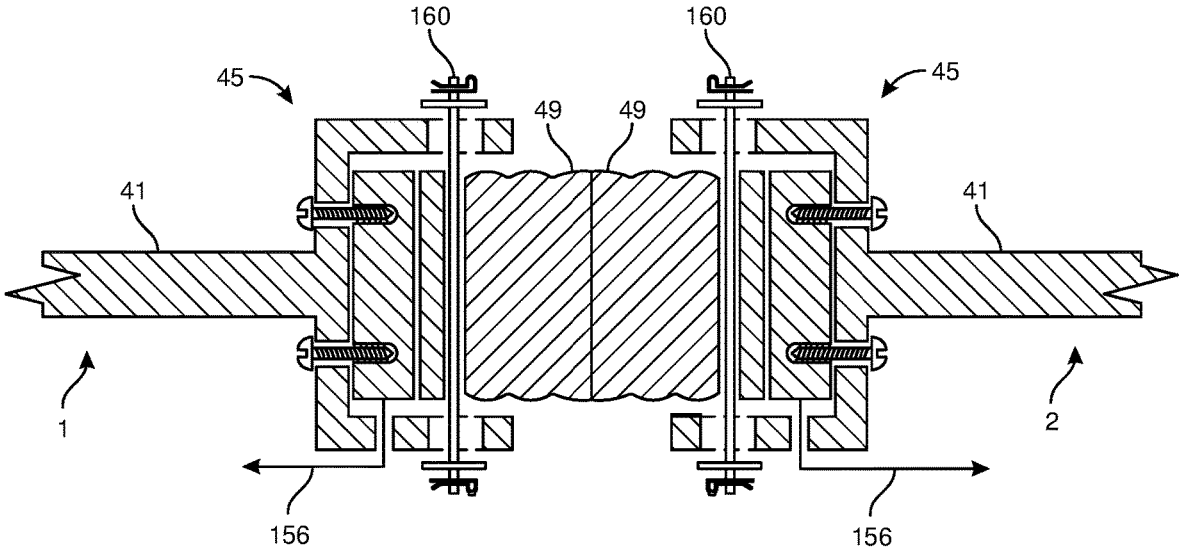
FIG. 85B shows a cross-sectional top view of a contacting side gasket/housing assemblies of the two adjacent railcars, according to embodiments of this disclosure.

As shown in FIG. 85B, the forces applied to the pressure sensor outer contact surfaces 224 may be converted to data signals that may be communicated by the pressure sensor wire harnesses 156 to the sensor interfaces 101 described above. The controlling computer systems 104 may use the pressure data to regulate the inner sill controlling cylinders 113, such as to translate the railcars 1 and 2 together or apart in order to produce a desired compressive force between the connected side gaskets 49. Prior to or during a storm event, the pressure sensor data from all the connected railcars can be communicated to a remote command and control station, where a user/operator may be able to monitor the data and performance of all side gasket 49 water seals.

Figure 86:
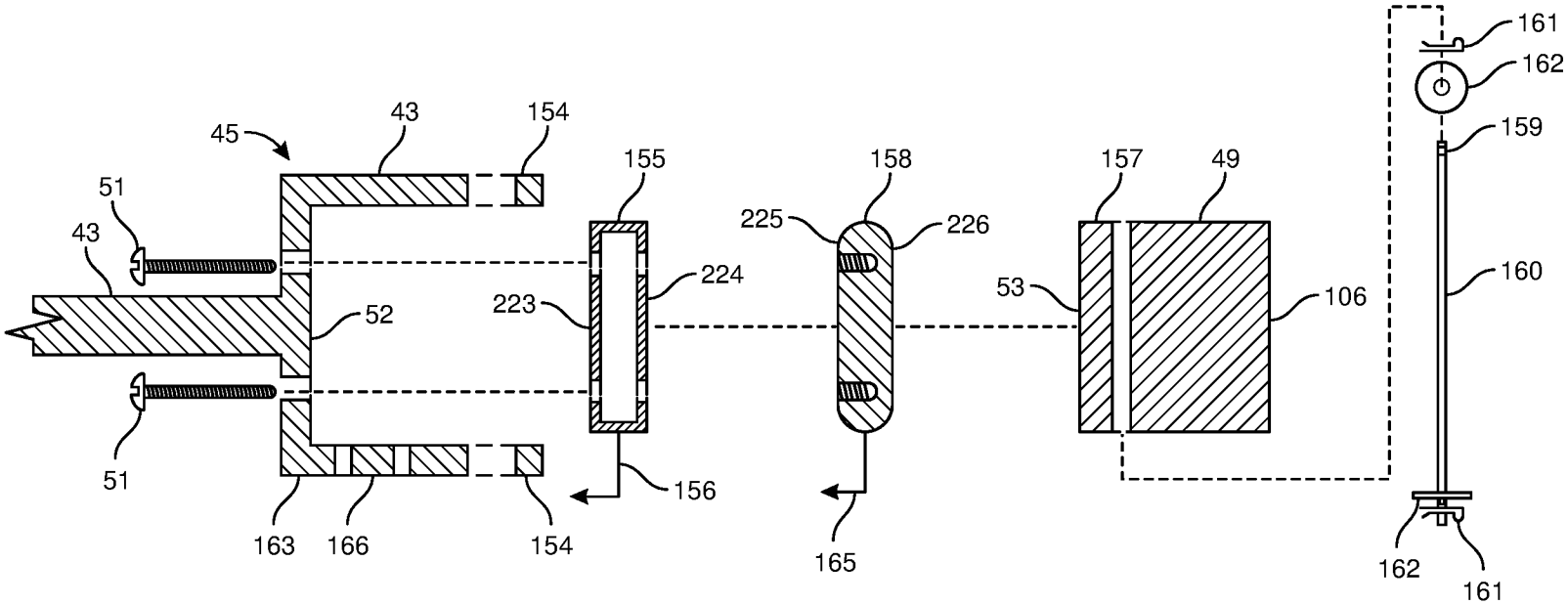
FIG. 86 shows a cross-sectional exploded top view of a side gasket/housing assembly equipped with a bladder and pressure sensor, according to embodiments of this disclosure.

In additional embodiments, the railcar can be provided with a side gasket bladder system that may be used to regulate the water sealing forces between joined side gaskets 49. FIG. 86 shows a side GHA 45 that is similar to the one shown in FIG. 83A, except that a side GHA bladder 158 may be placed between the side GHA pressure sensor 155 and the side gasket 49. In addition, the side GHA pressure sensor 155 may be made so that the screws 51 pass all the way through the side GHA pressure sensor 155 to attach to the side GHA bladder 158. The housing flange 43 may also have a greater length H7 (shown in FIG. 24A) and a bladder hose flange hole 166 may be provided on the housing flange 43 to accommodate the bladder hose 165.

To assemble the side GHA 45 with the side gasket bladder system, the side GHA pressure sensor 155 may be fit between the housing flanges 43 and onto the housing web 52. A pressure sensor wire harness 156 may be fed through the wire harness flange hole 163 and connected to the sensor interface 101 and the side GHA bladder 158 may be fit between the housing flanges 43 and onto the side GHA pressure sensor 155. The side GHA bladder 158 may be secured by screws 51 and the bladder hose 165 may be fed through the bladder hose flange hole 166 and connected to the valve system 108 operated by controlling computer system 104. The side gasket 49 may be fit between the housing flanges 43 and onto the side GHA bladder 158. A retaining rod 160 may be fitted with a washer 162 and a cotter pin 161 through the retaining rod cotter pin hole 159 on the first end of the retaining rod 160, and the other end of the retaining rod 160 may be inserted first through the retaining rod flange hole 154, then the retaining rod gasket hole 157, and finally the retaining rod flange hole 154 on the other side of the assembly. The retaining rod 160 may be secured with a washer 162 and a cotter pin 161 through the retaining rod cotter pin hole 159.

Figure 87A:
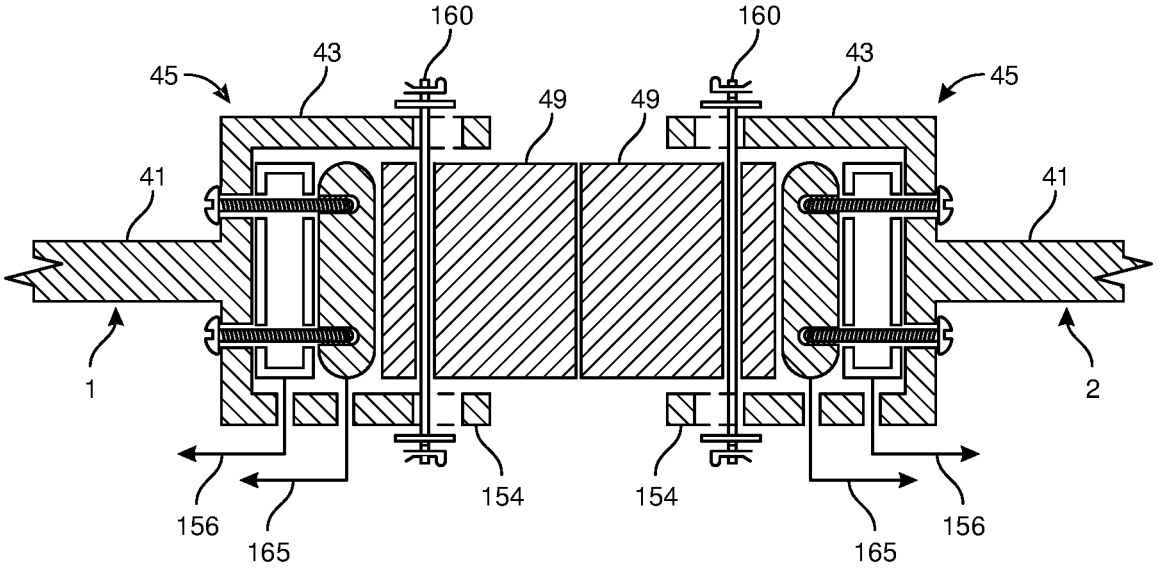
FIG. 87A show a cross-sectional top view of side gasket/housing assemblies of two adjacent railcars, according to additional embodiments of this disclosure.

FIG. 87A shows a fully assembled side GHA 45 with the side gasket bladder system. FIG. 87A also shows that when the two railcars are initially drawn together to make light contact between the side gaskets 49, very little, if any, compressive forces may be applied between the gasket outer contact surfaces 106. In this example, the side gaskets 49 and retaining rods 160 may be positioned in their rearmost positions along the retaining rod flange holes 154.

Figure 87B:
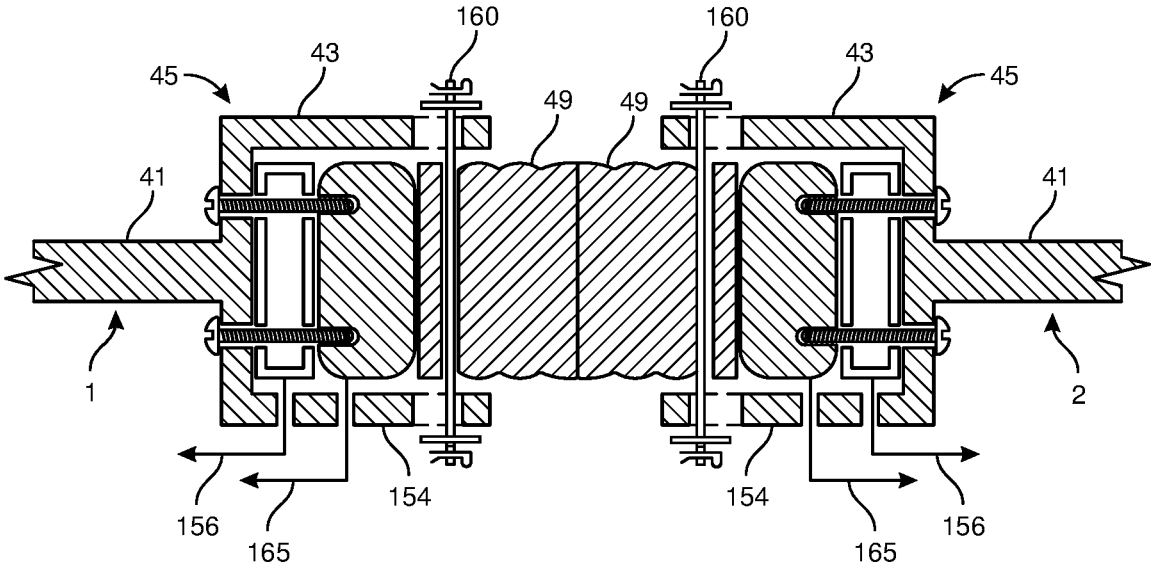
FIG. 87B show a cross-sectional top view of the side gasket/housing assemblies with pressure applied therebetween, according to embodiments of this disclosure.

FIG. 87B shows the side GHA 45 after the controlling computer systems 104 have inflated the side GHA bladders 158, such as by regulating the hydraulic fluid flow through the bladder hoses 165 such that the bladders' inner contact surfaces 225 push on the pressure sensors' outer contact surfaces 224 and the bladders' outer contact surfaces 226 push on the side gasket's 49 inner contact surfaces 53. As a result, the side gaskets 49 may be pushed forward to generate the compressive forces between the gaskets' outer contact surfaces 106.

The controlling computer systems 104 may achieve the desired forces between the side gasket's 49 by monitoring the pressure data provided by the side GHA pressure sensors 155 and/or by other pressure sensors connected to the bladder hoses 165 and by regulating the flow of hydraulic fluid through the bladder hoses 165 accordingly.

Figure 88:
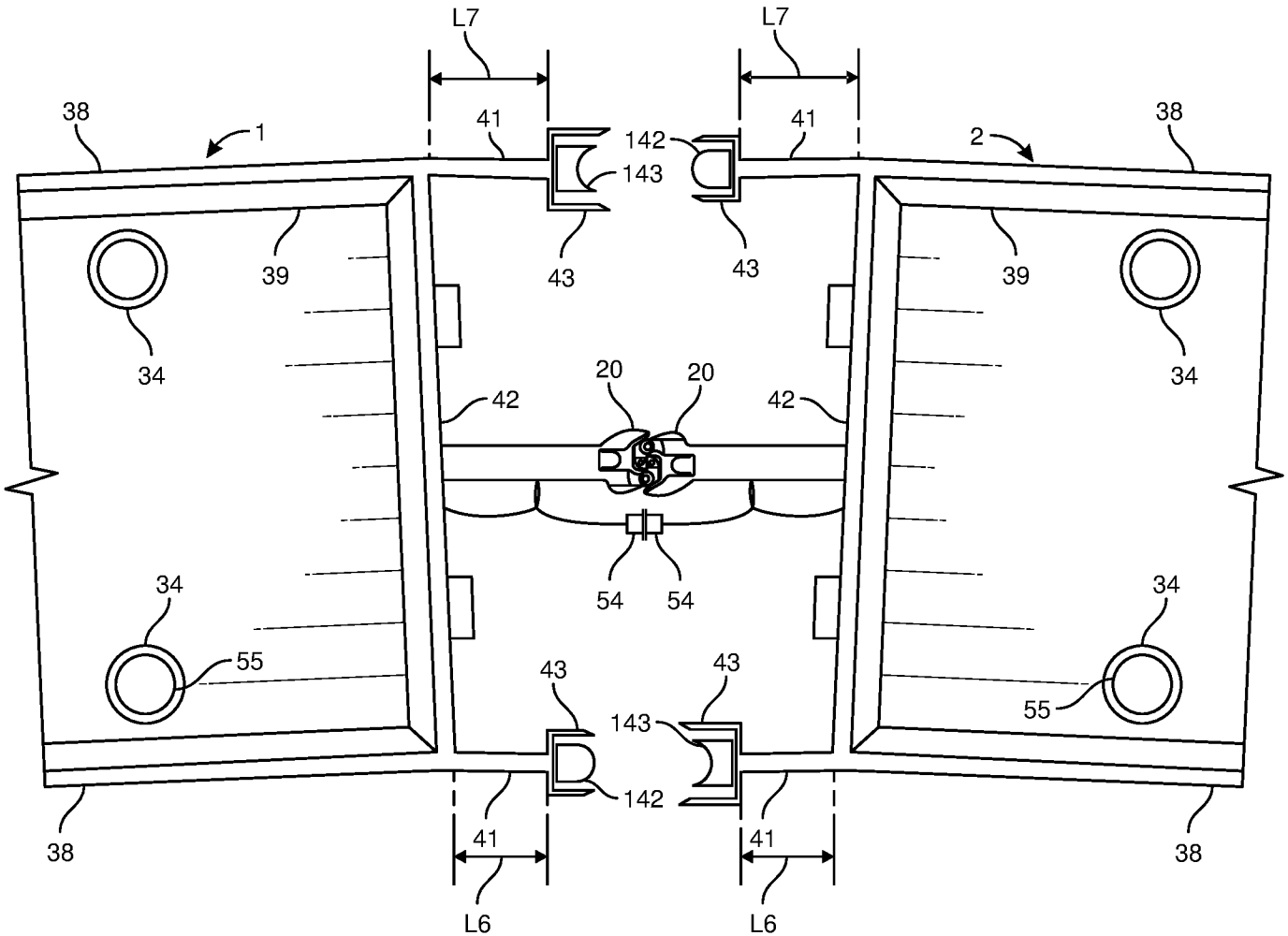
FIG. 88 shows a top view of two adjacent railcars that are made with WBA sidewall extensions of different lengths and self-aligning side gasket/housing flanges, according to embodiments of this disclosure.

In some embodiments, the WBA side gasket outer contact surfaces 106 can be made with different shapes. As shown in FIG. 88, for example, the WBA side gaskets can have convex outer contact surfaces 142 and concave outer contact surfaces 143. In general, including the WBA side and bottom gaskets, the gasket outer contact surfaces 106 on the railcar may be made to initially be planar, convex, concave, or any combination thereof or any other shape. For example, some shapes may increase a surface area of contact between the WBA side gaskets 49 to increase a water sealing effect. As noted above, the WBA side gaskets 49 may be made of rubber, for example. Alternatively or additionally, the WBA side gaskets 49 can be made to include cork, felt, graphite, metal, neoprene, paper, plastic polymer, polychloroprene, PVC, silicone, synthetic fiber, or any other material that may be used to form a water seal.

There may be situations where the water barriers may need to be formed on a curved railroad track. FIG. 88 shows the railcars 1 and 2, according to some embodiments, that include side wall extensions having different lengths. For example, an upper (in the view of FIG. 88) pair of side wall extensions 41 may have a length L7 that is greater than a lower (in the view of FIG. 88) pair of side wall extensions that have a length L6.

Figure 89:
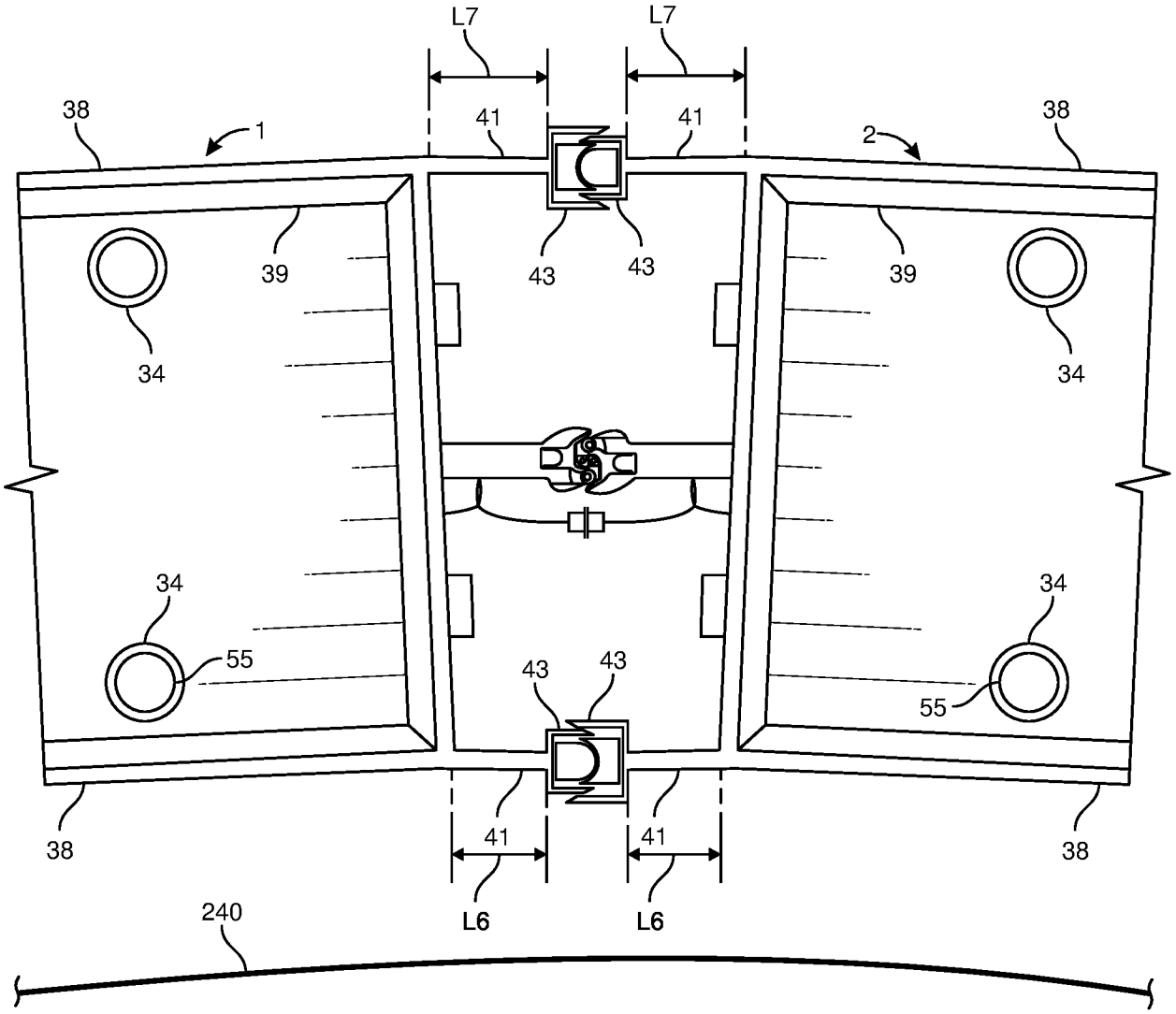
FIG. 89 shows a top view of the two adjacent railcars of FIG. 88 after being drawn together to form a horizontally arcuate water barrier with aligned side gasket/housing flanges and gaskets, according to embodiments of this disclosure.

FIG. 89 shows that the differential lengths of the side wall extensions 41 may cause the deployed railcars 1 and 2 to form an angled 240 (e.g., curved) water barrier when assembled. Increasing a difference between the side wall extension lengths L6 and L7 may increase the angle 240 of the connected railcars and, conversely, decreasing the difference between the side wall extension lengths L6 and L7 may decrease the degree of curvature 240 of the connected railcars.

Construction of the WBA underframe 26, WBA floor 39, BTPS underframe 23, BTPS floor 39 and WBA sidewall 38 have been described above in relation to the systems being deployed along a linear railroad track. Railcar curvature or curvature along a plurality of connected railcars can also be achieved by making the WBA underframe 26, WBA floor 39, BTPS underframe 23, BTPS floor 39, and/or WBA sidewall 38 curve or have different lengths along their lengths L10, L10, L3, L3 and L5, respectively.

FIGS. 88 and 89 also illustrate an alignment feature integrated into the housing flanges 43 adjacent to the WBA side gaskets. In this example, the housing flanges 43 may include complementary angled surfaces. As the housing flanges 43 are brought together, the complementary angled surfaces may abut and slide against each other to bring the WBA side gaskets into alignment. One of the housing flanges 43 may be sized and shaped to fit at least partially within the other of the joining housing flanges 43, as shown in FIG. 89. Such housing flanges 43 with complementary angled surfaces may be incorporated into other embodiments shown and described herein, including in railcars 1 and 2 that are configured to join to form a water barrier along straight or curved tracks.

Figure 90:
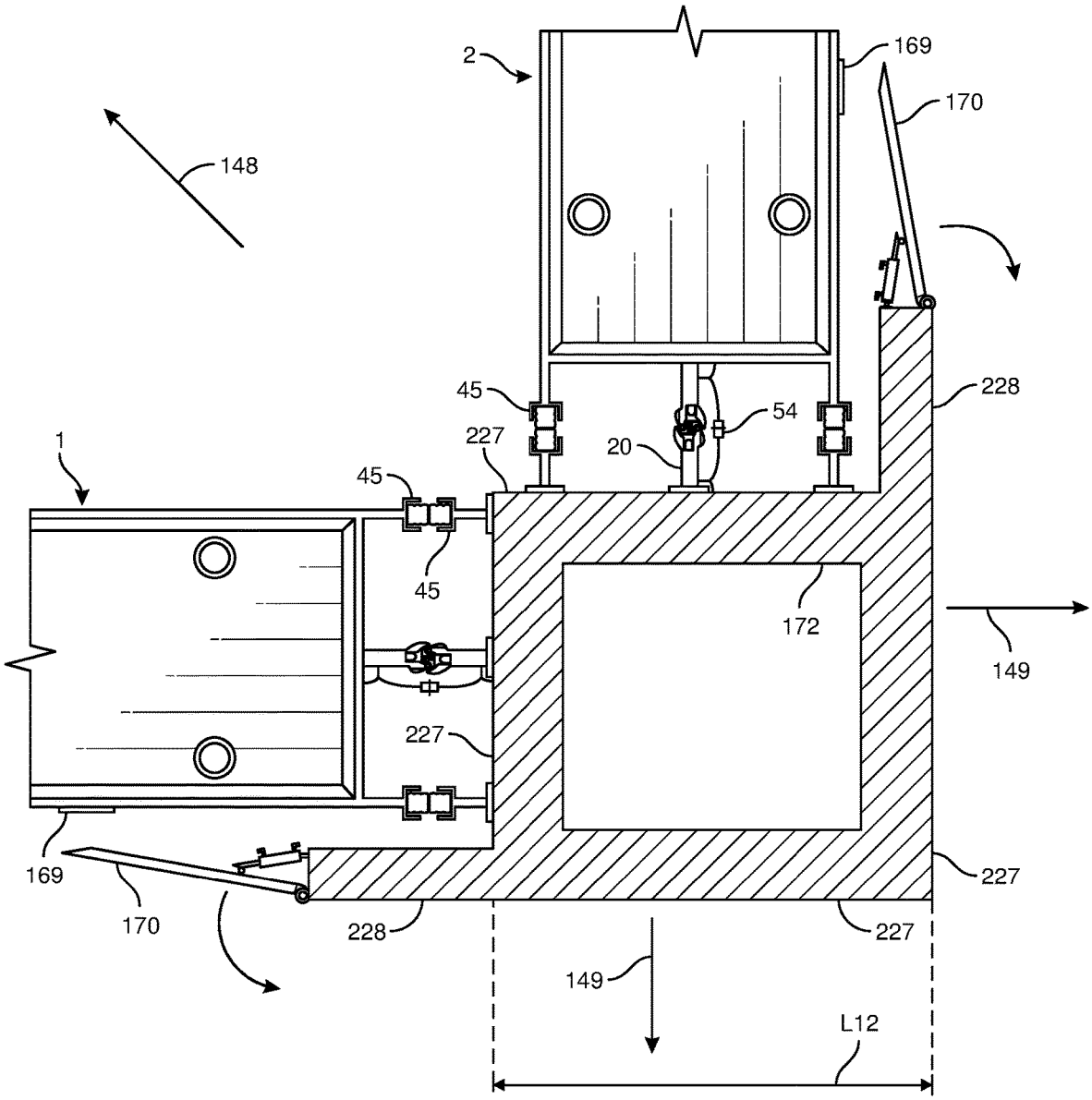
FIG. 90 shows a top view of two railcars that are docked to a docking tower, where storm doors are in an open position, according to embodiments of this disclosure.
Figure 93:
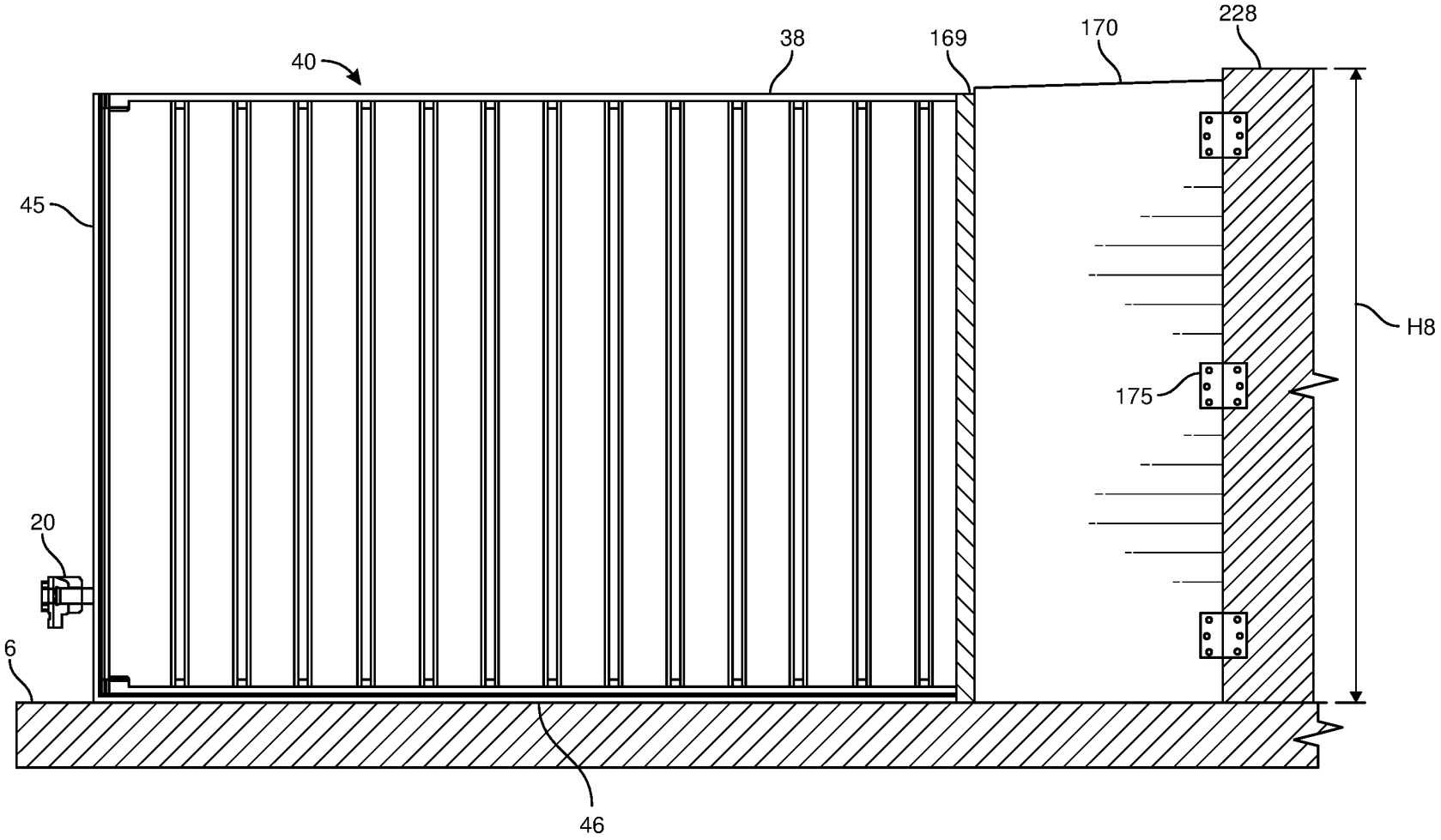
FIG. 93 shows a side view of a railcar with a docking tower's storm door sealed against the WBA sidewall vertical planar surface, according to embodiments of this disclosure.

In addition to curves, there may be situations where the water barriers may need to be deployed at an angle or a sharp change in direction. FIG. 90 shows a top view of the railcars 1 and 2 operating at a 90-degree angle while attached to a docking tower 172. It should be noted that the first railcar 1 may be the first in a plurality of railcars that are connected and extend in a first direction from the docking tower 172, and the second railcar 2 may be the first in a plurality of railcars that are connected and extend in a second, different direction from the docking tower 172. In some embodiments, the docking tower 172 may be made of concrete and may have four tower sidewalls 227 that are assembled at 90-degree angles to form a square. By way of example and not limitation, one side of the square may have a length L12 that is greater than the WBA width L13 (shown in FIG. 18). The docking tower 172 and wall extensions 228 may have a height H8 (shown in FIG. 93) that can be greater than, less than, or equal to the WBA height H4 (shown in FIG. 23).

Figure 91:
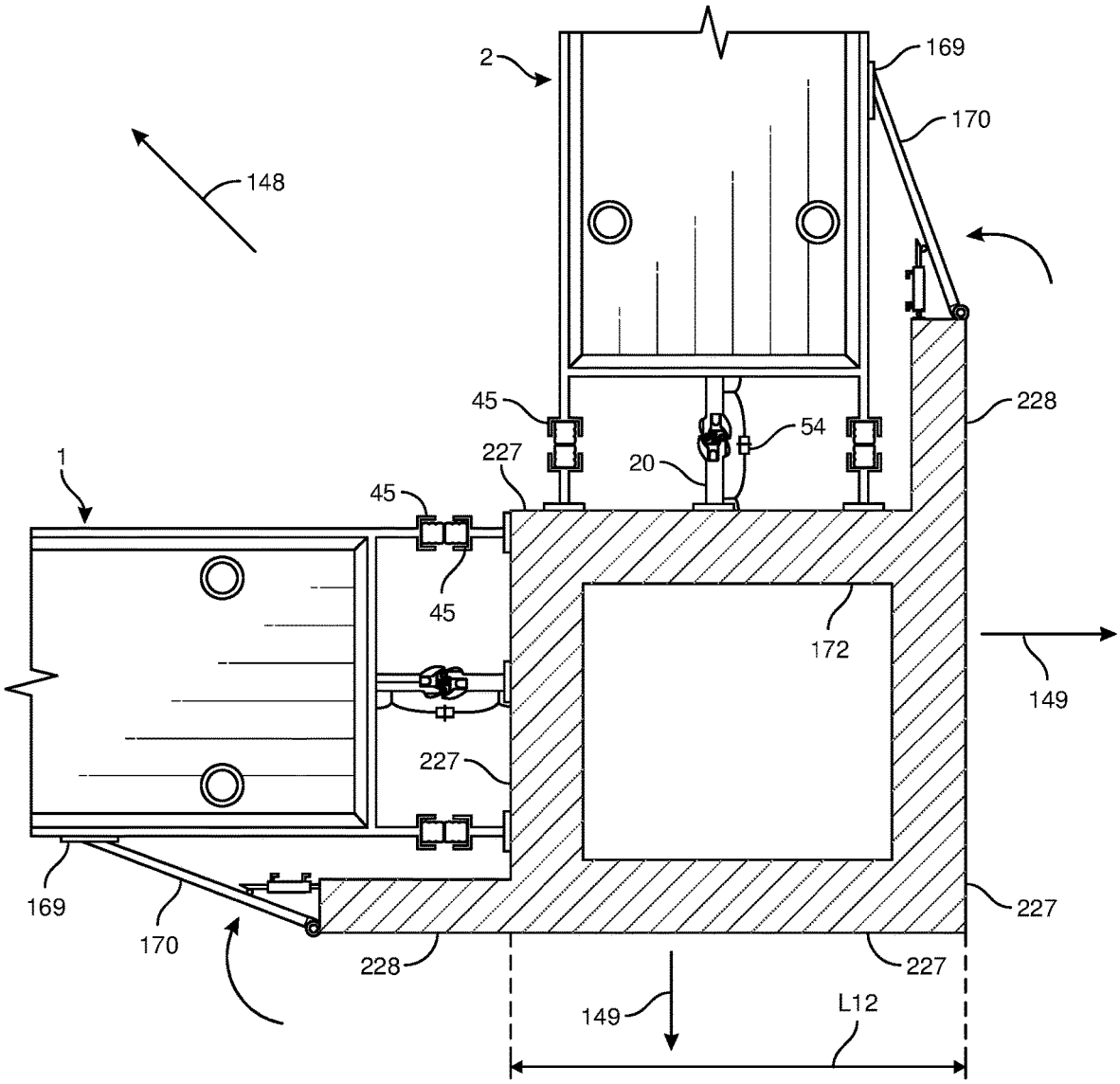
FIG. 91 shows a top view of the two railcars that are docked to the docking tower, where the storm doors are in a closed position, according to embodiments of this disclosure.
Figure 92:
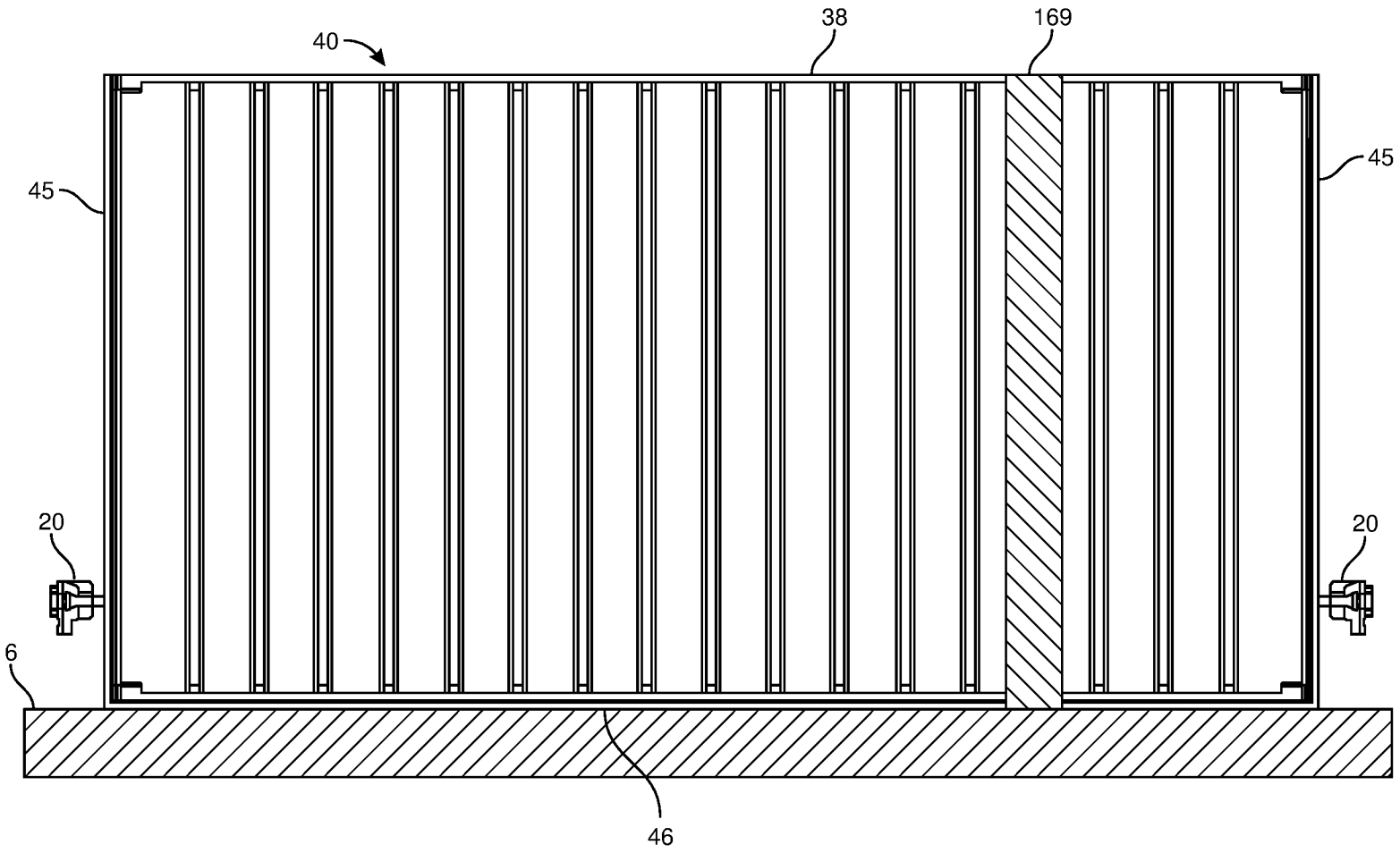
FIG. 92 shows a side view of a railcar with a vertical planar surface on the WBA sidewall, according to embodiments of this disclosure.

As illustrated in FIG. 90, two tower wall extensions 228, which may each have a storm door 170 attached with storm door hinges 175 (shown in FIG. 93), may extend from the docking tower 172. The storm door hinges 175 may allow the storm doors 170 to rotate around the hinge pins' vertical axes. The motion of the storm doors 170 may be controlled by hydraulic cylinders that may be operated by the respective controlling computer systems 104 through the resource couplers 54. The storm doors 170 may be provided with water sealing gaskets on both the sides and bottoms of the doors. In order to form a water seal against the railcars 1 and 2, each railcar 1 and 2 may be provided with a vertical steel door jamb 169 that may have a planar contact surface, as shown in FIG. 92. Additionally or alternatively, side GHAs 45 may extend from the docking tower 172 in a position and configuration to seal against the side GHAs 45 of the railcars 1 and 2, as shown in FIGS. 90 and 91.

When the storm doors 170 are closed on the door jamb 169, the storm door 170 gaskets may press against the door jamb 169 surface to form a water-resistant or water-tight mechanical seal between the storm doors 170 and the railcars 1 and 2. In addition, when the storm doors 170 are closed, the gaskets attached to the inner side of the storm doors 170 may press against the docking tower 172 to form a water-resistant or water-tight mechanical seal between the inner side of the storm doors 170 and the docking tower 172. The gaskets disposed on the bottom of the storm doors 170 may form a water-resistant or water-tight mechanical seal between the bottom the storm doors 170 and the planar surface 6.

FIG. 90 shows the storm doors 170 in an open position to allow the railcars 1 and 2 to movably dock or undock from the docking tower 172. FIG. 91 shows the storm doors 170 in a closed position in which the storm doors 170 may form water-resistant or water-tight mechanical seals against the railcars 1 and 2, the docking tower 172, and the planar surfaces 6. FIGS. 90 and 91 show the railcars 1 and 2 docked at the docking tower 172 at a 90-degree angle. However, the docking tower 172 can be constructed such that the railcars 1 and 2 can dock at any desired angle.

Figure 94:
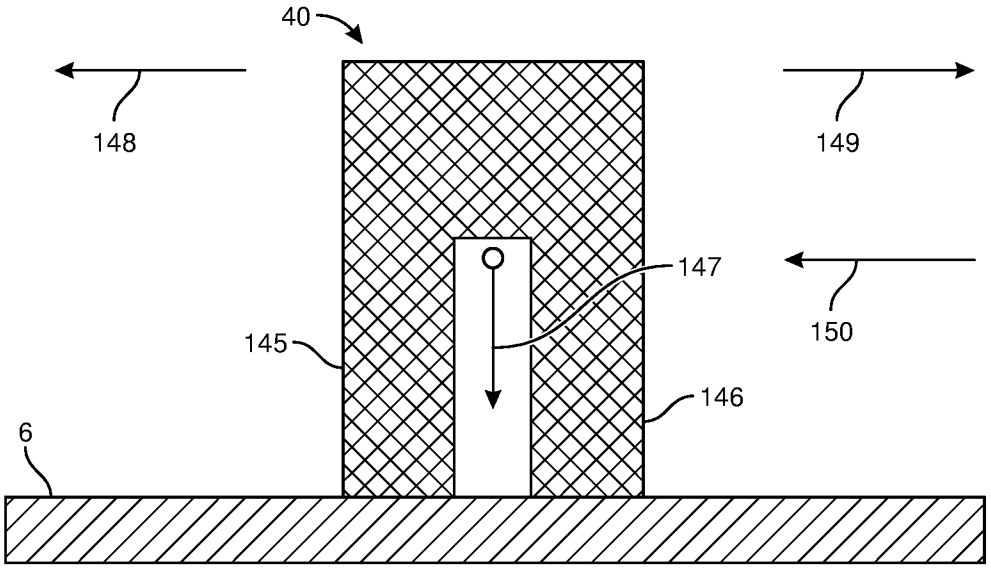
FIG. 94 shows an end view of a railcar in a deployed mode as a free-body diagram, according to embodiments of this disclosure.

FIG. 94 shows an end view of a free-body diagram that represents the WBA 40, where the weight 147 of the WBA 40 is resting on a planar surface 6. The WBA 40 may have a land-facing sidewall 145 and an ocean-facing sidewall 146. A weight 147 of the WBA 40 may be an enabling factor in the WBA's 40 ability to remain immovable in the face of water (e.g., storm surge) forces impacting or at rest against the ocean-facing sidewall 146. The greater the weight 147, the more secure the water barrier may be.

Figure 95:
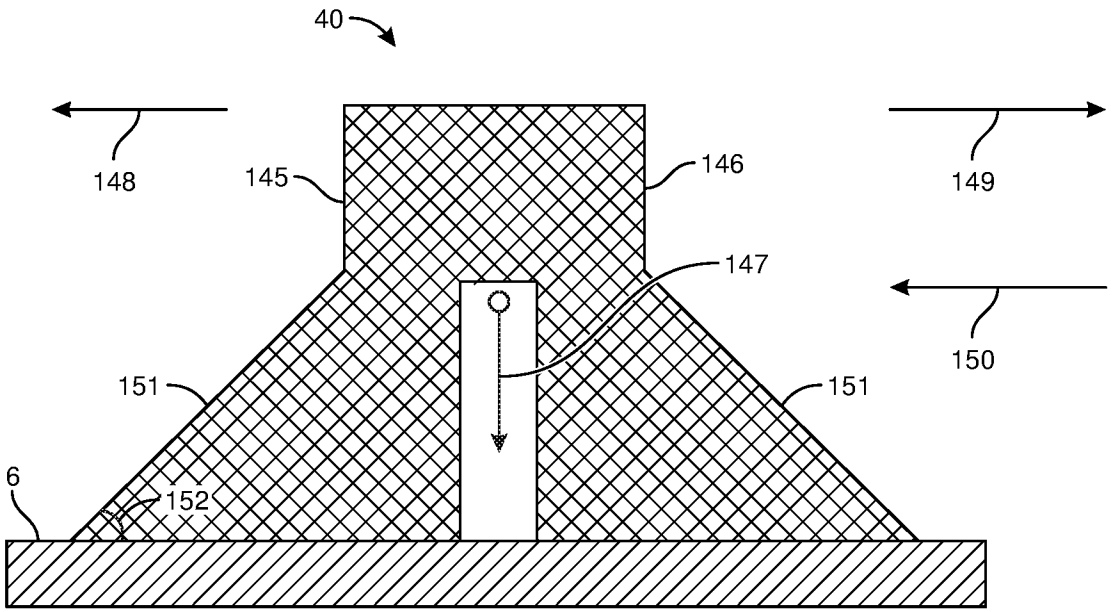
FIG. 95 shows an end view of an alternative free body diagram that represents a modified structure, according to embodiments of this disclosure.

FIG. 95 shows an end view of another free-body diagram that represents an alternative embodiment of the WBA 40. A portion of the ocean facing sidewall 146 may include a sloped surface 151. For example, the sloped surface may be made at a 45-degree angle 152, or some other angle, to the planar surface 6. Water striking the sloped surface 151 may simultaneously generate an inward horizontal force and a downward vertical force against the sloped surface 151. The downward vertical force may contribute to the WBA's 40 weight 147 and, therefore, the position stability and integrity of the WBA 40.

Figure 96:
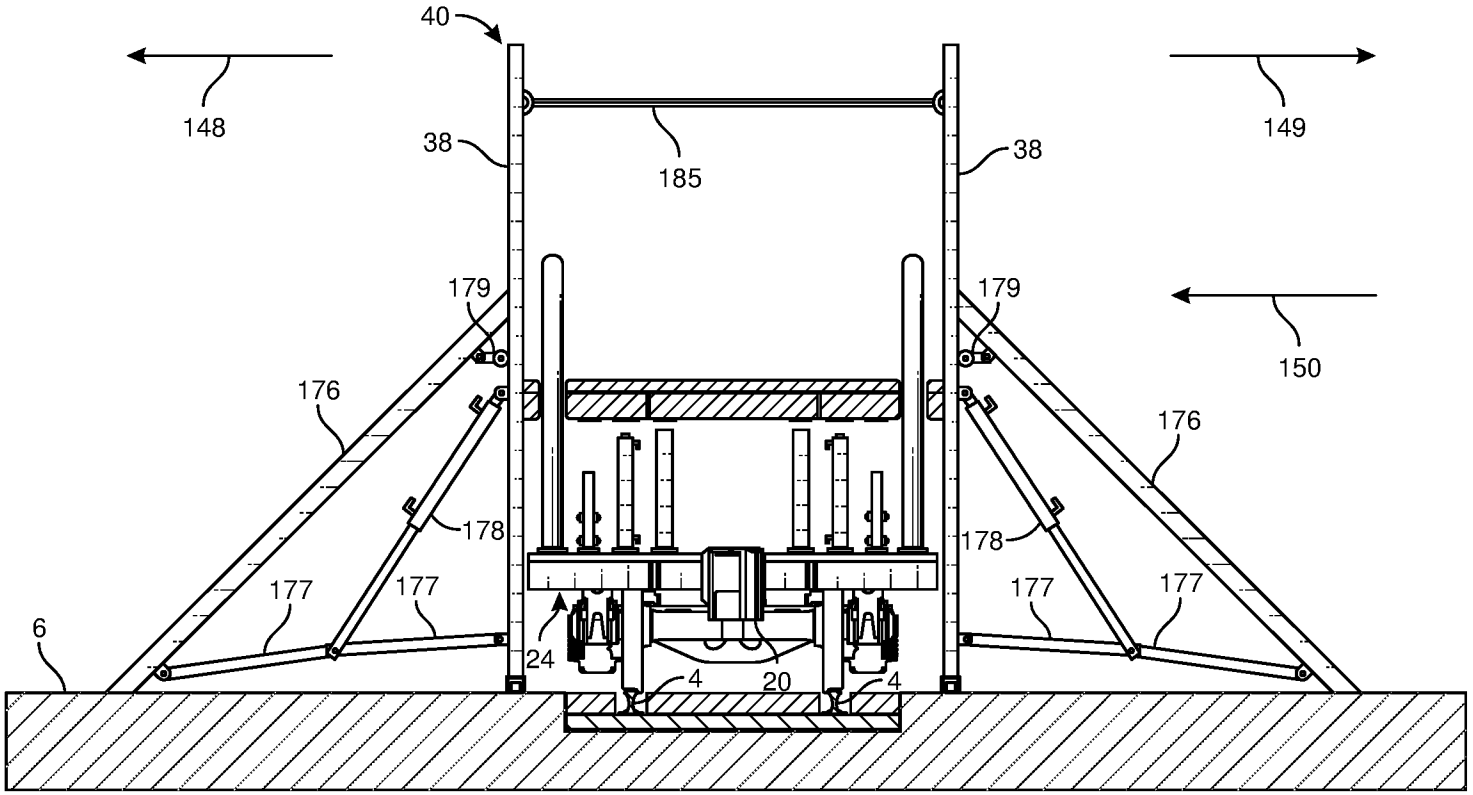
FIG. 96 shows a cross-sectional end view of a railcar with primary wave deflectors deployed on both sides of the WBA, according to additional embodiments of this disclosure.

The railcar can be made with a primary wave deflector (PWD) positioned on each side of the WBA 40 to provide the same benefits as the sloped surfaces 151, as well as additional stability by widening a base of the WBA 40. FIG. 96 shows an end view of the railcar with PWDs 176 positioned on the WBA 40, where the PWDs 176 are fully engaged. The PWDs 176 may be positioned at angle between the WBA sidewall 38 and planar surfaces 6. The PWDs 176 may be attached to and rest on the WBA sidewall 38 and planar surfaces 6, respectively. The PWDs 176 may have a length L14 (shown in FIG. 97) and a height H9 (shown in FIG. 101). The PWDs 176 may be articulated by the activation of PWD controlling cylinders 178. For example, the PWD controlling cylinders 178 may be operated by the controlling computer system 104.

The PWD controlling cylinders 178 may be connected to linkage arms 177 by joints. Opposite ends of the linkage arms 177 may be attached to the WBA sidewalls 38 and the PWDs 176. As the PWD controlling cylinder 178 piston rods are operated to their extended position, the linkage arms 177 may mechanically lower and push the lower portions of the PWDs 176 outward from WBA 40 to their expanded positions. The bottoms of the PWDs 176 may be landed onto the planar surfaces 6 at an angle 152 (FIG. 95), such as a 45-degree angle or some other angle. Simultaneously, as the PWD controlling cylinder 178 piston rods extend, upper portions of the PWDs 176 may move vertically downward as the PWDs 176 rotate around the PWD bearing assemblies 179. The vertical and rotational motions of the PWDs 176 may be controlled by mechanical interactions between the PWD bearing assemblies 179 and the vertically oriented PWD guide rails 180 (shown in FIG. 97). The PWD bearing assemblies 179 may be positioned and may operate inside of PWD guide rails 180.

The construction and assembly of the PWD bearing assemblies 179 and PWD guide rails 180 will be discussed in greater detail later in this document. The PWD controlling cylinders 178, linkage arms 177, PWD bearing assemblies 179, and PWD guide rails 180 may be used to move, place, control, and/or otherwise articulate the movement of the PWD 176. Alternatively, any one or combination of these components, with or without any other components, can be used to accomplish the same result. When the PWDs 176 are in their expanded positions, the top of the PWDs 176 may rest against the WBA sidewalls 38. In some examples, a part of the force from a storm surge 150 may be concentrated and potentially bend the ocean side 149 WBA sidewall 38 inward toward the interior of the WBA 40. In order to counteract these forces and the potential deformation of the WBA sidewall 38, I-beam sidewall braces 185 can be attached and extend from one WBA sidewall 38 to the other WBA sidewall 38 on the opposite side, as illustrated in FIG. 96.

Figure 97:
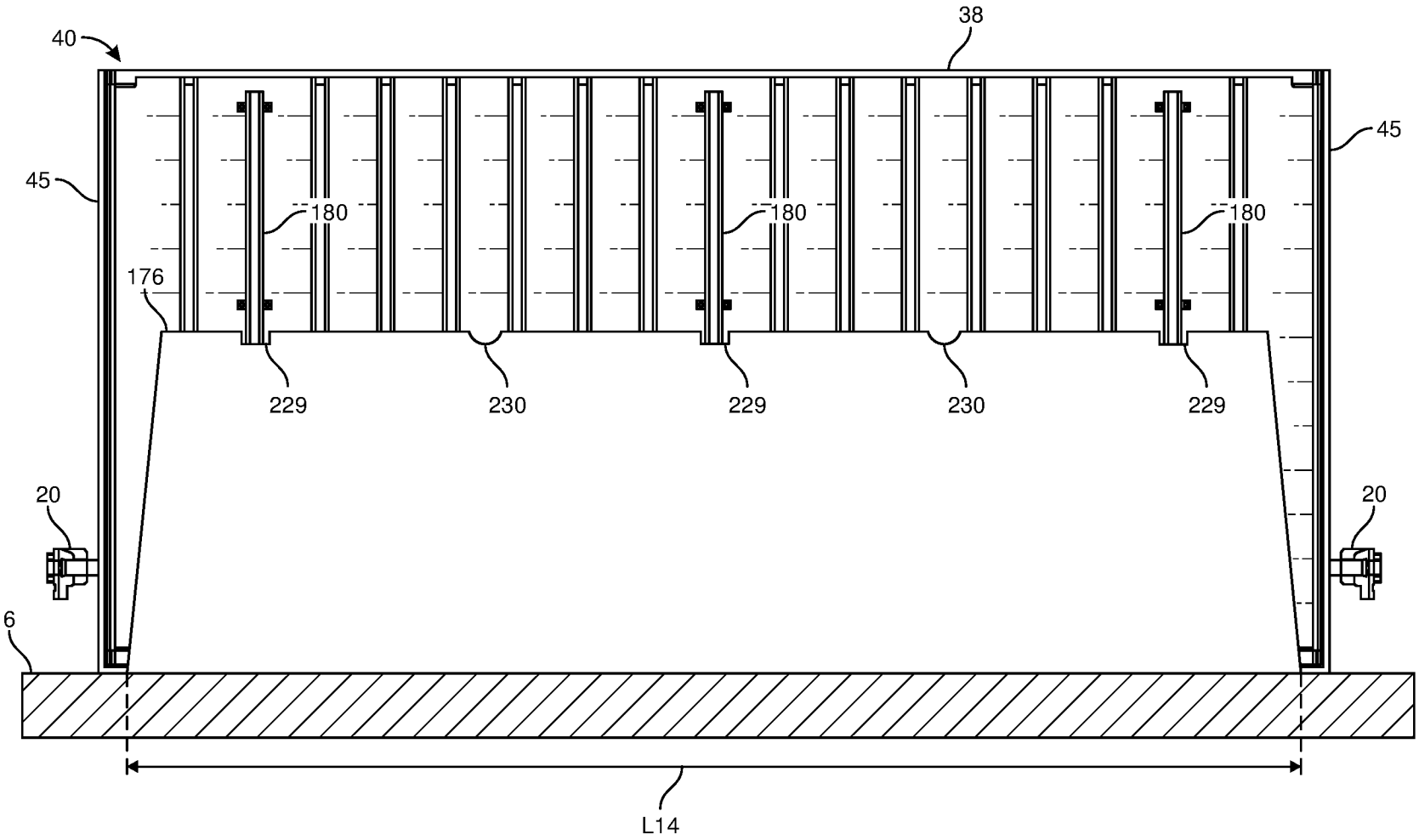
FIG. 97 shows a side view of the railcar with a primary wave deflector deployed on the side of the WBA, according to embodiments of this disclosure.

FIG. 97 shows a side view of the railcar with the PWD 176 being deployed and lying against the WBA sidewall 38 at an angle 152. Half-square shaped cut-out sections 229 may be made on the top of the PWD 176 to accommodate the physical space occupied by the PWD guide rails 180 as the remaining top edges of the PWD 176 lay flush against the WBA sidewall 38. In addition, half-shell bearings 230 may also be made on the top of the PWD 176 for reasons that will be discussed in greater detail later in this document. The three PWD guide rails 180 shown in FIG. 97 may each have a PWD bearing assembly 179 operating inside them and attached to the PWD 176. Separately, a PWD controlling cylinder 178 may be aligned with each of the PWD guide rails 180 and may operate with its own sets of linkage arms 177 as previously described.

Figure 98A:
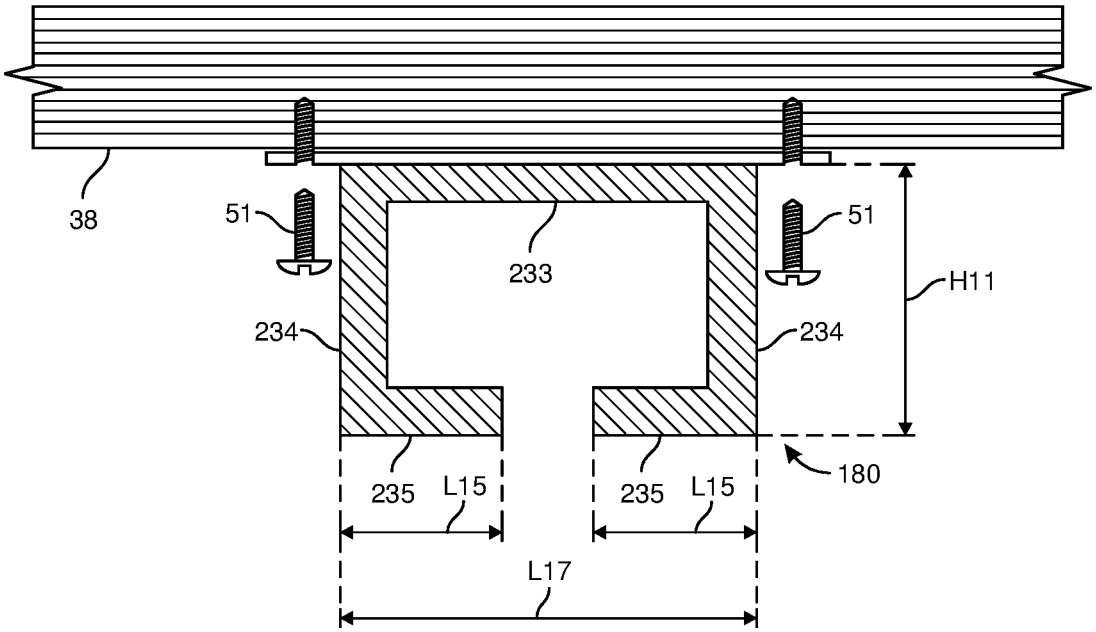
FIG. 98A shows a cross-sectional top view of a bearing track attached to a side of a WBA, according to embodiments of this disclosure.

FIG. 98A shows a top view of a PWD guide rail 180 that includes a C-channel beam. The guide rail web 233 may be attached to a bracket that may be attached to the WBA sidewall 38 with screws 51. A guide rail flange 234 with a height H11 may be attached to both sides of the guide rail web 233 at a 90-degree angle. The guide rail flanges 234 may have a width L17. Guide rail lips 235 may have a width L15 and may be attached to each flange at a 90-degree angle. A gap may exist between the guide rail lip 235 ends.

Figure 98B:
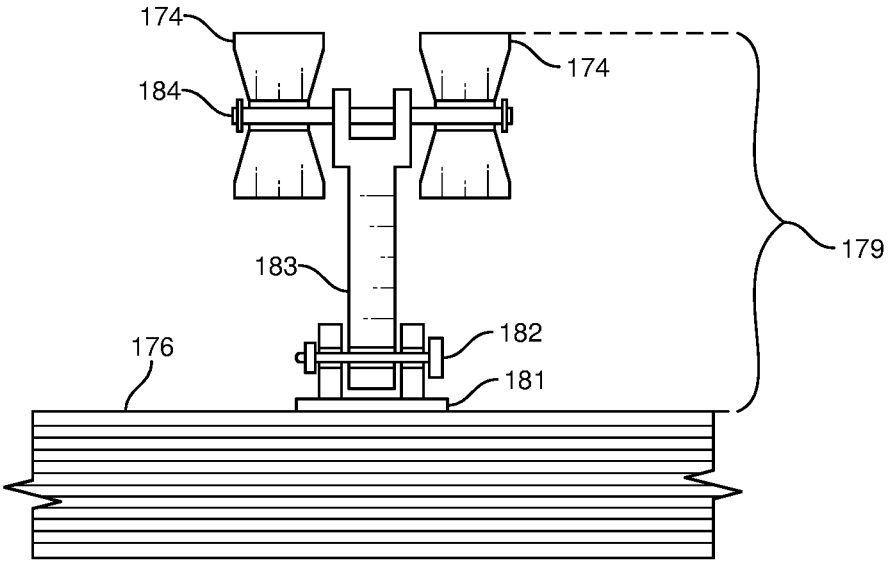
FIG. 98B shows a cross-sectional top view of a bearing assembly attached to an upper portion of the primary wave deflector, according to embodiments of this disclosure.

FIG. 98B shows a cross-sectional top view of the PWD bearing assembly 179, with a first side of the bearing assembly control arm 183 being movably attached to a bearing assembly hinge pin 182. The bearing assembly hinge pin 182 may be connected to a bearing assembly mounting bracket 181 that may be attached to the PWD 176. A second side of the bearing assembly control arm 183 may be attached to a bearing assembly axle 184 that may extend on both sides of the bearing assembly control arm 183. A roller bearing 174 may be mounted and secured on the bearing assembly axle 184 on each side of the bearing assembly control arm 183. The roller bearing 174 may be rotatable around the bearing assembly axle 184.

Figure 99:
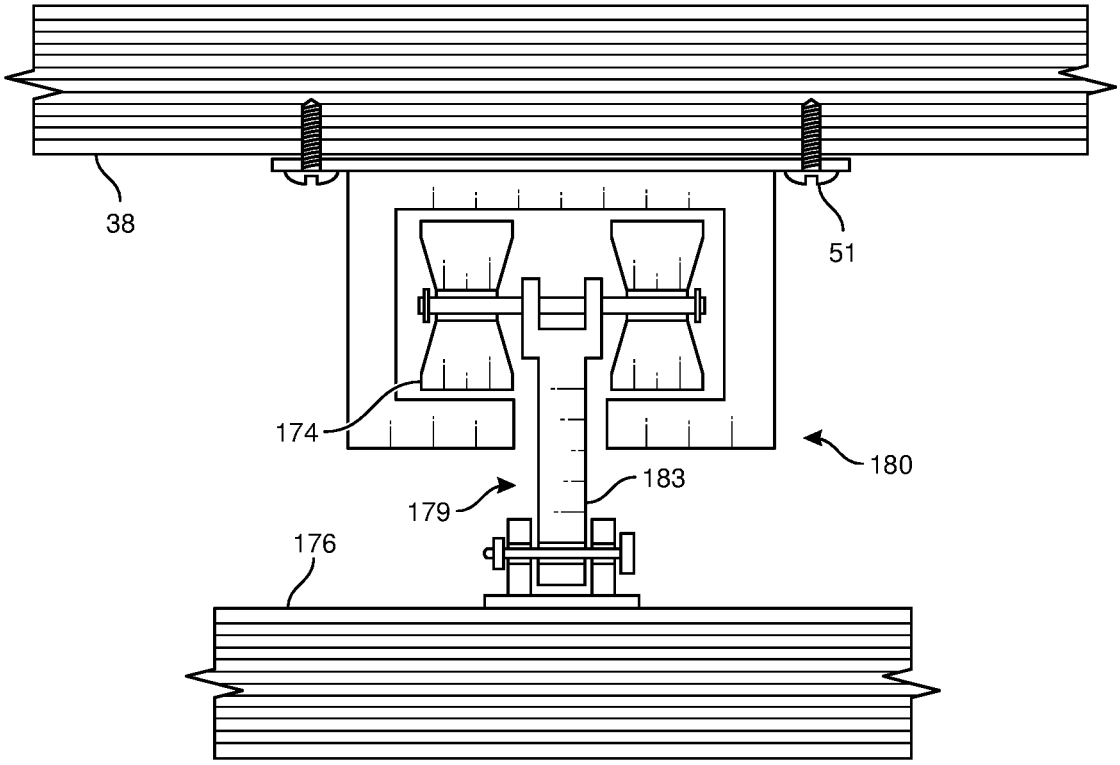
FIG. 99 shows a cross-sectional top view of an assembled bearing track and bearing assembly, according to embodiments of this disclosure.

FIG. 99 shows a top view of the PWD guide rail 180 assembled with the PWD bearing assembly 179. Referring to FIGS. 98 and 99 together, the roller bearings 174 may be positioned between inner surfaces of a guide rail web 233, guide rail flanges 234, and guide rail lips 235. The bearing assembly control arm 183 may be placed in the gap between the guide rail lip 235 ends. After assembly, the mechanical interactions between the PWD guide rail 180 and PWD bearing assembly 179 may restrict the upper portion of the PWD 176 to vertical movements up or down, which may be parallel to the WBA sidewall 38, while allowing the upper portion of PWD 176 to rotate around the axes provided by the PWD bearing assembly 179. Such axes may be centered on the bearing assembly hinge pins 182 and bearing assembly axles 184.

Figure 100:
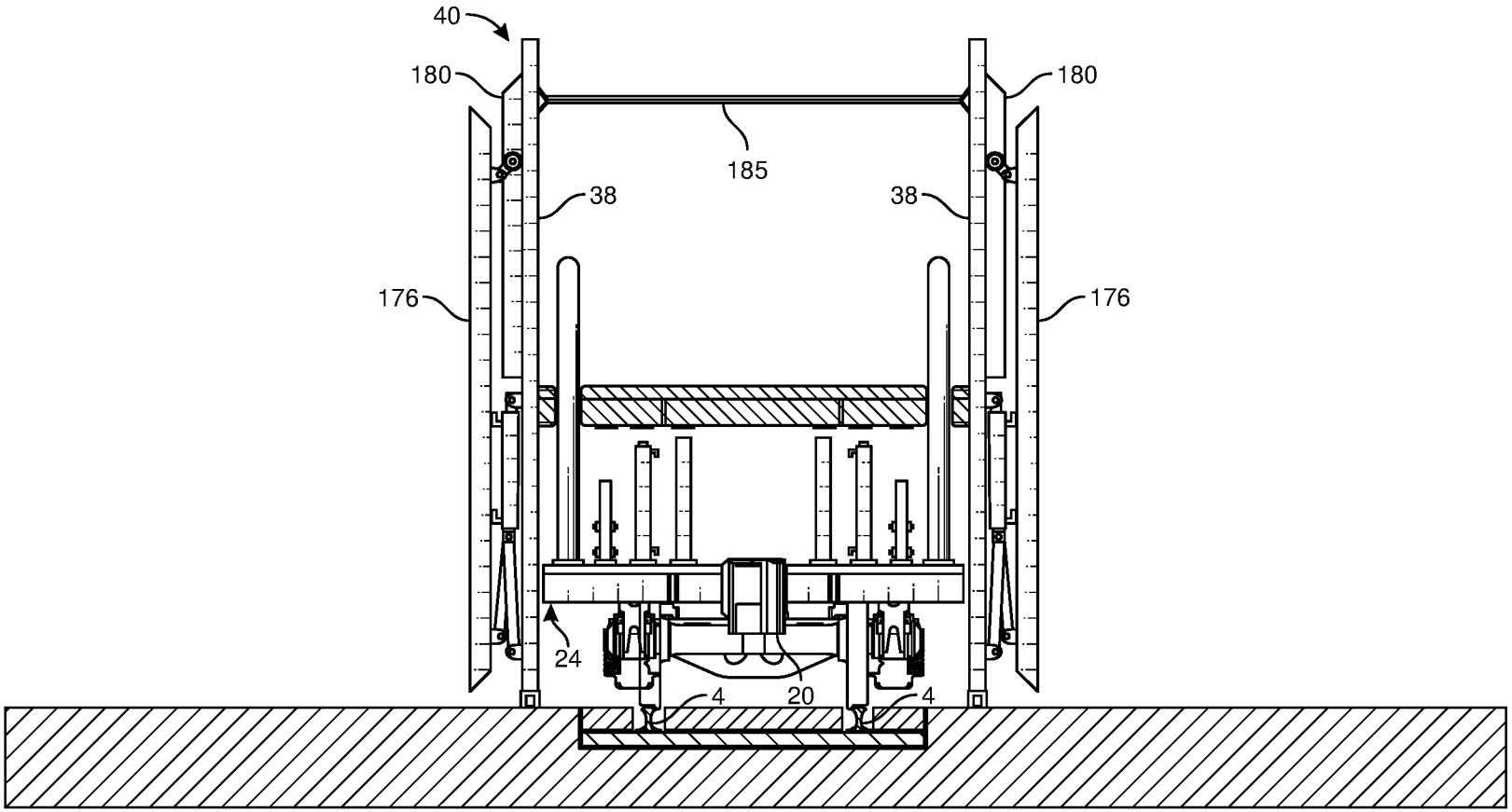
FIG. 100 shows a cross-sectional end view of a railcar with primary wave deflectors in a retracted position, according to embodiments of this disclosure.
Figure 101:
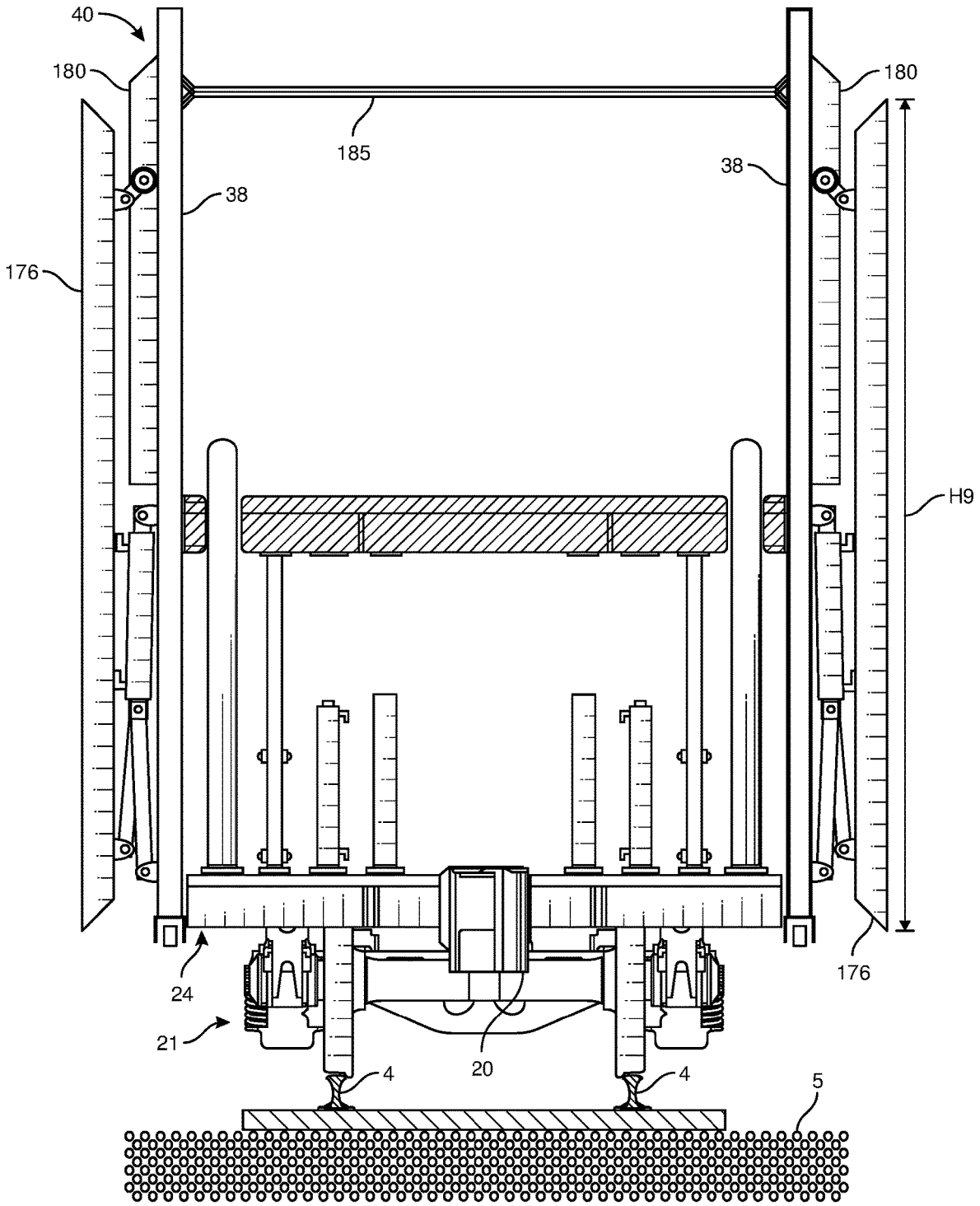
FIG. 101 shows another cross-sectional end view of the railcar with the primary wave deflectors retracted and lifted with the WBA in transport mode, according to embodiments of this disclosure.

FIG. 100 shows a cross-sectional end view of a railcar with the PWDs 176 disengaged, where the PWD controlling cylinder 178 piston rods are in their retracted positions. In the view of FIG. 100, the linkage arms 177 have mechanically raised and pulled the lower portions of the PWDs 176 inwardly toward the WBA 40. The bottoms of the PWDs 176 may be lifted off the planar surfaces 6. As the PWD controlling cylinder 178 piston rods retract, the upper portion of the PWDs 176 may move vertically upward as the PWDs 176 rotate around the PWD bearing assemblies 179. When the PWD controlling cylinder 178 piston rods are fully retracted, the PWDs 176 may be positioned close and parallel to the WBA sidewalls 38. FIG. 101 shows the railcar of FIG. 100 in a transport mode, where the WBA 40 and PWDs 176 are lifted to a higher position such that the railcar can safely be moved along the railroad tracks 4.

Figure 102:
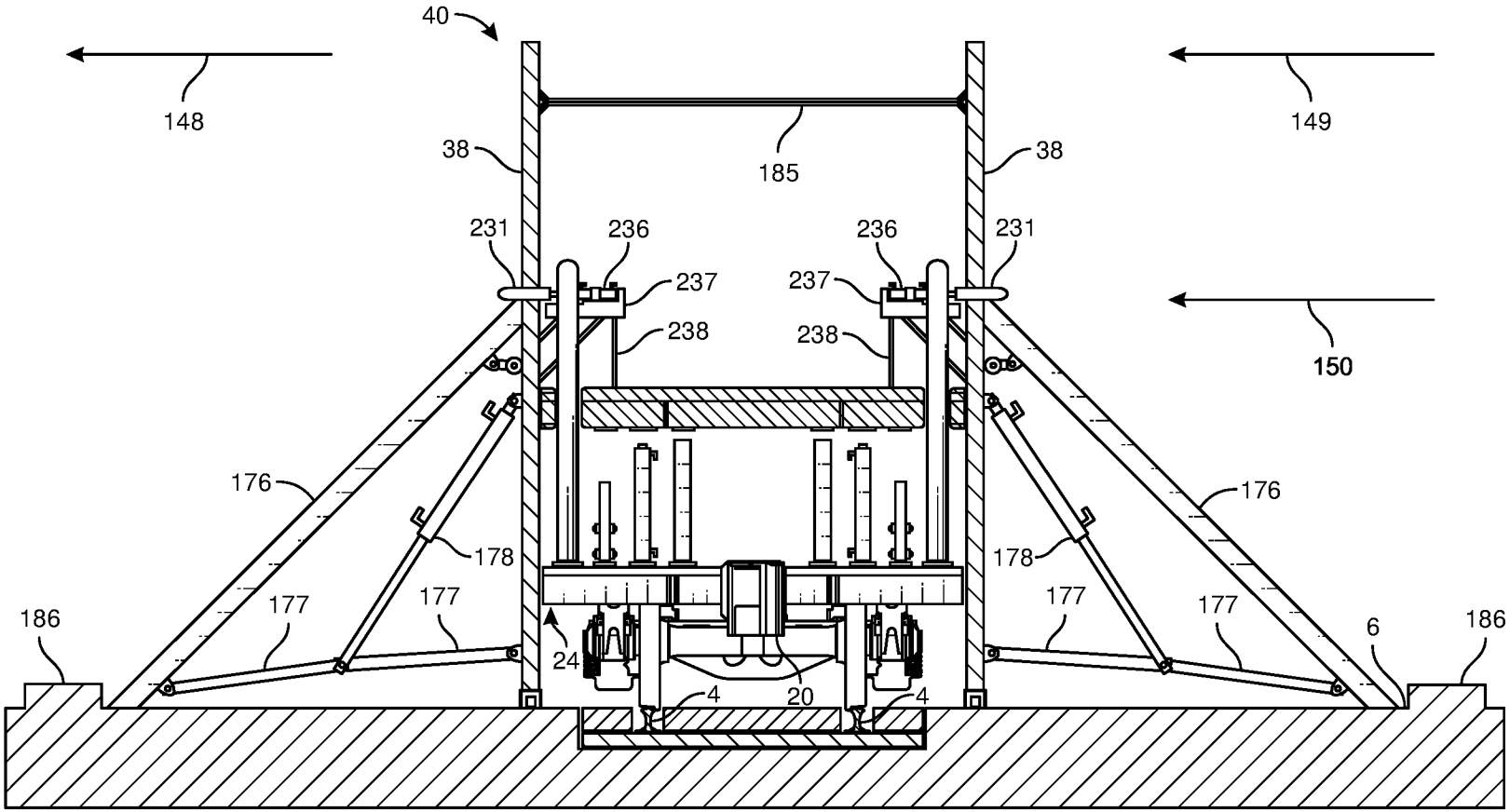

The railcar can be made with a PWD locking system that locks the PWD 176 in a downward, deployed position so that storm forces impacting or otherwise operating on the PWD 176 cannot lift the PWD 176 and compromise the integrity of the PWD. FIG. 102 shows a cross-sectional end view of the railcar with PWD deadbolts 231 movably positioned on the WBA 40 in their engaged mode. The PWD deadbolts 231 are fully extended in this example. The PWD deadbolts 231 may be controlled by the PWD deadbolt controlling cylinders 236 that are operated by the controlling computer system 104, described above. When the PWD deadbolts 231 are in their fully extended positions, the PWD deadbolts 231 may lock the PWDs 176 in their lowered positions by blocking the PWD's upper sections from being able to move upward, which is the mechanical motion used to move the PWDs 176 from their lowered positions. The ground-level blocks 186 may provide an additional mechanism to lock the entire WBA 40 into place. The ground-level blocks 186 may extend a height above the planar surface 6 and may extend a length L14 (refer to FIG. 97), or a part of the length L14. The vertical surfaces of the blocks 186 may engage the PWDs 176 at the bottom of the PWDs 176 and, by mechanical connection, inhibit the WBA 40 from moving horizontally and perpendicular to the vertical surfaces of the blocks 186. In addition, with the PWD deadbolts 231 engaged, the PWDs 176 may be locked into place by the PWD deadbolts 231 at the top of the PWDs 176 and the ground level blocks 186 at the bottom of the PWDs 176.

Figure 103:
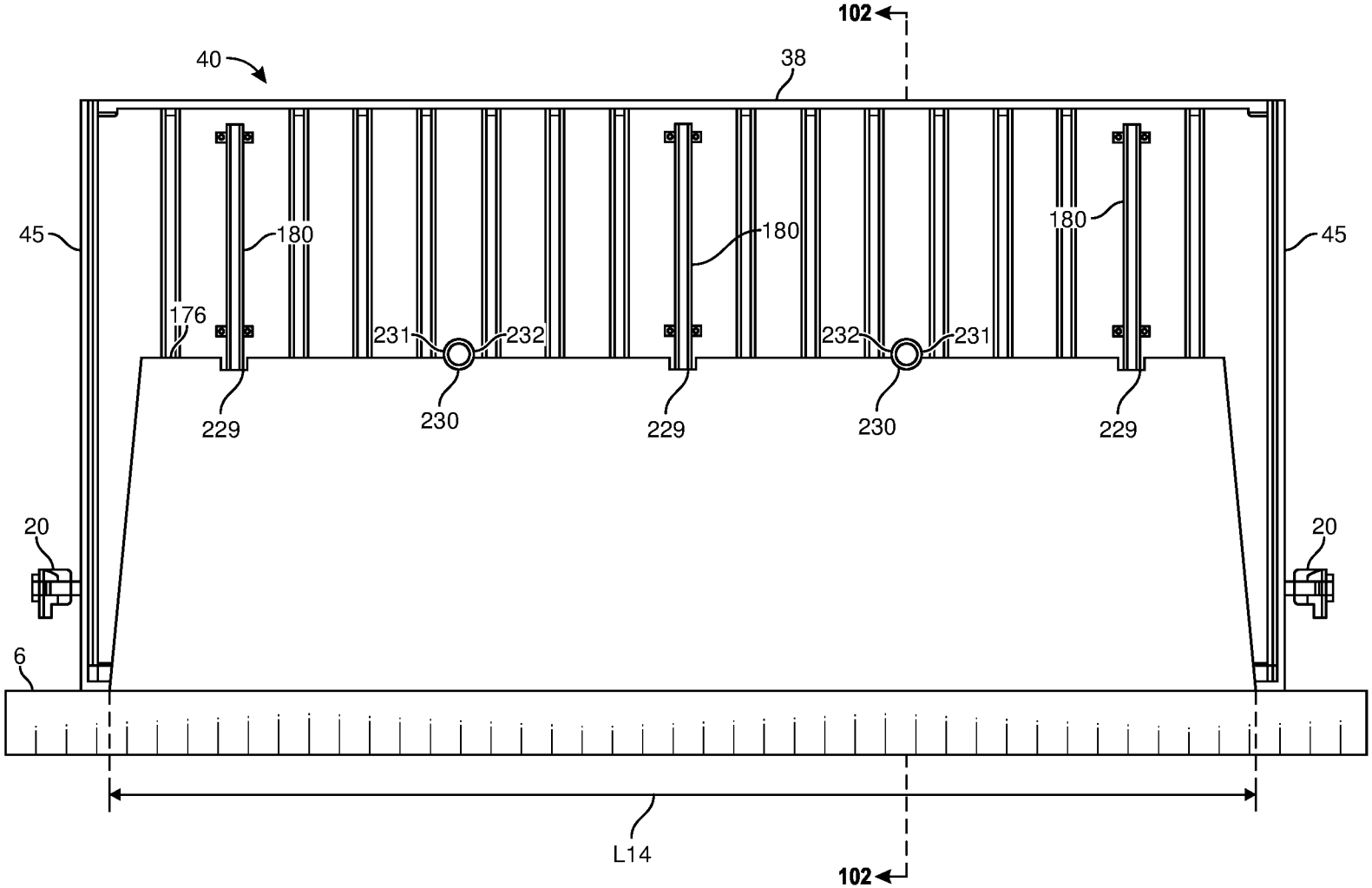

FIG. 103 shows a side view of the railcar with the PWD deadbolts 231 emerging through the sidewall holes 232 to block the motion of the PWD 176. When the PWD deadbolts 231 are fully extended, the PWD deadbolts 231 may be positioned and aligned to strike against the surfaces of the half-shell bearings 230 that are a part of the PWD 176. The radii of the half-shell bearings 230 may be slightly larger than the corresponding radii of the PWD deadbolts 231.

Figure 104A:
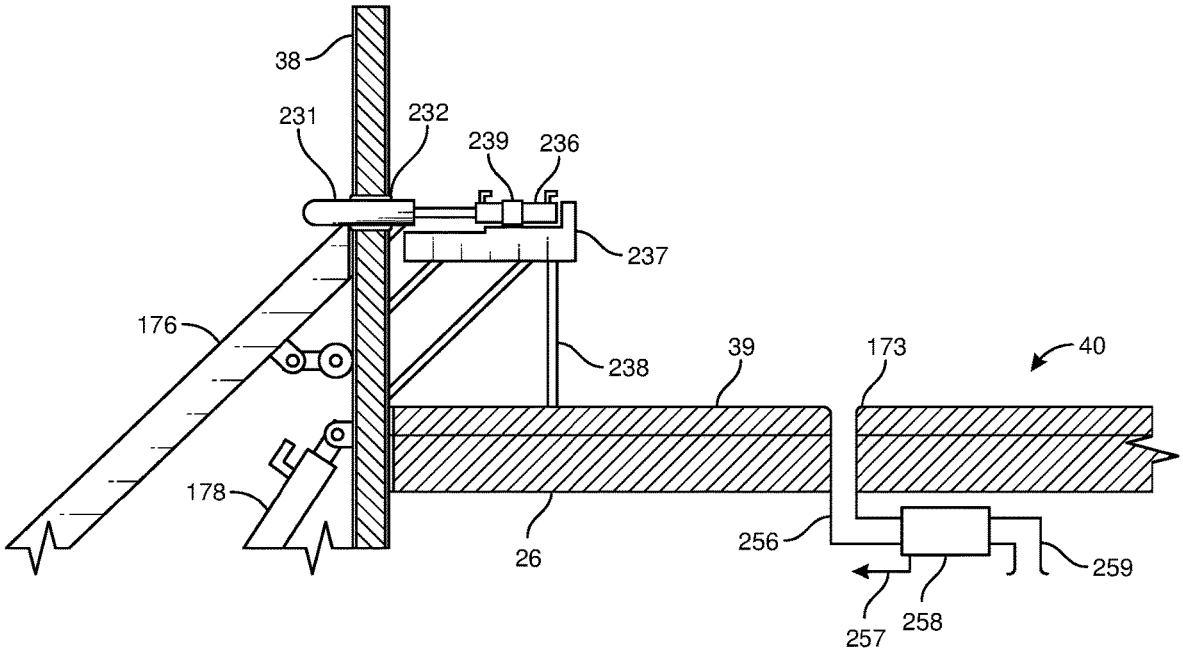
Figure 104B:
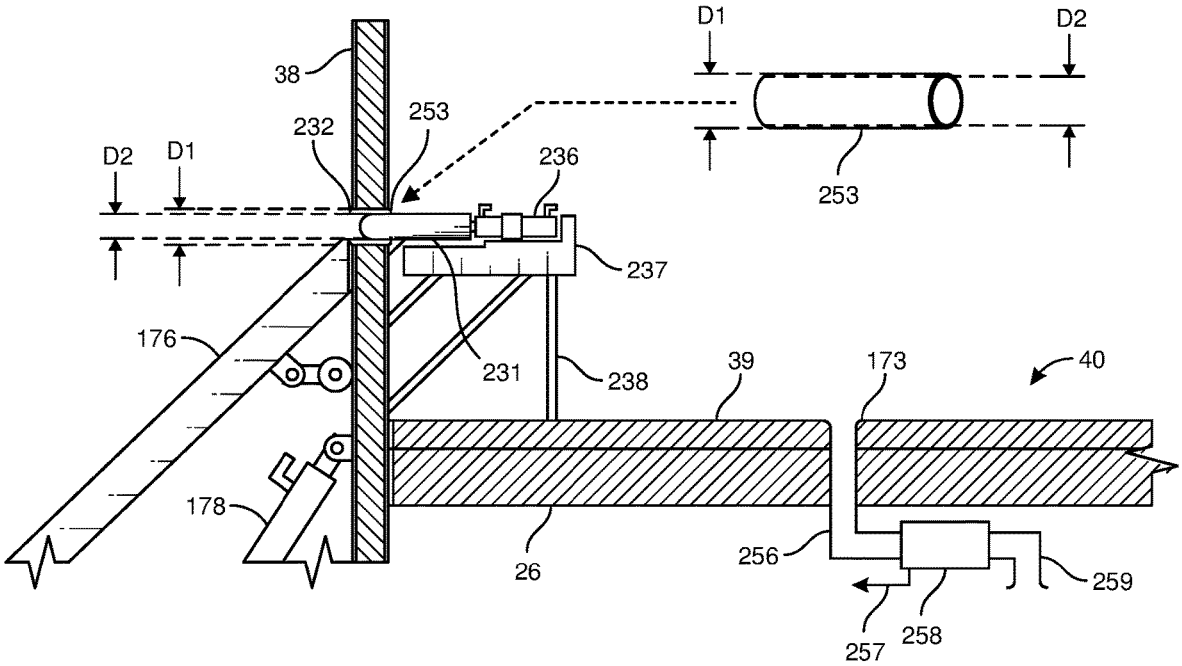

FIG. 104B shows a cross-sectional view of the PWD locking system in its disengaged mode. In this mode, the PWD deadbolt 231 may be fully retracted, with a tip of the PWD deadbolt 231 positioned behind the WBA sidewall's 38 outer surface such that the PWD deadbolt 231 is not in contact with the PWD 176. With the PWD deadbolt 231 in this position, the PWD 176 may be operated to close against the WBA sidewall 38 as described above and shown in FIG. 101. The PWD deadbolt 231 may be attached to a PWD deadbolt controlling cylinder 236. The PWD deadbolt controlling cylinder 236 may be operated by the controlling computer system 104 and may be attached to the deadbolt controlling cylinder platform 237 with a controlling cylinder bracket 239. The deadbolt controlling cylinder platform 237 may be positioned and supported by legs 238 that may be attached to the WBA sidewall 38 and WBA floor 39.

The sidewall hole 232 may have a diameter D1 that extends from an inner surface of the WBA sidewall 38 to an outer surface of WBA sidewall 38. The sidewall hole 232 may convey a fluid (water) through the WBA sidewall 38. Optionally, the sidewall hole 232 can be fitted with a bushing 253 that may have a uniform inner D2 and outer diameter D1 along its length. Use of a bushing 253 may provide a smooth, durable, inner radial surface for the reliable operation of the PWD deadbolt 231 within the bushing 253. The sidewall hole diameter D1 (FIG. 104B) can be changed to meet the design requirements, such as to accommodate a larger PWD deadbolt 231 in case greater forces are expected for a particular deployment. Optionally, the bushing 253 can be made to seat at least one O-ring gasket on the bushing's interior radial surface. The O-ring gasket may also be properly sized to fit around PWD deadbolt 231 to inhibit the passage of fluid (water) from one side of the O-ring gasket to the other.

FIG. 104A shows a cross-sectional view of the PWD locking system in its engaged mode. In this mode, the PWD deadbolt 231 may be fully extended. A portion of the PWD deadbolt 231 may be positioned a distance beyond WBA sidewall's 38 outer surface and the remaining portion may be positioned behind the WBA sidewall's 38 outer surface. The portion of the PWD deadbolt 231 that extends beyond the WBA sidewall's 38 outer surface may block the upward movement of the PWD 176 and, therefore, may lock the PWD 176 in its down, deployed position.

Figure 105:
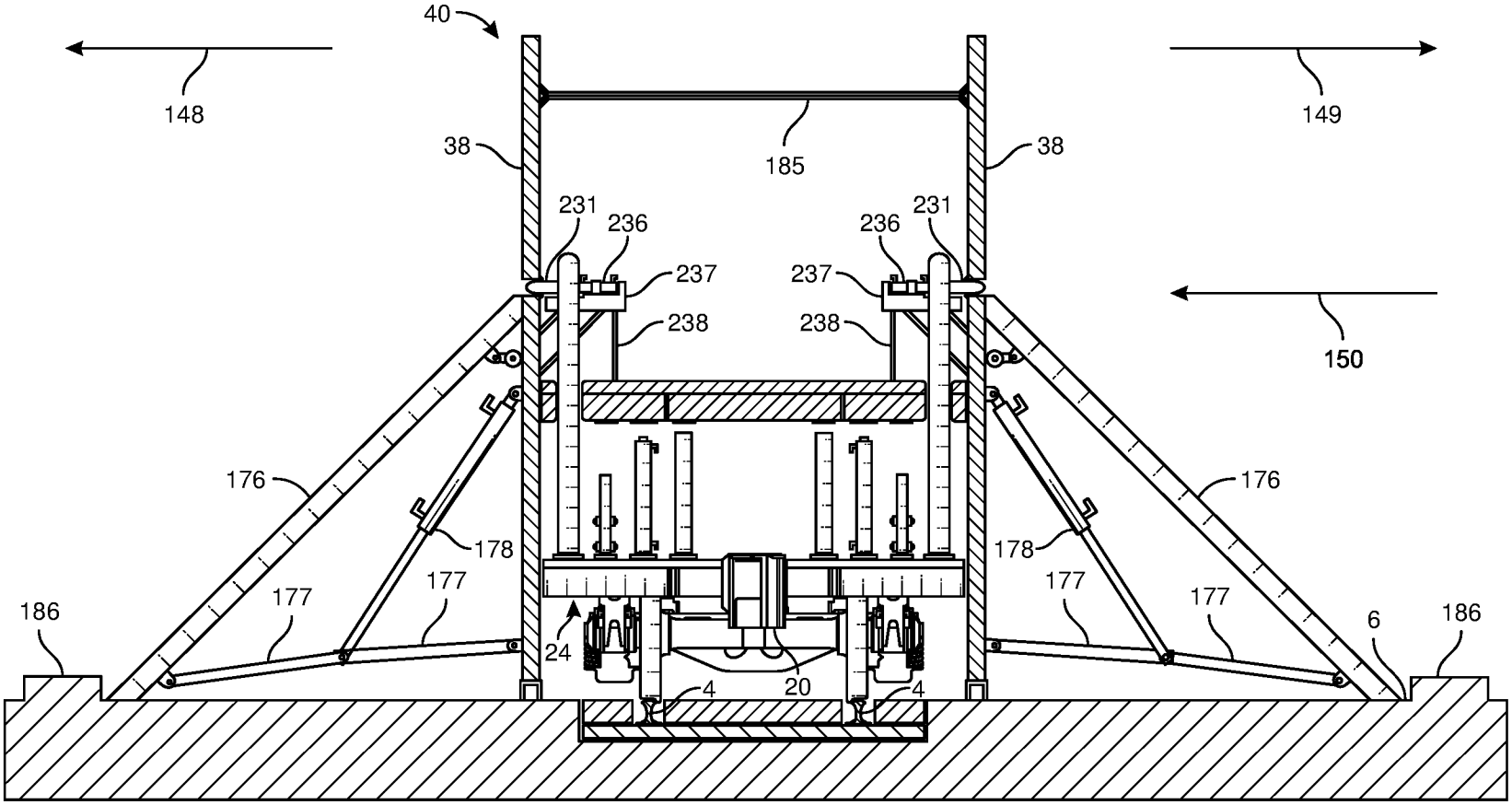

FIG. 105 shows a cross-sectional end view of the railcar with the PWD deadbolts 231 retracted. The PWDs 176 may be unlocked and able to move as operated by the PWD controlling cylinders 178.

Alternatively or additionally, the sidewall holes 232 may be used for a different purpose. FIG. 120A shows a cross-sectional end view of a railcar that includes a sidewall hole 232 positioned on the ocean side 149 WBA sidewall 38, at a vertical level above the WBA floor 39. In this case, the sidewall hole 232 may allow the WBA upper section 98 to flood with water 50 when the water level H12 rises vertically to and above the sidewall hole 232 level. It should be noted that the installation of a vertical guide rail covers 187 may seal and separate a WBA upper section 98 from a WBA lower section 144 (also shown in FIGS. 18 and 21). The WBA upper section 98 may be configured to hold water. For example, the vertical guide rail covers 187 may inhibit the water from flowing from the WBA upper section 98 to the WBA lower section 144 through gaps between the linear-motion bearings 34 and the vertical guide rails 55.

Optionally, in order to trap as much water as possible in the WBA upper section 98 during water wave events, hinged baffle plates 264 can be attached to the sidewall 38 interior surface and positioned over the sidewall holes 232. When water strikes the baffle plates with a sufficient force, the baffle plates 264 may open and allow water to flow into the WBA upper section 98, as shown in detailed view 265 of FIG. 120B. As soon as the water pressure decreases below the force necessary to keep the baffle plate 264 open, the baffle plate 264 may close to prevent water from escaping from the WBA upper section 98, as shown in detailed view 266 of FIG. 120C. At some point it may be desirable to release the water from the WBA upper section 98. As such, the WBA floor 39 may be fitted with a plurality of drainage holes 173, shown in FIGS. 104A and 104B, where the flow of fluid through the holes 173 may be regulated by drain valves 258 that may be electrically or hydraulically actuated, such as by the controlling computer system 104. In some embodiments, a drainage pipe 256 may be in fluid communication with the drainage hole 173 and may be operated by the drain valves 258. The drain valves 258 may be connected to the controlling computer system 104 by a drain valve control wire 257. A drainage discharge pipe 259 may be connected to an output side of the drain valve 258, such as to direct water to be discharged toward a drainage location.

FIG. 120A also shows another sidewall hole 207 that is positioned on WBA sidewall 38 facing the land side 148, at a vertical level below the WBA underframe 26 and close to the WBA bottom GHA 46. In this embodiment, the sidewall hole 207 may allow water in WBA lower section 144, if any, to drain out of the WBA lower section 144 and onto the surrounding land. Use of this sidewall hole 207 may also inhibit the potential flooding of the cylinders, electronics and other components.

The railcar can be made with a secondary wave deflector (SWD) that can stop waves from splashing over the WBA's 40 operational height H4 (FIG. 23). FIG. 106 shows a side view of the railcar with an SWD 197 that is movably disposed on top of the WBA sidewall 38. The SWD 197 may have a length L16 and a height H10. The outer facing surface of the SWD 197 may be planar in this example. The SWD 197 may be mounted on a plurality of SWD hinge arms 198.

Figure 107:
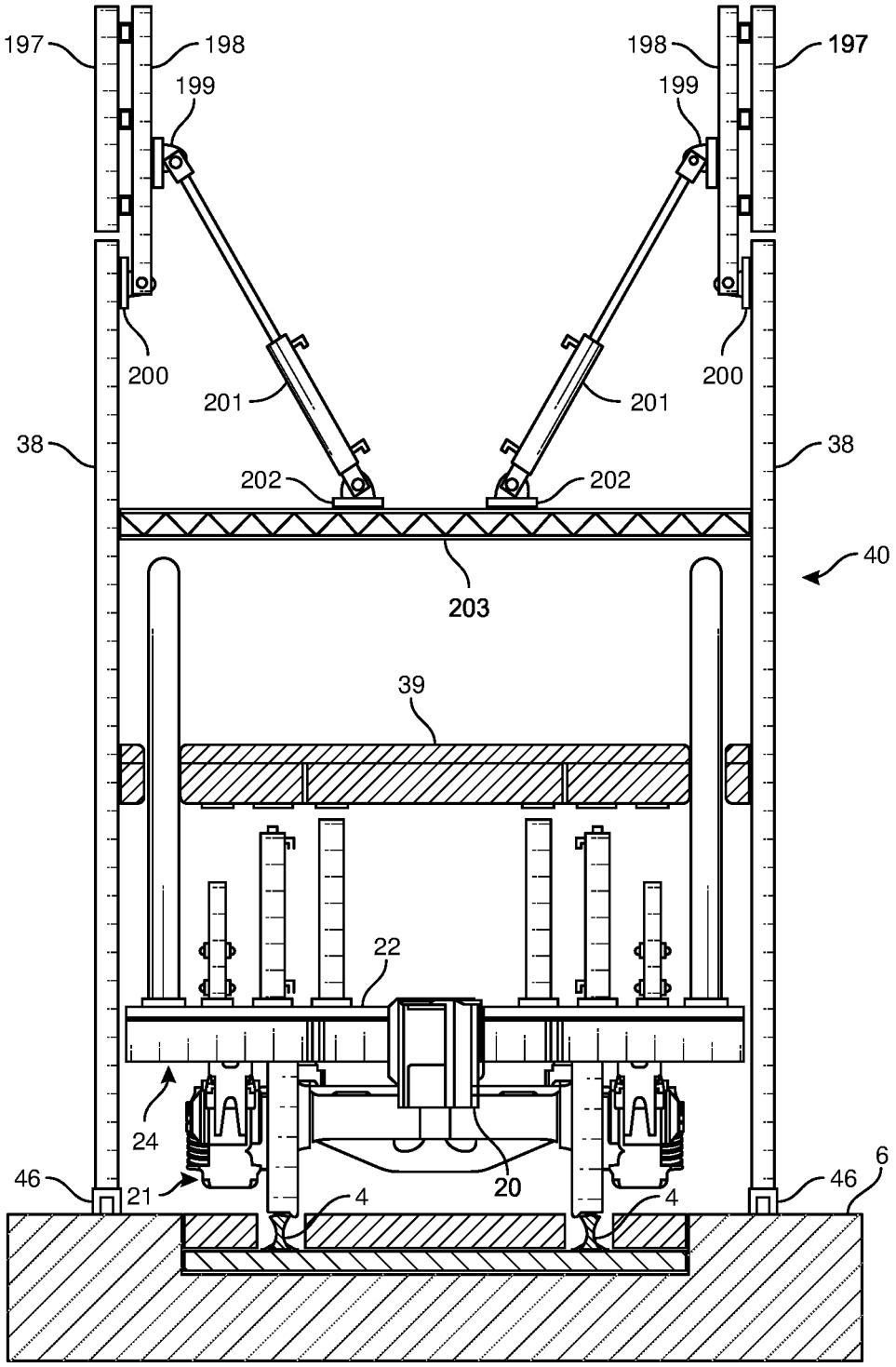
Figure 108:
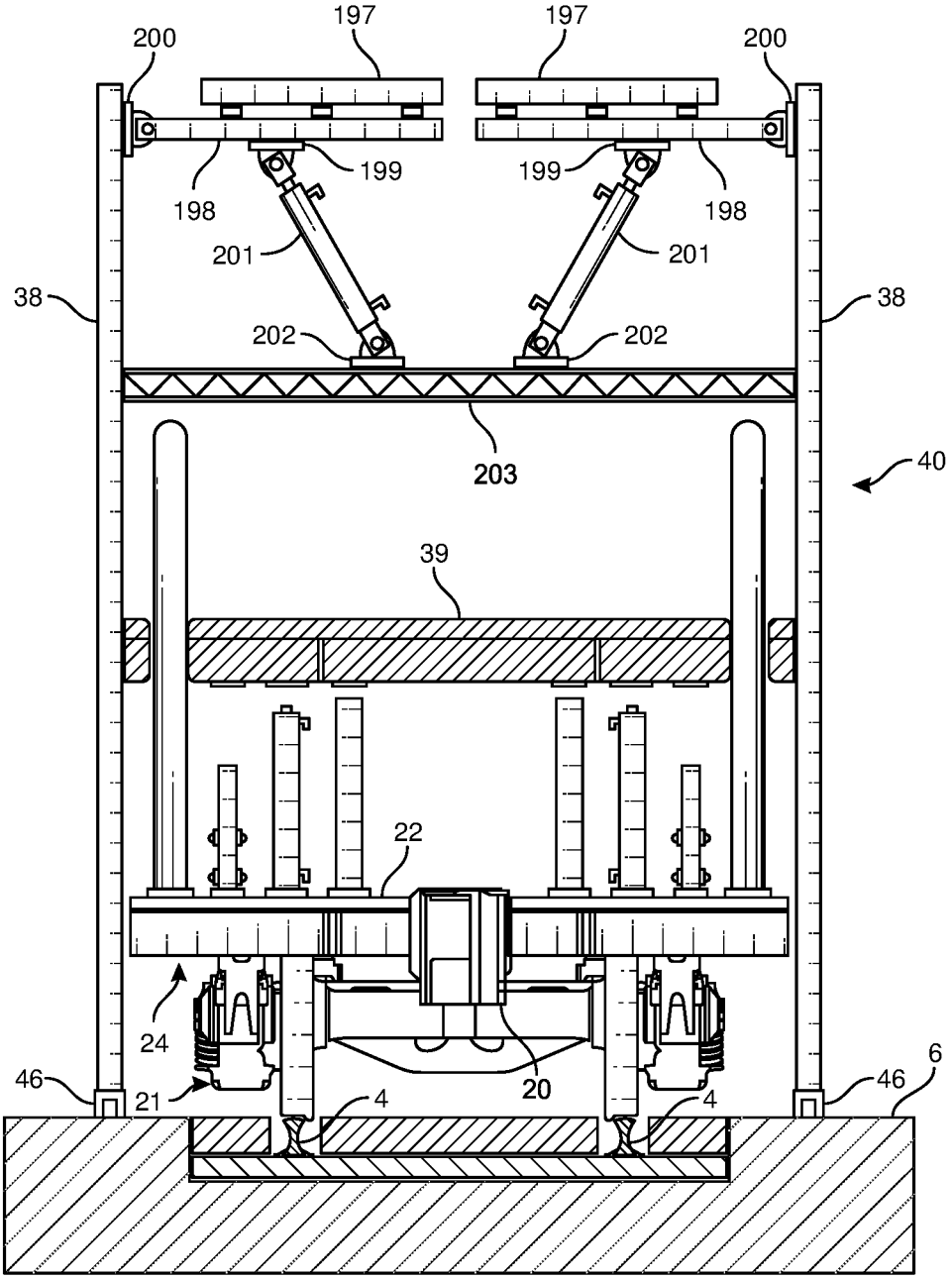
Figure 109:
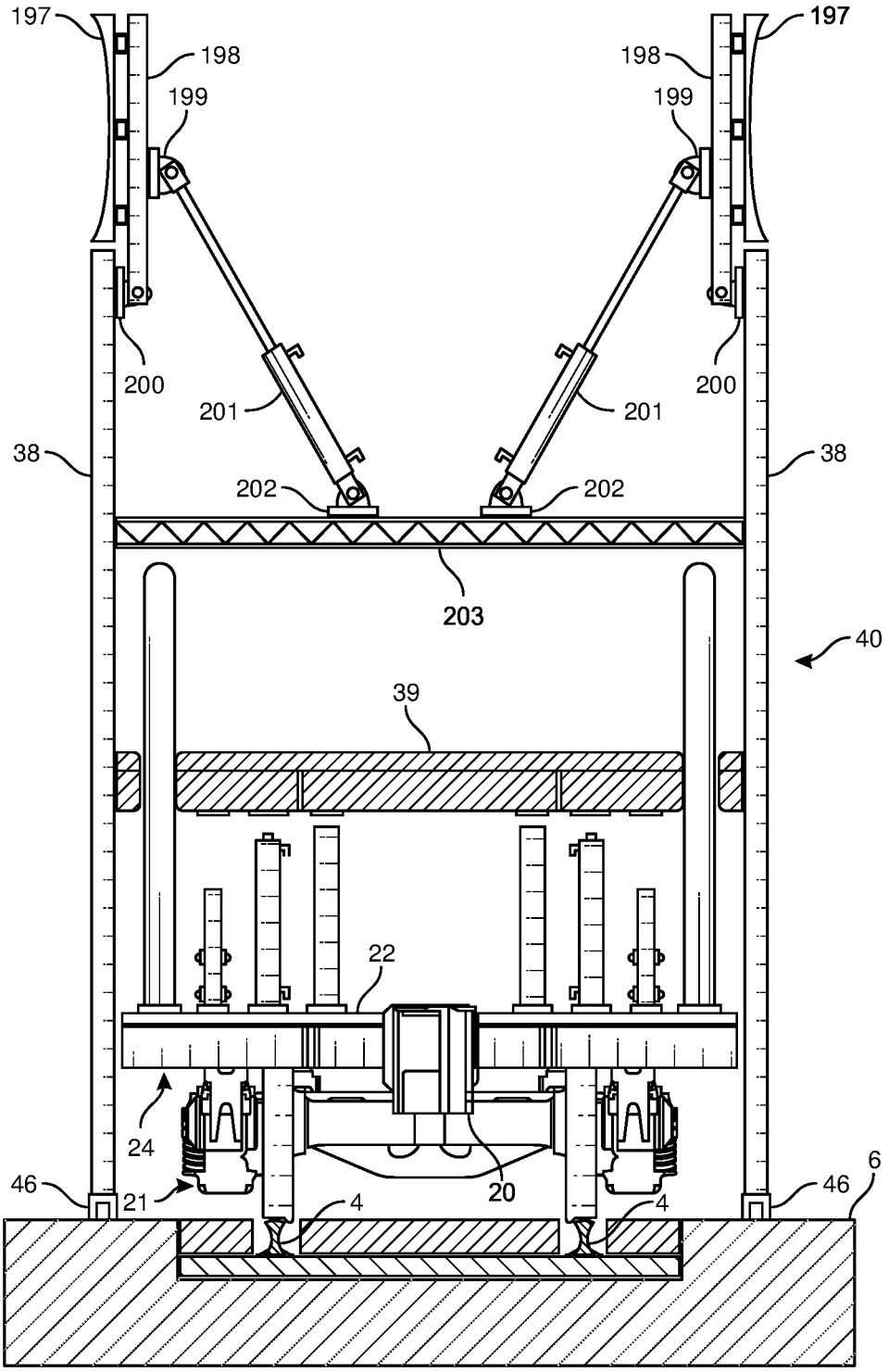

FIG. 107 shows an end view of the SWDs 197. The SWDs 197 may be attached to SWD hinge arms 198, which, in turn, may be attached to and rotatable around hinge/mounting bracket assembly 200 hinge pins. A bracket portion of the hinge/mounting bracket assemblies 200 may be attached to the WBA sidewalls 38. The positions of the SWDs 197 may be controlled by SWD controlling cylinders 201 that may be operated by the controlling computer system 104. Controlling cylinder piston rods may be connected to the SWD hinge arms 198 with upper cylinder hinge/mounting brackets 199. The bottom of the SWD controlling cylinders 201 may be attached to steel trusses 203 with lower cylinder hinge/mounting brackets 202. With the controlling cylinder piston rods operated to their extended positions, as shown in FIG. 107, the SWDs 197 may be positioned in their vertical positions to deflect water waves above the operational height H4 of the WBA 40. FIG. 108 shows that, with the controlling cylinder piston rods operated to their retracted positions, the SWDs 197 may be moved to their horizontal retracted positions, where they may be compatible with the railcar's transport mode. FIG. 109 shows that the SWD 197 outer facing surfaces can be made in an arcuate shape, for example. Both SWDs 197 can be operated to the same horizontal or vertical positions. Optionally, the SWDs 197 on a railcar can be configured such that one SWD 197 may be operated to the vertical position and another SWD 197 may be operated to the horizontal position. This optional configuration can allow the railcar's WBA upper section 98 to be filled with water. Referring to FIGS. 80, 107, and 108, with the land side 148 SWD 197 in the vertical position and the ocean side 149 SWD 197 in the horizontal position, any waves crashing over the ocean side 149 sidewall 38 can be blocked by the back of the land side 148 SWD 197 such that the blocked water can subsequently fall into and help fill the WBA upper section 98.

Figure 110:
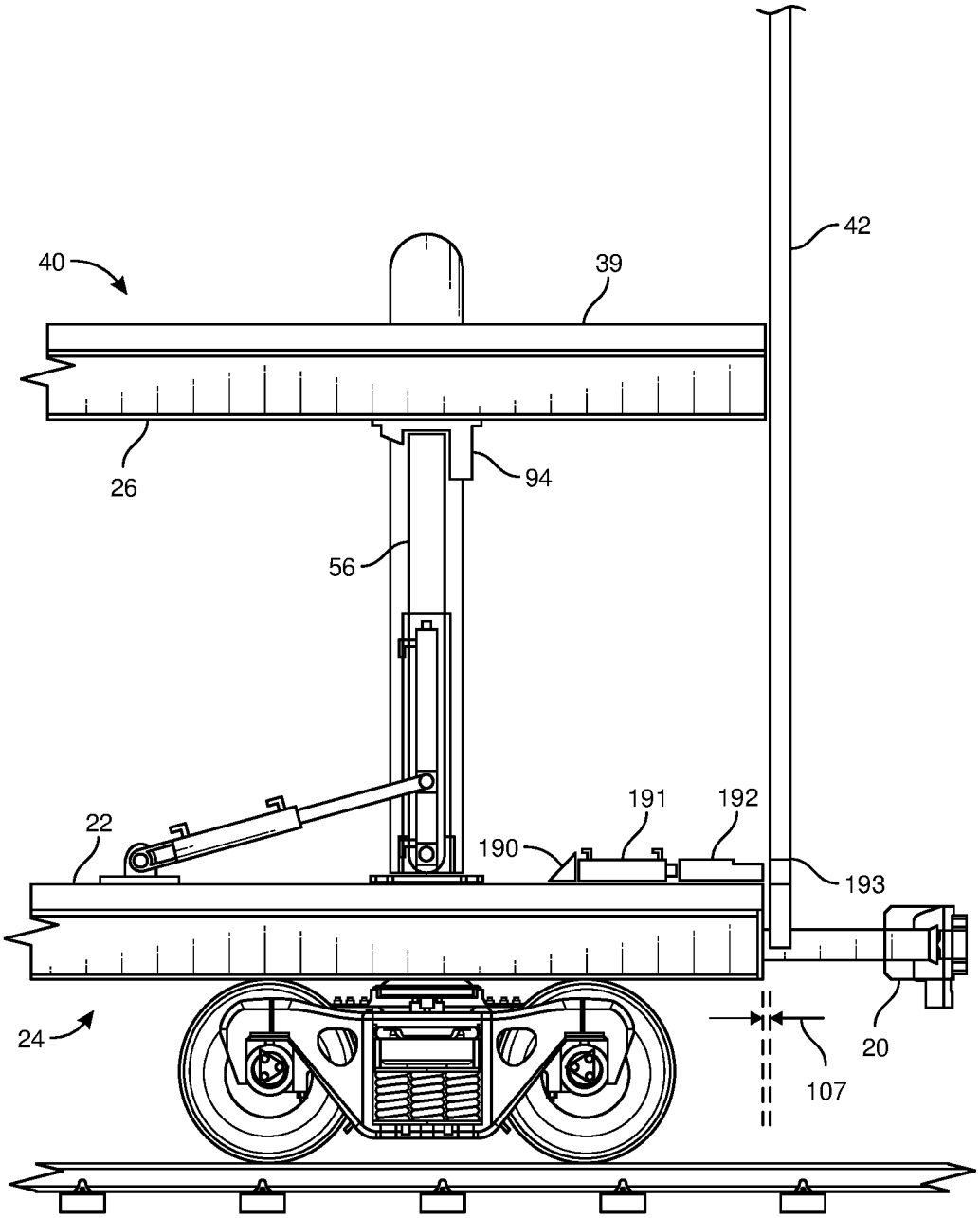

The railcar can be made with a brace/lock deadbolt system that may inhibit the lower portions of the WBA 40 from vibrating or striking against the BTPS 24. The brace/lock deadbolt system may also provide an additional mechanism to lock the WBA 40 in its transport mode position. For example, FIG. 110 shows a cross-sectional side view of an embodiment of a railcar in which a brace/lock deadbolt 192 may be movably attached to the BTPS floor 22. The brace/lock deadbolt 192 may be attached to the piston rod of a brace/lock deadbolt controlling cylinder 191. On its opposite end, the brace/lock deadbolt controlling cylinder 191 may be attached to the vertical surface of a controlling cylinder mounting block 190. The horizontal surface of the controlling cylinder mounting block 190 may be rigidly attached to the BTPS floor 22. The WBA endwall 42 may have a hole that is made into, or may be fitted with, a deadbolt endwall bearing 193 (e.g., a bushing). The brace/lock deadbolt controlling cylinder 191 may be operated by the controlling computer system 104. In the view of FIG. 110, the controlling computer system 104 has operated the brace/lock deadbolt 192 to a retracted position in which the brace/lock deadbolt 192 may be disengaged from the deadbolt endwall bearing 193. In this state, the WBA endwall 42 may be unlocked relative to the BTPS 24 by the brace/lock deadbolt 192.

Figure 111:
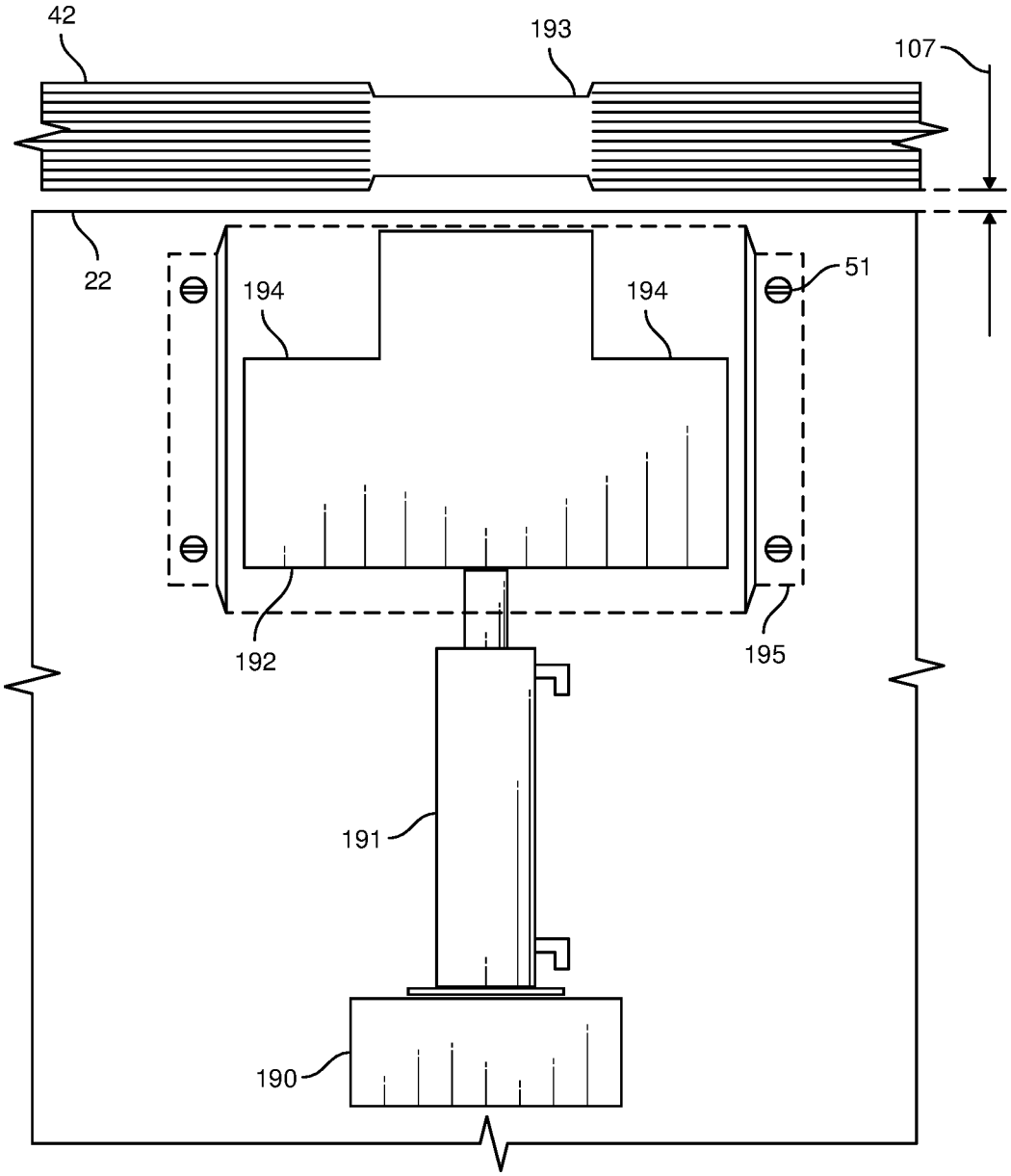

FIG. 111 shows a cross-sectional top view of an example brace/lock deadbolt assembly. The brace/lock deadbolt 192 may be movably attached to the BTPS floor 22 with a thick steel retaining bracket 195 that may be placed on top and around both sides of the brace/lock deadbolt 192. The deadbolt retaining bracket 195 may be attached to the BTPS floor 22 with screws 51, a weld, or another attachment mechanism (e.g., a fastener). The brace/lock deadbolt 192 may be attached to the piston rod of the brace/lock deadbolt controlling cylinder 191. On its opposite end, the brace/lock deadbolt controlling cylinder 191 may be attached to the controlling cylinder mounting block 190, which may be rigidly attached to the BTPS floor 22. The WBA endwall 42 may have a hole that is made into, or is fitted with, a deadbolt endwall bearing 193. In FIG. 111, the brace/lock deadbolt 192 is shown as retracted to its disengaged position from the deadbolt endwall bearing 193. In this example, the WBA endwall 42 may not be locked to the BTPS 24 by the brace/lock deadbolt 192.

The brace/lock deadbolt 192 may be made with shoulders 194 on both sides of the deadbolt 192. When the brace/lock deadbolt 192 is fully engaged into the deadbolt endwall bearing 193, the brace/lock deadbolt shoulders 194 may press against the inner surface of the WBA endwall 42 to brace the WBA endwall 42 from horizontal movements inward and striking the BTPS 24. The bracing action of the shoulders may be able to maintain the WBA-to-BTPS gap 107, as described above.

Figure 112:
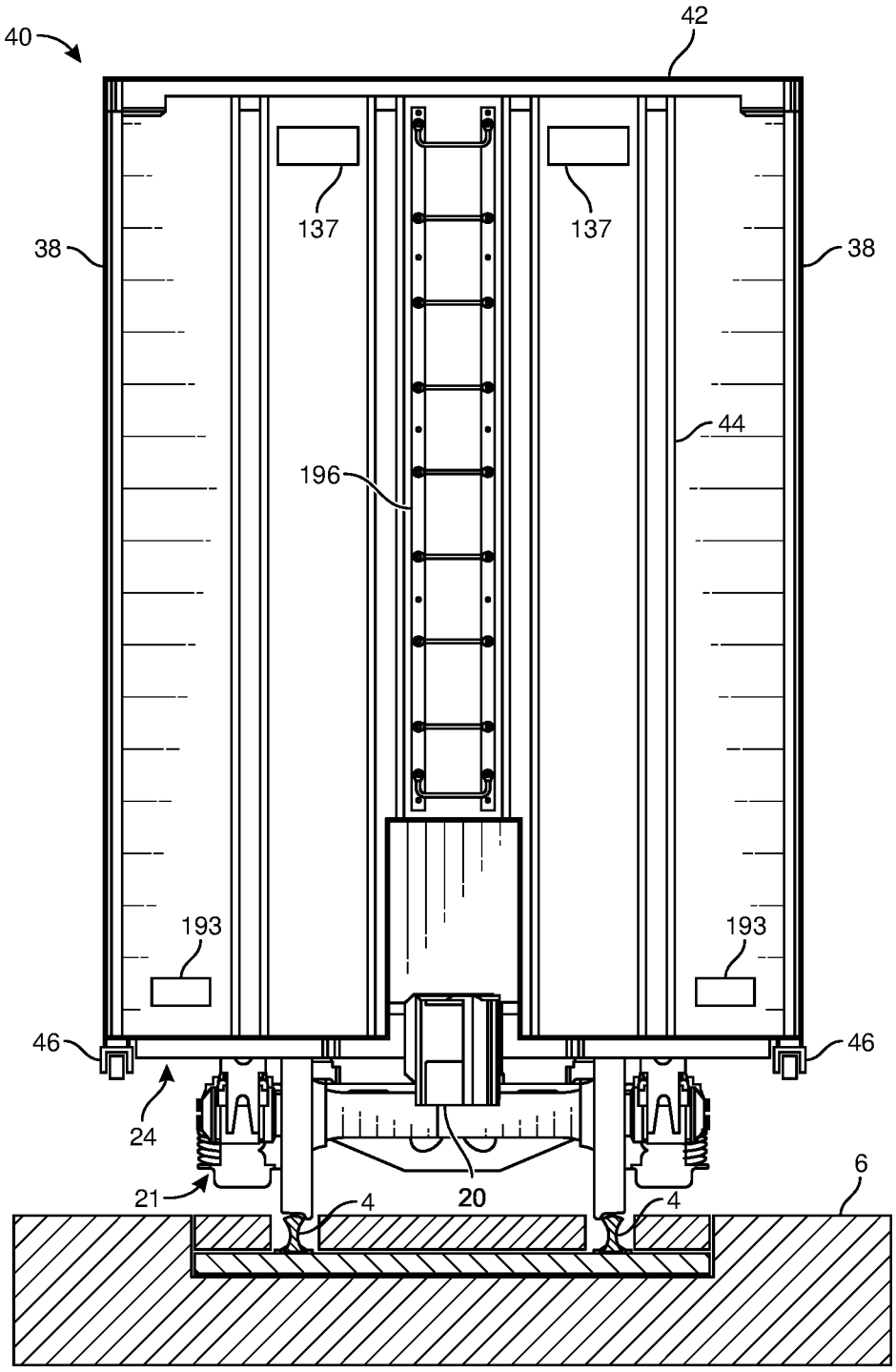

FIG. 112 shows an end view of the railcar with the brace/lock deadbolts 192 disengaged. In this example, the brace/lock deadbolts 192 are not inserted into the deadbolt endwall bearings 193.

Figure 113:
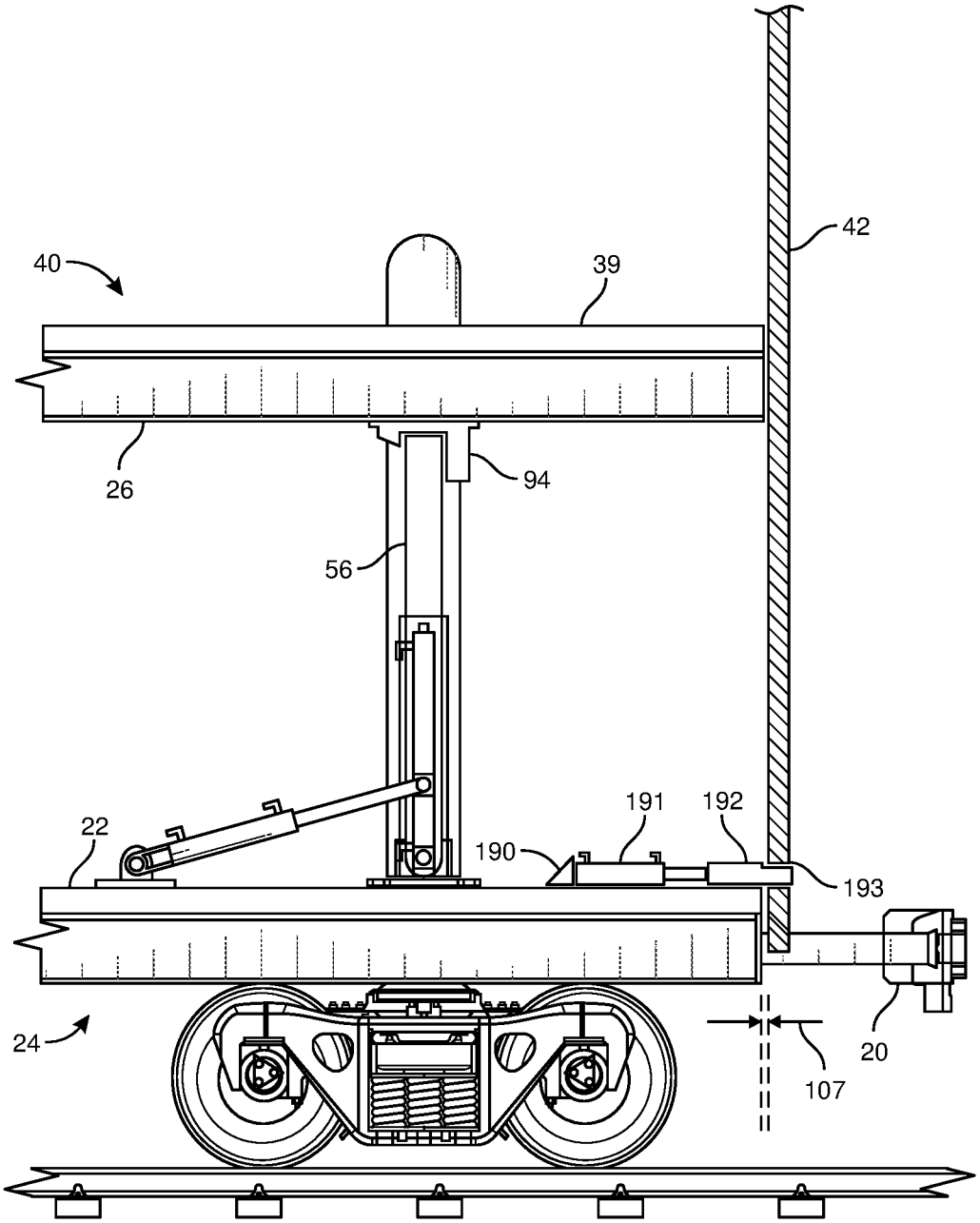

FIG. 113 shows a cross-sectional side view of the railcar with the brace/lock deadbolt controlling cylinder 191 being extended and engaged into the deadbolt endwall bearing 193. In this example, the brace/lock deadbolt 192 has vertically locked WBA endwall 42 to the BTPS 24. Because the WBA endwalls 42 are mechanically locked to the BTPS 24, the entire WBA 40 may be mechanically locked to the BTPS 24.

FIG. 114 shows a cross-sectional top view of the brace/lock deadbolt assembly. The brace/lock deadbolt controlling cylinder 191 is illustrated in an extended position and engaged into the deadbolt endwall bearing 193. The brace/lock deadbolt 192 may vertically lock the WBA endwall 42 relative to the BTPS 24. The brace/lock deadbolt shoulders 194 may be pressed and brace against the inner surface of the WBA endwall 42 to inhibit the WBA endwall 42 from horizontal movements inward. The bracing action may also maintain the WBA-to-BTPS gap 107. FIG. 115 shows an end view of the railcar with the brace/lock deadbolts 192 in an engaged position, after their extension and insertion into the respective deadbolt endwall bearings 193.

The brace/lock deadbolt 192 may perform two functions simultaneously, namely a bracing function and a locking function. Alternatively, the bracing or locking functions can be performed separately. For example, either the deadbolt or shoulders can be removed to result in a mechanism that performs either the bracing function or the locking function, respectively.

Embodiments of the brace/lock deadbolt 192 and its associated components have been described above as being positioned on top of the BTPS floor 22, with the deadbolt endwall bearing 193 positioned on the WBA endwall 42 at a corresponding level. In alternative embodiments, the brace/lock deadbolt 192 and its associated components can be made part of the BTPS end sill 62, or may be positioned at any height relative to the BTPS floor 22 by means of a platform, for example. In such embodiments, the deadbolt endwall bearing 193 may also be repositioned on the WBA endwall 42 at the appropriate corresponding level in order to maintain its function. Alternatively, the brace/lock deadbolt 192 and its associated components, including the bearings 193, can be made to operate on the WBA sidewalls 38 (rather than on the WBA endwall 42). In this example, the outer surface of the bearing 193 may be sealed to prevent water from pouring through the bearing 193 during a flooding event. Alternatively, the brace/lock deadbolt 192 and its associated components, including the bearings 193, can be used to replace the interlocking beam 56 as the primary means to lock the WBA 40 in its transport mode.

Given the significant forces that can act on the WBA 40 during a storm surge or other flooding event, it may be necessary to have an additional mechanical system to inhibit water from pushing the WBA 40 out of position. FIG. 121 shows a side view of a railcar with a WBA 40 that is fitted with a lower stabilizing system that may be located near the bottom of each end of the WBA 40. The lower stabilizing system may include a lower stabilizer contact pad 249, a sidewall hole 251, and a lower stabilizer cylinder piston rod 248.

FIG. 122 shows a top view of the lower stabilizing systems on a first railcar 1 and second adjacent railcar 2. In some embodiments, the lower stabilizing systems may be attached to the sidewall extensions 41. The lower stabilizing systems may include components such as lower stabilizer controlling cylinders 247, lower stabilizer controlling cylinder platforms 246, lower stabilizer cylinder piston rods 248, and lower stabilizer contact pads 249. FIG. 124A shows a cross-sectional end view of the railcar with the lower stabilizer controlling cylinder platform 246 firmly attached to the sidewall extension 41. The lower stabilizer controlling cylinder 247 may be firmly attached to the lower stabilizer controlling cylinder platform 246 and may be further secured by a lower stabilizer controlling cylinder bracket 252 that may wrap around lower stabilizer controlling cylinder 247 and may be secured to the lower stabilizer controlling cylinder platform 246. A hole 251 may be provided through the sidewall extension 41. A bushing 253 (shown in FIG. 104B) may be provided in the hole 251. The lower stabilizer controlling cylinder's 247 piston rod 248 may be configured to pass through the bushing to the exterior of the sidewall extension 41. A lower stabilizer contact pad 249 may be firmly attached to the end of the piston rod 248. The rigid ground-level block 250 may be made part of the concrete structure 48 with a length L19 (FIG. 122), a height above the planar surface 6, and a vertical contact surface that faces the WBA 40. The ground-level block 250 may be positioned a distance away from the WBA 40 and its components. The lower stabilizer controlling cylinder 247 of the lower stabilizing system may be operated by the controlling computer system 104.

FIGS. 124A and 122 illustrate the lower stabilizing system in its disengaged mode, where the lower stabilizer controlling cylinder's 247 piston rod 248 is retracted such the lower stabilizer contact pad 249 is very close to or in contact with the sidewall extension's 41 outer surface and an air gap may exist between the lower stabilizer contact pad 249 and the rigid ground level block 250.

FIGS. 124B and 123 illustrate the lower stabilizing system in its engaged mode, where the lower stabilizer controlling cylinder's 247 piston rod 248 is extended such the lower stabilizer contact pad 249 abuts against the rigid ground level block 250. With the lower stabilizing system engaged, the lower stabilizing system may oppose water forces imposed by the storm surge 150, such that the WBA 40 is inhibited from moving or repositioning toward the land side 148.

In the examples and drawings described above, the lower stabilizing system has been shown on the land side 148 of the WBA 40. Alternatively, the lower stabilizing system can be fitted to the ocean side 149 of the WBA 40.

FIG. 125A shows an additional embodiment in which an anti-tip configuration may be used to inhibit large waves from tipping the WBA 40. The ocean side 149 lower stabilizer contact pad 249 may be removed and the rigid ground level block 250 may be replaced by an equivalent length L19 I-beam 254. A bottom portion of the I-beam 254 may be firmly embedded in and made a part of the concrete structure 48. An upper portion of the I-beam 254 may have a flange 255 that may be positioned at a right angle to the web and directed toward the lower stabilizer controlling cylinder 247. When the ocean side 149 lower stabilizing system is engaged as shown in FIG. 125B, the lower stabilizer controlling cylinder's 247 piston rod 248 may extend under the I-beam flange 255, trapping a piston rod 248 from moving vertically upward and, therefore, mechanically inhibiting the WBA 40 from tipping clockwise (in the view of FIG. 125B) toward the land side 148. When the ocean side 149 lower stabilizing system is disengaged, as shown in FIG. 125A, the piston rod 248 may be fully retracted with the tip of the piston rod 248 positioned close to the sidewall extension's 41 outer surface, where the piston rod 248 is unable to engage the I-beam flange 255. Alternatively or additionally, this anti-tip lower stabilizing system configuration can be positioned on the land side 148 sidewall extension 41. Alternatively, the ocean side 149 lower stabilizer controlling cylinder 247 can operate a deadbolt similar to that shown in FIG. 104A and FIG. 104B, except that the deadbolt may be made with a length sufficient to engage the I-beam flange 255 when the lower stabilizer controlling cylinder 247 piston rod is fully extended. The lower stabilizer controlling cylinder 247 piston rod and deadbolt may be sized such that the tip of the deadbolt is positioned at the exterior vertical plane of the sidewall 38 when the lower stabilizer controlling cylinder 247 piston rod is fully retracted. With the deadbolt or non-deadbolt configuration, the sidewall hole 251 can be fitted with a bushing and O-ring gasket as discussed above.

Based on a particular intended use of the railcar, more weight may need to be added to the WBA 40. FIG. 116 shows a cross-sectional view of the railcar with a WBA supplemental load 188 added to the top interior of the WBA 40. The load may rest on the WBA floor 39. The WBA supplemental load 188 can be a formed load, such as a cement block(s), fluid, or an aggregate load such as sand, gravel, dirt or other loose material. If an aggregate load or fluid is used, a vertical guide rail cover 187 may be employed to protect the linear-motion bearing 34 from being fouled by the aggregate or breached by the fluid. The vertical guide rail cover 187 may have a cylindrical shape with a radius larger than the radius of the vertical guide rail 55. The length of the vertical guide rail cover 187 may be longer than the vertical guide rail's 55 height above the WBA floor 39 when the railcar is in the WBA service/safety mode. The vertical guide rail cover 187 may be made with a watertight cylindrical cap at its top. The vertical guide rail cover 187 may be fitted over and horizontally aligned with the linear-motion bearing 34, such that the vertical guide rail 55 does not contact the inner surfaces of vertical guide rail cover 187 as the vertical guide rail 55 passes through the linear-motion bearing 34. The vertical guide rail cover 187 may be provided with a gasket on its flange to create a watertight seal when the flange is attached to the WBA floor 39 with screws or other attachment means.

The railcar may include manual controls that can be used to operate all systems on the railcar, including the systems that might otherwise be operated by the controlling computer system 104. The manual controls can be used in the event of a failure of the controlling computer system 104, or by preference given a particular use and application of the railcar. FIG. 117 illustrates a cross-sectional side view of the railcar with manual controls placed on a manual control panel 205 that is mounted on the interior surface of the WBA endwall 42. A manual control operator platform 204 may also be attached to the interior surface of the WBA endwall 42 to provide a horizontal surface for the user/operator to stand on or to sit on with an operator's chair, for example.

Railcars according to the present disclosure may be moved on railroad tracks by a locomotive. FIG. 118 shows a side view of a locomotive 189 positioned on a railroad track 4. The locomotive 189 may be fitted with a railcar coupler 20 and resource couplers 54 on both ends of the locomotive 189 to provide connections for electrical power, electronic data, hydraulic fluid and/or pneumatic fluid (air) or other resources to the railcars. A railcar or a plurality of railcars of the present disclosure may be connected to the locomotive 189 by the railcar coupler 20 and the resource coupler 54. As an option, the locomotive 189 may be fitted with the systems to operate as a command and control station to operate the attached railcars as described herein.

It is noted that the embodiments of the water barrier system illustrated in the accompanying drawings are shown with mobile water barriers in the form of railcars by way of example, but the present disclosure is not so limited. In additional embodiments, mobile water barriers of the present disclosure may be in the form of semi-truck trailers, bus bodies, van bodies, etc. to be deployed on a road or other surface. To provide the water barrier system with mobile water barriers in these non-railcar forms, modifications to the designs shown in the accompanying drawings may be made, such as changing the wheels and/or supporting elements, etc. However, the basic concepts and principles for forming a water barrier system from such mobile water barriers will be similar to the example systems described and shown herein with reference to railcars.

Figure 1:
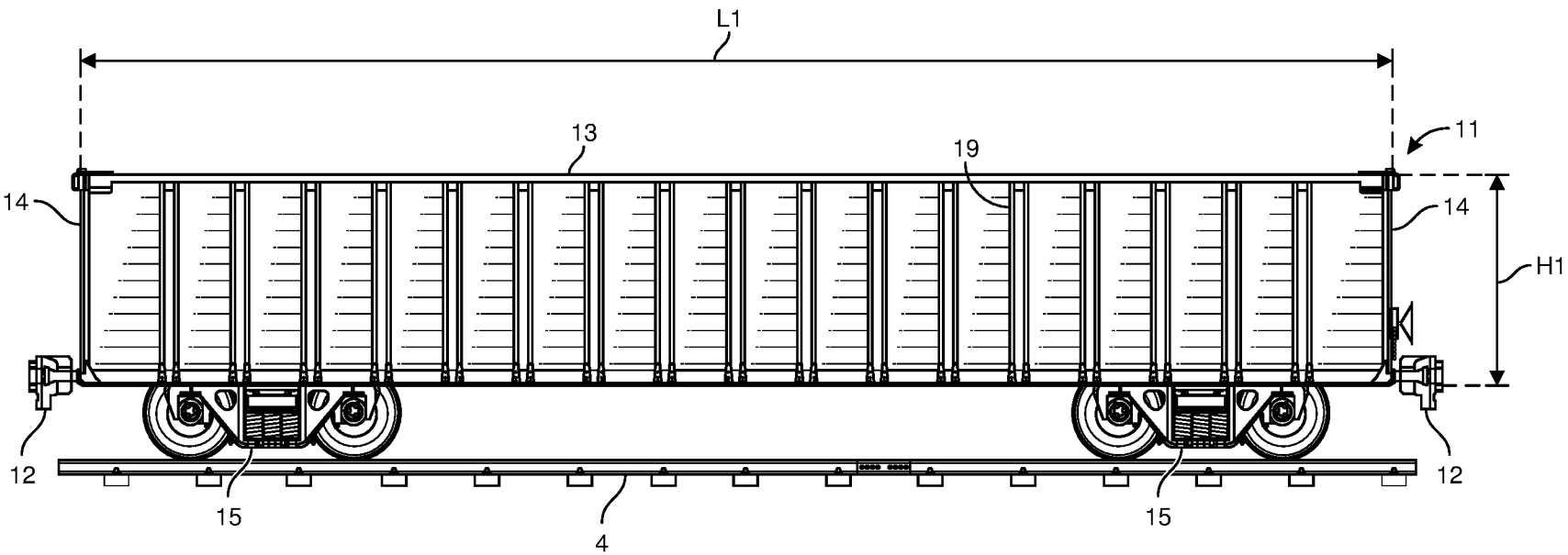
FIG. 1 (Prior Art)
FIG. 1 shows a side view of a prior art gondola railcar.
Figure 2:
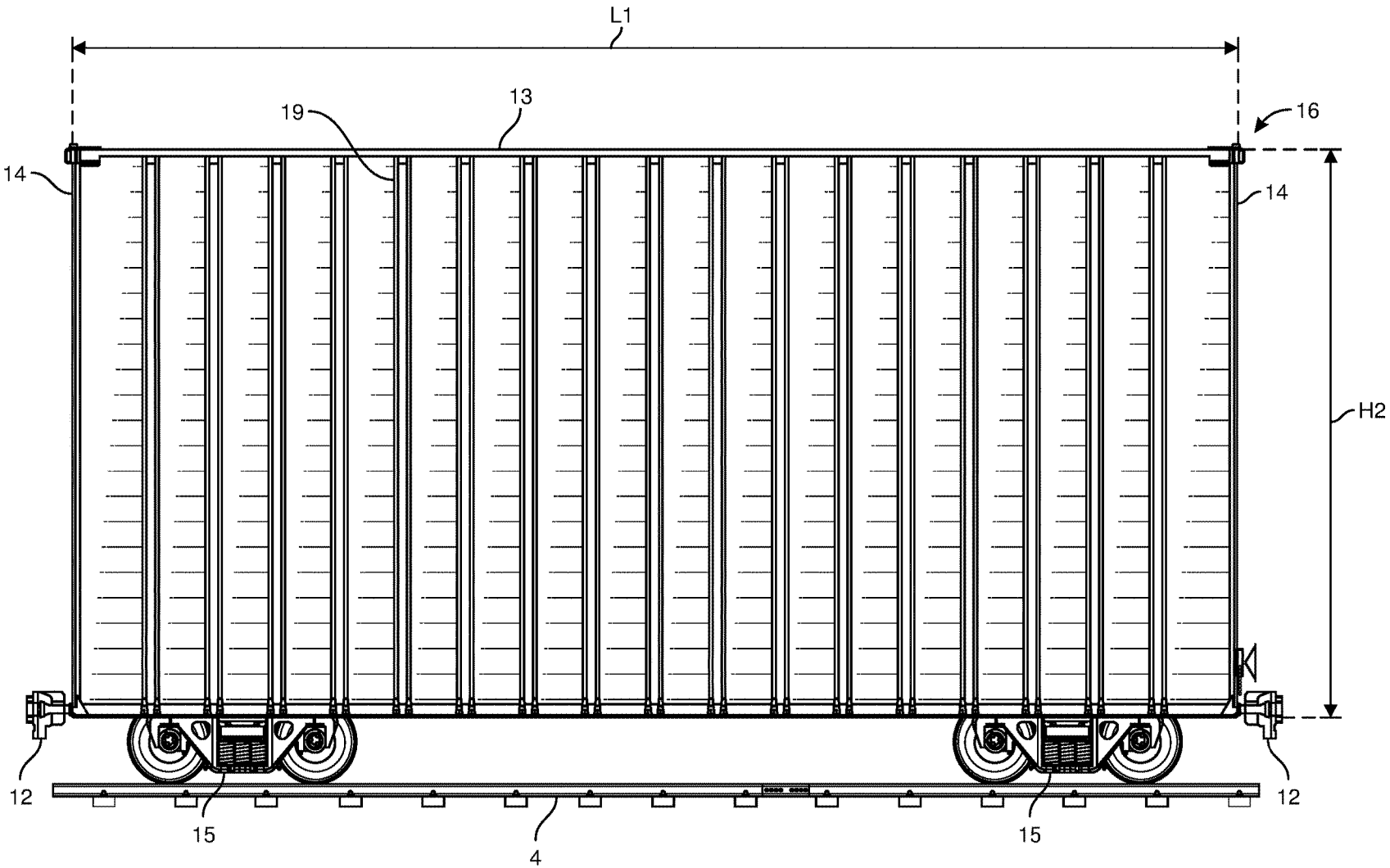
FIG. 2 (Prior Art)
FIG. 2 shows a side view of a prior art gondola railcar with higher side and end walls than in FIG. 1.
Figure 3:
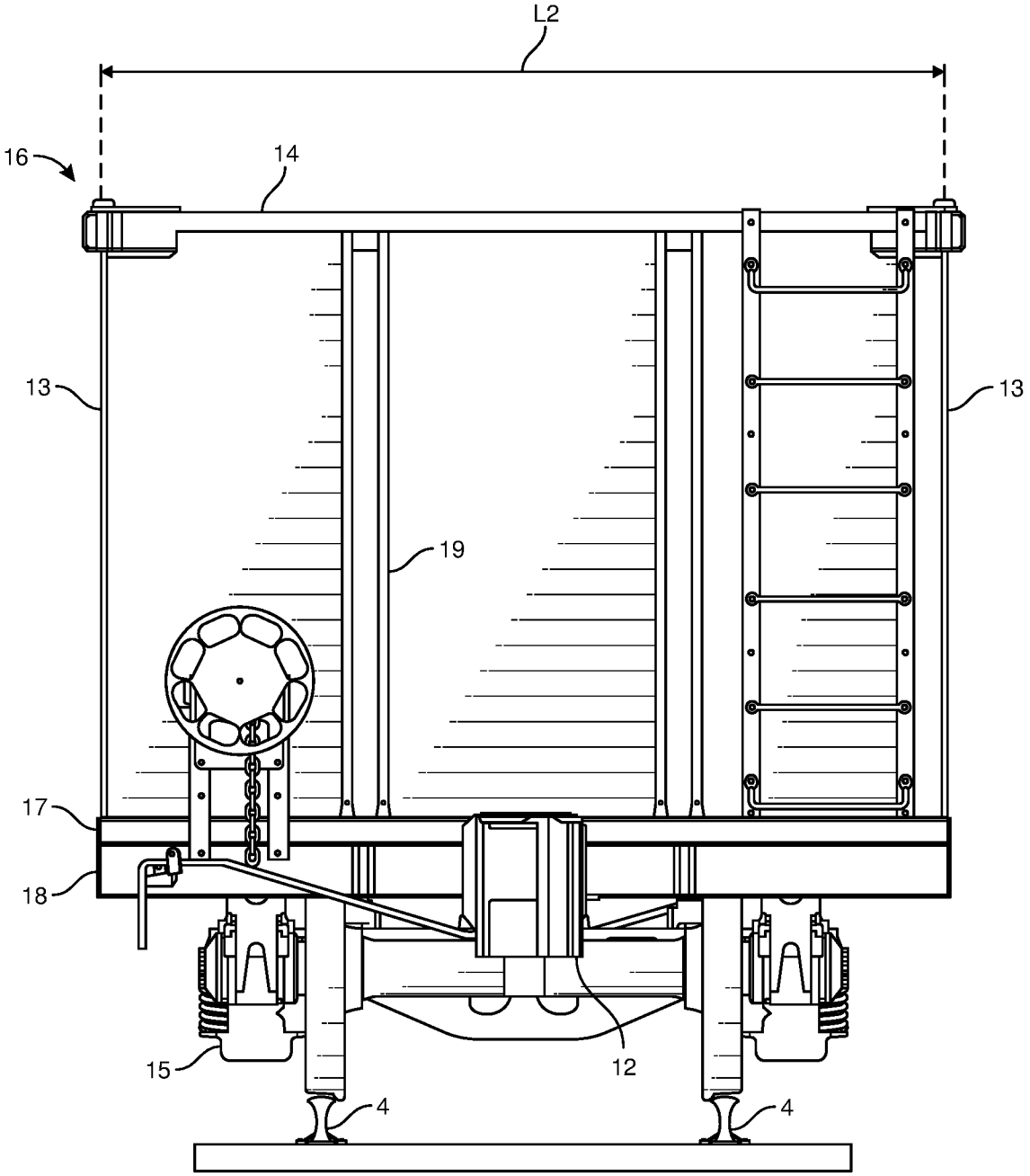
FIG. 3 (Prior Art)
FIG. 3 shows an end view of the prior art gondola railcar of FIG. 2
Figure 4:
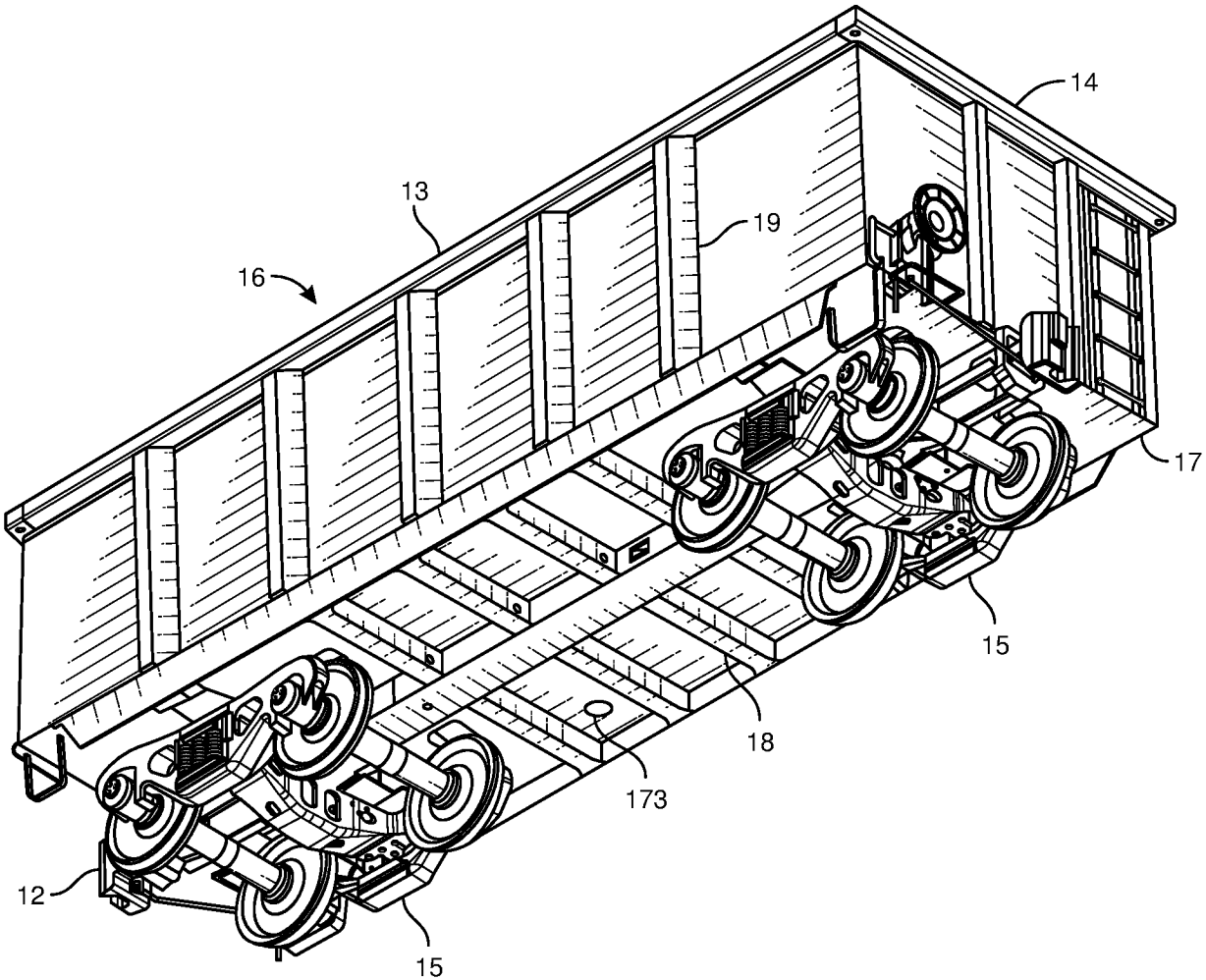
FIG. 4 (Prior Art)
FIG. 4 shows a bottom perspective view of the prior art gondola railcar of FIG. 2.
Figure 5:
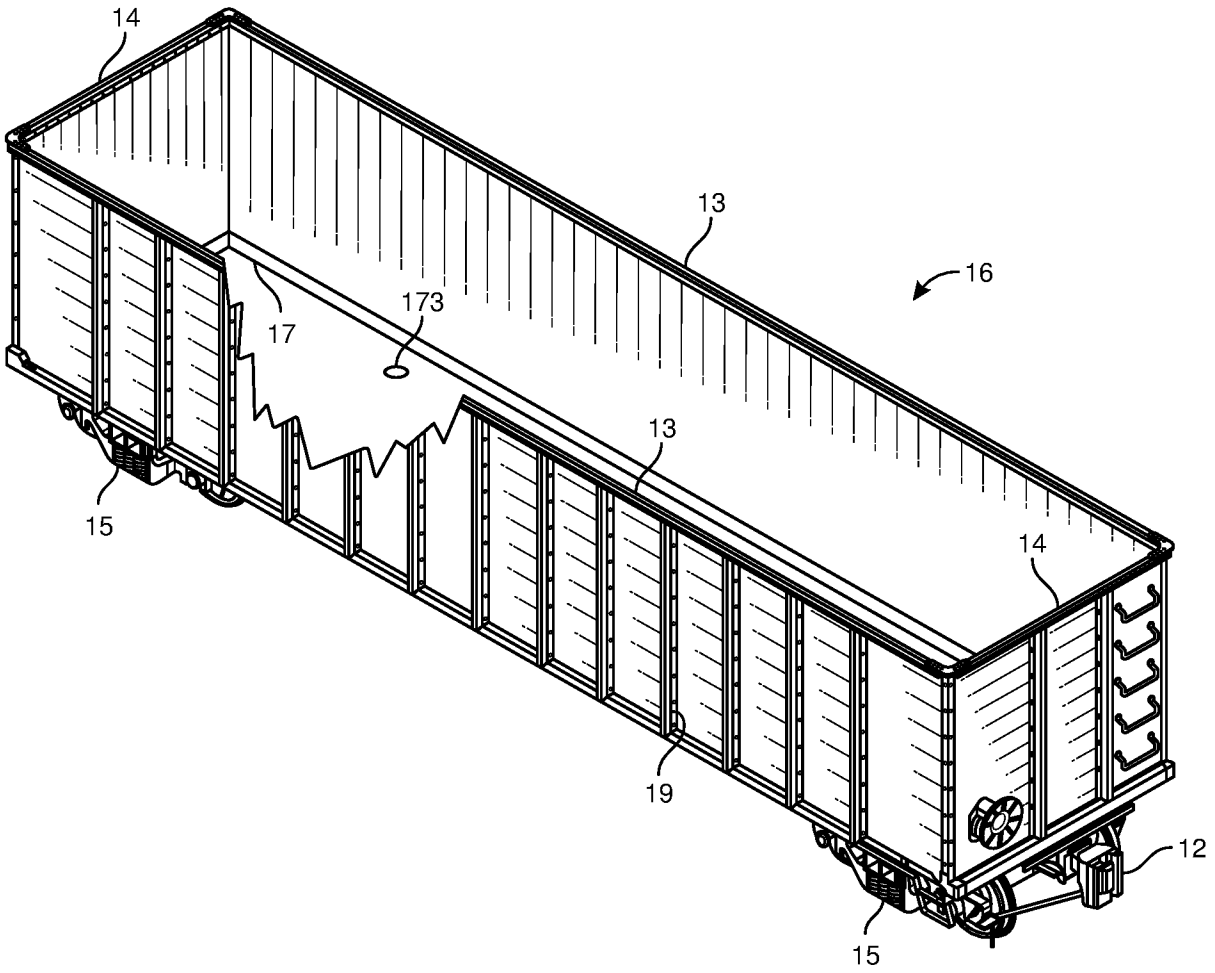
FIG. 5 (Prior Art)
FIG. 5 shows a partially cut-away top perspective view of the prior art gondola railcar of FIG. 2.
Figure 6:
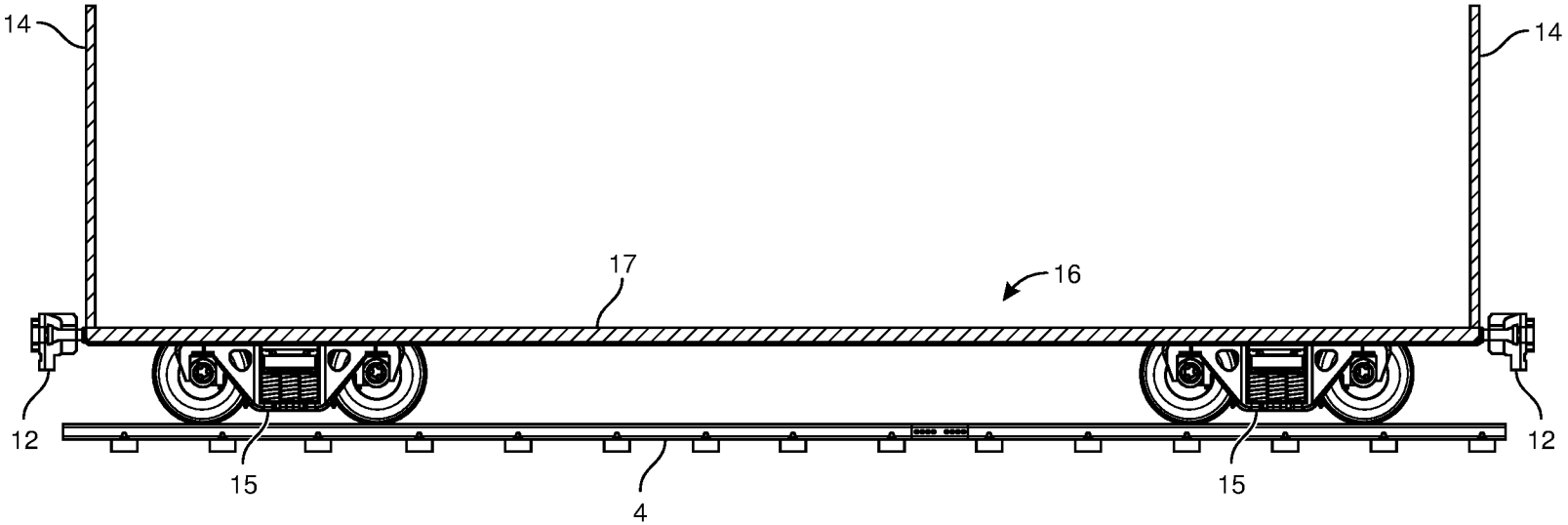
FIG. 6 (Prior Art)
FIG. 6 shows a side cut-away view of the prior art gondola railcar of FIG. 2.
Figure 7:
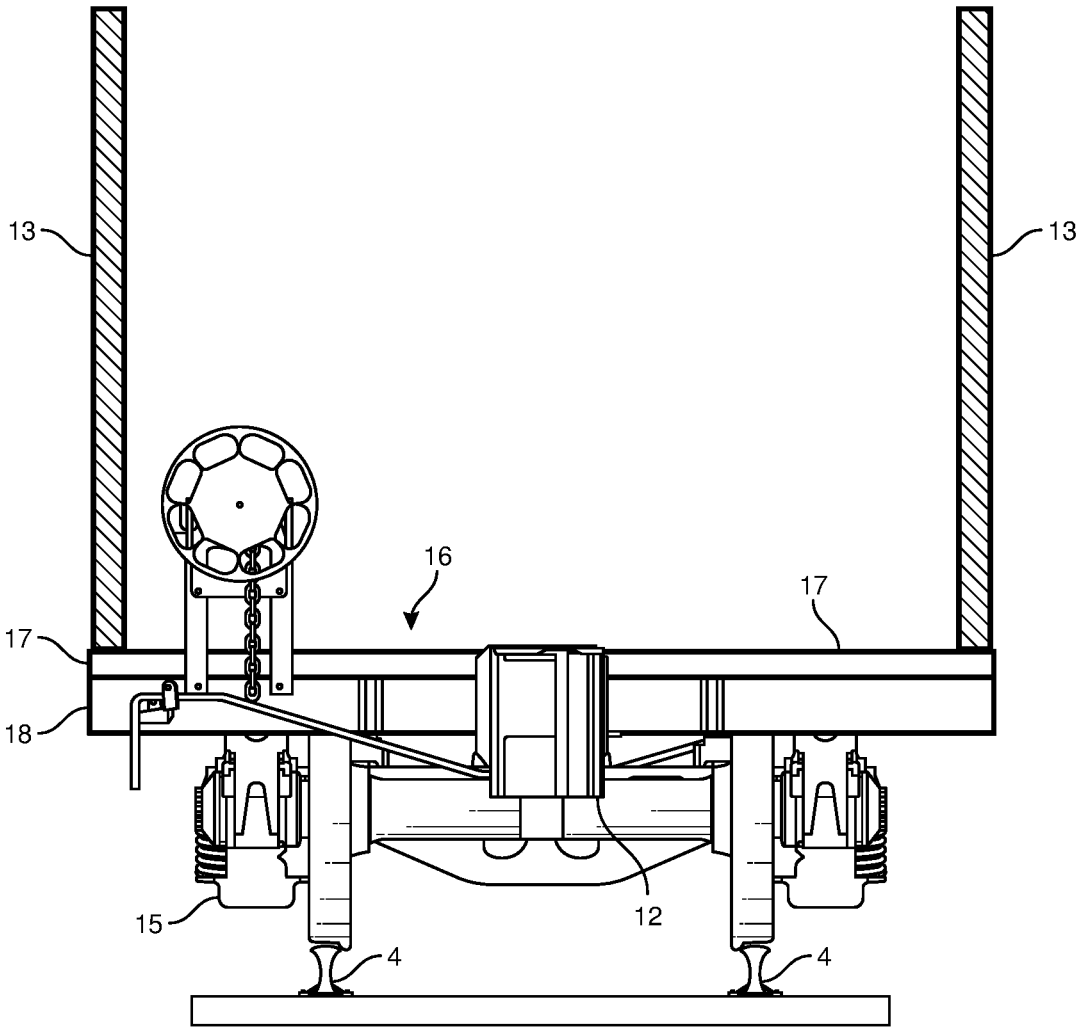
FIG. 7 (Prior Art)
FIG. 7 shows an end cut-away view of the prior art gondola railcar of FIG. 2 with the endwall removed for clarity.
Figure 8:
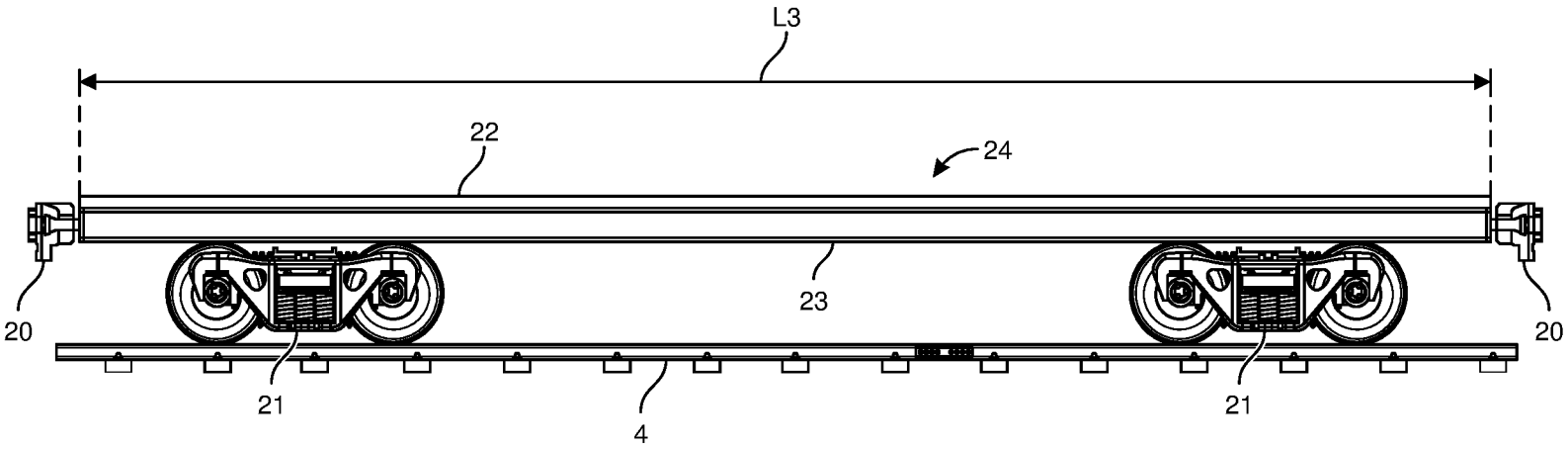
FIG. 8 (Prior Art)
FIG. 8 shows a side view of a prior art flatcar railcar.
Figure 9:
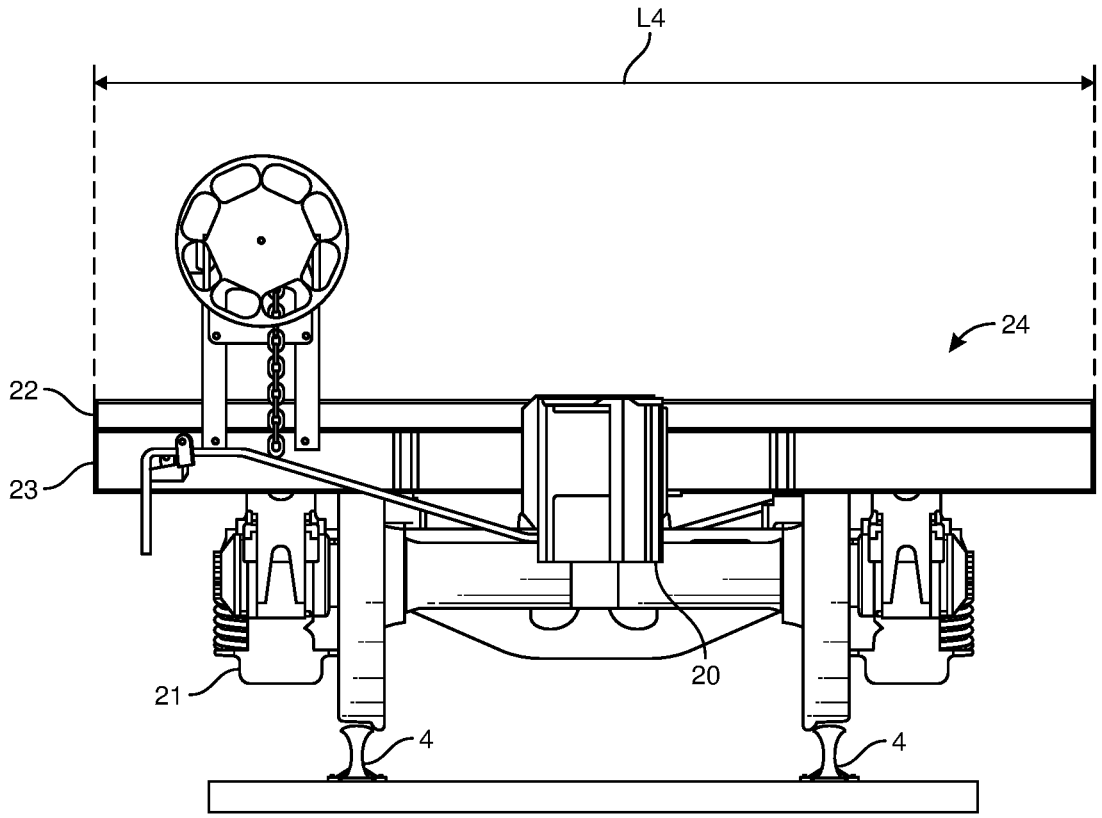
FIG. 9 (Prior Art)
FIG. 9 shows an end view of the prior art flatcar railcar of FIG. 8.
Figure 10:
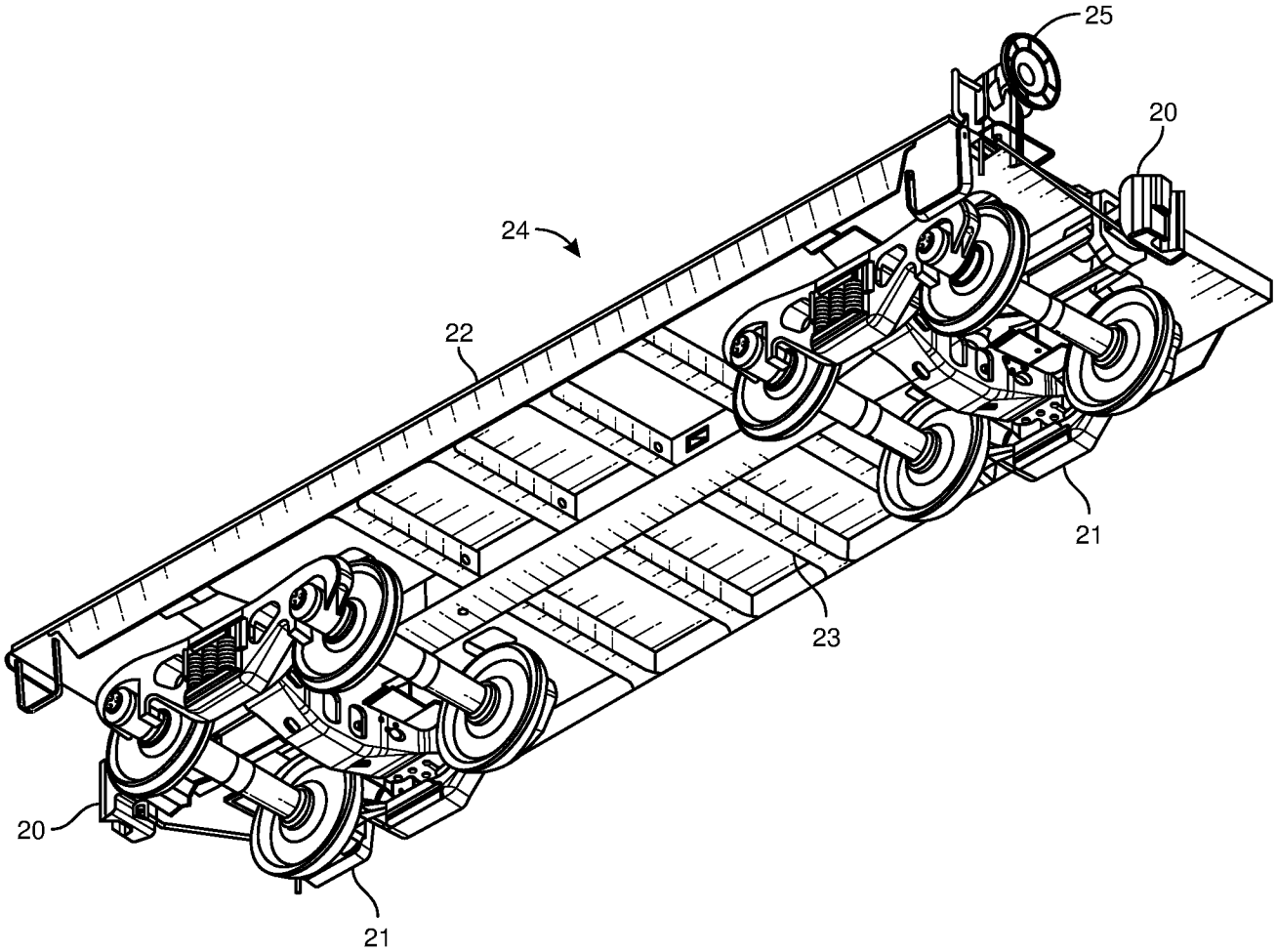
FIG. 10 (Prior Art)
FIG. 10 shows a bottom perspective view of the prior art flatcar railcar of FIG. 8.

To apply the disclosed concepts to non-railcar mobile water barriers, one or more of the following example modifications to the embodiments shown in the accompanying drawings may be made. For example, the trucks 21 (also referred to as "bogies") (e.g., FIG. 35) may be removed from the BTPS underframe 23. The BTPS underframe may be placed on a van, bus, or semi-truck frame. The van, bus, or semi-truck frame may have a length L3 (FIG. 8) or shorter and a width L4 (FIG. 9) or shorter. As an option, the BTPS underframe 23 and the van, bus, or semi-truck frame may be manufactured as an integral unit.

The van, bus, or semi-truck frame may be provided with additional components for transportation on a road or similar surface. For example, such additional components may include, but are not necessarily limited to, steering components, an engine, a transmission, drive wheels and other wheels, a wheel suspension system, etc., to move the mobile water barriers from one location to another as desired. As an option, all-wheel or four-wheel steering may be employed. In one example, steering, acceleration, and braking controls may be located on the manual control operator platform 204 and manual control panel 205 of the WBA 40, as shown in FIG. 117.

In some embodiments, the endwall 42 cut-outs 153 and other endwall 42 openings described above in relation to FIG. 79 may be omitted in non-railcar contexts. Thus, the endwall 42 may be a solid element that is impermeable to water flow. The WBA bottom GHA 46 may be extended along the length L9 (FIGS. 18 and 19) of the endwall 42. The length L6 of the WBA sidewall extension 41, as described above in relation to FIG. 20, may be shortened or the WBA sidewall extensions 41 may be removed to deploy the mobile water barriers via bus, van, or semi-truck. If removed, the WBA side GHAs 45 may be attached directly to the WBA endwalls 42. Alternatively, if the WBA sidewall extensions 41 are removed, a single, and potentially larger, WBA side GHA 45 may be positioned in a middle of a width L13 (FIG. 18) of the WBA endwall 42 to form a water seal with an adjacent vehicle or tower structure along its height H4 (FIG. 23), as described above. A side gasket 49 of such a modified WBA side GHA 45 may have a planar outer contact surface 106 as shown in FIG. 26, or an arcuate outer contact surface 142 and 143 as shown in FIG. 88. License plates, signal lights, and/or head lights may be attached to the endwalls 42 as needed for transportation along roads or other similar surfaces.

Because vans, buses, and/or semi-trucks may not be deployed along rails, a GPS and auto-parking technology may be employed to automatically align, position, park, and deploy a plurality of the mobile water barriers into a water barrier assembly. Thus, a GPS location system 102 (FIG. 48) may be included in such embodiments. The controlling computer system 104 (FIG. 48) may use the GPS location system 102 to determine a location of the mobile water barrier and to activate an auto-parking technology to automatically deploy a water barrier assembly in a location and with physical orientations as desired. Suitable auto-parking technologies are described in, for example, U.S. Pat. No. 4,931,930, titled "AUTOMATIC PARKING DEVICE FOR AUTOMOBILE," issued Jun. 5, 1990, the entire disclosure of which is hereby incorporated herein by reference.

Accordingly, disclosed are water barrier systems that may be deployed quickly, efficiently, cost-effectively, and securely. In some embodiments, this disclosure describes specialized railcars that can be used in a system of similar railcars. The system may have the ability to automatically or manually convert from a mobile form into a continuous water barrier assembly of any desired length to protect large land masses from major flooding events, such as storm surges, river flooding, and other flooding events. After the flood threat has diminished, the system of mobile water barriers can automatically or manually convert from the water barrier assembly form into a mobile form to be transported to another location, such as by rail, for storage or for re-deployment.

In some embodiments, as described above and shown in the accompanying drawings, a mobile water barrier of the present disclosure may have the ability to automatically join its sidewalls with the sidewalls of an adjacent mobile water barrier. The sidewalls can be lowered and sealed onto a surface, such as a ground-level planar surface. Thus, the system may transform itself from a mobile form into a continuous water barrier assembly of substantial height and length, where the length of the water barrier assembly is determined by the number of mobile water barriers used. This system can be used to form an effective barrier against storm surges, river flooding, and other significant flooding events. The system can be used strategically to protect cities and towns or can be used tactically to protect facilities such as oil refineries and nuclear power plants. After the flood threat has passed, the system can transform itself from the water barrier assembly form back into a mobile form to then be transported to another location (e.g., for storage or for another deployment), such as by rail.

The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed. The various example methods described and/or illustrated herein may also omit one or more of the steps described or illustrated herein or include additional steps in addition to those disclosed.

The preceding description has been provided to enable others skilled in the art to best utilize various aspects of the example embodiments disclosed herein. This example description is not intended to be exhaustive or to be limited to any precise form disclosed. Many modifications, combinations, and variations are possible without departing from the spirit and scope of the present disclosure. The embodiments disclosed herein should be considered in all respects illustrative and not restrictive. Reference should be made to the appended claims and their equivalents in determining the scope of the present disclosure.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and have the same meaning as the word "comprising."

What is claimed is:

1. A barrier system, comprising:

a first railcar barrier, comprising:

a first wheel assembly for supporting the first railcar barrier on a railway;

a first frame positioned over the first wheel assembly;

at least one first sidewall coupled to the first frame; and a first vertical control mechanism configured to lower the first frame relative to the first wheel assembly to abut the at least one first sidewall against a surface adjacent to the first railcar;

a second railcar barrier, comprising:

a second wheel assembly for supporting the second railcar barrier on the railway;

a second frame positioned over the second wheel assembly;

at least one second sidewall coupled to the second frame; and a second vertical control mechanism configured to lower the second frame relative to the second wheel assembly to abut the at least one second sidewall against a surface adjacent to the second railcar;

a translation mechanism for translating the first railcar barrier and the second railcar barrier toward each other to abut the at least one first sidewall against the at least one second sidewall;

a water pump system configured to pump water from one side of the at least one first sidewall and of the at least one second sidewall to an opposite side of the at least one first sidewall and of the at least one second sidewall; and a computer control system configured to control the first vertical control mechanism, the second vertical control mechanism, the translation mechanism, and the water pump system.

2. The barrier system of claim 1, wherein the computer control system comprises a computer-controlled hydraulic valve system.

3. The barrier system of claim 2, wherein the computer-controlled hydraulic valve system is operably coupled to the first vertical control mechanism and the second vertical control mechanism with connecting hoses.

4. The barrier system of claim 1, wherein the computer control system comprises a communications system configured to communicate with a remote command and control station.

5. The barrier system of claim 4, wherein the communications system is in wired communication with the remote command and control station.

6. The barrier system of claim 4, wherein the communications system is in wireless communication with the remote command and control station.

7. The barrier system of claim 1, wherein the computer control system comprises a battery for powering the computer control system.

8. The barrier system of claim 1, wherein the computer control system comprises a sensor interface configured to receive sensor data from one or more sensors associated with the first vertical control mechanism, the second vertical control mechanism, and the translation mechanism.

9. The barrier system of claim 1, wherein:

the first railcar barrier comprises a first bottom sealing element positioned along a first bottom edge of the at least one first sidewall; and the second railcar barrier comprises a second bottom sealing element positioned along a second bottom edge of the at least one second sidewall.

10. The barrier system of claim 9, wherein each of the first bottom sealing element and the second bottom sealing element comprises a compressible bottom gasket.

11. The barrier system of claim 1, wherein:

the at least one first sidewall comprises a first side sealing element positioned along an end of the at least one first sidewall;

the at least one second sidewall comprises a second side sealing element positioned along an end of the at least one second sidewall; and the first side sealing element and the second side sealing element abut each other when the translation mechanism abuts the at least one first sidewall against the at least one second sidewall.

12. The barrier system of claim 11, wherein at least one of the first side sealing element and the second side sealing element comprises a compressible side gasket.

13. A barrier system, comprising:

a first railcar barrier, comprising:

a first wheel assembly for supporting the first railcar barrier on a railway;

a first frame positioned over the first wheel assembly;

at least one first sidewall coupled to the first frame; and a first vertical control mechanism configured to lower the first frame relative to the first wheel assembly to abut the at least one first sidewall against a surface adjacent to the first railcar;

a second railcar barrier, comprising:

a second wheel assembly for supporting the second railcar barrier on the railway;

a second frame positioned over the second wheel assembly;

at least one second sidewall coupled to the second frame; and a second vertical control mechanism configured to lower the second frame relative to the second wheel assembly to abut the at least one second sidewall against a surface adjacent to the second railcar;

a translation mechanism for translating the first railcar barrier and the second railcar barrier toward each other to abut the at least one first sidewall against the at least one second sidewall;

at least one first drain valve for draining an interior of the first railcar barrier and at least one second drain valve for draining an interior of the second railcar barrier; and a control system configured to control the first vertical control mechanism, the second vertical control mechanism, the translation mechanism, the at least one first drain valve, and the at least one second drain valve.

14. The barrier system of claim 13, further comprising a computer control system configured to control the first vertical control mechanism, the second vertical control mechanism, and the translation mechanism, wherein the manual control system comprises a backup control system operable to override the computer control system.

15. The barrier system of claim 13, wherein the control system comprises a manual control system.

16. The barrier system of claim 13, further comprising a manual control operator platform positioned for supporting an operator of the manual control system.

* * * * *